US005714289A

United States Patent [19]

Kato et al.

[11] Patent Number: 5,714,289

[45] Date of Patent: *Feb. 3, 1998

[54] METHOD OF PREPARATION OF ELECTROPHOTOGRAPHIC PRINTING PLATE

[75] Inventors: Eiichi Kato; Sadao Osawa; Seishi Kasai, all of Shizuoka, Japan

[73] Assignee: Fuji Photo Film Co., Ltd., Kanagawa, Japan

[ * ] Notice: The term of this patent shall not extend beyond the expiration date of Pat. No. 5,620,822.

[21] Appl. No.: 457,604

[22] Filed: Jun. 1, 1995

Related U.S. Application Data

[63] Continuation of Ser. No. 133,087, filed as PCT/JP93/00179, Feb. 12, 1993, abandoned.

[30] Foreign Application Priority Data

| | | | |
|---|---|---|---|
| Feb. 12, 1992 | [JP] | Japan | 4-57269 |
| Apr. 10, 1992 | [JP] | Japan | 4-116794 |
| May 29, 1992 | [JP] | Japan | 4-161650 |
| Jun. 5, 1992 | [JP] | Japan | 4-169880 |
| Jun. 30, 1992 | [JP] | Japan | 4-194712 |
| Jul. 7, 1992 | [JP] | Japan | 4-201811 |

[51] Int. Cl.[6] ..... G03G 13/28

[52] U.S. Cl. ..... 430/49; 430/47; 430/126

[58] Field of Search ..... 430/49, 47, 126

[56] References Cited

U.S. PATENT DOCUMENTS

| | | | |
|---|---|---|---|
| 4,292,120 | 9/1981 | Nacci | 430/39 |
| 4,970,119 | 11/1990 | Koshizuka et al. | 428/411.1 |
| 5,176,974 | 1/1993 | Till et al. | 430/126 |
| 5,229,236 | 7/1993 | Kato et al. | 430/49 |
| 5,229,241 | 7/1993 | Kato et al. | 430/49 |
| 5,292,613 | 3/1994 | Sato et al. | 430/257 |
| 5,340,679 | 8/1994 | Badesha et al. | 430/126 |

*Primary Examiner*—George F. Lesmes
*Assistant Examiner*—Laura Weiner
*Attorney, Agent, or Firm*—Sughrue, Mion, Zinn, Macpeak & Seas, PLLC

[57] ABSTRACT

A method for preparation of an electrophotographic printing plate which can provide a printing plate excellent in image qualities of plate-making and printing, and continuously produce such printing plates in a stable manner for a long period of time and which is suitable for a scanning exposure system using a laser beam.

The method comprises forming a toner image by an electrophotographic process on a peelable transfer layer of an electrophotographic light-sensitive material which comprises an electrophotographic light-sensitive element a surface of which has releasability and the peelable transfer layer provided on the surface thereof which contains a thermoplastic resin capable of being removed upon a chemical reaction treatment, thermally transferring the toner image together with the transfer layer onto a support for a lithographic printing plate and removing the thermoplastic resin upon a treatment, for example, with an aqueous alkaline solution, whereby a printing plate is obtained.

12 Claims, 4 Drawing Sheets

METHOD OF PREPARATION OF ELECTROPHOTOGRAPHIC PRINTING PLATE

This is a Continuation of application Ser. No. 08/133,087, filed as PCT/JP93/00179, Feb. 12, 1993, now abandoned.

TECHNICAL FIELD

The present invention relates to a method for preparation of an electrophotographic printing plate, and more particularly to a method for preparation of an electrophotographic printing plate comprising transfer of a toner image formed by an electrophotographic process and removal of a transfer layer.

TECHNICAL BACKGROUND

Lithographic offset printing plates currently employed include PS plates which are produced by using a positively working photosensitive composition mainly comprising a diazo compound and a phenolic resin or a negatively working photosensitive composition mainly comprising an acrylic monomer or a prepolymer thereof. Since all of these conventional PS plates have low sensitivity, it is necessary to conduct contact exposure from a film on which an image has already been recorded for plate-making.

On the other hand, owing to the recent technical advancements of image processing by a computer, storage of a large amount of data and data communication, input of information, revision, edition, layout, and pagination are consistently computerized, and electronic editorial system enabling instantaneous output on a remote terminal plotter through a high speed communication network or a communications satellite has been practically used. The need of the electronic editorial system has been increasing especially in the field of printing newspaper requiring immediacy. Also in the field where an original is preserved as a film from which a printing plate may be reproduced in case of necessity, it is expected that digitalized data will be stored in very large volume recording media such as optical discs.

However, few direct type printing plate precursors directly preparing printing plates based on the output from a terminal plotter have been put to practical use. For the time being, even in the field where an electronic editorial system actually works, the output is once visualized on a silver halide photographic film, which is then subjected to contact exposure to a PS plate to produce a printing plate. One reason for this is difficulty in developing a direct type printing plate precursor having high sensitivity to a light source of the plotter, e.g., an He-Ne laser or a semiconductor laser, sufficient for enabling plate-making within a practically allowable period of time.

Light-sensitive materials having high photosensitivity which may possibly provide a direct type printing plate include electrophotographic light-sensitive materials. An attempt has been made in a system using an electrophotographic lithographic printing plate precursor in which a toner image is electrophotographically formed on an electrophotographic light-sensitive material containing photoconductive zinc oxide and then, non-image areas are subjected to oil-desensitization with an oil-desensitizing solution to obtain a lithographic printing plate, to apply a light-sensitive material having high sensitivity to semiconductor laser beam to the electrophotographic light-sensitive material.

For example, the use of specific spectral sensitizing dye is proposed as described, for example, in JP-B-2-28143 (the term "JP-B" as used herein means an "examined Japanese patent publication"), JP-A-63-124054 (the term "JP-A" as used herein means an "unexamined published Japanese patent application"), JP-A-63-241561, and JP-A-63-264763. Further, improvements in a binder resin for a photoconductive layer are proposed in order to increase photosensitivity and to reduce background stains in non-image areas (i.e., to improve water retentivity of non-image areas) as described, for example, in JP-A-63-220148, JP-A-1-116643, and JP-A-2-69759.

Since these plate-making techniques are based on oil-desensitization of zinc oxide for making it hydrophilic, and a specific oil-desensitizing solution and specific dampening water are used, there are various restrictions in that color inks usable are limited, in that printing durability is markedly reduced when neutral paper is employed as printing paper, and in that a printing machine in which a plate of this kind and a PS plate are exchangeably used must be thoroughly cleaned.

It is also known to electrophotographically make a lithographic printing plate by removing a photoconductive layer of non-image areas after the toner image formation. Printing plate precursors suitable for use in such a system are described, for example, in JP-B-37-17162, JP-B-38-6961, JP-B-38-7758, JP-B-41-2426, JP-B-46-39405, JP-A-50-19509, JP-A-50-19510, JP-A-52-2437, JP-A-54-145538, JPTA-54-134632, JP-A-55-105254, JP-A-55-153948, JP-A-55-161250, JP-A-57-147656, and JP-A-57-161863.

In order to use an electrophotographic light-sensitive material as a printing plate, binder resins which can be dissolved or swollen with an alkaline solvent and thereby removed are often used in the photoconductive layer so that the photoconductive layer in non-image areas can be etched with an alkaline etchant to expose the underlying hydrophilic surface. The resins soluble or swellable in the alkaline solvent are usually less compatible with organic photoconductive compounds than polycarbonate resins widely employed as binder resins for electrophotographic light-sensitive materials. Accordingly, the amount of the organic photoconductive compound to be incorporated into a photoconductive layer is limited. When a content of the organic photoconductive compound in a photoconductive layer is low, a transfer rate of carrier in the photoconductive layer is reduced even if a sufficient amount of carrier for offsetting the surface potential is generated in the photoconductive layer and, as a result, a rate of surface potential decay, i.e., a rate of response is reduced. This means prolongation of the time after exposure required for the surface potential to decay to a sufficient level for causing no fog and for starting toner development. As an exposure illuminance increases in order to shorten the exposure time for the purpose of minimizing the processing time, the above-described response time becomes longer. Therefore, the slow response is a great hindrance to achievement of reduction in total processing time.

Scanning exposure with a light source of high illuminance, e.g., a laser light source, arouses another problem. Specifically, if the response is slow, since the rate of surface potential decay differs between the area where scanning has started and the area where scanning ends, the resulting image suffers from fog in the latter area, although free from fog in the former area. This is disadvantageous for plate-making.

Binder resins which have conventionally been used in electrophotographic lithographic printing plate precursors include styrene-maleic anhydride copolymers, vinyl acetate-crotonic acid copolymers, vinyl acetate-maleic anhydride copolymers, and phenolic resins as described, for example, in JP-B-41-2426, JP-B-37-17162, JP-B-38-6961, JP-A-52-2437, JP-A-54-19803, JP-A-54-134632, JP-A-55-105254, JP-A-50-19509, and JP-A-50-19510.

It has been pointed out, however, that these known binder resins have various disadvantages when they are used in electrophotographic lithographic printing plate precursors using an organic photoconductive compound. For example, when a styrene-maleic anhydride copolymer resin is used as a binder resin, the film formed is rigid and may cause cracks in case of bending the plate. Also, the layer is so poor in adhesion that the plate fails to withstand mass printing. A film formed by using a phenolic resin as a binder resin is brittle and has poor printing durability. A film of a vinyl acetate-crotonic acid copolymer or a vinyl acetate-maleic anhydride copolymer also exhibits poor printing durability. In addition, satisfactory electrophotographic characteristics, especially charge retention in dark and photosensitivity cannot be secured with any of these resins.

Copolymers comprising an acrylic ester or methacrylic ester and a carboxylic acid-containing monomer are described in order to solve the above-described problems in JP-A-57-161863 and JP-A-58-76843. These binder resins make it feasible to use an electrophotographic light-sensitive material as a printing plate precursor. Nevertheless, the recently posed problem arising from the slow response described above, i.e., insufficient photosensitivity, still remains unsolved.

Further, in JP-B-1-209458 copolymers comprising an acrylic ester or methacrylic ester containing an aromatic ring and an acid group-containing monomer, e.g., a carboxylic acid are described, for achieving improved printing durability and photosensitivity. However, while the performance properties described above may be improved, these copolymers are disadvantageous in that the photoconductive layer of non-image areas (areas other than toner image areas) is not easily and rapidly removable so that strict control of conditions for removal is required.

More specifically, the problem in that the conditions for achieving complete removal of only non-image areas without causing dissolution of even minute toner image areas thereby to produce a printing plate having a reproduced image with high fidelity and causing no background stains are restricted is still unsolved.

In addition, in the above-described system in which the whole photoconductive layer of the non-image areas is dissolved out in an alkaline processing solution, the dissolved material is accumulated in the alkaline processing solution. Therefore, when the processing solution is used for successive treatment of a large number of plate precursors, problems, for example, precipitation of agglomerates and reduction of the dissolving power may occur.

The present invention is to solve the above-described various problems associated with conventional plate-making techniques.

An object of the present invention is to provide a method for preparation of an electrophotographic printing plate which can provide printing plates excellent in image qualities of plate-making and printing and continuously produce such printing plates in a stable manner for a long period of time.

Another object of the present invention is to provide a method for preparation of an electrophotographic printing plate which is suitable for an image formation system including scanning exposure using, for example, a laser beam-and capable of reducing running cost.

Still another object of the present invention is to provide a method for preparation of an electrophotographic printing plate in which heat-transfer can easily be performed and the transferred layer can easily be removed.

A further object of the present invention is to provide a method for preparation of an electrophotographic printing plate in which an electrophotographic light-sensitive element having a surface of good releasability and maintaining such a property.

A still further object of the present invention is to provide an electrophotographic light-sensitive material which is suitable for use in the above-described method for preparation of an electrophotographic printing plate.

A still further object of the present invention is to provide an apparatus which is suitable for use in the above-described method for preparation of an electrophotographic printing plate.

Other objects of the present invention will become apparent from the following description.

DISCLOSURE OF THE INVENTION

It has been found that the above described objects of the present invention are accomplished by a method for preparation of an electrophotographic printing plate comprising (a) a step of forming a toner image by an electrophotographic process on a peelable transfer layer of an electrophotographic light-sensitive material which comprises an electrophotographic light-sensitive element a surface of which has releasability and the peelable transfer layer provided on the surface thereof which is mainly composed of a thermoplastic resin capable of being removed upon a chemical reaction treatment, (b) a step of heat-transferring the toner image together with the transfer layer onto a receiving material a surface of which is capable of providing a hydrophilic surface suitable for lithographic printing at the time of printing, and (c) a step of removing the thermoplastic resin of the transfer layer on the receiving material upon the chemical reaction treatment.

It has also been found that they are accomplished by an electrophotographic light-sensitive material which comprises an electrophotographic light-sensitive element a surface of which has releasability and a peelable transfer layer provided on the surface thereof which is mainly composed of a thermoplastic resin capable of being removed upon a chemical reaction treatment.

Further, it has been found that they are accomplished by an electrophotographic plate-making apparatus comprising (a) an electrophotographic light-sensitive element a surface of which has releasability, (b) a means for providing a peelable transfer layer which is mainly composed of a thermoplastic resin capable of being removed upon a chemical reaction treatment on the surface of the electrophotographic light-sensitive element, (c) a means for forming a toner image by an electrophotographic process on the peelable transfer layer, and (d) a means for heat-transferring the toner image together with the transfer layer onto a receiving material a surface of which is capable of providing a hydrophilic surface suitable for lithographic printing at the time of printing, and wherein the electrophotographic light-sensitive element is repeatedly usable.

Specifically, the method for preparation of an electrophotographic printing plate according to the present invention is characterized by forming a toner image by a conventional electrophotographic process on a peelable transfer layer of an electrophotographic light-sensitive material which comprises an electrophotographic light-sensitive element a surface of which has releasability and the peelable transfer layer provided on the surface thereof which contains a thermoplastic resin capable of being removed upon a chemical reaction treatment, transferring the toner image together with the transfer layer onto a receiving material capable of providing a hydrophilic surface suitable for a lithographic printing plate, and then removing the transfer layer and leaving the toner image on the receiving material, thereby providing a lithographic printing plate.

The method for preparation of an electrophotographic printing plate according to the present invention will be diagrammatically described with reference to FIG. 1 of the drawings.

As shown in FIG. 1, the method for preparing a printing plate comprises forming a toner image 3 by a conventional electrophotographic process on an electrophotographic light-sensitive material comprising an electrophotographic light-sensitive element having at least a support 1 and a light-sensitive layer 2 and a peelable transfer layer 12 provided thereon as an uppermost layer, transferring the toner image 3 together with transfer layer 12 onto a receiving material 16 which is a support for an offset printing plate by heat transfer, and then removing the transfer layer 12 transferred onto the receiving material 16 upon a chemical reaction treatment to prepare a printing plate.

In case of conventional printing plates, hydrophilic non-image areas are formed by modification of the surface of a light-sensitive material itself, for example, by rendering a light-sensitive layer hydrophilic, or by dissolving out of a light-sensitive layer to expose the underlying hydrophilic surface of a support. On the contrary, according to the present invention, the printing plate is prepared by a method constructed from an entirely different point of view in that a transfer layer together with a toner image thereon is transferred to another support having a hydrophilic surface and then the transferred layer is removed by a chemical reaction treatment.

The transfer layer which can be used in the present invention is characterized in that no deterioration of electrophotographic characteristics (such as chargeability, dark charge retention rate, and photosensitivity) occur until a toner image is formed by an electrophotographic process, in that a good duplicated image is formed, in that it has sufficient thermoplasticity for easy transfer to a receiving material in a heat transfer process, and in that it is easily removed by a chemical reaction treatment to prepare a printing plate. It has been found that these characteristics of the transfer layer are achieved by using a thermoplastic resin (hereinafter referred to as resin (A) sometimes) capable of being removed by a chemical reaction treatment as a main component.

Further, the electrophotographic light-sensitive material which can be used in the present invention is characterized by having releasability on its surface in contact with the transfer layer in order to easily release the transfer layer.

Now, the transfer layer which can be used in the present invention will be described in greater detail below.

The transfer layer of the present invention is a layer having a function of being transferred from the releasing surface of electrophotographic light-sensitive material to a receiving material which provides a support for a printing plate and of being removed upon a chemical reaction treatment to prepare a printing plate. Therefore, the resin (A) constituting the transfer layer of the present invention is a resin which is thermoplastic and capable of being removed upon a chemical reaction treatment.

The term "resin capable of being removed upon a chemical reaction treatment" means and includes a resin which is dissolved and/or swollen upon a chemical reaction treatment to remove and a resin which is rendered hydrophilic upon a chemical reaction treatment and as a result, dissolved and/or swollen to remove.

The resin (A) has suitably a glass transition point (Tg) of not more than 120° C. or a softening point ranging from 40° to 150° C. The resin (A) preferably has a weight average molecular weight of from $1\times10^3$ to $1\times10^6$, and more preferably from $5\times10^3$ to $1\times10^5$.

One representative example of the resin (A) capable of being removed upon a chemical reaction treatment used in the transfer layer according to the present invention is a resin which can be removed with an alkaline processing solution. Particularly useful resins of the resins capable of being removed with an alkaline processing solution include polymers comprising a polymer component containing at least one polar group selected from a $—CO_2H$ group, a —CHO group, $—SO_3H$ group, a $—SO_2H$ group, a $—P(=O)(OH)R^1$ group (wherein $R^1$ represents a —OH group, a hydrocarbon group or a $—OR^2$ group (wherein $R^2$ represents a hydrocarbon group)), a —OH group and a cyclic acid anhydride-containing group.

The $—P(=O)(OH)R^1$ group denotes a group having the following formula:

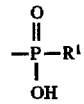

The hydrocarbon group represented by $R^1$ or $R^2$ preferably includes an aliphatic group having from 1 to 12 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylmethylphenyl, dichlorophenyl, methoxyphenyl, cyanophenyl, acetamidophenyl, acetylphenyl and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclo-pentane-1,2-dicarboxylic acid anhydride ring, cyclo-hexane-1,2-dicarboxylic acid anhydride ring, cyclo-hexene-1,2-dicarboxylic acid anhydride ring, and 2,3-bicyclo[2,2,2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphthalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., a methoxy group and an ethoxy group as an alkoxy group).

The polymer component containing the above-described specific polar group present in the resin (A) should not be particularly limited. For instance, the above-described polymer component containing the specific polar group used in the resin (A) may be any of vinyl compounds each having the polar group. Such vinyl compounds are described, for example, in *Kobunshi Data Handbook (Kiso-hen)*, edited by Kobunshi Gakkai, Baifukan (1986). Specific examples of the vinyl compound are acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the above-described polar group in the substituent thereof.

Specific examples of the polymer components containing the specific polar group are set forth below, but the present invention should not be construed as being limited thereto. In the following formulae, $R^3$ represents —H or —$CH_3$; $R^4$ represents —H, —$CH_3$ or —$CH_2COOCH_3$; $R^5$ represents an alkyl group having from 1 to 4 carbon atoms; $R^6$ represents an alkyl group having from 1 to 6 carbon atoms, a benzyl group or a phenyl group; f represents an integer of from 1 to 3; g represents an integer of from 2 to 11; h represents an integer of from 1 to 11; and i represents an integer of from 2 to 4; and j represents an integer of from 2 to 10.

(a-1)

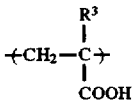

(a-2)

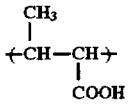

(a-3)

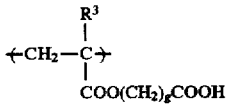

(a-4)

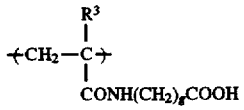

(a-5)

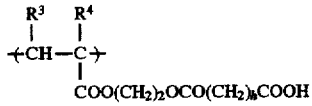

(a-6)

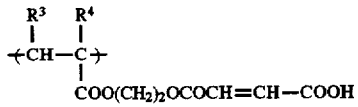

-continued (a-7)

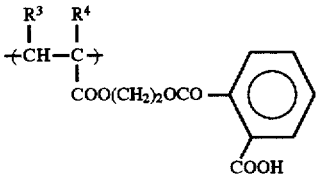

(a-8)

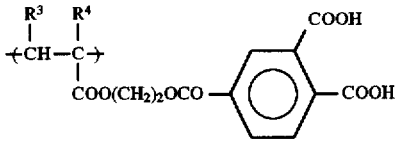

(a-9)

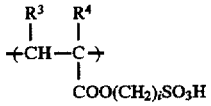

(a-10)

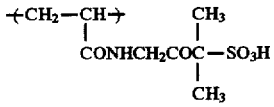

(a-11)

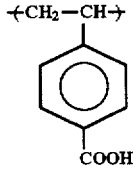

(a-12)

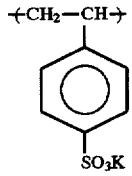

(a-13)

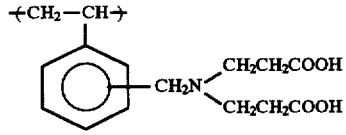

(a-14)

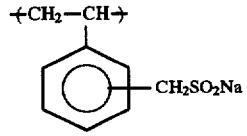

(a-15)

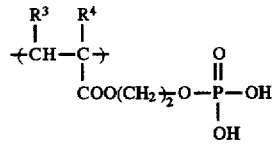

(a-16)

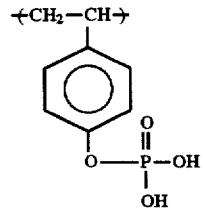

-continued
(a-17)
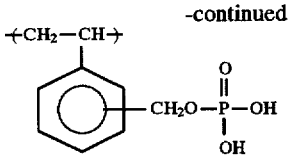
(a-18)
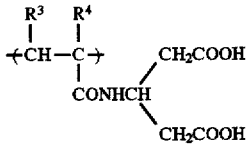
(a-19)
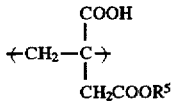
(a-20)
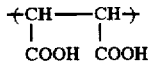
(a-21)
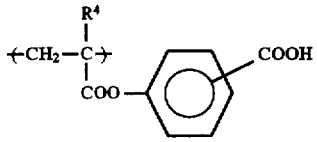
(a-22)
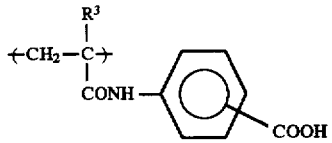
(a-23)
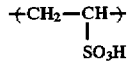
(a-24)
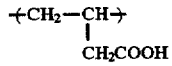
(a-25)
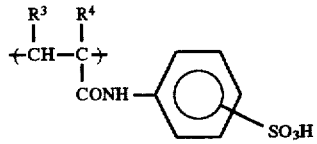
(a-26)
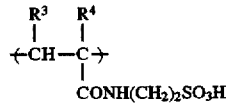
(a-27)
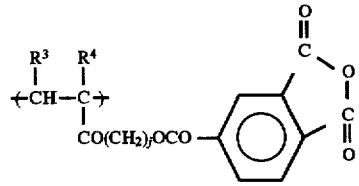
(a-28)
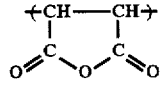
(a-29)
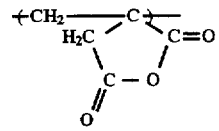
-continued
(a-30)
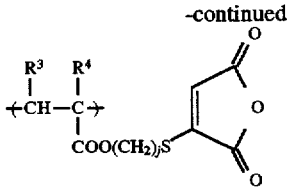
(a-31)
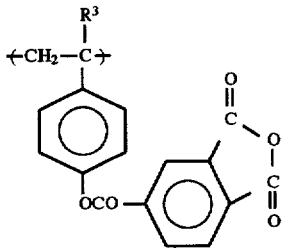
(a-32)
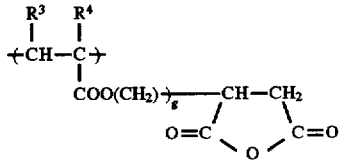
(a-33)
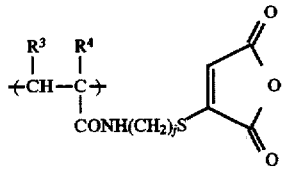
(a-34)
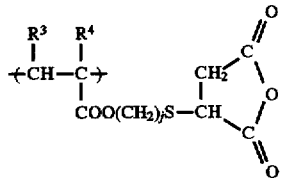
(a-35)
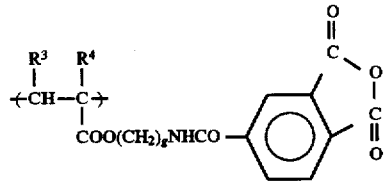
(a-36)
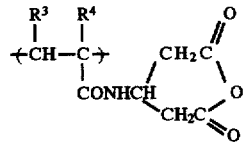
(a-37)
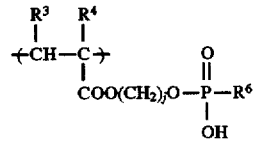
(a-38)
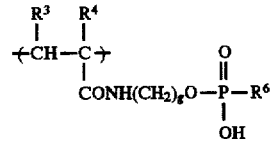

-continued (a-39)

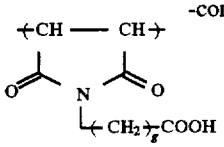

(a-40)

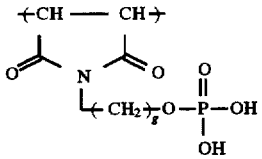

(a-41)

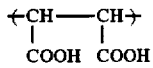

(a-42)

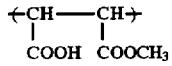

(a-43)

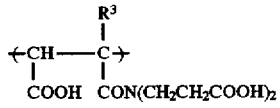

(a-44)

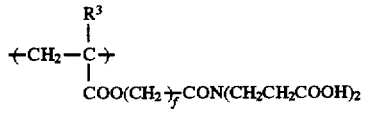

(a-45)

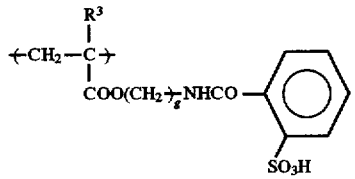

(a-46)

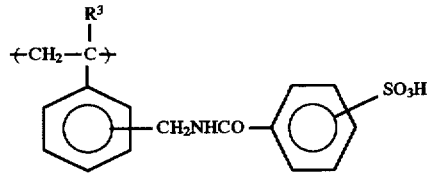

(a-47)

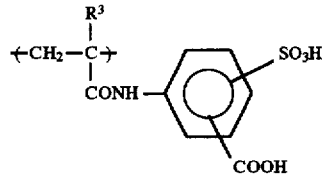

(a-48)

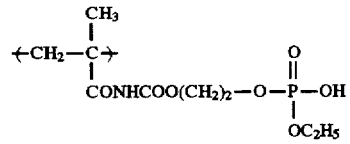

(a-49)

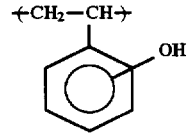

(a-50)

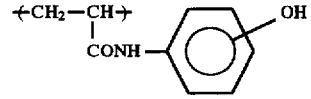

-continued (a-51)

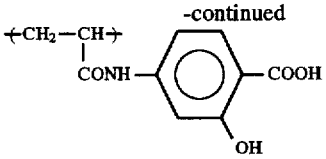

(a-52)

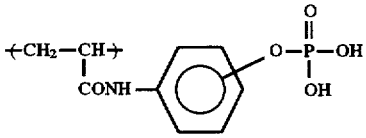

(a-53)

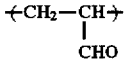

The content of the polar group-containing polymer component in the resin (A) of this type is preferably from 3 to 50% by weight, and more preferably from 5 to 40% by weight based on the total polymer component in the resin (A).

If the content of the polar group-containing polymer component is less than 3% by weight, removal of the transfer layer with an alkaline solution may be insufficient and background stains in non-image areas may occur when used as a printing plate. On the other hand, if the content exceeds 50% by weight, a glass transition point or softening point of the resulting resin (A) become high even though other copolymer components used in the resin (A) are adjusted and as a result, the transferability of transfer layer onto a receiving material may degrade.

The resin (A) contains other polymer component(s) in addition to the above-described specific polar group-containing polymer component in order to maintain its thermoplasticity. As such polymer components, those which form a homopolymer having a glass transition point of not more than 120° C. are preferred. More specifically, examples of such other polymer components include those corresponding to the repeating unit represented by the following general formula (I):

(I)

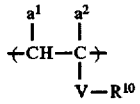

wherein V represents —COO—, —OCO—, —O—, —CO—, $—C_6H_4—$, $—(CH_2)_nCOO—$ or $—(CH_2)_nOCO—$; n represents an integer of from 1 to 4; $R^{10}$ represents a hydrocarbon group having from 1 to 22 carbon atoms; and $a^1$ and $a^2$, which may be the same or different, each represents a hydrogen atom, a fluorine atom, a chlorine atom, a bromine atom, a cyano group, a trifluoromethyl group, a hydrocarbon group having from 1 to 7 carbon atoms (e.g., methyl, ethyl, propyl, butyl, pentyl, hexyl, phenyl and benzyl) or $—COOZ^1$ (wherein $Z^1$ represents a hydrocarbon group having from 1 to 7 carbon atoms).

Preferred examples of the hydrocarbon group represented by $R^{10}$ include an alkyl group having from 1 to 18 carbon atoms which may be substituted (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 2-hydroxypropyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, naphthylmethyl, 2-naphthylethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), and an aromatic group having from 6 to 12 carbon atoms which may be substituted (e.g., phenyl, tolyl, xylyl, mesityl, naphthyl, methoxyphenyl, ethoxyphenyl, fluorophenyl, difluorophenyl, bromophenyl, chlorophenyl, dichlorophenyl, methoxycarbonylphenyl, ethoxycarbonylphenyl, and cyanophenyl).

The content of the polymer component represented by the general formula (I) is preferably from 50 to 97% by weight based on the total polymer component in the resin (A).

Moreover, the resin (A) may further contain other copolymerizable polymer components than the polar group-containing polymer component and the polymer component represented by the general formula (I). Examples of monomers corresponding to such other polymer components include, in addition to methacrylic acid esters, acrylic acid esters and crotonic acid esters containing substituents other than those described for the general formula (I), α-olefins, vinyl or allyl esters of carboxylic acids (including, e.g., acetic acid, propionic acid, butyric acid, valetic acid, benzoic acid, naphthalenecarboxylic acid, as examples of the carboxylic acids), acrylonitrile, methacrylonitrile, vinyl ethers, iraconic acid esters (e.g., dimethyl ester, and diethyl ester), acrylamides, methacrylamides, styrenes (e.g., styrene, vinyltoluene, chlorostyrene, hydroxystyrene, N,N-dimethylaminomethylstyrene, methoxycarbonylstyrene, methanesulfonyloxystyrene, and vinylnaphthalene), vinyl sulfone compounds, vinyl ketone compound, and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine). Such other polymer components may be employed in an appropriate range wherein the transferability of the resin (A) is not damaged. Specifically, it is preferred that the content of such other polymer components does not exceed 30% by weight based on the total polymer component of the resin (A).

Another representative example of the resin (A) capable of being removed upon the chemical reaction treatment used in the transfer layer according to the present invention is a resin which has a hydrophilic group protected by a protective group and is capable of forming the hydrophilic group upon a chemical reaction.

The chemical reaction for converting the protected hydrophilic group to a hydrophilic group includes a reaction for rendering hydrophilic with a processing solution utilizing a conventionally known reaction, for example, hydrolysis, hydrogenolysis, oxygenation, β-release, and nucleophilic substitution, and a reaction for rendering hydrophilic by a decomposition reaction induced by exposure of actinic radiation.

Particularly useful resins of the resins capable of being rendered hydrophilic upon the chemical reaction treatment includes polymers comprising a polymer component containing at least one functional group capable of forming at least one hydrophilic group selected from a $—CO_2H$ group, a —CHO group, a $—SO_3H$ group, a $—SO_2H$ group, a $—PO_3H_2$ group and a —OH group upon a chemical reaction.

The polymer component containing a functional group capable of forming a hydrophilic group upon a chemical reaction (a hydrophilic group-forming functional group) is included not less than 10% by weight, and preferably not less than 20% by weight, based on the total polymer component of the resin (A) of this type. A polymer containing 100% by weight of such polymer components can be naturally used. If the content of the polymer component containing a hydrophilic group-forming functional group is less than 10% by weight, removal of the transfer layer after the chemical reaction for preparing a printing plate may be insufficient and undesirable background stains may occur in non-image areas of prints.

Now, the functional group capable of forming at least one hydrophilic group ($—CO_2H$, —CHO, $—SO_3H$, $—SO_2H$, $—PO_3H_2$, or —OH) upon the chemical reaction which can be used in the present invention will be described in greater detail below.

The number of hydrophilic groups formed from one functional group capable of forming a hydrophilic group upon the chemical reaction may be one, two or more.

Now, a functional group capable of forming at least one carboxyl group upon the chemical reaction will be described below.

According to one preferred embodiment of the present invention, a carboxy group-forming functional group is represented by the following general formula (F-I):

$$—COO—L^1 \qquad \text{(F-I)}$$

wherein $L^1$ represents

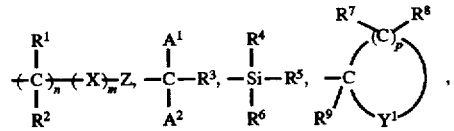

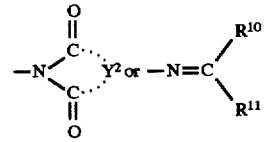

wherein $R^1$ and $R^2$, which may be the same or different, each represent a hydrogen atom or a hydrocarbon group; X represents an aromatic group; Z represents a hydrogen atom, a halogen atom, a trihalomethyl group, an alkyl group, a cyano group, a nitro group, $—SO_2—Z^1$ (wherein $Z^1$ represents a hydrocarbon group), $—COO—Z^2$ (wherein $Z^2$ represents a hydrocarbon group), $—O—Z^3$ (wherein $Z^3$ represents a hydrocarbon group), or $—CO—Z^4$ (wherein $Z^4$ represents a hydrocarbon group); n and m each represent 0, 1 or 2, provided that when both n and m are 0, Z is not a hydrogen atom; $A^1$ and $A^2$, which may be the same or different, each represent an electron attracting group having a positive Hammett's σ value; $R^3$ represents a hydrogen atom or a hydrocarbon group; $R^4$, $R^5$, $R^6$, $R^{10}$ and $R^{11}$, which may be the same or different, each represent a hydrocarbon group or $—O—Z^5$ (wherein $Z^5$ represents a hydrocarbon group); $Y^1$ represents an oxygen atom or a sulfur atom; $R^7$, $R^8$, and $R^9$, which may be the same or different, each represent a hydrogen atom, a hydrocarbon group or $—O—Z^7$ (wherein $Z^7$ represents a hydrocarbon group); p represents an integer of 3 or 4; $Y^2$ represents an organic residue for forming a cyclic imido group.

In more detail, $R^1$ and $R^2$, which may be the same or different, each preferably represents a hydrogen atom or a straight chain or branched chain alkyl group having from 1 to 12 carbon atoms which may be substituted (e.g., methyl, ethyl, propyl, chloromethyl, dichloromethyl, trichloromethyl, trifluoromethyl, butyl, hexyl, octyl, decyl, hydroxyethyl, or 3-chloropropyl). X preferably represents a phenyl or naphthyl group which may be substituted (e.g., phenyl, methylphenyl, chlorophenyl, dimethylphenyl, chloromethylphenyl, or naphthyl). Z preferably represents a hydrogen atom, a halogen atom (e.g., chlorine or fluorine), a trihalomethyl group (e.g., trichloromethyl or trifluoromethyl), a straight chain or branched chain alkyl group having from 1 to 12 carbon atoms which may be substituted (e.g., methyl, chloromethyl, dichloromethyl, ethyl, propyl, butyl, hexyl, tetrafluoroethyl, octyl, cyanoethyl, or chloroethyl), a cyano group, a nitro group, $—SO_2—Z^1$ (wherein $Z^1$ represents an aliphatic group (for example an alkyl group having from 1 to 12 carbon atoms which may be substituted (e.g., methyl, ethyl, propyl, butyl, chloroethyl, pentyl, or octyl) or an aralkyl group having from 7 to 12 carbon atoms which may be substituted (e.g., benzyl, phenethyl, chlorobenzyl, methoxybenzyl, chlorophenethyl, or methylphenethyl)), or an aromatic group (for example, a phenyl or naphthyl group which may be substituted (e.g., phenyl, chlorophenyl, dichlorophenyl, methylphenyl, methoxyphenyl, acetylphenyl, acetamidophenyl, methoxycarbonylphenyl, or naphthyl)), $—COO—Z^2$ (wherein $Z^2$ has the same meaning as $Z^1$ above), $—O—Z^3$ (wherein $Z^3$ has the same meaning as $Z^1$ above), or $—CO—Z^4$ (wherein $Z^4$ has the same meaning as $Z^1$ above). n and m each represent 0, 1 or 2, provided that when both n and m are 0, Z is not a hydrogen atom.

$R^4$, $R^5$, and $R^6$, which may be the same or different, each preferably represent an aliphatic group having 1 to 18 carbon atoms which may be substituted (wherein the aliphatic group includes an alkyl group, an alkenyl group, an aralkyl group, and an alicyclic group, and the substituent therefor includes a halogen atom, a cyano group, and $—O—Z^6$ (wherein $Z^6$ represents an alkyl group, an aralkyl group, an alicyclic group, or an aryl group)), an aromatic group having from 6 to 18 carbon atoms which may be substituted (e.g., phenyl, tolyl, chlorophenyl, methoxyphenyl, acetamidophenyl, or naphthyl), or $—O—Z^5$ (wherein $Z^5$ represents an alkyl group having from 1 to 12 carbon atoms which may be substituted, an alkenyl group having from 2 to 12 carbon atoms which may be substituted, an aralkyl group having from 7 to 12 carbon atoms which may be substituted, an alicyclic group having from 5 to 18 carbon atoms which may be substituted, or an aryl group having from 6 to 18 carbon atoms which may be substituted).

$A^1$ and $A^2$ may be the same or a different, at least one of $A^1$ and $A^2$ represents an electron attracting group, with the sum of their Hammett's $\sigma_p$ values being 0.45 or more. Examples of the electron attracting group for $A^1$ or $A^2$ include an acyl group, an aroyl group, a formyl group, an alkoxycarbonyl group, a phenoxycarbonyl group, an alkylsulfonyl group, an aroylsulfonyl group, a nitro group, a cyano group, a halogen atom, a halogenated alkyl group, and a carbamoyl group.

A Hammett's $\sigma_p$ value is generally used as an index for estimating the degree of electron attracting or donating property of a substituent. The greater the positive value, the higher the electron attracting property. Hammett's σ values of various substituents are described, e.g., in Naoki Inamoto, *Hammett Soku—Kozo to Han-nosei*, Maruzen (1984).

It seems that an additivity rule applies to the Hammett's $\sigma_p$ values in this system so that both of $A^1$ and $A^2$ need not be electron attracting groups. Therefore, where one of them is an electron attracting group, the other may be any group selected without particular limitation as far as the sum of their $\sigma_p$ values is 0.45 or more.

$R^3$ preferably represents a hydrogen atom or a hydrocarbon group having from 1 to 8 carbon atoms which may be substituted, e.g., methyl, ethyl, propyl, butyl, pentyl, hexyl, octyl, allyl, benzyl, phenethyl, 2-hydroxyethyl, 2-methoxyethyl, 2-ethoxyethyl, 3-methoxypropyl, or 2-chloroethyl.

$Y^1$ represents an oxygen atom or a sulfur atom. $R^7$, $R^8$, and $R^9$, which may be the same or different, each preferably represents a hydrogen atom, a straight chain or branched chain alkyl group having from 1 to 18 carbon atoms which may be substituted (e.g., methyl, ethyl, propyl, butyl, hexyl, octyl, decyl, dodecyl, octadecyl, chloroethyl, methoxyethyl, or methoxypropyl), an alicyclic group which may be substituted (e.g., cyclopentyl or cyclohexyl), an aralkyl group having from 7 to 12 carbon atoms which may be substituted (e.g., benzyl, phenethyl, chlorobenzyl, or methoxybenzyl), an aromatic group which may be substituted (e.g., phenyl, naphthyl, chlorophenyl, tolyl, methoxyphenyl, methoxycarbonylphenyl, or dichlorophenyl), or $—O—Z^7$ (wherein $Z^7$ represents a hydrocarbon group and specifically the same hydrocarbon group as described for $R^7$, $R^8$, or $R^9$). p represents an integer of 3 or 4.

$Y^2$ represents an organic residue for forming a cyclic imido group, and preferably represents an organic residue represented by the following general formula (A) or (B):

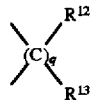

(A)

wherein $R^{12}$ and $R^{13}$, which may be the same or different, each represent a hydrogen atom, a halogen atom (e.g., chlorine or bromine), an alkyl group having from 1 to 18 carbon atoms which may be substituted (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, or 2-(ethoxymethoxy)ethyl), an aralkyl group having from 7 to 12 carbon atoms which may be substituted (e.g., benzyl, phenethyl, 3-phenylpropyl, methylbenzyl, dimethylbenzyl, methoxybenzyl, chlorobenzyl, or bromobenzyl), an alkenyl group having from 3 to 18 carbon atoms which may be substituted (e.g., allyl, 3-methyl-2-propenyl, 2-hexenyl, 4-propyl-2-pentenyl, or 12-octadecenyl), $—S—Z^8$ (wherein $Z^8$ represents an alkyl, aralkyl or alkenyl group having the same meaning as $R^{12}$ or $R^{13}$ described above or an aryl group which may be substituted (e.g., phenyl, tolyl, chlorophenyl, bromophenyl, methoxyphenyl, ethoxyphenyl, or ethoxycarbonylphenyl)) or $—NH—Z^9$ (wherein $Z^9$ has the same meaning as $Z^8$ described above). Alternatively, $R^{12}$ and $R^{13}$ may be taken together to form a ring, such as a 5- or 6-membered monocyclic ring (e.g., cyclopentane or cyclohexane) or a 5- or 6-membered bicyclic ring (e.g., bicyclopentane, bicycloheptane, bicyclooctane, or bicyclooctene). The ring may be substituted. The substituent includes those described for $R^{12}$ or $R^{13}$. q represents an integer of 2 or 3.

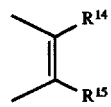

(B)

wherein $R^{14}$ and $R^{15}$, which may be the same or different, each have the same meaning as $R^{12}$ or $R^{13}$ described above. Alternatively, $R^{14}$ and $R^{15}$ may be taken together to form an aromatic ring (e.g., benzene or naphthalene).

According to another preferred embodiment of the present invention, the carboxyl group-forming functional group is a group containing an oxazolone ring represented by the following general formula (F-II):

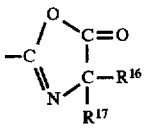

(F-II)

wherein $R^{16}$ and $R^{17}$, which may be the same or different, each represent a hydrogen atom or a hydrocarbon group, or $R^{16}$ and $R^{17}$ may be taken together to form a ring.

In the general formula (F-II), $R^{16}$ and $R^{17}$ each preferably represents a hydrogen atom, a straight chain or branched chain alkyl group having from 1 to 12 carbon atoms which may be substituted (e.g., methyl, ethyl, propyl, butyl, hexyl, 2-chloroethyl, 2-methoxyethyl, 2-methoxycarbonylethyl, or 3-hydroxypropyl), an aralkyl group having from 7 to 12 carbon atoms which may be substituted (e.g., benzyl, 4-chlorobenzyl, 4-acetamidobenzyl, phenethyl, or 4-methoxybenzyl), an alkenyl group having from 2 to 12 carbon atoms which may be substituted (e.g., vinyl, allyl, isopropenyl, butenyl, or hexenyl), a 5- to 7-membered alicyclic group which may be substituted (e.g., cyclopentyl, cyclohexyl, or chlorocyclohexyl), or an aromatic group which map be substituted (e.g., phenyl, chlorophenyl, methoxyphenyl, acetamidophenyl, methylphenyl, dichlorophenyl, nitrophenyl, naphthyl, butylphenyl, or dimethylphenyl). Alternatively, $R^{16}$ and $R^{17}$ may be taken together to form a 4- to 7-membered ring (e.g., tetramethylene, pentamethylene, or hexamethylene).

A functional group capable of forming at least one sulfo group upon the chemical reaction includes a functional group represented by the following general formula (F-III) or (F-IV):

$$-SO_2-O-L^2 \quad \text{(F-III)}$$

$$-SO_2-S-L^2 \quad \text{(F-IV)}$$

wherein $L^2$ represents

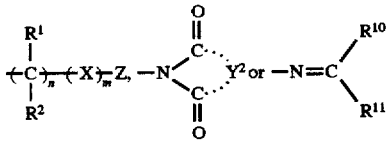

wherein $R^1$, $R^2$, X, Z, n, m, $Y^2$, $R^{10}$, and $R^{11}$ each has the same meaning as defined above.

A functional group capable of forming at least one sulfinic acid group upon the chemical reaction includes a functional group represented by the following general formula (F-V):

$$-SO_2-L^3 \quad \text{(F-V)}$$

wherein $L^3$ represents

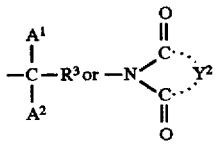

wherein $A^1$, $A^2$, $R^3$ and $Y^2$ each has the same meaning as defined above.

A functional group capable of forming at least one $-PO_3H_2$ group upon the chemical reaction includes a functional group represented by the following general formula (F-VI):

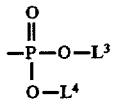

(VI)

wherein $L^3$ and $L^4$, which may be the same or different, each has the same meaning as $L^1$ described above.

One preferred embodiment of functional groups capable of forming at least one hydroxyl group upon the chemical reaction includes a functional group represented by the following general formula (F-VII):

$$-O-L^5 \quad \text{(F-VII)}$$

wherein $L^5$ represents

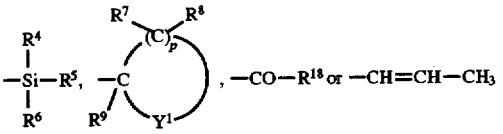

wherein $R^4$, $R^5$, $R^6$, $R^7$, $R^8$, $R^9$, $Y^1$, and p each has the same meaning as defined above; and $R^{18}$ represents a hydrocarbon group, and specifically the same hydrocarbon group as described for $R^1$.

Another preferred embodiment of functional groups capable of forming at least one hydroxyl group upon the chemical reaction includes a functional group wherein at least two hydroxyl groups which are sterically close to each other are protected with one protective group. Such hydroxyl group-forming functional groups are represented, for example, by the following general formulae (F-VIII), (F-IX) and (F-X):

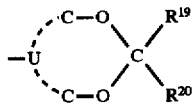

(F-VIII)

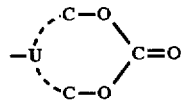

(F-IX)

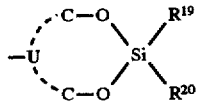

(F-X)

wherein $R^{19}$ and $R^{20}$, which may be the same or different, each represents a hydrogen atom, a hydrocarbon group, or $-O-Z^{10}$ (wherein $Z^{10}$ represents a hydrocarbon group); and U represents a carbon-to-carbon bond which may contain a hetero atom, provided that the number of atoms present between the two oxygen atoms is 5 or less.

More specifically, $R^{19}$ and $R^{20}$, which may be the same as different, each preferably represents a hydrogen atom, an alkyl group having from 1 to 12 carbon atoms which may be substituted (e.g., methyl, ethyl, propyl, butyl, hexyl, 2-methoxyethyl, or octyl), an aralkyl group having from 7 to 9 carbon atoms which may be substituted (e.g., benzyl, phenethyl, methylbenzyl, methoxybenzyl, or chlorobenzyl), an alicyclic group having from 5 to 7 carbon atoms (e.g., cyclopentyl or cyclohexyl), an aryl group which may be substituted (e.g., phenyl, chlorophenyl, methoxyphenyl, methylphenyl, or cyanophenyl), or —$OZ^{10}$ (wherein $Z^{10}$ represents a hydrocarbon group, and specifically the same hydrocarbon group as described for $R^{19}$ or $R^{20}$), and U represents a carbon-to-carbon bond which may contain a hetero atom, provided that the number of atoms present between the two oxygen atoms is 5 or less.

Specific examples of the functional groups represented by the general formulae (F-I) to (F-X) described above are set forth below, but the present invention should not be construed as being limited thereto. In the following formulae (f-1) through (f-67), the symbols used have the following meanings respectively:

$W_1$: —CO—, —$SO_2$—, or

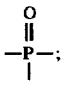

$W_2$: —CO— or —$SO_2$—;

$Q^1$: —$C_nH_{2n+1}$ (n: an integer of from 1 to 8),

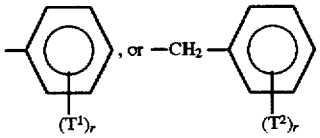

$T^1$, $T^2$: —H, —$C_nH_{2n+1}$, —$OC_nH_{2n+1}$, —CN, —$NO_2$, —Cl, —Br, —$COOC_nH_{2n+1}$, —NHCO—$C_nH_{2n+1}$, or —$COC_nH_{2n+1}$;

r: an integer of from 1 to 5;

$Q^2$: —$C_nH_{2n+1}$, —$CH_2C_6H_5$, or —$C_6H_5$;

$Q^3$: —$C_mH_{2m+1}$ (m: an integer of from 1 to 4) or —$CH_2C_6H_5$;

$Q^4$: —H, —$CH_3$, or —$OCH_3$;

$Q^5$, $Q^6$: —H, —$CH_3$, —$OCE_3$, —$C_6H_5$, or —$CH_2C_6H_5$;

G: —O— or —S—; and

J: —Cl or —Br $-W_1-O-(CH_2)_2COQ^1$ (f-1)

$-W_1-O-C(CH_3)_2-CH_2COQ^1$ (f-2)

$-W_1-O(CH_2)_2COOQ^1$ (f-3)

$-W_1-O(CH_2)_2SO_2Q^1$ (f-4)

$-W_1-O(CH_2)_2CN$ (f-5)

$-W_1-O(CH_2)_2NO_2$ (f-6)

$-W_1-OCH(Q^2)CH_2COQ^1$ (f-7)

$-W_1-O-CH_2CH(Q^2)COQ^1$ (f-8)

$-W_1-OCH(Q^2)CH(Q^2)COQ^1$ (f-9)

-continued $-W_1-O-C(CH_3)_2CH_2SO_2Q^1$ (f-10)

$-W_1-O-C(COCH_3)(COOQ^1)-Q^3$ (f-11)

$-W_1-O-C(COOQ^1)(COOQ^1)-Q^3$ (f-12)

$-W_1-O-C(CN)(CN)-Q^3$ (f-13)

$-W_1-O-C(COQ^1)(COQ^2)-Q^3$ (f-14)

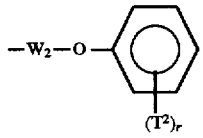

(f-15)

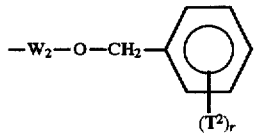

(f-16)

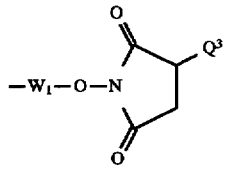

(f-17)

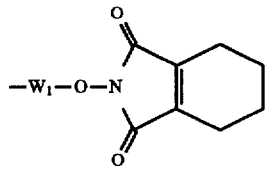

(f-18)

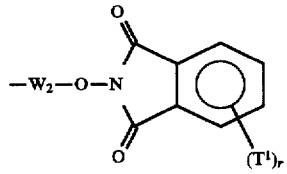

(f-19)

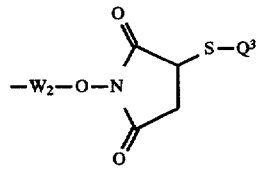

(f-20)

-continued
(f-21)
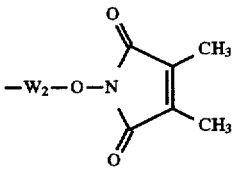
(f-22)
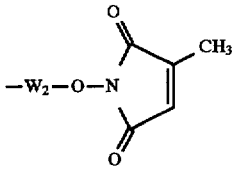
(f-23)
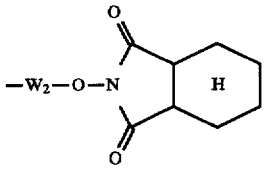
(f-24)
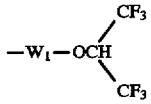
(f-25)
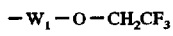
(f-26)
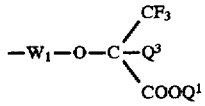
(f-27)
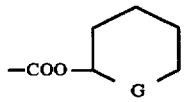
(f-28)
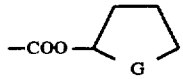
(f-29)
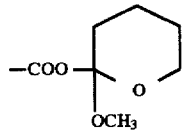
(f-30)
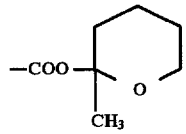
(f-31)
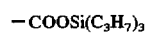
(f-32)
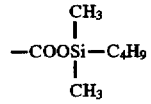
(f-33)
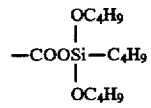
-continued
(f-34)
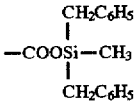
(f-35)
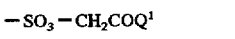
(f-36)
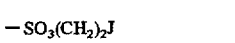
(f-37)
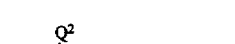
(f-38)
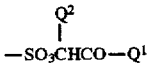
(f-39)
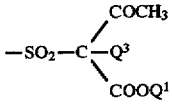
(f-40)
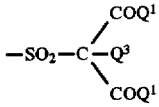
(f-41)
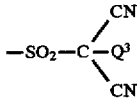
(f-42)
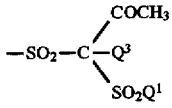
(f-43)
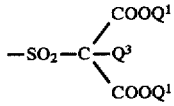
(f-44)
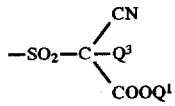
(f-45)
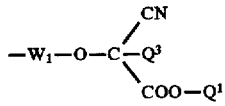
(f-46)
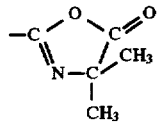
(f-47)
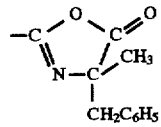
(f-48)
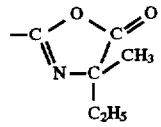

-continued (f-49)

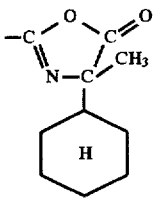

(f-50)

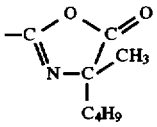

(f-51)

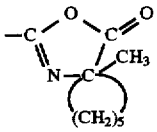

(f-52)

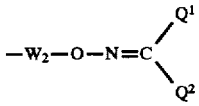

(f-53)

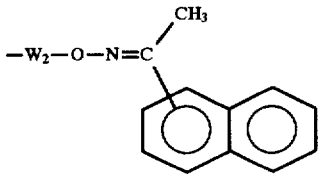

(f-54)

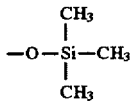

(f-55)

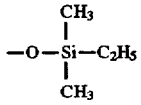

(f-56)

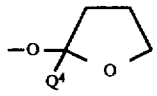

(f-57)

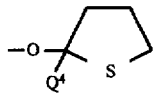

(f-58)

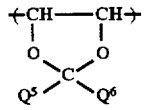

(f-59)

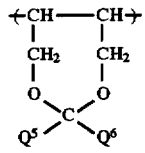

(f-60)

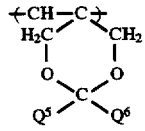

-continued (f-61)

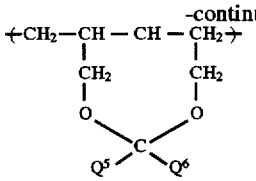

(f-62)

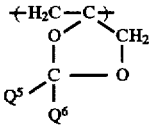

(f-63)

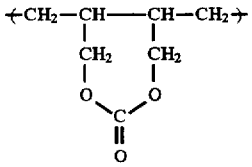

(f-64)

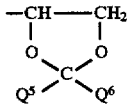

(f-65)

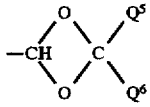

(f-66)

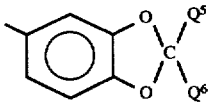

(f-67)

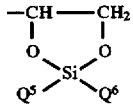

The polymer component which contains a functional group capable of forming at least one hydrophilic group selected from —COOH, —CHO, $—SO_3H$, $—SO_2H$, $—PO_3H_2$ and —OH upon the chemical reaction which can be used in the present invention is not particularly limited. Specific examples thereof include a polymer component corresponding to a repeating unit represented by the following general formula (II):

(II)

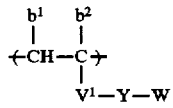

wherein $V^1$ represents —COO—, —OCO—, —O—, —CO—,

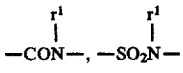

(wherein $r^1$ represents a hydrogen atom or a hydrocarbon group), —CONHCOO—, —CONHCONH—, $—CH_2COO—$, $—CH_2OCO—$, or $—C_6H_4—$; Y represents a single bond or an organic moiety linking $—V^1—$ and —W, or $—V^1—Y—$ means a mere bond through which W is directly bonded to the moiety of

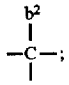

W represents a functional group capable of forming a hydrophilic group, for example, a group represented by any of the general formulae (F-I) to (F-X); and $b^1$ and $b^2$, which may be the same or different, each represents a hydrogen atom, a halogen atom, a cyano group, an alkyl group, an aralkyl group, or an aryl group.

In more detail, $V^1$ preferably represents —COO—, —OCO—, —O—, —CO—,

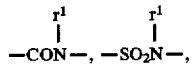

or $—C_6H_4—$, wherein $r^1$ represents a hydrogen atom, an alkyl group having from 1 to 8 carbon atoms which may be substituted (e.g., methyl, ethyl, propyl, butyl, pentyl, hexyl, octyl, 2-chloroethyl, 2-bromoethyl, 2-cyanoethyl, 2-methoxyethyl, 2-hydroxyethyl, or 3-bromopropyl), an aralkyl group having from 7 to 9 carbon atoms which may be substituted (e.g., benzyl, phenethyl, 3-phenylpropyl, chlorobenzyl, bromobenzyl, methylbenzyl, methoxybenzyl, chloromethylbenzyl, or dibromobenzyl), or an aryl group which may be substituted (e.g., phenyl, tolyl, xylyl, mesityl, methoxyphenyl, chlorophenyl, bromophenyl, or chloromethylphenyl).

Y represents a single bond or an organic moiety linking $—V^1—$ and —W.

The organic moiety represented by Y which links $—V^1—$ and —W includes a carbon atom, a hetero atom (e.g., an oxygen atom, an sulfur atom or a nitrogen atom) and a combination thereof. Specific examples of the organic moiety include

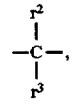

$—C_6H_{10}—$, $—C_6H_4—$, —CH=CH—, —O—, —S—,

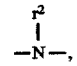

—COO—, —CONH—, $—SO_2—$, $—SO_2NH—$, —NHCOO—, —NHCONH—,

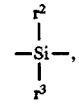

and combinations thereof, wherein $r^2$ and $r^3$ each has the same meaning as $r^1$ described above. Alternatively, $—V^1—Y—$ may not be present whereby —W is directly bonded.

$b^1$ and $b^2$, which may be the same or different, each represents a hydrogen atom, a halogen atom (e.g., chlorine or bromine), a cyano group, or a hydrocarbon group (for example, an alkyl group having from 1 to 12 carbon atoms which may be substituted (e.g., methyl, ethyl, propyl, butyl, methoxycarbonyl, ethoxycarbonyl, propoxycarbonyl, butoxycarbonyl, hexyloxycarbonyl, methoxycarbonylmethyl, ethoxycarbonylmethyl, or butoxycarbonylmethyl), an aralkyl group (e.g., benzyl or phenethyl), or an aryl group (e.g., phenyl, tolyl, xylyl, or chlorophenyl)).

Specific examples of a portion of the polymer component represented by the general formula (II) formed by omitting a hydrophilic group-forming functional group (W) therefrom are set forth below, but the present invention should not be construed as being limited thereto. In the following formulae (b-1) through (b-17), b represents H or $CE_3$; n represents an integer of from 2 to 8; and m represents an integer of from 0 to 8.

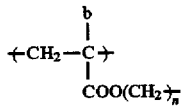

(b-1)

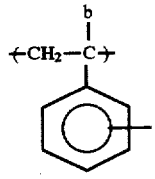

(b-2)

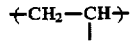

(b-3)

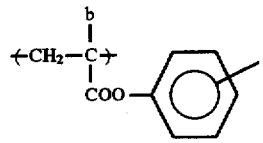

(b-4)

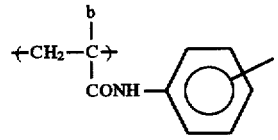

(b-5)

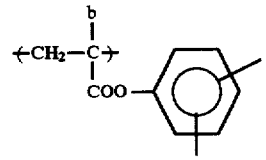

(b-6)

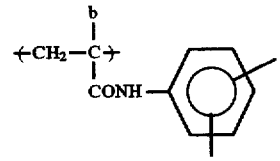

(b-7)

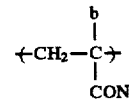

(b-8)

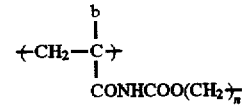

(b-9)

-continued (b-10)

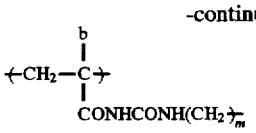

(b-11)

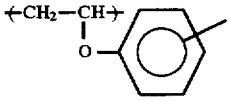

(b-12)

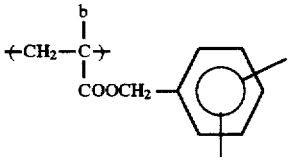

(b-13)

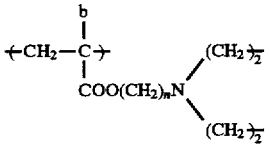

(b-14)

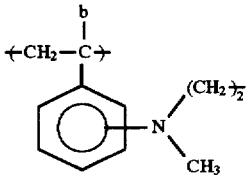

(b-15)

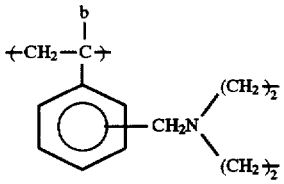

(b-16)

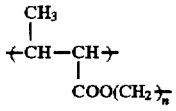

(b-17)

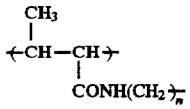

The above-described functional group capable of forming at least one hydrophilic group selected from —COOH, —CEO, —$SO_3H$, —$SO_2H$, —$PO_3H_2$, and —OH upon the chemical reaction used in the present invention is a functional group in which such a hydrophilic group is protected with a protective group. Introduction of the protective group into a hydrophilic group by a chemical bond can easily be carried out according to conventionally known methods. For example, the reactions as described in J. F. W. McOmie, *Protective Groups in Organic Chemistry*, Plenum Press (1973), T. W. Greene, *Protective Groups in Organic Synthesis*, Wiley-Interscience (1981), Nippon Kagakukai (ed.), *Shin Jikken Kaqaku Koza*, Vol. 14, "eYuki Kagobutsu no Gosei to gan-no", Maruzen (1978), and Yoshio iwakura and Keisuke Kurita, *Han-nosei Kobunshi*, Kodansha can be employed.

In order to introduce the functional group which can be used in the present invention into a resin, a process using a so-called polymer reaction in which a polymer containing at least one hydrophilic group selected from —COOH, —CHO, —$SO_3H$, —$SO_2H$, —$PO_3H_2$, and —OH is reacted to convert its hydrophilic group to a protected hydrophilic group or a process comprising synthesizing at least one monomer containing at least one of the functional groups, for example, those represented by the general formulae (F-I) to (F-X) and then polymerizing the monomer or copolymerizing the monomer with any appropriate other copolymerizable monomer(s) is used.

The latter process (comprising preparing the desired monomer and then conducting polymerization reaction) is preferred for reasons that the amount or kind of the functional group to be incorporated into the polymer can be appropriately controlled and that incorporation of impurities can be avoided (in case of the polymer reaction process, a catalyst to be used or by-products are mixed in the polymer).

For example, a resin containing a carboxyl group-forming functional group may be prepared by converting a carboxyl group of a carboxylic acid containing a polymerizable double bond or a halide thereof to a functional group represented by the general formula (F-I) by the method as described in the literature references cited above and then subjecting the functional group-containing monomer to a polymerization reaction.

Also, a resin containing an oxazolone ring represented by the general formula (F-II) as a carboxyl group-forming functional group may be obtained by conducting a polymerization reaction of at least one monomer containing the oxazolone ring, if desired, in combination with other copolymerizable monomer(s). The monomer containing the oxazolone ring can be prepared by a dehydrating cyclization reaction of an N-acyloyl-α-amino acid containing a polymerizable unsaturated bond. More specifically, it can be prepared according to the method described in the literature references cited in Yoshio Iwakura and Keisuke Kurita, *Han-nosei Kobunshi*, Ch. 3, Kodansha.

In addition to the polymer component containing the hydrophilic group-forming functional group, the resin A may further contain other polymer component(s). As such other polymer components, any monomers copolymerizable with the monomer corresponding to the polymer component containing the functional group may be used. Examples of suitable copolymerizable monomers are described, e.g., in Kobunshi Gakkai (ed.), *Kobunshi Data Handbook (Kisohen)*, Baifukan (1986) and J. Brandrup and E. H. Immergut, *Polymer Handbook*, John Wiley & Sons (1989).

Specific examples of the copolymerizable monomers include an ester of acrylic acid, an α- and/or β-substituted acrylic acid (e.g., α-acetoxyacrylic acid, α-acetoxymethylacrylic acid, α-(2-amino)methylacrylic acid, α-chloroacrylic acid, α-bromoacrylic acid, α-fluoroacrylic acid, α-tributylsilylacrylic acid, α-cyanoacrylic acid, β-chloroacrylic acid, β-bromoacrylic acid, α-chloro-β-methoxyacrylic acid, or α,β-dichloroacetic acid), methacrylic acid, iraconic acid, crotonic acid, or a 2-alkenylcarboxylic acid (e.g., 2-pentenoic acid, 2-methyl-2-hexenoic acid, 2-octenoic acid, 4-methyl-2-hexenoic acid, or 4-ethyl-2-octenoic acid) (examples of the ester part including a hydrocarbon group containing from 1 to 22 carbon atoms which may be substituted (e.g., methyl, ethyl, propyl, butyl, pentyl hexyl, heptyl, octyl, nonyl, decyl, dodecyl, tridecyl, tetradecyl, hexadecyl, octadecyl, butenyl, hexenyl, octenyl, dodecenyl, octadecenyl, 2-methoxyethyl, 3-methoxyethyl, 3-methoxypropyl, 2-chloroethyl, hexafluoropropyl, cyclopentyl, cyclohexyl, benzyl, phenethyl, methylbenzyl, phenyl, tolyl, naphthyl, methoxyphenyl, and chlorophenyl)), an α-olefin, a vinyl or allyl ester of a carboxylic acid (examples of the acid including e.g., acetic acid, propionic acid, butyric acid, valeric acid, benzoic acid, or naphthalenecarboxylic acid), acrylonitrile, methacrylonitrile, a vinyl ether, an itaconic ester (e.g., dimethyl itaconate or diethyl itaconate), an acrylamide, a methacrylamide, a styrene (e.g., styrene, vinyltoluene, chlorostyrene, hydroxystyrene, N,N-dimethylaminomethylstyrene, methoxycarbonylstyrene, methanesulfonyloxystyrene, or vinylnaphthalene), a vinyl sulfone-containing compound, a vinyl ketone-containing compound, and a heterocyclic vinyl compound (e.g., vinylpyrrolidone, vinylpyridine, vinylimidazole, vinylthiophene, vinylimidazoline, vinylpyrazole, vinyldioxane, vinylquinoline, vinyltetrazole, or vinyloxazine).

By using the thermoplastic resin (A) capable of being removed upon the chemical reaction as described in greater detail above in the transfer layer according to the present invention, heat transfer of the layer to a receiving material can be easily performed and the removal of the transferred layer to prepare a printing plate can also easily conducted. Moreover, the transfer layer has no adverse influence on the electrophotographic characteristics despite of being provided as the uppermost layer of electrophotographic light-sensitive material.

If desired, the transfer layer may further contain other conventional thermoplastic resins in addition to the resin (A). It should be noted, however, that such other resins be used in a range that the easy removal of the transfer layer is not deteriorated.

Examples of other thermoplastic resins which may be used in combination with the resin (A) include vinyl chloride resins, polyolefin resins, olefin-styrene copolymer resins, vinyl alkanoate resins, polyester resins, polyether resins, acrylic resins, cellulose resins, and fatty acid-modified cellulose resins. Specific examples of usable resins are described, e.g., in *Plastic Zairyo Koza Series*, Vols. 1 to 18, Nikkan Kogyo Shinbunsha (1961), Kinki Kagaku Kyokai Vinyl Bukai (ed.), *Polyenka Vinyl*, Nikkan Kogyo Shinbunsha (1988), Eizo Omori, *Kinosei Acryl Jushi*, Techno System (1985), Ei-ichiro Takiyama, *Polyester Jushi Handbook*, Nikkan Kogyo Shinbunsha (1988), Kazuo Yuki, *Howa Polyester Jushi Handbook*, Nikkan Kogyo Shinbunsha (1989), Kobunshi Gakkai (ed.), *Kobunshi Data Handbook (Oyo-hen)*, Ch. 1, Baifukan (1986), and Yuji Harasaki, *Saishin Binder Gijutsu Binran*, Ch. 2, Sogo Gijutsu Center (1985). These thermoplastic resins may be used either individually or in combination of two or more thereof.

If desired, the transfer layer may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, microcrystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot-melt Secchaku no Jissai*, pp. 29 to 107, Kobunshi Kankokai (1983).

The transfer layer suitably has a thickness of from 0.1 to 20 μm, and preferably from 0.5 to 10 μm. If the transfer layer is too thin, it is liable to result in insufficient transfer, and if the layer is too thick, troubles on the electrophotographic process tend to occur, failing to obtain a sufficient image density or resulting in degradation of image quality.

In order to form the transfer layer in the present invention, conventional layer-forming methods can be employed. For instance, a solution or dispersion containing the composition for the transfer layer is applied onto the surface of light-sensitive element in a known manner. In particular, for the formation of transfer layer on the surface of light-sensitive element, a hot-melt coating-method, electrodeposition coating method or transfer method is preferably used. These methods are preferred in view of easy formation of the transfer layer on the surface of light-sensitive element in an electrophotographic apparatus. Each of these methods will be described in greater detail below.

The hot-melt coating method comprises hot-melt coating of the composition for the transfer layer by a known method. For such a purpose, a mechanism of a non-solvent type coating machine, for example, a hot-melt coating apparatus for a hot-melt adhesive (hot-melt coater) as described in the above-mentioned *Hot-melt Secchaku no Jissai*, pp. 197 to 215 can be utilized with modification to suit with coating onto the light-sensitive drum. Suitable examples of coating machines include a direct roll coater, an offset gravure roll coater, a rod coater, an extrusion coater, a slot orifice coater, and a curtain coater.

A melting temperature of the thermoplastic resin at coating is usually in a range of from 50° to 180° C., while the optimum temperature is determined depending on the composition of the thermoplastic resin to be used. It is preferred that the resin is first molten using a closed pre-heating device having an automatic temperature controlling means and then heated in a short time to the desired temperature in a position to be coated on the light-sensitive element. To do so can prevent from degradation of the thermoplastic resin upon thermal oxidation and unevenness in coating.

A coating speed may be varied depending on flowability of the thermoplastic resin at the time being molten by heating, a kind of coater, and a coating amount, etc., but is suitably in a range of from 1 to 100 mm/sec, preferably from 5 to 40 mm/sec.

Now, the electrodeposition coating method will be described below. According to this method, the thermoplastic resin is electrostatically adhered or electrodeposited (hereinafter simply referred to as electrodeposition sometimes) on the surface of light-sensitive element in the form of resin grains and then transformed into a uniform thin film, for example, by heating, thereby the transfer layer being formed.

Therefore, the thermoplastic resin grains must have either a positive charge or a negative charge. The electroscopicity of the resin grains is appropriately determined depending on a charging property of the electrophotographic light-sensitive element to be used in combination.

An average grain diameter of the resin grains having the physical property described above is generally in a range of from 0.01 to 15 μm, preferably from 0.05 to 5 μm and more preferably from 0.1 to 1 μm. The resin grains may be employed as powder grains (in case of dry type electrodeposition) or grains dispersed in a non-aqueous system (in case of wet type electrodeposition). The resin grains dispersed in a non-aqueous system are preferred since they can easily prepare a thin layer of uniform thickness.

The resin grains used in the present invention can be produced by a conventionally known mechanical powdering method or polymerization granulation method. These methods can be applied to the production of resin grains for both of dry type electrodeposition and wet type electrodeposition.

The mechanical powdering method for producing powder grains used in the dry type electrodeposition method includes a method wherein the thermoplastic resin is directly powdered by a conventionally known pulverizer to form fine grains (for example, a method using a ball mill, a paint shaker or a jet mill). If desired, mixing, melting and kneading of the materials for resin grains before the powdering and classification for a purpose of controlling a grain diameter and after-treatment for treating the surface of grain after the powdering may be performed in an appropriate combination. A spray dry method is also employed.

Specifically, the powder grains can be easily produced by appropriately using a method as described in detail, for example, in Shadanhojin Nippon Funtai Kogyo Gijutsu Kyokai (ed.), *Zoryu Handbook*, II ed., Ohm Sha (1991), Kanagawa Keiei Kaihatsu Center, *Saishin Zoryu Gijutsu no Jissai*, Kanagawa Keiei Kaihatsu Center Shuppan-bu (1984), and Masafumi Arakawa et al (ed.), *Saishin Funtai no Sekkei Gijutsu*, Techno System (1988).

The polymerization granulation methods include conventionally known methods using an emulsion polymerization reaction, a seed polymerization reaction, or a suspension polymerization reaction each conducted in an aqueous system and using a dispersion polymerization reaction conducted in a non-aqueous solvent system.

More specifically, grains are formed according to the methods as described, .for example, in Soichi Muroi, *Kobunshi Latex no Kagaku*, Kobunshi Kankokai (1970), Taira Okuda and Hiroshi Inagaki, *Gosei Jushi Emulsion*, Kobunshi Kankokai (1978), soichi Muroi, *Kobunshi Latex Nyumon*, Kobunsha (1983), I. Pürma and P. C. Wang, *Emulsion Polymerization*, I. Pürma and J. L. Gaudon, *ACS Symp. Sev.*, 24, p. 34 (1974), Fumio Kitahara et al, *Bunsan Nyukakei no Kagaku*, Kogaku Tosho (1979), and Soichi Muroi (supervised), *Chobiryushi Polymer no Saisentan Gijutsu*, C. M. C. (1991), and then collected and pulverized in such a manner as described in the reference literatures cited with respect to the mechanical method above, thereby the resin grains being obtained.

In order to conduct dry type electrodeposition of the fine powder grains thus-obtained, a conventionally known method, for example, a coating method of electrostatic powder and a developing method with a dry type electrostatic developing agent can be employed. More specifically, a method for electrodeposition of fine grains charged by a method utilizing, for example, corona charge, triboelectrification, induction charge, ion flow charge, and inverse ionization phenomenon, as described, for example, in J. F. Hughes, *Seiden Funtai Toso*, translated by Hideo Nagasaka and Machiko Midorikawa, or a developing method, for example, a cascade method, a magnetic brush method, a fur brush method, an electrostatic method, an induction method, a touchdown method and a powder cloud method, as described, for example, in Koich Nakamura (ed.), *Saikin no Denshishashin Genzo System to Toner Zairyo no Kaihatsu-Jitsuyoka*, Ch. 1, Nippon Kogaku Joho (1985) is appropriately employed.

The production of resin grains dispersed in a non-aqueous system which are used in the wet type electrodeposition method can also be performed by any of the mechanical powdering method and polymerization granulation method as described above.

The mechanical powdering method includes a method wherein the thermoplastic resin is dispersed together with a dispersion polymer in a wet type dispersion machine (for example, a ball mill, a paint shaker, Keddy mill, and Dyno-mill), and a method wherein the materials for resin grains and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan*, Kyoritsu Shuppan (1971), D. E. Solomon, *The Chemistry of Organic Film Formers*, John Wiley & Sons (1967), *Paint and Surface Coating Theory and Practice*, Yuji Harasaki, *Coating Kogaku*, Asakura Shoten (1971), and Yuji Harasaki, *Coating no Kiso Kagaku*, Maki Shoten (1977).

The polymerization granulation method includes a dispersion polymerization method in a non-aqueous system conventionally known and is specifically described, for example, in *Chobiryushi Polymer no Saisentan Gijutsu*, Ch. 2, mentioned above, *Saikin no Denshishashin Genzo System to Toner Zairyo no Kaihatsu-Jitsuyoka, Ch.* 3, mentioned above, and K. E. J. Barrett, *Dispersion Polymerization in Organic Media*, John Wiley & Sons (1975).

As the non-aqueous solvent used in the dispersion polymerization method in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of mono-disperse system with a very narrow distribution of grain diameters.

A dispersive medium used for the resin grains dispersed in a non-aqueous system is usually a non-aqueous solvent having an electric resistance of not less than $10^8$ Ω·cm and a dielectric constant of not more than 3.5, since the dispersion is employed in a method wherein the resin grains are electrodeposited utilizing a wet type electrostatic photographic developing process or electrophoresis in electric fields.

The method in which grains mainly comprising the thermoplastic resin dispersed in an electrical insulating solvent having an electric resistance of not less than $10^8$ ΩQ·cm and a dielectric constant of not more than 3.5 are supplied is preferred in view of easy preparation of the transfer layer having a uniform and small thickness.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzene, toluene, styrene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu-Jitsuyoka*, pp. 139 to 148, mentioned above, Denshishashin Gakkai (ed.), Denshishashin Gijutsu no *Kiso to Oyo*, pp. 497 to 505, Corona Sha (1988), and Yuji Harasaki, *Denshishashin*, Vol. 16, No. 2, p. 44 (1977). Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965.

The dispersion of resin grains in a non-aqueous system (latex) which can be employed for electrodeposition usually comprises from 0.1 to 20 g of grains containing mainly the thermoplastic resin, from 0.01 to 50 g of a dispersion stabilizing resin and if desired, from 0.0001 to 10 g of a charge control agent in one liter of an electrically insulating dispersive medium.

The thermoplastic resin grains which are prepared, provided with an electrostatic charge and dispersed in an electrically insulting liquid behave in the same manner as an electrophotographic wet type developing agent. For instance, the resin grains can be subjected to electrophoresis on the surface of light-sensitive element using a developing device, for example, a slit development electrode device as described in *Denshi- shashin Gijutsu no Kiso to Oyo*, pp. 275 to 285, mentioned above. Specifically, the grains mainly comprising the thermoplastic resin are supplied between the electrophotographic light-sensitive element and an electrode placed in face of the light-sensitive element, and migrate due to electrophoresis according to potential gradient applied from an external power source to adhere to or electrodeposit on the electrophotographic light-sensitive element, thereby a film being formed.

In general, if the charge of grains is positive, an electric voltage was applied between an electro-conductive support of the light-sensitive element and a development electrode of a developing device from an external power source so that the light-sensitive material is negatively charged, thereby the grains being electrostatically electrodeposited on the surface of light-sensitive element.

Electrodeposition of grains can also be performed by wet type toner development in a conventional electrophotographic process. Specifically, the light-sensitive element is uniformly charged and then subjected to a conventional wet type toner development without exposure to light or after conducting a so-called print-off in which only unnecessary regions are exposed to light, as described in *Denshishashin Gijutsu no Kiso to Oyo*, pp. 46 to 79, mentioned above.

The amount of thermoplastic resin grain adhered to the light-sensitive element can be appropriately controlled, for example, by an external bias voltage applied, a potential of the light-sensitive element charged and a developing time.

After the electrodeposition of grains, the developing solution is wiped off upon squeeze using a rubber roller, a gap roller or a reverse roller. Other known methods, for example, corona squeeze and air squeeze can also be employed. Then, the deposit is dried with cool air or warm air or by a infrared lamp preferably to be rendered the thermoplastic resin grains in the form of a film, thereby the transfer layer being formed.

Now, the formation of transfer layer by the transfer method will be described below. According to this method, the transfer layer provided on a releasable support typically represented by release paper (hereinafter simply referred to as release paper) is transferred onto the surface of electrophotographic light-sensitive element.

The release paper having the transfer layer thereon is simply supplied to a transfer device in the form of a roll or sheet.

The release paper which can be employed in the present invention include those conventionally known as described, for example, in *Nenchaku (Nensecchaku) no Shin Gijutsu to Sono Yoto-Kakushu Oyoseihin no Kaihatsu Siryo*, published by Keiei Kaihatsu Center Shuppan-bu (May 20, 1978), and *All Paper Guide Shi no Shohin Jiten, Jo Kan, Bunka Sangyo Ben*, published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% is coated on the substrate, for example, by a gravure roll, a reverse roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale are also generally employed. Specific examples thereof include Separate Shi (manufactured by Ohji Seishi K. K.), King Rease (manufactured by Shikoku Seishi K. K.), Sun Release (manufactured by Sanyo Kokusaku Pulp K. K.) and NK High Release (manufactured by Nippon Kako Seishi K. K.).

In order to form the transfer layer on release paper, a composition for the transfer layer mainly composed of the thermoplastic resin is applied to releasing paper in a conventional manner, for example, by bar coating, spin coating or spray coating to form a film.

For a purpose of heat transfer of the transfer layer on release paper to the electrophotographic light-sensitive element, conventional heat transfer methods are utilized. Specifically, release paper having the transfer layer thereon is pressed on the electrophotographic light-sensitive element to heat transfer the transfer layer. For instance, a device shown in FIG. 6 is employed for such a purpose. In FIG. 6, release paper 10 having thereon the transfer layer 12 comprising the thermoplastic resin is heat-pressed on the light-sensitive element by a heating roller 117*b*, thereby the transfer layer 12 being transferred on the surface of light-sensitive element 11. The release paper 10 is cooled by a cooling roller 117*c* and recovered. The light-sensitive element is heated by a pre-heating means 17*a* to improve transferability of the transfer layer 12 upon heat-press, if desired.

The conditions for transfer of the transfer layer from release paper to the surface of light-sensitive element are preferably as follows. A nip pressure of the roller is from 0.1 to 10 kgf/cm$^2$ and more preferably from 0.2 to 8 kgf/cm$^2$. A temperature at the transfer is from 25° to 100° C. and more preferably from 40° to 80° C. A speed of the transportation is from 0.5 to 100 mm/sec and more preferably from 3 to 50 mm/sec. The speed of transportation may differ from that of the electrophotographic step or that of the heat transfer step of the transfer layer to the receiving material.

Now, the electrophotographic light-sensitive element on the surface of which the transfer layer is formed will be described in detail below.

Any conventionally known electrophotographic light-sensitive element can be employed as far as the surface of the light-sensitive element has releasability so as to easily release the transfer layer provided thereon.

More specifically, an electrophotographic light-sensitive element wherein an adhesive strength of the surface thereof measured by JIS Z 0237-1980 "Testing methods of pressure sensitive adhesive tapes and sheets" is not more than 200 gram-force is exemplified.

One example of such an electrophotographic light-sensitive element is one using amorphous silicon as a photoconductive substance. Another example thereof is an electrophotographic light-sensitive element containing a polymer having a polymer component containing at least one of a silicon atom and a fluorine atom in the region near to the surface thereof. The term "region near to the surface of electrophotographic light-sensitive element" used herein means the uppermost layer of the light-sensitive element and includes an overcoat layer provided on a photoconductive layer and the uppermost photoconductive layer. Specifically, an overcoat layer is provided on the light-sensitive element having a photoconductive layer as the uppermost layer which contains the above-described polymer to impart the releasability, or the above-described polymer is incorporated into the uppermost layer of a photoconductive layer (including a single photoconductive layer and a laminated photoconductive layer) to modify the surface thereof so as to exhibit the releasability. By using such a light-sensitive element, the transfer layer can be easily and completely transferred to a receiving material since the surface of the light-sensitive element has the good releasability.

In order to impart the releasability to the overcoat layer or the uppermost photoconductive layer, a polymer containing a silicon atom and/or a fluorine atom is used as a binder resin of the layer. It is also preferred to use a small amount of a block copolymer containing a polymer segment comprising a silicon atom and/or fluorine atom-containing polymer component described in greater detail below (hereinafter referred to as a surface-localized type copolymer) in combination with other binder resins. Further, such a resin containing a silicon atom and/or a fluorine atom is employed in the form of grains.

In the case of providing an overcoat layer, it is preferred to use the above-described surface-localized type block copolymer together with other binder resins of the layer for maintaining sufficient adhesion between the overcoat layer and the photoconductive layer. The surface-localized type copolymer is ordinarily used in a proportion of from 0.1 to 20 parts by weight per 100 parts by weight of the total composition of the overcoat layer.

Specific examples of the overcoat layer include a protective layer which is a surface layer provided on the light-sensitive element for protection known as one means for ensuring durability of the surface of a light-sensitive element for a plain paper copier (PPC) using a dry toner against repeated use. For instance, techniques relating to a protective layer using a silicon type block copolymer are described, for example, in JP-A-61-95358, JP-A-55-83049, JP-A-62-87971, JP-A-61-189559, JP-A-62-75461, JP-A-61-139556, JP-A-62-139557, and JP-A-62-208055. Techniques relating to a protective layer using a fluorine type block copolymer are described, for example, in JP-A-61-116362, JP-A-61-117563, JP-A-61-270768, and JP-A-62-14657. Techniques relating to a protecting layer using grains of a resin containing a fluorine-containing polymer component in combination with a binder resin are described in JP-A-63-249152 and JP-A-63-221355.

On the other hand, the method of modifying the surface of the uppermost photoconductive layer so as to exhibit the releasability is effectively applied to a so-called disperse type light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component in a block and resin grains containing a fluorine atom and/or silicon atom-containing polymer component, whereby the resin material migrates to the surface of the layer and is concentrated and localized there to have the surface imparted with the releasability. The copolymers and resin grains which can be used include those described in Japanese Patent Application No. 249819/91.

In order to further ensure surface localization, a block copolymer comprising at least one fluorine atom and/or fluorine atom-containing polymer segment and at least one polymer segment containing a photo and/or heatcurable group-containing component as blocks can be used as a binder resin for the overcoat layer or the photoconductive layer. Examples of such polymer segments containing a photo and/or heatcurable group-containing component are described in Japanese Patent Application Nos. 259430/91, 289649/91, and 289648/91. Alternatively, a photo and/or heatcurable resin may be used in combination with the fluorine atom and/or silicon atom-containing resin according to the present invention.

Where the polymer containing a fluorine atom and/or silicon atom-containing polymer component used in the present invention is a random copolymer, the content of the fluorine atom and/or silicon atom-containing polymer component is preferably not less than 60% by weight, and more preferably not less than 80% by weight in the total polymer components.

In a preferred embodiment, the above-described polymer is a block copolymer comprising at least one polymer segment (A) containing not less than 50% by weight of a fluorine atom and/or silicon atom-containing polymer component and at least one polymer segment (B) containing 0 to 20% by weight of a fluorine atom and/or silicon atom-containing polymer component, the polymer segments (A) and (B) being bonded in the form of blocks. More preferably, the polymer segment (B) of the block copolymer contains at least one polymer component containing at least one photo and/or heatcurable functional group.

It is preferred that the polymer segment (B) does not contain any fluorine atom and/or silicon atom-containing polymer component.

As compared with a random copolymer, the block copolymer comprising the polymer segments (A) and (B) (surface-localized type copolymer) is more effective not only for improving the surface releasability but also for maintaining such a releasability.

More specifically, where a film is formed in the presence of a small amount of the resin of block copolymer containing a fluorine atom and/or a silicon atom, the resins easily migrate to the surface portion of the film and are concentrated there by the end of a drying step of the film to thereby modify the film surface so as to exhibit the releasability.

Where the resin is the block copolymer in which the fluorine atom and/or silicon atom-containing polymer segment exists in a block, the other polymer segment containing no, or if any a small proportion of, fluorine atom and/or silicon atom-containing polymer component undertakes sufficient interaction with the film-forming binder resin since it has good compatibility therewith. Thus, during the formation of the transfer layer on the light-sensitive element, further migration of the resin into the transfer layer is inhibited or prevented by an anchor effect to form and maintain the definite interface between the transfer layer and the photoconductive layer.

Further, where the segment (B) of the block copolymer contains a photo and/or heatcurable group, crosslinking between the polymer molecules takes place during the film formation to thereby ensure retention of the releasability at the interface between the light-sensitive element and the transfer layer.

The above-described polymer may be used in the form of resin grains as described above. Preferred resin grains are resin grains dispersible in a non-aqueous solvent. Such resin grains include a block copolymer comprising a non-aqueous solvent-insoluble polymer segment which contains a fluorine atom and/or silicon atom-containing polymer component and a non-aqueous solvent-soluble polymer segment which contains no, or if any not more than 20% of, fluorine atom and/or silicon atom-containing polymer component.

Where the resin grains according to the present invention are used in combination with a binder resin, the insolubilized polymer segment undertakes migration of the grains to the surface portion and concentration there while the soluble polymer segment exerts an interaction with the binder resin (an anchor effect) similarly to the above-described resin. When the resin grains contain a photo and/or heatcurable group, further migration of the grains to the transfer layer can be avoided.

Now, the polymer component containing a fluorine atom and/or silicon atom-containing substituent according to the present invention will be described in detail below. The fluorine atom and/or silicon atom-containing substituent may be incorporated into the polymer main chain of the polymer or may be contained as a substituent of the polymer side chain.

The fluorine atom-containing substituents include monovalent or divalent organic residues, for example, $-C_hF_{2h+1}$ (wherein h represents an integer of from 1 to 18), $-(CF_2)_jCF_2H$ (wherein j represents an integer of from 1 to 17), $-CFH_2$,

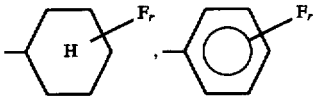

(wherein r represents an integer of from 1 to 5), $-CF_2-$, $-CFH-$,

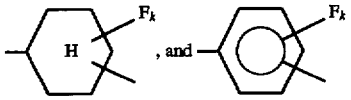

(wherein k represents an integer of from 1 to 4).

The silicon atom-containing substituents include monovalent or divalent organic residues, for example,

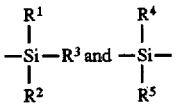

wherein $R^1$, $R^2$, $R^3$, $R^4$, and $R^5$, which may be the same or different, each represents a hydrocarbon group which may be substituted or $-OR^6$ wherein $R^6$ represents a hydrocarbon group which may be substituted.

The hydrocarbon group represented by $R^1$, $R^2$, $R^3$, $R^4$ or $R^5$ include specifically an alkyl group having from 1 to 18 carbon atoms which may be substituted (e.g., methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl, or 2,2,2,2',2',2'-hexafluoroisopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, or 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, or dimethoxybenzyl), an alicyclic group having from 5 to 8 carbon atoms which may be substituted (e.g., cyclohexyl, 2-cyclohexylethyl, or 2-cyclopentylethyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, or dodecyloylamidophenyl). $R^6$ in $-OR^6$ has the same meaning as the above-described hydrocarbon group for $R^1$.

The fluorine atom and/or silicon atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g., —O—, —S—,

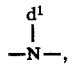

—SO—, $-SO_2-$, —COO—, —OCO—, —CONHCO—, —NHCONH—,

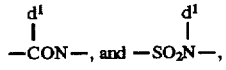

wherein $d^1$ has the same meaning as $R^1$ above.

Examples of the divalent aliphatic groups are shown below.

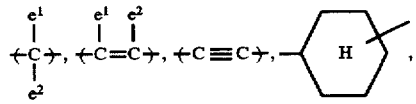

-continued

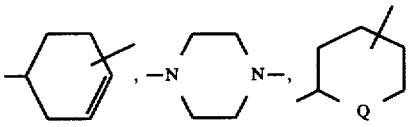

wherein $e^1$ and $e^2$, which may be the same or different, each represents a hydrogen atom, a halogen atom (e.g., chlorine or bromine) or an alkyl group having from 1 to 12 carbon atoms (e.g., methyl, ethyl, propyl, chloromethyl, bromomethyl, butyl, hexyl, octyl, nonyl or decyl); and Q represents —O—, —S—, or

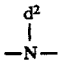

wherein $d^2$ represents an alkyl group having from 1 to 4 carbon atoms, $—CH_2Cl$, or $—CH_2Br$.

Examples of the divalent aromatic groups include a benzene ring, a naphthalene ring, and a 5- or 6-membered heterocyclic ring having at least one hetero atom selected from an oxygen atom, a sulfur atom and a nitrogen atom. The aromatic groups may have a substituent, for example, a halogen atom (e.g., fluorine, chlorine or bromine), an alkyl group having from 1 to 8 carbon atoms (e.g., methyl, ethyl, propyl, butyl, hexyl or octyl) or an alkoxy group having from 1 to 6 carbon atoms (e.g., methoxy, ethoxy, propoxy or butoxy). Examples of the heterocyclic ring include a furan ring, a thiophene ring, a pyridine ring, a piperazine ring, a tetrahydrofuran ring, a pyrrole ring, a tetrahydropyran ring, and a 1,3-oxazoline ring.

Specific examples of the repeating units having the fluorine atom and/or silicon atom-containing substituent as described above are set forth below, but the present invention should not be construed as being limited thereto. In formulae (c-1) to (c-32) below, $R_f$ represents any one of the following groups of from (1) to (11); and b represents a hydrogen atom or a methyl group.

$—C_nF_{2n+1}$ (1)

$—CH_2C_nF_{2n+1}$ (2)

$—CH_2CH_2C_nF_{2n+1}$ (3)

$—CH_2(CH_2)_mCFHCF_3$ (4)

$—CH_2CH_2(CH_2)_mCFHCF_3$ (5)

$—CH_2CH_2(CH_2)_mCFHCF_2H$ (6)

$—CH_2(CF_2)_mCFHCF_3$ (7)

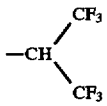

(8)

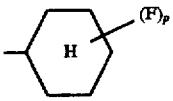

(9)

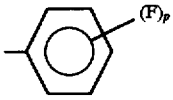

(10)

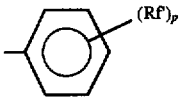

(11)

wherein $R_f'$ represents any one of the above-described groups of from (1) to (8); n represents an integer of from 1 to 18; m represents an integer of from 1 to 18; and p represents an integer of from 1 to 5.

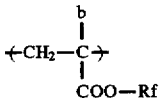

(c-1)

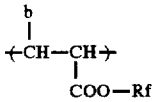

(c-2)

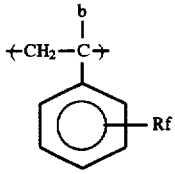

(c-3)

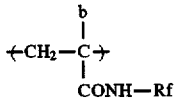

(c-4)

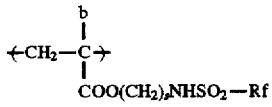

s: an integer of from 1 to 12

(c-5)

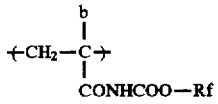

(c-6)

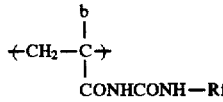

(c-7)

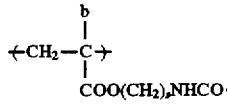

(c-8)

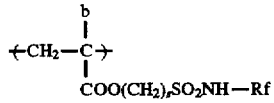

(c-9)

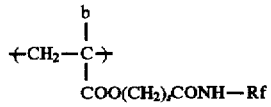

(c-10)

-continued
(c-11)
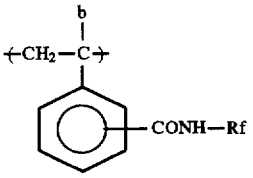
(c-12)
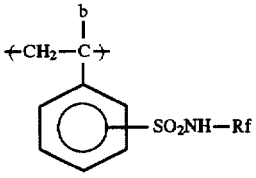
(c-13)
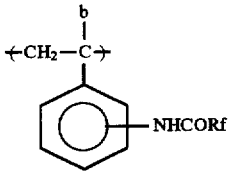
(c-14)
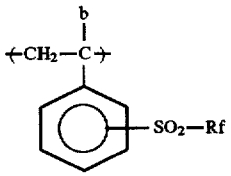
(c-15)
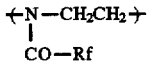
(c-16)
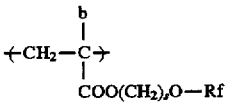
(c-17)
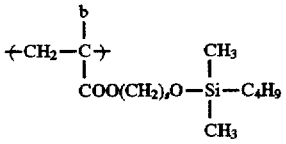
(c-18)
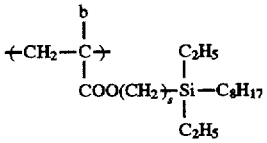
(c-19)
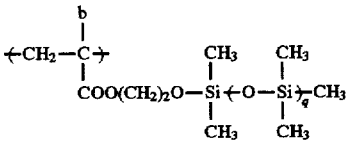
q: an integer of from 1 to 20
-continued
(c-20)
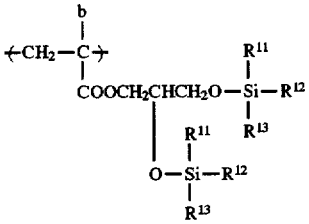
$R^{11}$, $R^{12}$, $R^{13}$: an alkyl group having from 1 to 12 carbon atoms
(c-21)
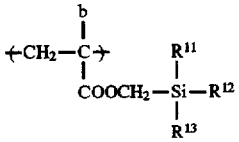
(c-22)
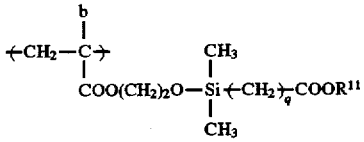
(c-23)
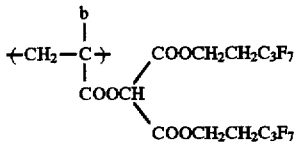
(c-24)
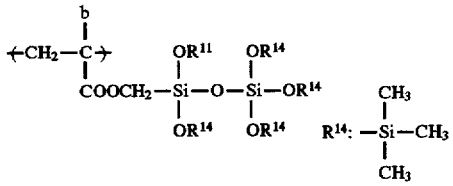
(c-25)
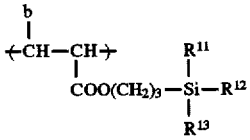
(c-26)
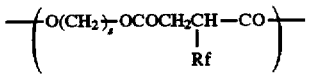
(c-27)
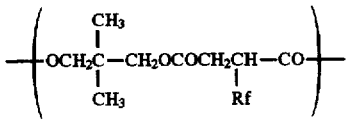
(c-28)
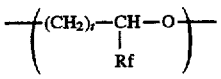
t: an integer of from 3 to 6
(c-29)
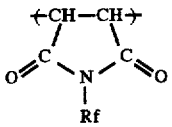
(c-30)
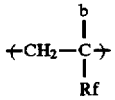

-continued

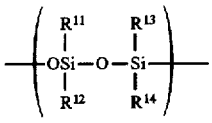

(c-31)

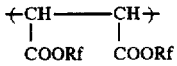

(c-32)

Of the resins (hereinafter sometimes referred to as resin (P)) and resin grains (hereinafter sometimes referred to as resin grain (L)) each containing silicon atom and/or fluorine atom used in the present invention, the so-called surface-localized type copolymers will be described in detail below.

The content of the silicon atom and/or fluorine atom-containing polymer component in the segment (A) is at least 50% by weight, preferably not less than 70% by weight, and more preferably not less than 80% by weight. The content of the fluorine atom and/or silicon atom-containing polymer component in the segment (B) bonded to the segment (A) is not more than 20% by weight, and preferably 0% by weight.

A weight ratio of segment (A) : segment (B) ranges usually from 1 to 95 : 5 to 99, and preferably from 5 to 90: 10 to 95. If the weight ratio is out of this range, the migration effect and anchor effect of the resin (P) or resin grain (L) at the surface region of light-sensitive element are decreased and, as a result, the releasability in order to peel the transfer layer is reduced.

The resin (P) preferably has a weight average molecular weight of from $5\times10^3$ to $1\times10^6$, and more preferably from $1\times10^4$ to $5\times10^5$. The segment (A) in the resin (P) preferably has a weight average molecular weight of at least $1\times10^3$.

The resin grain (L) preferably has an average grain diameter of from 0.001 to 1 μm, and more preferably from 0.05 to 0.5 μm.

A preferred embodiment of the surface-localized type copolymer in the resin (P) according to the present invention will be described below. Any type of the block copolymer can be used as far as the fluorine atom and/or silicon atom-containing polymer component is contained in block. The term "to be contained in block" means that the polymer has the polymer segment (A) containing not less than 50% by weight of the fluorine atom and/or silicon atom-containing polymer component. The forms of blocks include an A—B type block, an A—B—A type block, a B—A—B type block, a grafted type block, and a starlike type block as schematically illustrated below.

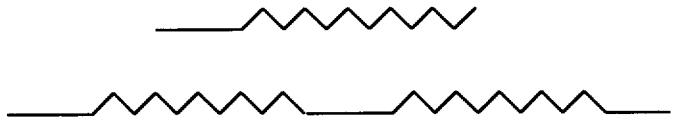

A—B Type

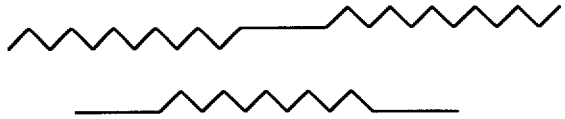

A—B—A (B—A—B) Type

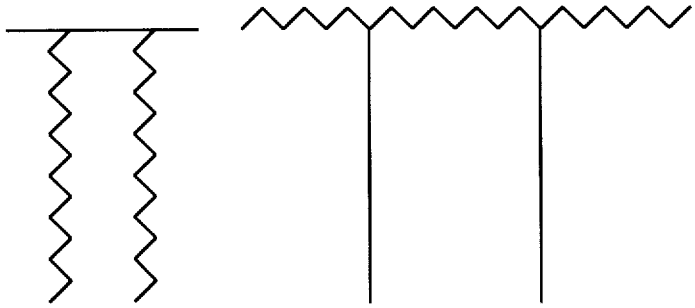

Graft Type (The number of the grafts is arbitrary)

-continued

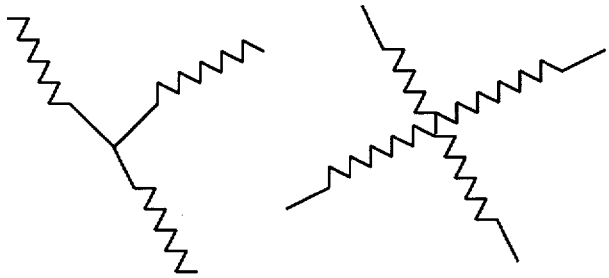

Starlike Type (The number of the grafts is arbitrary)

———— : Segment A (containing flourine atom and /or silicon atom)

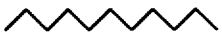 : Segment B (containing no or little fluorine atom and/or silicon atom)

These various types of block copolymers (P) can be synthesized in accordance with conventionally known polymerizing methods. Useful methods are described, e.g., in W. J. Burlant and A. S. Eoffman, *Block and Graft Polymers*, Reuhold (1986), R. J. Cevesa, *Block and Graft Copolymers*, Butterworths (1962), D. C. Allport and W. H. James, *Block Copolymers*, Applied Sci. (1972), A. Noshay and J. E. McGrath, *Block Copolymers*, Academic Press (1977), G. Huvtreg, D. J. Wilson, and G. Riess, *NATO ASIser. SerE.*, Vol. 1985, p. 149, and V. Perces, *Applied Polymer Sci.*, Vol. 285, p. 95 (1985).

For example, ion polymerization reactions using an organometallic compound (e.g., an alkyl lithium, lithium diisopropylamide, an alkali metal alcoholate, an alkylmagnesium halide, or an alkylaluminum halide) as a polymerization initiator are described, for example, in T. E. Hogeu-Esch and J. Smid, *Recent Advances in Anion Polymerization*, Elsevier (New York) (1987), Yoshio Okamoto, *Kobunshi*, Vol. 38, P. 912 (1989), Mitsuo Sawamoto, *Kobunshi*, Vol. 38, p. 1018 (1989), Tadashi Narita, *Kobunshi*, Vol. 37, p. 252 (1988), B. C. Anderson, et al., *Macromolecules*, Vol. 14, p. 1601 (1981), and S. Aoshima and T. Higasimura, *Macromolecules*, Vol. 22, p. 1009 (1989).

Ion polymerization reactions using a hydrogen iodide/iodine system are described, for example, in T. Higashimura, et al., *Macromol. Chem., Macromol. Symp.*, Vol. 13/14, p. 457 (1988), and Toshinobu Higashimura and Mitsuo Sawamoto, *Kobunshi Ronbunshu*, Vol. 46, p. 189 (1989).

Group transfer polymerization reactions are described, for example, in D. Y. Sogah, et al., *Macromolecules*, Vol. 20, p. 1473 (1987), O. W. Webster and D. Y. Sogah, *Kobunshi*, Vol. 36, p. 808 (1987), M. T. Reetg, et al., *Angew. Chem. Int. Ed. Engl.*, Vol. 25, p. 9108 (1986), and JP-A-63-97609.

Living polymerization reactions using a metalloporphyrin complex are described, for example, in T. Yasuda, T. Aida, and S. Inoue, *Macromolecules*, Vol. 17, p. 2217 (1984), M. Kuroki, T. Aida, and S. Inoue, *J. Am. Chem. Soc.*, Vol. 109, p. 4737 (1987), M. Kuroki, et al., *Macromolecules*, Vol. 21, p. 3115 (1988), and M. Kuroki and I. Inoue, *Yuki Gosei Kagaku*, Vol. 47, p. 1017 (1989).

Ring-opening polymerization reactions of cyclic compounds are described, for example, in S. Kobayashi and T. Saegusa, *Ring Opening Polymerization*, Applied Science Publishers Ltd. (1984), W. Seeliger, et al., *Angew. Chem. Int. Ed. Engl.*, Vol. 5, p. 875 (1966), S. Kobayashi, et al., *Poly. Bull.*, Vol. 13, p. 447 (1985), and Y. Chujo, et al., *Macromolecules*, Vol. 22, p. 1074 (1989).

Photo living polymerization reactions using a dithiocarbamate compound or a xanthate compound, as an initiator are described, for example, in Takayuki Otsu, *Kobunshi*, Vol. 37, p. 248 (1988), Shun-ichi Himori and Koichi Otsu, *Polymer Rep. Jap.*, Vol. 37, p. 3508 (1988), JP-A-64-111, JP-A-64-26619, and M. Niwa, *Macromolecules*, Vol. 189, p. 2187 (1988).

Radical polymerization reactions using a polymer containing an azo group or a peroxide group as an initiator to synthesize block copolymers are described, for example, in Akira Ueda, et al., *Kobunshi Ronbunshu*, Vol. 33, p. 931 (1976), Akira Ueda, *Osaka Shiritsu Kogyo Kenkyusho Hokoku*, Vol. 84 (1989), O. Nuyken, et al., *Macromol. Chem., Rapid. Commun.*, Vol. 9, p. 671 (1988), and Ryohei Oda, *Kagaku to Kogyo*, Vol. 61, p. 43 (1987).

Syntheses of graft type block copolymers are described in the above-cited literature references and, in addition, Fumio Ide, *Graft Jugo to Sono Oyo*, Kobunshi Kankokai (1977), and Kobunshi Gakkai (ed.), *Polymer Alloy*, Tokyo Kagaku Dojin (1981). For example, known grafting techniques including a method of grafting of a polymer chain by a polymerization initiator, an actinic ray (e.g., radiant ray, electron beam), or a mechanochemical reaction; a method of grafting with chemical bonding between functional groups of polymer chains (reaction between polymers); and a method of grafting comprising a polymerization reaction of a macromonomer may be employed.

The methods of grafting using a polymer are described, for example, in T. Shiota, et al., *J. Appl. Polym. Sci.*, Vol. 13, p. 2447 (1969), W. H. Buck, *Rubber Chemistry and Technology*, Vol. 50, p. 109 (1976), Tsuyoshi Endo and Tsutomu Uezawa, *Nippon Secchaku Kyokaishi*, Vol. 24, p. 323 (1988), and Tsuyoshi Endo, ibid., Vol. 25, p. 409 (1989).

The methods of grafting using a macromonomer are described, for example, in P. Dreyfuss and R. P. Quirk, *Encycl. Polym. Sci. Eng.*, Vol. 7, p. 551 (1987), P. F. Rempp and E. Franta, *Adv. Polym. Sci.*, Vol. 58, p. 1 (1984), V. Percec, *Appl. Poly. Sci.*, Vol. 285, p. 95 (1984), R. Asami and M. Takari, *Macromol. Chem. Suppl.*, Vol. 12, p. 163 (1985), P. Rempp, et al., *Macromol. Chem. Suppl.*, Vol. 8, p. 3 (1985), Katsusuke Kawakami, *Kagaku Kogyo*, Vol. 38, p. 56 (1987), Yuya Yamashita, *Kobunshi*, Vol. 31, p. 988 (1982), Shiro Kobayashi, *Kobunshi*, Vol. 30, p. 625 (1981), Toshinobu Higashimura, *Nippon Secchaku Kyokaishi*, Vol. 18, p. 536 (1982), Koichi Itoh, *Kobunshi Kako*, Vol. 35, p. 262 (1986), Takashiro Azuma and Takashi Tsuda, *Kino Zairyo*, Vol. 1987, No. 10, p. 5, Yuya Yamashita (ed.), *Macromonomer no Kagaku to Kogyo*, I.P.C. (1989), Tsuyoshi Endo (ed.), *Atarashii Kinosei Kobunshi no Bunshi Sekkei*, Ch. 4, C.M.C. (1991), and Y. Yamashita, et al., *Polym. Bull.*, Vol. 5, p. 361 (1981).

Syntheses of starlike block copolymers are described, for example, in M. T. Reetz, *Angew. Chem. Int. Ed. Engl.*, Vol. 27, p. 1373 (1988), M. Sgwarc, *Carbanions, Living Polymers and Electron Transfer Processes*, Wiley (New York) (1968), B. Gordon, et al., *Polym. Bull.*, Vol. 11, p. 349 (1984), R. B. Bates, et al., *J. Org. Chem.*, Vol. 44, p. 3800 (1979), Y. Sogah, *A.C.S. Polym. Rapr.*, Vol. 1988, No. 2, p. 3, J. W. Mays, *Polym. Bull.*, Vol. 23, p. 247 (1990), I. M. Khan et al., *Macromolecules*, Vol. 21, p. 2684 (1988), A. Morikawa, *Macromolecules*, Vol. 24, p. 3469 (1991), Akira Ueda and Toru Nagai, *Kobunshi*, Vol. 39, p. 202 (1990), and T. Otsu, *Polymer Bull.*, Vol. 11, p. 135 (1984).

While reference can be made to known techniques described in the literatures cited above, the method for synthesizing the block copolymers (P) according to the present invention is not limited to these methods.

A preferred embodiment of the resin grains (L) according to the present invention will be described below. As described above, the resin grains (L) preferably comprises the fluorine atom and/or silicon atom-containing polymer segment (A) insoluble in a non-aqueous solvent and the polymer segment (B) which is soluble in a non-aqueous solvent and contains substantially no fluorine atom and/or silicon atom, and have an average grain diameter of not more than 1 μm. The polymer segment (A) constituting the insoluble portion of the resin grain may have a crosslinked structure.

Preferred methods for synthesizing the resin grains (L) described above include the non-aqueous dispersion polymerization method hereinbefore described with respect to the non-aqueous thermoplastic resin grains. Specific examples of the method described above are also applied to the resin grains (L).

The non-aqueous solvents which can be used in the preparation of the non-aqueous solvent-dispersed resin grains include any organic solvents having a boiling point of not more than 200° C., either individually or in combination of two or more thereof. Specific examples of such organic solvents include those described with respect to the non-aqueous dispersion polymerization method above.

Dispersion polymerization in such a non-aqueous solvent system easily results in the production of mono-dispersed resin grains having an average grain diameter of not greater than 1 μm with a very narrow size distribution.

More specifically, a monomer corresponding to the polymer component constituting the segment (A) (hereinafter referred to as a monomer (a)) and a monomer corresponding to the polymer component constituting the segment (B) (hereinafter referred to as a monomer (b)) are polymerized by heating in a non-aqueous solvent capable of dissolving a monomer (a) but incapable of dissolving the resulting polymer in the presence of a polymerization initiator, for example, a peroxide (e.g., benzoyl peroxide or lauroyl peroxide), an azobis compound (e.g., azobisisobutyronitrile or azobisisovaleronitrile), or an organometallic compound (e.g., butyl lithium). Alternatively, a monomer (a) and a polymer comprising the segment (B) (hereinafter referred to as a polymer (PB)) are polymerized in the same manner as described above.

The inside of the polymer grain (L) according to the present invention may have a crosslinked structure. The formation of crosslinked structure can be conducted by any of conventionally known techniques. For example, (i) a method wherein a polymer containing the polymer segment (A) is crosslinked in the presence of a crosslinking agent or a curing agent; (ii) a method wherein at least the monomer (a) corresponding to the polymer segment (A) is polymerized in the presence of a polyfunctional monomer or oligomer containing at least two polymerizable functional groups to form a network structure over molecules; or (iii) a method wherein the polymer segment (A) and a polymer containing a reactive group-containing polymer component are subjected to a polymerization reaction or a polymer reaction to cause crosslinking may be employed.

The crosslinking agents to be used in the method (i) include those commonly employed as described, e.g., in Shinzo Yamashita and Tosuke Kaneko (ed.), *Kakyozai Handbook*, Taiseisha (1981) and Kobunshi Gakkai (ed.), *Kobunshi Data Handbook (Kiso-hen)*, Baifukan (1986).

Specific examples of suitable crosslinking agents include organosilane compounds known as silane coupling agents (e.g., vinyltrimethoxysilane, vinyltributoxysilane, γ-glycidoxypropyltrimethoxysilane, γ-mercaptopropyltriethoxysilane, and γ-aminopropyltriethoxysilane), polyisocyanate compounds (e.g., toluylene diisocyanate, diphenylmethane diisocyanate, triphenylmethane triisocyanate, polymethylenepolyphenyt isocyanate, hexamethylene diisocyanate, isophorone diisocyanate, and polymeric polyisocyanates), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), polyepoxy-containing compounds and epoxy resins (e.g., the compounds as described in Hiroshi Kakiuchi (ed.), *Shin-Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea•Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)).

Specific examples of the polymerizable functional groups which are contained in the polyfunctional monomer or oligomer (the monomer will sometimes be referred to as a polyfunctional monomer (d)) having two or more polymerizable functional groups used in the method (ii) above include $CH_2=CH—CH_2—$, $CH_2=CH—CO—O—$, $CH_2=CH—$, $CH_2=C(CH_3)—CO—O—$, $CH(CH_3)=CH—CO—O—$, $CH_2=CH—CONH—$, $CH_2=C(CH_3)—CONH—$, $CH(CH_3)=CH—CONH—$, $CH_2=CH—O—CO—$, $CH_2=C(CH_3)—O—CO—$, $CH_2=CH—CH_2—O—CO—$, $CH_2=CH—NHCO—$, $CH_2=CH—CH_2—NHCO—$, $CH_2=CH—SO_2—$, $CH_2=CH—CO—$, $CH_2=CH—O—$, and $CH_2=CH—S—$. The two or more polymerizable functional groups present in the polyfunctional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters, vinyl ethers, or allyl ethers of polyhydric alcohols (e.g., ethylene glycol, diethylene glycol, triethylene glycol, polyethylene glycol 200, 400 or 600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-butylenediamine) and vinyl-containing carboxylic acids (e.g., methacrylic acid, acrylic acid, crotonic acid, and allylacetic acid).

Specific examples of the monomer or oligomer having two or more different polymerizable functional groups include reaction products between vinyl-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl-containing carboxylic acids.

The monomer or oligomer containing two or more polymerizable functional groups is used in an amount of not more than 10 mol %, and preferably not more than 5 mol %, based on the total amount of monomer (a) and other monomers copolymerizable with monomer (a) to form the resin.

Where crosslinking between polymer molecules is conducted by the formation of chemical bonds upon the reaction of reactive groups in the polymers according to the method (iii), the reaction may be effected in the same manner as usual reactions of organic low-molecular weight compounds.

From the standpoint of obtaining mono-dispersed resin grains having a narrow size distribution and easily obtaining fine resin grains having a diameter of 0.5 μm or smaller, the method (ii) using a polyfunctional monomer is preferred for the formation of network structure. Specifically, a monomer (a), a monomer (b) and/or a polymer (PB) and, in addition, a polyfunctional monomer (d) are subjected to polymerization granulation reaction to obtain resin grains. Where the above-described polymer (PB) comprising the segment (B) is used, it is preferable to use a polymer (PB') which has a polymerizable double bond group copolymerizable with the monomer (a) in the side chain or at one terminal of the main chain of the polymer (PB).

The polymerizable double bond group is not particularly limited as far as it is copolymerizable with the monomer (a). Specific examples thereof include

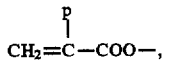

$C(H_3)H{=}CH{-}COO{-}$, $CH_2{=}C(CH_2COOH){-}COO{-}$,

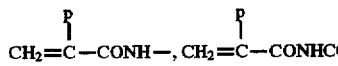

-continued

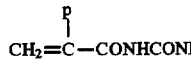

$C(CH_3)H{=}CH{-}CONH{-}$, $CH_2{=}CHCO{-}$, $CH_2{=}CH(CH_2)_n{-}OCO{-}$ (wherein n represents 0 or an integer of from 1 to 3), $CH_2{=}CHO{-}$, and $CH_2{=}CH{-}C_6H_4$, wherein p represents —H or —$CH_3$.

The polymerizable double bond group may be bonded to the polymer chain either directly or via a divalent organic residue. Specific examples of these polymers include those described, for example, in JP-A-61-43757, JP-A-1-257969, JP-A-2-74956, JP-A-1-282566, JP-A-2-173667, JP-A-3-15862, and JP-A-4-70669.

In the preparation of resin grains, the total amount of the polymerizable compounds used is from about 5 to about 80 parts by weight, preferably from 10 to 50 parts by weight, per 100 parts by weight of the non-aqueous solvent. The polymerization initiator is usually used in an amount of from 0.1 to 5% by weight based on the total amount of the polymerizable compounds. The polymerization is carried out at a temperature of from about 30° to about 180° C., and preferably from 40° to 120° C. The reaction time is preferably from 1 to 15 hours.

Now, an embodiment in which the resin (P) contains a photo and/or heatcurable group or the resin (P) is used in combination with a photo and/or heatcurable resin will be described below.

The polymer components containing at least one photo and/or heatcurable group, which may be incorporated into the resin (P), include those described in the above-cited literature references. More specifically, the polymer components containing the above-described polymerizable functional group(s) can be used.

The content of the polymer component containing at least one photo and/or heatcurable group in the block copolymer (P) ranges from 1 to 95 parts by weight, and preferably from 10 to 70 parts by weight, based on 100 parts by weight of the polymer segment (B) therein. Also, the content is preferably from 5 to 40 parts by weight based on 100 parts by weight of the total polymer component of the block copolymer (P). If the content is less than the lower limit, curing of the photoconductive layer after film formation does not proceed sufficiently, sometimes resulting in insufficient maintenance of the interface between the photoconductive layer and the transfer layer formed thereon, and thus giving adverse influences on the peeling off of the transfer layer. If the content exceeds the upper limit, the electrophotographic characteristics of the photoconductive layer are deteriorated, sometimes resulting in reduction in reproducibility of original in duplicated image and occurrence of background fog in non-image areas.

The photo and/or heatcurable group-containing block copolymer (P) is preferably used in an amount of not more than 40% by weight based on the total binder resin. If the proportion of the resin (P) is more than 40% by weight, the electrophotographic characteristics of the light-sensitive element tend to be deteriorated.

The fluorine atom and/or silicon atom-containing resin may also be used in combination with the photo and/or heatcurable resin (D) in the present invention. The photo and/or heatcurable group in the resin (D) is not particularly limited and includes those described above with respect to the block copolymer.

Any of conventionally known curable resins may be used as the photo and/or heatcurable resin (D). For example, resins containing the curable group as described with respect to the block copolymer (P) may be used.

These conventionally known binder resins for an electrophotographic light-sensitive layer are described, e.g., in Takaharu Shibata and Jiro Ishiwatari, *Kobunshi*, Vol. 17, p. 278 (1968), Harumi Miyamoto and Hidehiko Takei, Imaging, Vol. 1973, No. 8, Koichi Nakamura (ed.), *Kiroku Zairyoyo Binder no Jissai Gijutsu*, Ch. 10, C. M.C. (1985), Denshishashin Gakkai (ed.), *Denshishashinyo Yukikankotai no Genjo Symposium* (preprint) (1985), Hiroshi Kokado (ed.), *Saikin no Kododenzairyo to Kankotai no Kaihatsu•Jitsuyoka*, Nippon Kagaku Joho (1986), Denshishashin Gakkai (ed.), *Denshishashin Gijutsu no Kiso To Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshishashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

More specifically, reference can be made to Tsuyoshi Endo, *Netsukokasei Kobunshi no Seimitsuka*, C.M.C. (1986), Yuji Harasaki, *Saishin Binder Gijutsu Binran*, Ch. II-1, Sogo Gijutsu Center (1985), Takayuki Otsu, *Acryl Jushi no Gosei•Sekkei to Shinyoto Kaihatsu*, Chubu Kei-ei Kaihatsu Center Shuppanbu (1985), and Eizo Omori, *Kinosei Acryl-Kei Jushi*, Techno System (1985).

As described above, while the overcoat layer or the photoconductive layer contains the silicon atom and/or fluorine atom-containing resin and, if desired, other binder resins, it is preferred that the layer further contains a small amount of photo and/or heatcurable resin (D) and/or a crosslinking agent for further improving film curability.

The amount of photo and/or heatcurable resin (D) and/or crosslinking agent to be added is from 0.01 to 20% by weight, and preferably from 0.1 to 15% by weight, based on the total amount of the whole binder resin. If the amount is less than 0.01% by weight, the effect of improving film curability decreases. If it exceeds 20% by weight, the electrophotographic characteristics may be adversely affected.

A combined use of a crosslinking agent is preferable. Any of ordinarily employed crosslinking agents may be utilized. Suitable crosslinking agents are described, e.g., in Shinzo Yamashita and Tosuke Kaneko (ed.), *Kakyozai Handbook*, Taiseisha (1981) and Kobunshi Gakkai (ed.), *Kobunshi Data Handbook* (*Kiso-hen*), Baifukan (1986).

Specific examples of suitable crosslinking agents include organosilane compounds (such as silane coupling agents, e.g., vinyltrimethoxysilane, vinyltributoxysilane, γ-glycidoxypropyltrimethoxysilane, γ-mercaptopropyltriethoxysilane, and γ-aminopropylethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), polyol compounds (e.g., 1,4-butanediol, polyoxypropylene glycol, a polyoxyethylene glycol, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), titanate coupling compounds (e.g., titanium tetrabutoxide, titanium tetrapropoxide, and isopropyltrisstearoyl titanate), aluminum coupling compounds (e.g., aluminum butylate, aluminum acetylacetate, aluminum oxide octate, and aluminum trisacetylacetate), polyepoxy-containing compounds and epoxy resins (e.g., the compounds as described in Hiroshi Kakiuchi (ed.), *Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea•Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)). In addition, monomers containing a polyfunctional polymerizable group (e.g., vinyl methacrylate, acryl methacrylate, ethylene glycol diacrylate, polyethylene glycol diacrylate, divinyl succinate, divinyl adipate, diacryl succinate, 2-methylvinyl methacrylate, trimethylolpropane trimethacrylate, divinylbenzene, and pentaerythritol polyacrylate) may also be used as the crosslinking agent.

As described above, the uppermost layer of the photoconductive layer (a layer which will be in contact with the transfer layer) is preferably cured after film formation. It is preferred that the binder resin, the block copolymer (P), the curable resin (D), and the crosslinking agent to be used in the photoconductive layer are so selected and combined that their functional groups easily undergo chemical bonding to each other.

Combinations of functional groups which easily undergo a polymer reaction are well known. Specific examples of such combinations are shown in Table 1 below, wherein a functional group selected from Group A can be combined with a functional group selected from Group B. However, the present invention should not be construed as being limited thereto.

TABLE 1

| Group A | Group B |
|---|---|
| $-COOH$, $-PO_3H_2$, $-OH$, $-SH$, $-NH_2$, $-NHR$, $-SO_2H$ | 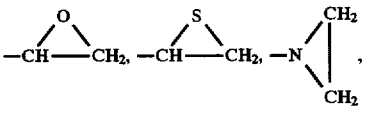 $-COCl$, $-SO_2Cl$, a cyclic acid anhydride group, $-N=C=O$, $-N=C=S$, |

TABLE 1-continued

| Group A | Group B |
|---|---|
| | 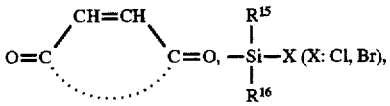 |
| | 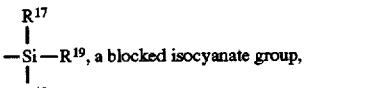 |
| | 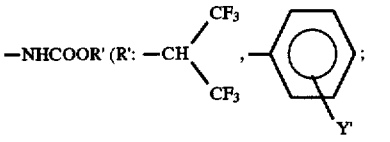 |
| | $Y'$: $-CH_3$, $-Cl$, $-OCH_3$), |
| | 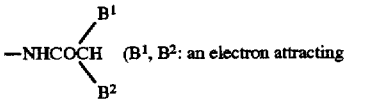 ($B^1$, $B^2$: an electron attracting group), |
| | 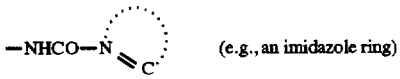 (e.g., an imidazole ring) |

In Table 1, $R^{15}$ and $R^{16}$ each represents an alkyl group; $R^{17}$, $R^{18}$, and $R^{19}$ each represents an alkyl group or an alkoxy group, provided that at least one of them is an alkoxy group; R represents a hydrocarbon group; $B^1$ and $B^2$ each represent an electron attracting group, e.g., —CN, $—CF_3$, $—COR^{20}$, $—COOR^{20}$, $—SO_2OR^{20}$ ($R^{20}$ represents a hydrocarbon group, e.g., $C_nH_{2n+1}$ (n: an integer of from 1 to 4), $—CH_2C_6H_5$, or $—C_6H_5$).

If desired, a reaction accelerator may be added to the binder resin for accelerating the crosslinking reaction in the light-sensitive layer.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride).

The reaction accelerators which may be used for the crosslinking reaction involving polymerization include polymerization initiators, such as peroxides and azobis compounds.

After a coating composition for the light-sensitive layer is coated, the binder resin is cured by light and/or heat. Heat curing can be carried out by drying under severer conditions than those for the production of a conventional light-sensitive element. For example, elevating the drying temperature and/or increasing the drying time may be utilized. After drying the solvent of the coating composition, the film is preferably subjected to a further heat treatment, for example, at 60° to 150° C. for 5 to 120 minutes. The conditions of the heat treatment may be made milder by using the above-described reaction accelerator in combination.

Curing of the resin containing a photocurable functional group can be carried out by incorporating a step of irradiation of actinic ray into the production line. The actinic rays to be used include visible light, ultraviolet light, far ultraviolet light, electron beam, X-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 to 50 cm for 10 seconds to 10 minutes.

The photoconductive substances for the electrophotographic light-sensitive element which can be used in the present invention are not particularly limited, and any known photoconductive substances may be employed. Suitable photoconductive substances are described, e.g., in Denshishashin Gakkai (ed.), *Denshishashin Gijutsu no Kiso to Oyo*, Corona Sha (1988) and Hiroshi Kokado (ed.), *Saikin no Kododen Zairyo to Kankotai no Kaihatsu•Jitsuyoka*, Nippon Kagaku Joho (1985).

Specifically, the photoconductive layer includes a single layer made of a photoconductive compound itself and a photoconductive layer comprising a binder resin having dispersed therein a photoconductive compound. The dispersed type photoconductive layer may have a single layer structure or a laminated structure. The photoconductive compounds used in the present invention may be inorganic compounds or organic compounds.

Inorganic photoconductive compounds used in the present invention include those conventionally known for example, zinc oxide, titanium oxide, zinc sulfide, cadmium sulfide, selenium, selenium-tellurium, silicon, lead sulfide.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer mainly comprising an organic photoconductive compound, a sensitizing dye, and a binder resin as described, e.g., in JP-B-37-17162, JP-B-62-51462, JP-A-52-2437, JP-A-54-19803, JP-A-56-107246, and JP-A-57-161863; (ii) a layer mainly comprising a charge generating agent, a charge transporting agent, and a binder resin as described, e.g., in JP-A-56-146145, JP-A-60-17751, JP-A-60-17752, JP-A-60-17760, JP-A-60-254142, and JP-A-62-54266; and (iii) a double-layered structure containing a charge generating agent and a charge transporting agent in separate layers as described, e.g., in JP-A-60-230147, JP-A-60-230148, and JP-A-60-238853.

The photoconductive layer of the electrophotographic light-sensitive element according to the present invention may have any of the above-described structure.

The organic photoconductive compounds which may be used in the present invention include (a) triazole derivatives described, e.g., in U.S. Pat. No. 3,112,197, (b) oxadiazole derivatives described, e.g., in U.S. Pat. No. 3,189,447, (c) imidazole derivatives described in JP-B-37-16096, (d) polyarylalkane derivatives described, e.g., in U.S. Pat. Nos. 3,615,402, 3,820,989, and 3,542,544, JP-B-45-555, JP-B-

51-10983, JP-A-51-93224, JP-A-55-108667, JP-A-55-156953, and JP-A-56-36656, (e) pyrazoline derivatives and pyrazolone derivatives described, e.g., in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546, (f) phenylenediamine derivatives described, e.g., in U.S. Pat. No. 3,615,404, JP-B-51-10105, JP-B-46-3712, JP-B-47-28336, JP-A-54-83435, JP-A-54-110836, and JP-A-54-119925, (g) arylamine derivatives described, e.g., in U.S. Pat. Nos. 3,567,450, 3,180,703, 3,240,597, 3,658,520, 4,232,103, 4,175,961, and 4,012,376, JP-B-49-35702, West German Patent (DAS) 1,110,518, JP-B-39-27577, JP-A-55-144250, JP-A-56-119132, and JP-A-56-22437, (h) amino-substituted chalcone derivatives described, e.g., in U.S. Pat. No. 3,526,501, (i) N,N-bicarbazyl derivatives described, e.g., in U.S. Pat. No. 3,542,546, (j) oxazole derivatives described, e.g., in U.S. Pat. No. 3,257,203, (k) styrylanthracene derivatives described, e.g., in JP-A-56-46234, (l) fluorenone derivatives described, e.g., in JP-A-54-110837, (m) hydrazone derivatives described, e.g., in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144, (n) benzidine derivatives described, e.g., in U.S. Pat. Nos. 4,047,948, 4,047,949, 4,265,990, 4,273,846, 4,299,897, and 4,306,008, (o) stilbene derivatives described, e.g., in JP-A-58-190953, JP-A-59-95540, JP-A-59-97148, JP-A-59-195658, and JP-A-62-36674, (P) polyvinylcarbazole and derivatives thereof described in JP-B-34-10966, (q) vinyl polymers, such as polyvinylpyrene, polyvinylanthracene, poly-2-vinyl-4-(4'-dimethylaminophenyl)-5-phenyloxazole, and poly-3-vinyl-N-ethylcarbazole, described in JP-B-43-18674 and JP-B-43-19192, (r) polymers, such as polyacenaphthylene, polyindene, and an acenaphthylene-styrene copolymer, described in JP-B-43-19193, (s) condensed resins, such as pyrene-formaldehyde resin, bromopyrene-formaldehyde resin, and ethyl-carbazole-formaldehyde resin, described, e.g., in JP-B-56-13940, and (t) triphenylmethane polymers described in JP-A-56-90833 and JP-A-56-161550.

The organic photoconductive compounds which can be used in the present invention are not limited to the above-described compounds (a) to (t), and any of known organic photoconductive compounds may be employed in the present invention. The organic photoconductive compounds may be used either individually or in combination of two or more thereof.

The sensitizing dyes which can be used in the photoconductive layer of (i) include those conventionally known as described, e.g., in *Denshishashin,* Vol. 12, p. 9 (1973) and *Yuki Gosei Kagaku,* Vol. 24, No. 11, p. 1010 (1966). Specific examples of suitable sensitizing dyes include pyrylium dyes described, e.g., in U.S. Pat. Nos. 3,141,770 and 4,283,475, JP-A-48-25658, and JP-A-62-71965; triarylmethane dyes described, e.g., in *Applied Optics Supplement,* Vol. 3, p. 50 (1969) and JP-A-50-39548; cyanine dyes described, e.g., in U.S. Pat. No. 3,597,196; and styryl dyes described, e.g., in JP-A-60-163047, JP-A-59-164588, and JP-A-60-252517.

The charge generating agents which can be used in the photoconductive layer of (ii) include various conventionally known charge generating agents, either organic or inorganic, such as selenium, selenium-tellurium, cadmium sulfide, zinc oxide, and organic pigments, for example, (1) azo pigments (including monoazo, bisazo, and trisazo pigments) described, e.g., in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941, and JP-B-60-45664, (2) metal-free or metallized phthalocyanine pigments described, e.g., in U.S. Pat. Nos. 3,397,086 and 4,666,802, JP-A-51-90827, and JP-A-52-55643, (3) perylene pigments described, e.g., in U.S. Pat. No. 3,371,884 and JP-A-47-30330, (4) indigo or thioindigo derivatives described, e.g., in British Patent 2,237,680 and JP-A-47-30331, (5) quinacridone pigments described, e.g., in British Patent 2,237,679 and JP-A-47-30332, (6) polycyclic quinone dyes described, e.g., in British Patent 2,237,678, JP-A-59-184348, JP-A-62-28738, and JP-A-47-18544, (7) bisbenzimidazole pigments described, e.g., in JP-A-47-30331 and JP-A-47-18543, (8) squarylium salt pigments described, e.g., in U.S. Pat. Nos. 4,396,610 and 4,644,082, and (9) azulenium salt pigments described, e.g., in JP-A-59-53850 and JP-A-61-212542.

These organic pigments may be used either individually or in combination of two or more thereof.

A mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resin.

The binder resins which can be used in the light-sensitive element according to the present invention include those for conventionally known electrophotographic light-sensitive elements. A preferred weight average molecular weight of the binder resin is from $5\times10^3$ to $1\times10^6$, and particularly from $2\times10^4$ to $5\times10^5$. A preferred glass transition point of the binder resin is from −40° to 200° C., and particularly from −10° to 140° C.

Conventional binder resins which may be used in the present invention are described, e.g., in Takaharu Shibata and Jiro Ishiwatari, *Kobunshi,* Vol. 17, p. 278 (1968), Harumi Miyamoto and Hidehiko Takei, *Imaging,* Vol. 1973, No. 8, Koichi Nakamura (ed.), *Kioku Zairyoyo Binder no Jissai Gijutsu,* Ch. 10, C.M.C. (1985), Denshishashin Gakkai (ed.), *Denshishashinyo Yukikankotai no Genjo Symposium* (preprint) (1985), Hiroshi Kokado (ed.), *Saikin no Kododen Zairyo to Kankotai no Kaihatsu•Jitsuyoka,* Nippon Kagaku Joho (1986), Denshishashin Gakkai (ed.), *Denshishashin Gijutsu no Kiso to Oyo,* Ch. 5, Corona (1988), D. Tatt and S. C. Heidecker, *Tappi,* Vol. 49, No. 10, p. 439 (1966), E. S. Baltazzi and R. G. Blanchlotte, et al., *Photo. Sci. Eng.,* Vol. 16, No. 5, p. 354 (1972), and Nguyen Chank Keh, Isamu Shimizu and Eiichi Inoue, *Denshi Shashin Gakkaishi,* Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described e.g., in Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), and Tadaaki Tani, *Nihon Shashin Gakkaishi*, Vol. 35, p. 208 (1972).

Specific examples of carbonium dyes, triphenylmethane dyes, xanthene dyes, and phthalein dyes are described, e.g., in JP-B-51-452, JP-A-50-90334, JP-A-50-114227, JP-A-53-39130, JP-A-53-82353, U.S. Pat. Nos. 3,052,540 and 4,054,450, and JP-A-57-16456.

Usable polymethine dyes, such as oxonol dyes, merocyanine dyes, cyanine dyes, and rhodacyanine dyes, are described in F. M. Hamer, *The Cyanine Dyes and Related Compounds*. Specific examples of these dyes are described, e.g., in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

Further, polymethine dyes capable of performing spectral sensitization in the near infrared region of 700 nm or more include those described, e.g., in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, No. 216, pp. 117–118 (1982).

The light-sensitive element of the present invention is excellent in that the characteristics thereof hardly vary with the combined use of various sensitizing dyes.

If desired, the light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, 2,3-dichloro-5,6-dicyanobenzoquinone, dinitrofluorenone, trinitrofluorenone, and tetracyanoethylene; and polyarylalkane compounds, hindered phenol compounds and p-phenylenediamine compounds as described in the literature references cited in Hiroshi Kokado, et al., *Saikin no Kododen Zairyo to Kankotai no Kaihatsu•Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

As described above, the electrophotographic light-sensitive element of the present invention is characterized in that its surface in contact with the transfer layer has good releasability. Whether the releasability is good or bad is determined upon an adhesive strength measured by JIS Z 0237-1980 "Testing methods of pressure sensitive adhesive tapes and sheets". More specifically, the adhesive strength of the surface in contact with the transfer layer measured by the above-described testing method is suitably not more than 200 gram•force (g•f), preferably not more than 150 g•f, and more preferably not more than 100 g•f. The testing is conducted using the electrophotographic light-sensitive element of the present invention as the test plate and an adhesive tape of 6 mm in width as the adhesive tape at a peeling rate of 120 mm/min. The value thus-obtained is calculated in terms of an adhesive tape of 10 mm in width to determine the adhesive strength.

The electrophotographic light-sensitive material suitable for the preparation of the printing plate according to the present invention is characterized by comprising an electrophotographic light-sensitive element which comprises a conductive support having thereon an electrophotographic light-sensitive layer and the surface of which has the releasability and having on the surface a peelable transfer layer which is mainly composed of a themoplastic resin capable of being removed upon a chemical reaction treatment. After the transfer layer is released from the electrophotographic light-sensitive element, the latter can be repeatedly used upon providing again the transfer layer thereon.

In order to form the toner image by an electrophotographic process according to the present invention, any methods and apparatus conventionally known can be employed.

The developers which can be used in the present invention include conventionally known developers for electrostatic photography, either dry type or liquid type. For example, specific examples of the developer are described in *Denshishashin Gijutsu no Kiso to Oyo*, supra, pp. 497–505, Koichi Nakamura (ed.), *Toner Zairyo no Kaihatsu•Jitsuyoka*, Ch. 3, Nippon Kagaku Joho (1985), Gen Machida, *Kirokuyo Zairyo to Kankosei Jushi*, pp. 107–127 (1983), and Denshishasin Gakkai (ed.), *Imaging*, Nos. 2–5, "Denshishashin no Genzo•Teichaku•Taiden•Tensha", Gakkai Shuppan Center.

Dry developers practically used include one-component magnetic toners, two-component toners, one-component non-magnetic toners, and capsule toners. Any of these dry developers may be employed in the present invention.

The typical liquid developer is basically composed of an insulating organic solvent, for example, an isoparaffinic aliphatic hydrocarbon (e.g., isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic dye or pigment) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin*, Vol. 16, No. 2, p. 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles mainly comprising a resin (and, if desired, a colorant) are preferably present in an amount of from 0.5 to 50 parts by weight per 1000 parts by weight of a carrier liquid. If the toner content is less than 0.5 part by weight, the image density is insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

The heat-transfer of the toner image together with the transfer layer onto a receiving material can be performed using known methods and apparatus.

The receiving material used in the present invention is any of material which provide a hydrophilic surface suitable for lithographic printing. Supports conventionally used for offset printing plates (lithographic printing plates) can be preferably employed. Specific examples of support include a substrate having a hydrophilic surface, for example, a plastic sheet, paper having been rendered durable to printing, an aluminum plate, a zinc plate, a bimetal plate, e.g., a copper-aluminum plate, a copper-stainless steel plate, or a chromium-copper plate, a trimetal plate, e.g., a chromium-copper-aluminum plate, a chromium-lead-iron plate, or a chromium-copper-stainless steel plate. The support preferably has a thickness of from 0.1 to 3 mm, and particularly from 0.1 to 1 mm.

A support with an aluminum surface is preferably subjected to a surface treatment, for example, surface graining, immersion in an aqueous solution of sodium silicate, potassium fluorozirconate or a phosphate, or anodizing. Also, an aluminum plate subjected to surface graining and then immersion in a sodium silicate aqueous solution as described in U.S. Pat. No. 2,714,066, or an aluminum plate subjected to anodizing and then immersion in an alkali silicate aqueous solution as described in JP-B-47-5125 is preferably employed.

Anodizing of an aluminum surface can be carried out by electrolysis of an electrolytic solution comprising at least one aqueous or nonaqueous solution of an inorganic acid (e.g., phosphoric acid, chromic acid, sulfuric acid or boric acid) or an organic acid (e.g., oxalic acid or sulfamic acid) or a salt thereof to oxidize the aluminum surface as an anode.

Silicate electrodeposition as described in U.S. Pat. No. 3,658,662 or a treatment with polyvinylsulfonic acid described in West German Patent Application (OLS) 1,621,478 is also effective.

The surface treatment is conducted not only for rendering the surface of a support hydrophilic, but also for improving adhesion of the support to the transferred toner image.

Further, in order to control an adhesion property between the support and the transfer layer having provided thereon the toner image, a surface layer may be provided on the surface of the support.

A plastic sheet or paper as the support should have a hydrophilic surface layer, as a matter of course, since its areas other than those corresponding to the toner images must be hydrophilic. Specifically, a receiving material having the same performance as a known direct writing type lithographic printing plate precursor or an image-receptive layer thereof may be employed.

Now, the step of removing the transfer layer transferred on the receiving material will be described below. In order to remove the transfer layer, an appropriate means can be selected in consideration of a chemical reaction treatment upon which a thermoplastic resin used in the transfer layer is removed. For instance, an alkaline processing solution is employed when the thermoplastic resin is a kind of resin which is soluble in an aqueous alkaline solution.

The alkaline processing solution used for removing the transfer layer is not particularly limited as far as it has a pH of not less than 8. A pH of 9 or higher is preferred in order to conduct the removal of transfer layer rapidly and efficiently. The alkaline processing solution can be prepared by using any of conventionally known inorganic or organic compounds, for example, carbonates, sodium hydroxide, potassium hydroxide, potassium silicate, sodium silicate and organic amine compounds, either individually or in combination thereof. Known pH control agents may also be employed in order to adjust the pH of solution.

The processing solution may further contain other compounds. For example, a water-soluble organic solvent may be used in a range of from about 1 to about 50 parts by weight per 100 parts by weight of water. Suitable examples of the water-soluble organic solvent include alcohols (e.g., methanol, ethanol, propanol, propargyl alcohol, benzyl alcohol, and phenethyl alcohol), ketones (e.g., acetone, methyl ethyl ketone, cyclohexanone and acetophenone), ethers (e.g., dioxane, trioxane, tetrahydrofuran, ethylene glycol dimethyl ether, propylene glycol diethyl ether, ethylene glycol monomethyl ether, propylene glycol monomethyl ether, and tetrahydropyran), amides (e.g., dimethylformamide, pyrrolidone, N-methylpyrrolidone, and dimethylacetamide) esters (e.g., methyl acetate, ethyl acetate, and ethyl formate), sulforan and tetramethylurea. These organic solvents may be used either individually or in combination of two or more thereof.

The processing solution may contain a surface active agent in an amount ranging from about 0.1 to about 20 parts by weight per 100 parts of weight of the processing solution. Suitable examples of the surface active agent include conventionally known anionic, cationic or nonionic surface active agents, such as the compounds as described, for example, in Hiroshi Horiguchi, *Shin Kaimen Kasseizai*, Sankyo Shuppan (1975) and Ryohei Oda and Kazuhiro Teramura, *Kaimen Kasseizai no Gosei to Sono Oyo*, Maki Shoten (1980). Moreover, conventionally known antiseptic compounds and antimoldy compounds are employed in appropriate amounts in order to improve the antiseptic property and antimoldy property of the processing solution during preservation.

With respect to the conditions of the treatment, a temperature of from about 15° to about 60° C., and an immersion time of from about 10 seconds to about 5 minutes are preferred.

When the thermoplastic resin used is a kind of resin which reveals a hydrophilic property upon a chemical reaction, treatment with a processing solution or treatment with irradiation of actinic ray can be employed for removal the transfer layer.

In order to effect the removal by a chemical reaction with a processing solution, an aqueous solution which is adjusted to the prescribed pH is used. Known pH control agents can be employed to adjust the pH of solution. While the pH of the processing solution used may be any of acidic, neutral and alkaline region, the processing solution is preferably employed in a neutral to alkaline region taking account of an anticorrosive property and a property of dissolving the transfer layer. The alkaline processing solution can be prepared by using any of conventionally known organic or inorganic compounds, such as carbonates, sodium hydroxide, potassium hydroxide, potassium silicate, sodium silicate, and organic amine compounds, either individually or in combination thereof.

The processing solution may contain a hydrophilic compound which contains a substituent having a Pearson's nucleophilic constant n (refer to R. G. Pearson and H. Sobel, *J. Amer. Chem. Soc.*, Vol. 90, p. 319 (1968)) of not less than 5.5 and has a solubility of at least 1 part by weight in 100 parts by weight of distilled water, in order to accelerate the reaction for rendering hydrophilic.

Suitable examples of such hydrophilic compounds include hydrazines, hydroxylamines, sulfites (e.g., ammonium sulfite, sodium sulfite, potassium sulfite or zinc sulfite), thiosulfates, and mercapto compounds, hydrazide compounds, sulfinic acid compounds and primary or secondary amine compounds each containing at least one polar group selected from a hydroxyl group, a carboxyl group, a sulfo group, a phosphono group and an amino group in the molecule thereof.

Specific examples of the polar group-containing mercapto compounds include 2-mercaptoethanol, 2-mercaptoethylamine, N-methyl-2-mercaptoethylamine, N-(2-hydroxyethyl)-2-mercaptoethylamine, thioglycolic acid, thiomalic acid, thiosalicylic acid, mercaptobenzenecarboxylic acid, 2-mercaptotoluensulfonic acid, 2-mercaptoethylphosphonic acid, mercaptobenzenesulfonic acid, 2-mercaptopropionylaminoacetic acid, 2-mercapto-1-aminoacetic acid, 1-mercaptopropionylaminoacetic acid, 1,2-dimercaptopropionylaminoacetic acid, 2,3-dihydroxypropylmercaptan, and 2-methyl-2-mercapto-1-aminoacetic acid. Specific examples of the polar group-containing sulfinic acid compounds include 2-hydroxyethylsulfinic acid, 3-hydroxypropanesulfinic acid, 4-hydroxybutanesulfinic acid, carboxybenzenesulfinic acid, and dicarboxybenzenesulfinic acid. Specific examples of the polar group-containing hydrazide compounds include 2-hydrazinoethanolsulfonic acid, 4-hydrazinobutanesulfonic acid, hydrazinobenzenesulfonic acid, hydrazinobenzenesulfonic acid, hydrazinobenzoic acid, and hydrazinobenzenecarboxylic acid. Specific examples of the polar group-containing primary or secondary amine compounds include N-(2-hydroxyethyl)amine, N,N-di(2-hydroxyethyl)amine, N,N-di(2-hydroxyethyl) ethylenediamine, tri-(2-hydroxyethyl)ethylenediamine, N-(2,3-dihydroxypropyl)amine, N,N-di(2,3-dihydroxypropyl)amine, 2-aminopropionic acid, aminobenzoic acid, aminopyridine, aminobenzenedicarboxylic acid, 2-hydroxyethylmorpholine, 2-carboxyethylmorpholine, and 3-carboxypiperazine.

The amount of the nucleophilic compound present in the processing solution is preferably from 0.05 to 10 mol/l, and more preferably from 0.1 to 5 mol/l. The pH of the processing solution is preferably not less than 4.

The processing solution may contain other compounds in addition to the pH control agent and nucleophilic compound described above. For example, organic solvents soluble in water, surface active agents, antiseptic compounds and anti-moldy compounds each illustrated with respect to the alkaline processing solution described hereinbefore may be employed. The amounts of such additives are same as those described above.

With respect to the conditions of the treatment, a temperature of from about 15° to about 60° C., and an immersion time of from about 10 seconds to about 5 minutes are preferred.

The treatment with the processing solution may be combined with a physical operation, for example, application of ultrasonic wave or mechanical movement (such as rubbing with a brush).

Actinic ray which can be used for decomposition to render the transfer layer hydrophilic upon the irradiation treatment includes any of visible light, ultraviolet light, far ultraviolet light, electron beam, X-ray, γ-ray, and α-ray, with ultraviolet light being preferred. More preferably rays having a wavelength range of from 310 to 500 nm are used. As a light source, a high-pressure or ultrahigh-pressure mercury lamp is ordinarily utilized. Usually, the irradiation treatment can be sufficiently carried out from a distance of from 5 to 50 cm for a period of from 10 seconds to 10 minutes. The thus irradiated transfer layer is then soaked in an aqueous solution whereby the transfer layer is easily removed.

In order to prepare a printing plate according to the present invention, a duplicated image is first formed through a conventional electrophotographic process. Specifically, each step of charging, light exposure, development and fixing is performed in a conventionally known manner. Particularly, a combination of a scanning exposure system using a laser beam based on digital information and a development system using a liquid developer is an advantageous process since highly accurate images can be obtained.

One specific example of the methods for preparing a printing plate is illustrated below. An electrophotographic light-sensitive material is positioned on a flat bed by a register pin system and fixed on the flat bed by air suction from the backside. Then it is charged by means of a charging device, for example, the device as described in Denshishashin Gakkai (ed.), *Denshishashin Gijutsu no Kiso to Oyo,* p. 212 et seq., Corona Sha (1988). A corotron or scotron system is usually used for the charging process. In a preferred charging process, the charging conditions may be controlled by a feedback system of the information on charged potential from a detector connected to the light-sensitive material thereby to control the surface potential within a predetermined range.

Thereafter, the charged light-sensitive material is exposed to light by scanning with a laser beam in accordance with the system described, for example, in ibidem, p. 254 et seq. Of four color separation images, first the image corresponding to a yellow plate is converted to a dot pattern and exposed.

Toner development is then conducted using a liquid developer. The light-sensitive material charged and exposed is removed from the flat bed and developed according to the direct wet type developing method as described, for example, in ibidem, p. 275 et seq. The exposure mode is determined in accord with the toner image development mode. Specifically, in case of reversal development, a negative image is irradiated with a laser beam, and a toner having the same charge polarity as that of the charged light-sensitive material is electrodeposited on the exposed area with a bias voltage applied. For the details, reference can be made to ibidem, p. 157 et seq.

After the toner development, the light-sensitive material is squeezed to remove the excess developer as described in ibidem, p. 283 and dried. Preferably, the light-sensitive material may be rinsed with the carrier liquid used in the liquid developer before squeezing.

The thus-formed toner image on the light-sensitive material is then heat-transferred to a receiving material together with the transfer layer thereof. An apparatus for transferring the transfer layer with the toner image thereon to a receiving material is illustrated in FIG. 2. The apparatus is composed of a pair of rollers covered with rubber 4 each containing therein a heating means 5 which are driven with a predetermined nip pressure applied. The surface temperature of rollers 4 is preferably in a range of from 50° to 150° C., and more preferably from 80° to 120° C., the nip pressure between rollers 4 is preferably in a range of from 0.2 to 20 kgf/cm$^2$, and more preferably from 0.5 to 10 kgf/cm$^2$, and the transportation speed is preferably in a range of from 0.1 to 100 mm/sec, and more preferably from 1 to 30 mm/sec. As a matter of course, these conditions should be optimized according to the physical properties of the transfer layer and light-sensitive element of the light-sensitive material and the receiving material each employed.

The temperature of roller surface is preferably maintained within a predetermined range by means of a surface temperature detective means 6 and a temperature controller 7. A pre-heating means and a cooling means for the light-sensitive material may be provided in front of and at the rear of the heating roller portion, respectively. Although not shown in FIG. 2, as a means for pressing two rollers, a pair of springs provided at both ends of the shaft of at least one roller or an air cylinder using compressed air may be employed.

The transfer layer transferred on the receiving material is then subjected to a chemical reaction treatment, through which the transfer layer is dissolved or swollen and then/eliminated, whereby the transfer layer is completely removed to prepare an offset printing plate.

The method for preparation of an electrophotographic printing plate according to the present invention includes an embodiment which comprises (a) a step of forming a peelable transfer layer which is mainly composed of a thermoplastic resin capable of being removed upon a chemical reaction treatment on a surface of an electrophotographic light-sensitive element which surface has releasability, (b) a step of forming a toner image by an electrophotographic process on the peelable transfer layer, (c) a step of heat-transferring the toner image together with the transfer layer onto a receiving material a surface of which is capable of providing a hydrophilic surface suitable for lithographic printing at the time of printing, and (d) a step of removing the thermoplastic resin of the transfer layer on the receiving material upon the chemical reaction treatment.

According to this embodiment, since the transfer layer is formed each time on the light-sensitive element, the light-sensitive element can be repeatedly employed after the transfer layer is released therefrom. Therefore, it is a remarkable feature that the formation and release of the transfer layer can be performed in sequence with the electrophotographic process in an electrophotographic plate making apparatus without throwing the light-sensitive element away after using it only once.

More specifically, in the method for preparation of an electrophotographic printing plate in accordance with the present invention, as schematically shown in FIG. 1 of the accompanying drawings, a transfer layer 12 comprising a thermoplastic resin capable of being removed by a chemical reaction treatment is formed on the surface of an electrophotographic light-sensitive element comprising at least a support 1 and a light-sensitive layer 2 in an electrophotographic plate making apparatus, then a toner image 3 is formed through a conventional electrophotographic process, and the toner image 3 together with transfer layer 12 is heat-transferred to a receiving material 16 having a hydrophilic property like a support for an offset printing plate has, thereby obtaining a printing plate precursor. Thereafter the transfer layer 12 transferred to the receiving material 16 is subjected to a chemical reaction treatment to remove the thermoplastic resin by dissolution or swell and release in the same apparatus or by a separate apparatus, thereby obtaining a lithographic printing plate.

In order to form the transfer layer in the electrophotographic plate making apparatus, the hot-melt coating method, electrodeposition coating method and transfer method described above are preferred.

The method for preparation of an electrophotographic printing plate according to the present invention will be described as well as a plate making apparatus useful for carrying out the method with reference to the accompanying drawings, hereinbelow.

FIG. 3 is a schematic view of an electrophotographic plate making apparatus suitable for carrying out the method of the present invention. In this example, the transfer layer is formed by the hot-melt coating method.

Thermoplastic resin 12*a* is coated on the surface of a light-sensitive element 11 provided on the peripheral surface of a drum by a hot-melt coater 13 and is caused to pass under a suction/exhaust unit 15 to be cooled to a predetermined temperature. After the hot-melt coater 13 is moved to the stand-by position indicated as 13*a*, a liquid developing unit set 14 is moved to the position where the hot-melt coater 13 was. The unit set 14 is provided with a liquid developing unit 14P containing a liquid developer.

The light-sensitive element 11 bearing thereon the transfer layer 12 of the thermoplastic resin is then subjected to the electrophotographic process. Specifically, when it is uniformly charged to, for instance, a positive polarity by a corona charger 18 and then is exposed imagewise by an exposure device (e.g., a semi-conductor laser) 19 on the basis of image information, the potential is lowered in the exposed regions and thus, a contrast in potential is formed between the exposed regions and the unexposed regions. The liquid developing unit 14P containing a liquid developer having a positive electrostatic charge of the liquid developing unit set 14 is brought near the surface of the light-sensitive element 11 and is kept stationary with a gap of 1 mm therebetween.

The light-sensitive material is first pre-bathed by a pre-bathing means provided in the developing unit set, and then the liquid developer is supplied on the surface of the light-sensitive material while applying a developing bias voltage between the light-sensitive material and a development electrode by a bias voltage source and wiring (not shown). The bias voltage is applied so that it is slightly lower than the surface potential of the unexposed regions, while the development electrode is charged to positive and the light-sensitive material is charged to negative. When the bias voltage applied is too low, a sufficient density of the toner image cannot be obtained.

The liquid developer is subsequently washed off by a rinsing means of the developing unit set and the rinse solution adhering to the surface of the light-sensitive material is removed by a squeeze means. Then, the light-sensitive material is dried by passing under the suction/exhaust unit 15. Meanwhile a heat transfer means 17 is kept away from the surface of the light-sensitive material.

After the image is formed on the transfer layer, the transfer layer is pre-heated by a pre-heating means 17*a* and is pressed against a rubber roller 17*b* having therein a heater with a temperature control means with the receiving material 16 intervening therebetween. The transfer layer and the receiving material are then passed under a cooling roller 17*c*, thereby heat-transferring the toner image to the receiving material together with the transfer layer. Thus a cycle of steps is terminated.

The heat transfer means 17 for heating-transferring the transfer layer to the receiving material comprises the pre-heating means 17*a*, the heating roller 17*b* which is in the form of a metal roller having therein a heater and is covered with rubber, and the cooling roller 17*c*. As the pre-heating means 17*a*, a non-contact type heater such as an infrared line heater, a flash heater or the like is used, and the transfer layer is pre-heated in a range below a temperature of the surface of the light-sensitive material achieved with heating by the heating roller 17*b*. The surface temperature of light-sensitive material heated by the heating roller 17*b* is preferably in a range of from 50° to 150° C., and more preferably from 80° to 120° C.

The cooling roller 17*c* comprises a metal roller which has a good thermal conductivity such as aluminum, copper or the like and is covered with silicone rubber. It is preferred that the cooling roller 17*c* is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller 17*c* is maintained within a predetermined range.

The nip pressure of the rollers is preferably in a range of from 0.2 to 20 kgf/cm$^2$ and more preferably from 0.5 to 15 kgf/cm$^2$. Although not shown, the rollers may be pressed by springs provided on opposite ends of the roller shaft or by an air cylinder using compressed air.

A speed of the transportation is suitably in a range of from 0.1 to 100 mm/sec and preferably in a range of from 1 to 30 mm/sec. The speed of transportation may differ between the electrophotographic process and the heat transfer step.

By stopping the apparatus in the state where the transfer layer has been formed, the next operation can start with the electrophotographic process. Further the transfer layer acts to protect the light-sensitive layer and prevent the properties of the light-sensitive layer from deteriorating due to environmental influence.

It is needless to say that the above-described conditions should be optimized depending on the physical properties of the transfer layer, the light-sensitive element (i.e., the light-sensitive layer and the support) and the receiving material. Especially it is important to determine the conditions of pre-heating, roller heating and cooling in the heat transfer step taking into account the factors such as glass transition point, softening temperature, flowability, tackiness, film properties and film thickness of the transfer layer. Specifically, the conditions should be set so that the tackiness of the transfer layer increases and the transfer layer is closely adhered to the receiving material when the transfer layer softened to a certain extent by the pre-heating means passes the heating roller, and so that the temperature of the transfer layer is decreased to reduce the flowability and the tackiness after the transfer layer subsequently passes the cooling roller and thus the transfer layer is peeled as a film from the surface of the light-sensitive element together with the toner thereon.

Thereafter the transfer layer on the receiving material is subjected to a chemical reaction treatment to remove the transfer layer by dissolution or swell and release thereby obtaining an offset printing plate.

FIG. 4 is a schematic view of another electrophotographic plate making apparatus suitable for carrying out the method of the present invention. In this example, the transfer layer is formed by the electrodeposition coating method.

A dispersion 12*b* of thermoplastic resin grains is supplied to an electrodeposition unit 14T provided in a movable liquid developing unit set 14. The electrodeposition unit 14T is first brought near the surface of the light-sensitive element 11 and is kept stationary with a gap of 1 mm therebetween. The light-sensitive element 11 is rotated while supplying the dispersion 12*b* of thermoplastic resin grains into the gap and applying an electric voltage across the gap from an external power source (not shown), whereby the grains are deposited over the entire image-forming areas of the surface of the light-sensitive element 11.

The dispersion 12*b* of thermoplastic resin grains excessively adhered to the surface of the light-sensitive element 11 is removed by a squeezing device built in the electrodeposition unit 14T, and the light-sensitive element is dried by passing under the suction/exhaust unit 15. Then the thermoplastic resin grains are fused by the pre-heating means 17*a* and thus a transfer layer 12 in the form of thermoplastic resin film is obtained.

Thereafter the transfer layer is cooled to a predetermined temperature, if desired, from an outside of the light-sensitive element or from an inside of the drum of the light-sensitive element by a cooling device which is similar to the suction/exhaust unit 15, although not shown.

After moving away the electrodeposition unit 14T, the liquid developing unit set 14 is posited. The unit set 14 is provided with a liquid developing unit 14P containing a liquid developer. The unit may be provided, if desired, with a pre-bathing means, a rinsing means and/or a squeeze means in order to prevent stains of the non-image portions. As the pre-bathing solution and the rinse solution, a carrier liquid for the liquid developer is generally used.

Then the electrophotographic process and the transfer process are subsequently effected. These processes are the same as those described above in conjunction with the example where the hot-melt coating method is used. Also, other conditions related to the apparatus are the same as those described above.

FIG. 5 is a schematic view of still another electrophotographic plate making apparatus suitable for carrying out the method of the present invention. In this example, the transfer layer is formed by the transfer method.

The apparatus of FIG. 5 has essentially the same constitution as the apparatus (FIG. 3) used in the hot-melt coating method described above except for means for forming the transfer layer on the surface of light-sensitive element. The electrophotographic process, the transfer process and the conditions thereof performed after forming the transfer layer 12 on the surface of light-sensitive element 11 are also the same as those described above.

In FIG. 5, the apparatus separately provided with a transfer means 117 for transferring the transfer layer 12 from release paper 10 onto the light-sensitive element 11 and a transfer means 17 for transferring the transfer layer having a toner image thereon onto the receiving material 16 is shown. However, a method wherein the transfer layer 12 is first transferred from the release paper 10 to the light-sensitive element using the transfer means 117, a toner image is formed thereon by an electrophotographic process and then the toner image is transferred to the receiving material 16 together with the transfer layer using again the transfer means 117 while now supplying the receiving material 16 can also be employed.

Figure 1:
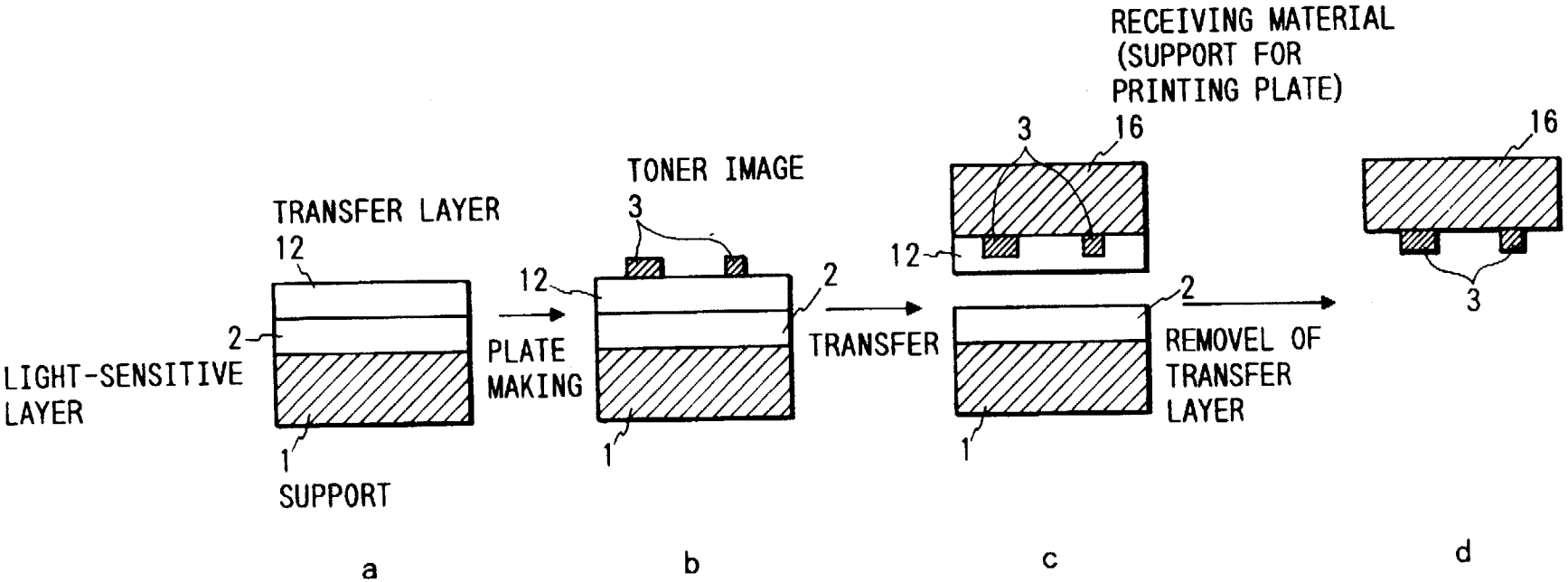
FIG. 1 is a schematic view for explanation of the method for preparation of a printing plate.
Figure 2:
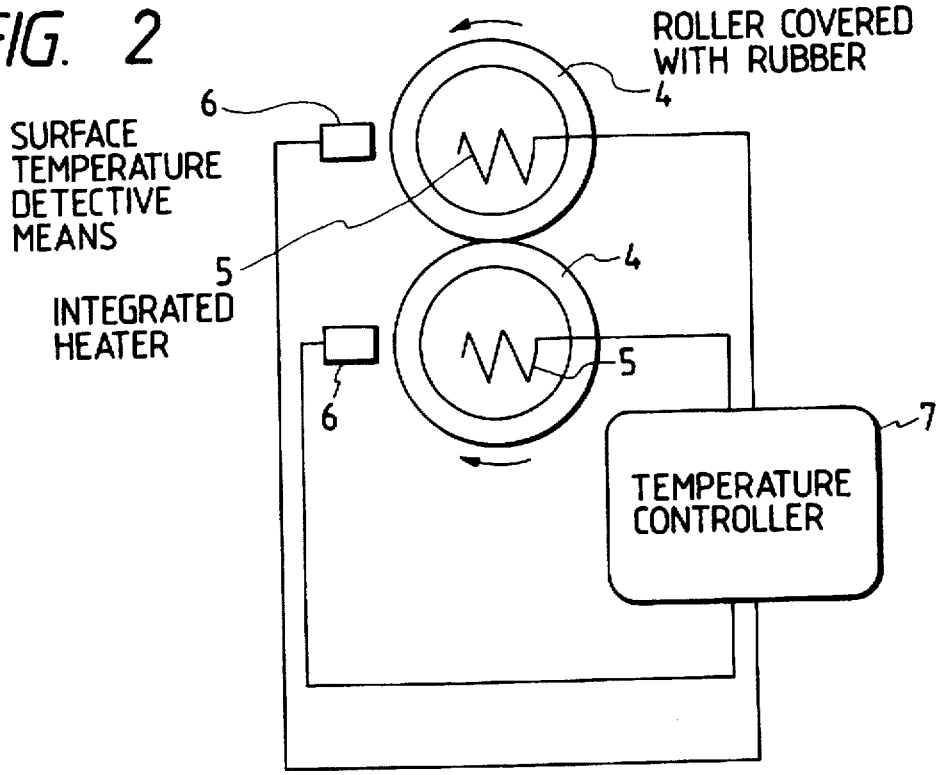
FIG. 2 is a schematic view of the apparatus for heat-transfer of the transfer layer to a receiving material.

Explanation of the Symbols:

1 Support of light-sensitive element
2 Light-sensitive layer
3 Toner image
4 Roller covered with rubber
5 Integrated heater
6 Surface temperature detective means
7 Temperature controller
10 Release paper
11 Light-sensitive element
12 Transfer layer
12*a* Thermoplastic resin
12*b* Dispersion of thermoplastic resin grains
13 Hot-melt coater
13*a* Stand-by position of hot-melt coater
14 Liquid developing unit set
14T Electrodeposition unit
14P Liquid developing unit
15 Suction/exhaust unit
15*a* Suction part
15*b* Exhaust part
16 Receiving material (support for printing plate)
17 Heat transfer means
17*a* Pre-heating means
17*b* Heating roller
17*c* Cooling roller
18 Corona charger
19 Exposure device
117 Heat transfer means
117*b* Heating roller
117*c* Cooling roller

BEST MODE FOR CONDUCTING THE INVENTION

The present invention is illustrated in greater detail with reference to the following examples, but the present invention is not to be construed as being limited thereto.

Synthesis Examples of Resin (P):

SYNTHESIS EXAMPLE 1 OF RESIN (P): (P-1)

A mixed solution of 80 g of methyl methacrylate, 20 g of a dimethylsiloxane macromonomer (FM-0725 manufactured by Chisso Corp.; weight average molecular weight (Mw): $1\times10^4$), and 200 g of toluene was heated to a temperature of 75° C. under nitrogen gas stream. To the solution was added 1.0 g of 2,2'-azobisisobutyronitrile (abbreviated as AIBN), followed by reacting for 4 hours. To the mixture was further added 0.7 g of AIBN, and the reaction was continued for 4 hours. An Mw of the copolymer thus-obtained was $5.8\times10^4$ (as measured by the G.P.C. method).

Resin (P-1)

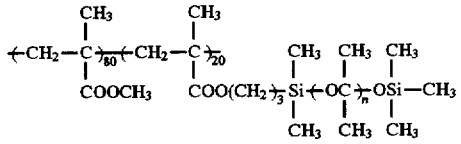

SYNTHESIS EXAMPLES 2 TO 9 OF RESIN (P): (P-2) TO (P-9)

Each of copolymers was synthesized in the same manner as in Synthesis Example 1 of Resin (P), except for replacing methyl methacrylate and the macromonomer (FM-0725) with each monomer corresponding to the polymer component shown in Table 2 below. An Mw of each of the resulting polymers was in a range of from $4.5\times10^4$ to $6\times10^4$.

TABLE 2

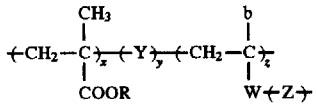

| Synthesis Example of Resin (P) | (P) | −R | −Y− | −b | −W− | −Z− | x/y/z (weight ratio) |
|---|---|---|---|---|---|---|---|
| 2 | P-2 | $-C_2H_5$ | $-CH_2-C(CH_3)(COOCH_2CH\underset{O}{\frown}CH_2)-$ | $-CH_3$ | $-COO(CH_2)_2S-$ | $-CH_2-C(CH_3)(COO(CH_2)_2C_8F_{17})-$ | 65/15/20 |
| 3 | P-3 | $-CH_3$ | $-CH_2-CH(COOCH_3)-$ | $-H$ | $COO(CH_2)_2OCO-*$ <br> $*-(CH_2)_2S-$ | $-CH_2-C(CH_3)(COOCH_2CF_2CFHCF_3)-$ | 60/10/30 |
| 4 | P-4 | $-CH_3$ | $-CH_2-C(CH_3)(COOCH_2CH(OH)CH_2OH)-$ | $-CH_3$ | $COOCH_2CH(OH)CH_2-*$ <br> $*-OOC(CH_2)_2S-$ | $-CH_2-C(CH_3)(COO(CH_2)_3Si(CH_3)_2-OSi(CH_3)_3)-$ | 65/10/25 |
| 5 | P-5 | $-C_3H_7$ | $-CH_2-C(CH_3)(COO(CH_2)_2NHCOOCH(CF_3)_2)-$ | $-CH_3$ | $COOCH_2CH(OH)CH_2-*$ <br> $*-OOC(CH_2)_2S-$ | $-CH_2-C(CH_3)(COO(CH_2)_2Si(CH_3)_2-(OSi(CH_3)_2)_3-OSi(CH_3)_3)-$ | 65/15/20 |

TABLE 2-continued

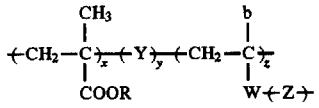

| Synthesis Example of Resin (P) | (P) | −R | −Y− | −b | −W− | −Z− | x/y/z (weight ratio) |
|---|---|---|---|---|---|---|---|
| 6 | P-6 | $-CH_3$ | $-CH_2-C(CH_3)(COO(CH_2)_3Si(OC_2H_5)_3)-$ | $-CH_3$ | $-COOCH_2CH(OH)CH_2-*$ <br> $*-OOC(CH_2)_2S-$ | $-CH_2-C(CH_3)(COO(CH_2)_3Si(OSi(CH_3)_3)_2-O-Si(CH_3)_3)-$ | 50/20/30 |
| 7 | P-7 | $-C_2H_5$ | 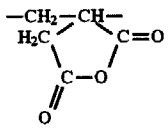 | $-H$ | $-CONH(CH_2)_2S-$ | $-CH_2-C(CH_3)(COOCH(CF_3)_2)-$ | 57/8/35 |
| 8 | P-8 | $-CH_3$ | $-CH_2-CH(CONH(CH_2)_6OH)-$ | $-H$ | $-COO(CH_2)_2OCO-*$ <br> $*-CH_2S-$ | $-CH_2-CH(CONHC_{17}F_{35})-$ | 70/15/15 |
| 9 | P-9 | $-C_2H_5$ | $-CH_2-C(CH_3)(COO(CH_2)_2NHCOCH(COCH_3)_2)-$ | $-CH_3$ | $-COO(CH_2)_2OCO-*$ <br> $*-CH_2S-$ | $-CH_2-C(CH_3)(COO(CH_2)_3SO_2NHC_{12}F_{25})-$ | 80/0/20 |

SYNTHESIS EXAMPLE 10 OF RESIN (P): (P-10)

A mixed solution of 60 g of 2,2,3,4,4,4-hexafluorobutyl methacrylate, 40 g of a methyl methacrylate macromonomer (AA-6 manufactured by Toagosei Chemical Industry Co., Ltd.; Mw: $1\times10^4$), and 200 g of benzotrifluoride was heated to a temperature of 75° C. under nitrogen gas stream. To the solution was added 1.0 g of AIBN, followed by reacting for 4 hours. To the mixture was further added 0.5 g of AIBN, and the reaction was continued for 4 hours. An Mw of the copolymer thus-obtained was $6.5\times10^4$.

Resin (P-10)

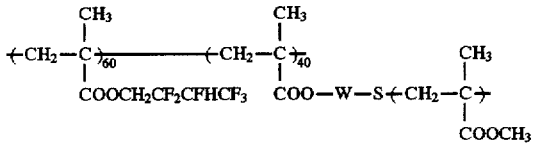

—W—: an organic residue (unknown)

SYNTHESIS EXAMPLES 11 TO 15 OF RESIN (P): (P-11) To (P-15)

Each of copolymers was synthesized in the same manner as in Synthesis Example 10 of Resin (P), except for replacing the monomer and the macromonomer used in Synthesis Example 10 of Resin (P) with each monomer corresponding to the polymer component and each macromonomer both shown in Table 3 below. An Mw of each of the resulting copolymers was in a range of from $4.5\times10^4$ to $6.5\times10^4$.

TABLE 3

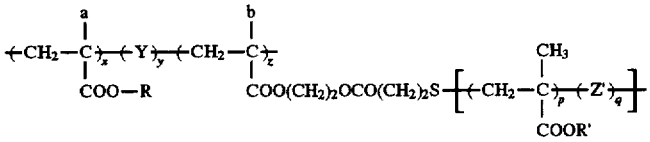

| Synthesis Example of Resin (P) | (P) | —a | —R | —Y— | —b |
|---|---|---|---|---|---|
| 11 | P-11 | $-CH_3$ | $-(CH_2)_2C_nF_{2n+1}$ n = 8~10 | — | $-CH_3$ |
| 12 | P-12 | $-CH_3$ | $-(CH_2)_2CF_2CFHCF_3$ | — | —H |

| Synthesis Example of Resin (P) | —R' | —Z'— | x/y/z (weight ratio) | p/g (weight ratio) |
|---|---|---|---|---|
| 11 | $-CH_3$ | $-CH_2-C(CH_3)(COOCH_2CHCH_2)$ (O) | 70/0/30 | 70/30 |
| 12 | $-CH_3$ | $-CH_2-C(CH_3)(COO(CH_2)_3Si(OCH_3)_2)-CH_3$ | 60/0/40 | 70/30 |

| Synthesis Example of Resin (P) | (P) | —a | —R | —Y— | —b |
|---|---|---|---|---|---|
| 13 | P-13 | $-CH_3$ | $-CH_2CF_2CF_2H$ | $-CH_2-C(CH_3)(COO(CH_2)_2SiO(Si(CH_3)_3)SiO(Si(CH_3)_3)Si(CH_3)_3)-$ | $-CH_3$ |
| 14 | P-14 | —H | $-CH_2CF_2CFHCF_3$ | $-CH_2-C(CH_3)(COO(CH_2)_3Si(CF_3)_2-C_2H_5)-$ | $-CH_3$ |

TABLE 3-continued

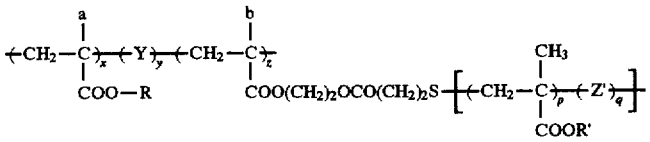

| Synthesis Example of Resin (P) | −R' | −Z'− | x/y/z (weight ratio) | p/g (weight ratio) |
|---|---|---|---|---|
| 13 | — | $-CH_2-C(CH_3)(COOCH_2CH=CH_2)-$ | 40/30/30 | 90/10 |
| 14 | $-C_2H_5$ | $-CH_2-C(CH_3)(COO(CH_2)_2OH)-$ | 30/45/25 | 60/40 |

| Synthesis Example of Resin (P) | (P) | −a | −R | −Y− | −b |
|---|---|---|---|---|---|
| 15 | P-15 | $-CH_3$ | $-(CH_2)_3Si(CH_3)_2-O-Si(CH_3)_2-O-Si(CH_3)_2-CH_3$ | — | $-CH_3$ |

| Synthesis Example of Resin (P) | −R' | −Z'− | x/y/z (weight ratio) | p/g (weight ratio) |
|---|---|---|---|---|
| 15 | $-C_2H_5$ | $-CH_2-CH(COOH)-$ | 80/0/20 | 90/10 |

SYNTHESIS EXAMPLE 16 OF RESIN (P): (P-16)

A mixed solution of 67 g of methyl methacrylate, 22 g of methyl acrylate, 1 g of methacrylic acid, and 200 g of toluene was heated to a temperature of 80° C. under nitrogen gas stream. To the solution was added 10 g of Polymer Azobis Initiator (PI-1) having the structure shown below, followed by reacting for 8 hours. After completion of the reaction, the reaction mixture was poured into 1.5 1 of methanol, and the precipitate thus-deposited was collected and dried to obtain 75 g of a copolymer having an Mw of $3\times10^4$.

Polymer Initiator (PI-1)

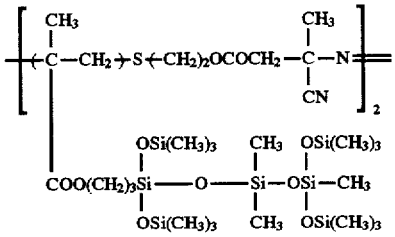

Polymer (P-16)

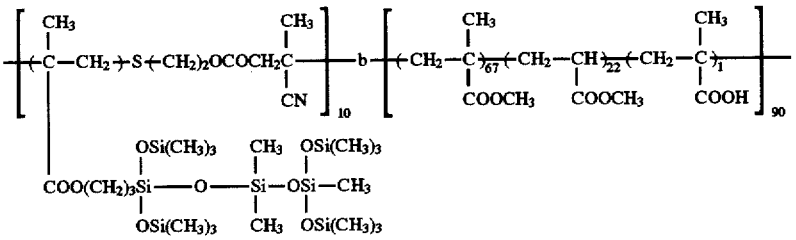

—b—: a bond between blocks

SYNTHESIS EXAMPLE 17 OF RESIN (P): (P-17)

A mixed solution of 70 g of methyl methacrylate and 200 g of tetrahydrofuran was thoroughly degassed under nitrogen gas stream and cooled to −20° C. To the solution was added 0.8 g of 1,1-diphenylbutyl lithium, followed by reacting for 12 hours. To the reaction mixture was then added a mixed solution of 30 g of Monomer (M-1) shown below and 60 g of tetrahydrofuran which had been thoroughly degassed under nitrogen gas stream, followed by reacting for 8 hours.

After rendering the mixture to 0° C., 10 ml of methanol was added thereto to conduct a reaction for 30 minutes to stop the polymerization. The resulting polymer solution was heated to a temperature of 30° C. with stirring, and 3 ml of a 30% ethanol solution of hydrogen chloride was added thereto, followed by stirring for 1 hour. The reaction mixture was distilled under reduced pressure to remove the solvent until the volume was reduced to half and the residue was reprecipitated in 1 l of petroleum ether. The precipitate was collected and dried under reduced pressure to obtain 76 g of a polymer having an Mw of $6.8\times10^4$.

Monomer (M-1)

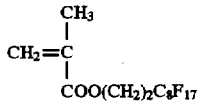

Resin (P-17)

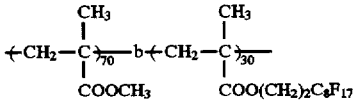

SYNTHESIS EXAMPLE 18 OF RESIN (P): (P-18)

A mixed solution of 52.5 g of methyl methacrylate, 22.5 g of methyl acrylate, 0.5 g of methylaluminum tetraphenylporphynate, and 200 g of methylene chloride was heated to a temperature of 30° C. under nitrogen gas stream. The solution was irradiated with light from a xenon lamp of 300 W at a distance of 25 cm through a glass filter for 20 hours. To the mixture was added 25 g of Monomer (M-2) shown below, and the resulting mixture was further irradiated with light under the same conditions as above for 12 hours. To the reaction mixture was added 3 g of methanol, followed by stirring for 30 minutes to stop the reaction. The reaction mixture was reprecipitated in 1.5 l of methanol, and the precipitate was collected and dried to obtain 78 g of a polymer having an Mw of $7\times10^4$.

Monomer (M-2)

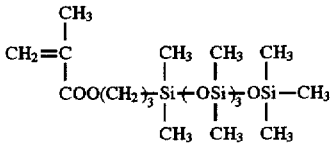

Resin (P-18)

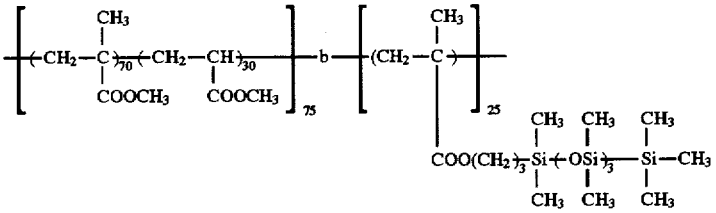

SYNTHESIS EXAMPLE 19 OF RESIN (P): (P-19)

A mixture of 50 g of ethyl methacrylate, 10 g of glycidyl methacrylate, and 4.8 g of benzyl N,N-diethyldithiocarbamate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. The reaction mixture was dissolved in 100 g of tetrahydrofuran, and 40 g of Monomer (M-3) shown below was added thereto. After displacing the atmosphere with nitrogen, the mixture was again irradiated with light for 10 hours. The reaction mixture obtained was reprecipitated in 1 l of methanol, and the precipitate was collected and dried to obtain 73 g of a polymer having an Mw of $4.8\times10^4$.

Monomer (M-3)

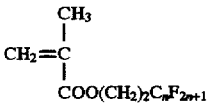

(n: an integer of from 8 to 10)

Resin (P-19)

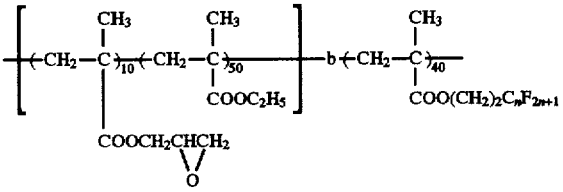

(n: an integer of from 8 to 10)

SYNTHESIS EXAMPLE 20 OF RESIN (P): (P-20)

A mixture of 50 g of methyl methacrylate, 25 g of ethyl methacrylate, and 1.0 g of benzyl isopropylxanthate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. To the mixture was added 25 g of Monomer (M-1) described above. After displacing the atmosphere with nitrogen, the mixture was again irradiated with light for 10 hours. The reaction mixture obtained was reprecipitated in 2 l of methanol, and the precipitate was collected and dried to obtain 63 g of a polymer having an Mw of $6\times10^4$.

Resin (P-20)

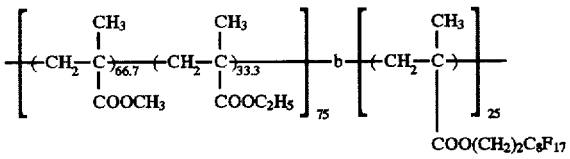

SYNTHESIS EXAMPLES 21 TO 27 OF RESIN (P): (P-21) TO (P-27)

Each of copolymers shown in Table 4 below was prepared in the same manner as in Synthesis Example 19 of Resin (P). An Mw of each of the resulting polymers was in a range of from $3.5\times10^4$ to $6\times10^4$.

TABLE 4

| Synthesis Example of Resin (P) | (P) | A-B Type Block Copolymer (weight ratio) |
|---|---|---|
| 21 | P-21 | 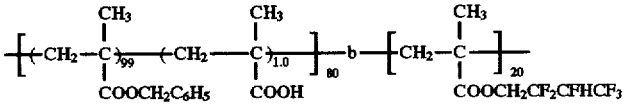 |
| 22 | P-22 | 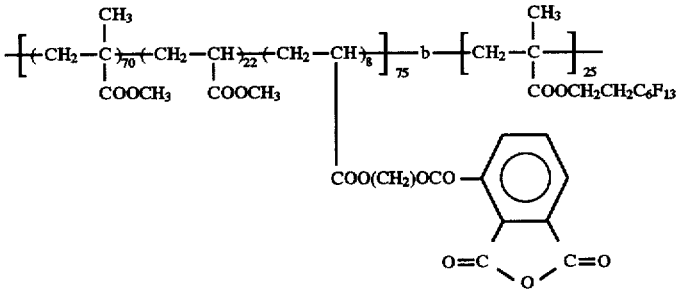 |
| 23 | P-23 | 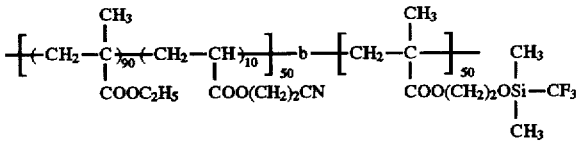 |
| 24 | P-24 | 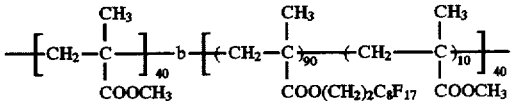 |
| 25 | P-25 | 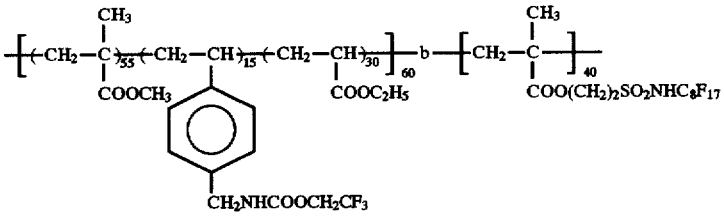 |
| 26 | P-26 | 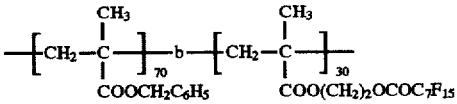 |

TABLE 4-continued

| Synthesis Example of Resin (P) | (P) | A-B Type Block Copolymer (weight ratio) |
|---|---|---|
| 27 | P-27 | $[(CH_2-C(CH_3)(COOCH_2C_6H_5))_{97}-(CH_2-C(CH_3)(COO(CH_2)_2O-P(=O)(OH)-OH))_3]_{75}-b-[CH_2-C(CH_3)(COO(CH_2)_2OSi(CH_3)_2-C_8F_{17})]_{25}$ |

SYNTHESIS EXAMPLE 28 OF RESIN (P): (P-28)

A copolymer having an Mw of $4.5\times10^4$ was prepared in the same manner as in Synthesis Example 19 of Resin (P), except for replacing benzyl N,N-diethyldithiocarbamate with 18 g of Initiator (I-1) having the structure shown below.

Initiator (I-1)

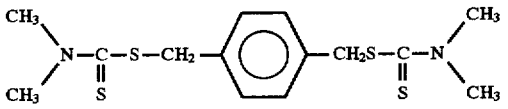

Resin (P-28)

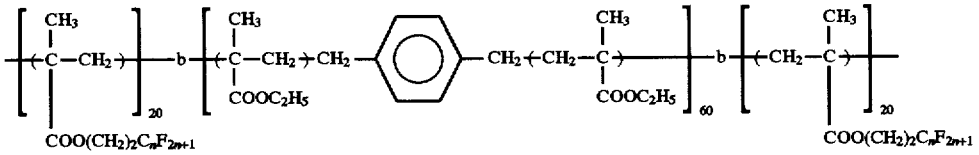

(n: an integer of from 8 to 10)

SYNTHESIS EXAMPLE 29 OF RESIN (P): (P-29)

A copolymer having an Mw of $2.5\times10^4$ was prepared in the same manner as in Synthesis Example 20 of Resin (P), except for replacing benzyl isopropylxanthate with 0.8 g of Initiator (I-2) having the structure shown below.

Initiator (I-2)

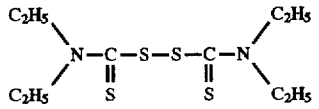

Resin (P-29)

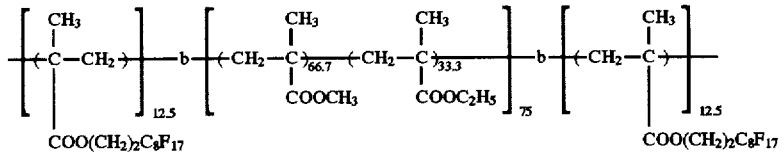

SYNTHESIS EXAMPLE 30 OF RESIN (P): (P-30)

A mixed solution of 68 g of methyl methacrylate, 22 g of methyl acrylate, 10 g of glycidyl methacrylate, 17.5 g of Initiator (I-3) having the structure shown below, and 150 g of tetrahydrofuran was heated to a temperature of 50° C. under nitrogen gas stream. The solution was irradiated with light from a high-pressure mercury lamp of 400 W at a distance of 10 cm through a glass filter for 10 hours to conduct photopolymerization. The reaction mixture obtained was reprecipitated in 1 l of methanol, and the precipitate was collected and dried to obtain 72 g of a polymer having an Mw of $4.0\times10^4$.

A mixed solution of 70 g of the resulting polymer, 30 g of Monomer (M-2) described above, and 100 g of tetrahydrofuran was heated to a temperature of 50° C. under nitrogen gas stream and irradiated with light under the same conditions as above for 13 hours. The reaction mixture was reprecipitated in 1.5 l of methanol, and the precipitate was collected and dried to obtain 78 g of a copolymer having an Mw of $6\times10^4$.

Initiator (I-3)
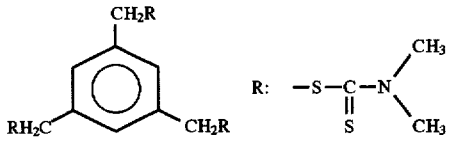
Resin (P-30)
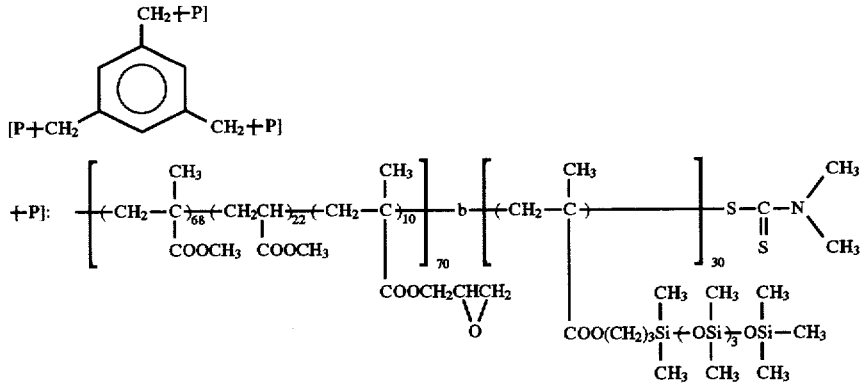
SYNTHESIS EXAMPLES 31 TO 38 OF RESIN (P): (P-31) TO (P-38)
In the same manner as in Synthesis Example 30 of Resin (P), except for replacing 17.5 g of Initiator (I-3) with 0.031 mol of each of the initiators shown in Table 5 below, each of the copolymers shown in Table 5 was obtained. A yield thereof was in a range of from 70 to 80 g and an Mw thereof was in a range of from $4\times10^4$ to $6\times10^4$.

TABLE 5
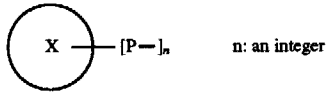
n: an integer
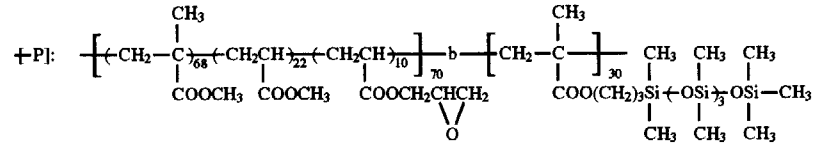
| Synthesis Example of Resin (P) | (P) | Initiator (I) | —R | 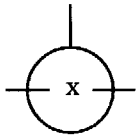 |
|---|---|---|---|---|
| 31 | P-31 | (I-4) 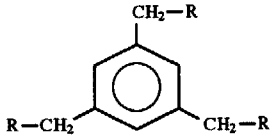 | 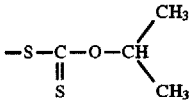 | 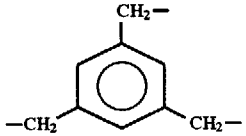 |
| 32 | P-32 | (I-5) 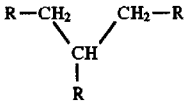 | 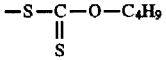 | 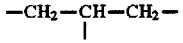 |
| 33 | P-33 | (I-6) 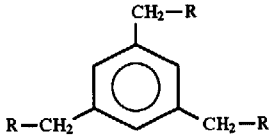 | 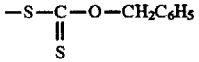 | 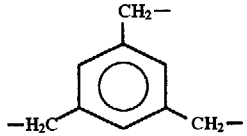 |

TABLE 5-continued
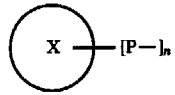
n: an integer
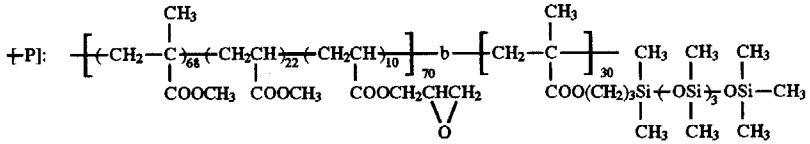
| Synthesis Example of Resin (P) | (P) | Initiator (I) | —R | 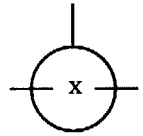 |
|---|---|---|---|---|
| 34 | P-34 | (I-7) 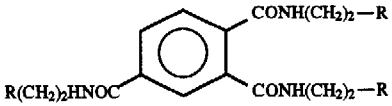 | 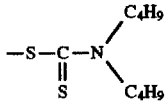 | 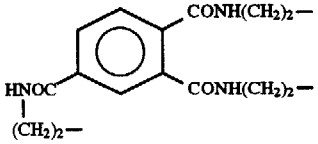 |
| 35 | P-35 | (I-8) 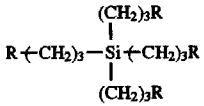 | 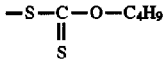 | 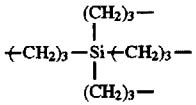 |
| 36 | P-36 | (I-9) 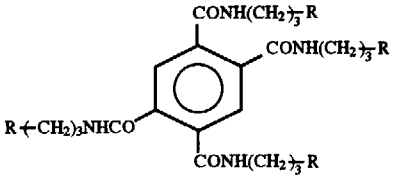 | 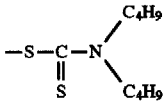 | 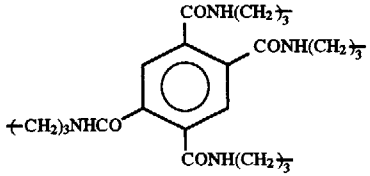 |

TABLE 5-continued
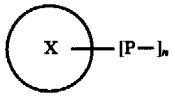
n: an integer
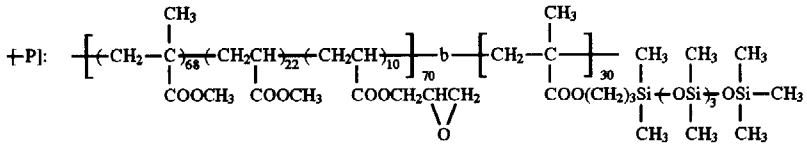
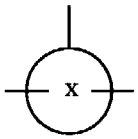
| Synthesis Example of Resin (P) | (P) | Initiator (I) | —R | |
|---|---|---|---|---|
| 37 | P-37 | (I-10) 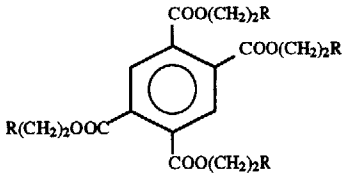  | 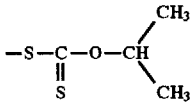  | 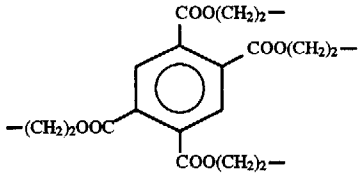  |
| 38 | P-38 | (I-11) 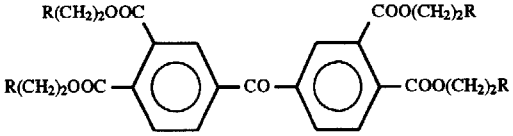  | 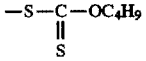  | 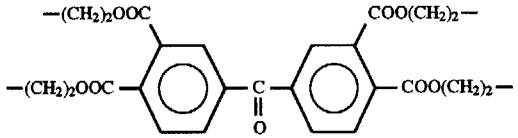  |

Synthesis Examples of Resin Grain (L):

SYNTHESIS EXAMPLE 1 OF RESIN GRAIN (L): (L-1)

A mixed solution of 40 g of Monomer (LM-1) having the structure shown below, 2 g of ethylene glycol dimethacrylate, 4.0 g of Dispersion Stabilizing Resin (LP-1) having the structure shown below, and 180 g of methyl ethyl ketone was heated to a temperature of 60° C. with stirring under nitrogen gas stream. To the solution was added 0.3 g of 2,2'-azobis(isovaleronitrile) (abbreviated as AIVN), followed by reacting for 3 hours. To the reaction mixture was further added 0.1 g of AIVN, and the reaction was continued for 4 hours. After cooling, the reaction mixture was passed through a nylon cloth of 200 mesh to obtain a white dispersion. The average grain diameter of the latex was 0.25 μm (the grain diameter was measured by CAPA-500 manufactured by Horiba, Ltd.).

Monomer (LM-1)

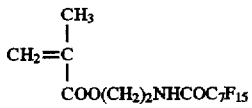

Dispersion Stabilizing Resin (LP-1)

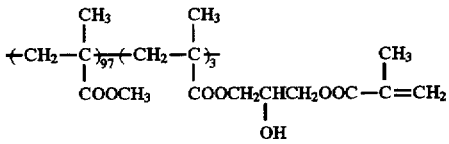

Mw: $3 \times 10^4$ (weight ratio)

SYNTHESIS EXAMPLE 2 OF RESIN GRAIN (L): (L-2)

A mixed solution of 5 g of AB-6 (a monofunctional macromonomer comprising a butyl acrylate unit, manufactured by Toagosei Chemical Industry Co., Ltd.) as a dispersion stabilizing resin and 140 g of methyl ethyl ketone was heated to a temperature of 60° C. under nitrogen gas stream while stirring. To the solution was added dropwise a mixed solution of 40 g of Monomer (LM-2) having the structure shown below, 1.5 g of ethylene glycol diacrylate, 0.2 g of AIVN, and 40 g of methyl ethyl ketone over a period of one hour. After the addition, the reaction was continued for 2 hours. To the reaction mixture was further added 0.1 g of AIVN, followed by reacting for 3 hours to obtain a white dispersion. After cooling, the dispersion was passed through a nylon cloth of 200 mesh. The average grain diameter of the dispersed resin grains was 0.35 μm.

Monomer (LM-2)

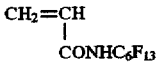

SYNTHESIS EXAMPLES 3 TO 11 OF RESIN GRAIN (L): (L-3) TO (L-11)

Each of resin grains was synthesized in the same manner as in Synthesis Example 1 of Resin Grain (L), except for replacing Monomer (LM-1), ethylene glycol dimethacrylate and methyl ethyl ketone with each of the compounds shown in Table 6 below, respectively. An average grain diameter of each of the resulting resin grains was in a range of from 0.15 to 0.30 μm.

TABLE 6

| Synthesis Example of Resin Grain (L) | (L) | Monomer (LM) | Crosslinking Polyfunctional Monomer | Amount | Reaction Solvent |
|---|---|---|---|---|---|
| 3 | L-3 | (LM-3) 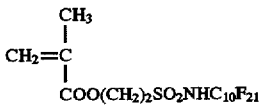 | Ethylene glycol dimethacrylate | 2.5 g | Methyl ethyl ketone |
| 4 | L-4 | (LM-4) 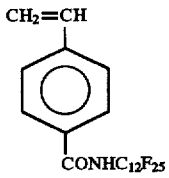 | Divinylbenzene | 3 g | Methyl ethyl ketone |
| 5 | L-5 | (LM-5) 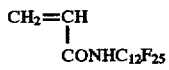 | — | | Methyl ethyl ketone |

TABLE 6-continued

| Synthesis Example of Resin Grain (L) | (L) | Monomer (LM) | Crosslinking Polyfunctional Monomer | Amount | Reaction Solvent |
|---|---|---|---|---|---|
| 6 | L-6 | (LM-6) $CH_2=C(CH_3)-CONH(CH_2)_3Si(CH_3)_2-C_4F_9$ | Diethylene glycol diacrylate | 5 g | n-Hexane |
| 7 | L-7 | (LM-7) $CH_2=C(CH_3)-COOCH(CF_3)_2$ | Ethylene glycol dimethacrylate | 3.5 g | n-Hexane |
| 8 | L-8 | (LM-8) $CH_2=CH-COO(CH_2)_2CONHC_8F_{17}$ | Trimethylolpropane trimethacrylate | 2.5 g | Methyl ethyl ketone |
| 9 | L-9 | (LM-9) $CH_2=CH-CONH(CH_2)_3Si[OSi(CH_3)_3]_3$ | Trivinylbenzene | 3.3 g | Ethyl acetate/ n-Hexane (4/1 by weight) |
| 10 | L-10 | (LM-10) $CH_2=C(CH_3)-COO(CH_2)_2NHCONH(CH_2)_3Si[OSi(CH_3)_3]_3$ | Divinyl glutaconate | 4 g | Ethyl acetate/ n-Hexane (2/1 by weight) |
| 11 | L-11 | (LM-11) $CH_2=C(CH_3)-CONHCOOCH_2CF_2CFHCF_3$ | Propylene glycol diacrylate | 3 g | Methyl ethyl ketone |

SYNTHESIS EXAMPLES 12 TO 17 OF RESIN GRAIN (L): (L-12) TO (L-17)

Each of resin grains was synthesized in the same manner as in Synthesis Example 2 of Resin Grain (L), except for replacing 5 g of AB-6 (dispersion stabilizing resin) with each of Resins (LP) shown in Table 7 below. An average grain diameter of each of the resulting resin grains was in a range of from 0.10 to 0.25 μm.

TABLE 7

| Synthesis Example of Resin Grain (L) | (L) | Dispersion Stabilizing Resin (LP) | Amount |
|---|---|---|---|
| 12 | L-12 | $(CH_2-C(CH_3)(COOCH_3))_{67}-(CH_2-CH(COOCH_3))_{30}-(CH_2-C(CH_3))_{3}$ $COO(CH_2)_2OCO(CH_2)_2COOCH_2CH(OH)CH_2OCO-CH=CH_2$ (LP-2) Mw $3.3\times10^4$ | 4 g |
| 13 | L-13 | $(CH_2-C(CH_3)(COOC_2H_5))_{97}-(CH_2-CH(COOH))_{1.0}-(CH_2-C(CH_3))_{2}$ $CONH(CH_2)_{10}OCO-C(CH_3)=CH_2$ (LP-3) Mw $2.5\times10^4$ | 2 g |

TABLE 7-continued

| Synthesis Example of Resin Grain (L) | (L) | Dispersion Stabilizing Resin (LP) | Amount |
|---|---|---|---|
| 14 | L-14 | 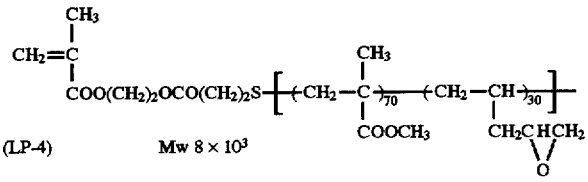 (LP-4) Mw $8 \times 10^3$ | 6 g |
| 15 | L-15 | 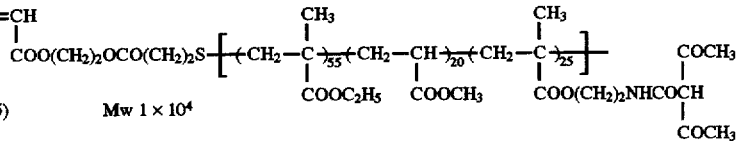 (LP-5) Mw $1 \times 10^4$ | 6 g |
| 16 | L-16 | 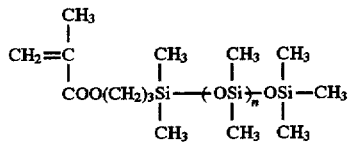 (LP-6) Mw $1 \times 10^4$ | 4 g |
| 17 | L-17 | 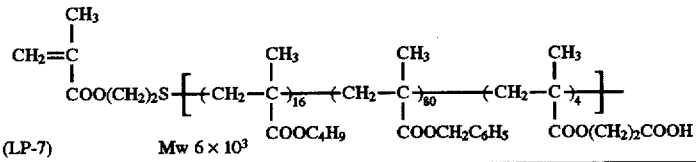 (LP-7) Mw $6 \times 10^3$ | 5 g |

SYNTHESIS EXAMPLES 18 TO 23 OF RESIN GRAIN (L): (L-18) TO (L-23)

Each of resin grains was synthesized in the same manner as in Synthesis Example 2 of Resin Grain (L), except for replacing 40 g of Monomer (LM-2) with each of the monomers shown in Table 8 below and replacing 5 g of AB-6 (dispersion stabilizing resin) with 6 g of Dispersion Stabilizing Resin (LP-8) having the structure shown below. An average grain diameter of each of the resulting resin grains was in a range of from 0.05 to 0.20 μm.

Dispersion Stabilizing Resin (LP-8)

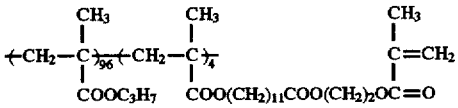

Mw $3 \times 10^4$

TABLE 8

| Synthesis Example of Resin Grain (L) | (L) | Monomer (LM) | Amount | Other Monomer | Amount |
|---|---|---|---|---|---|
| 18 | L-18 | (LM-12) 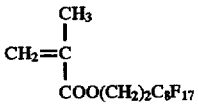 | 30 g | $CH_2=CH$ \| $CONHCH_2OCH_3$ | 10 g |
| 19 | L-19 | (LM-13) 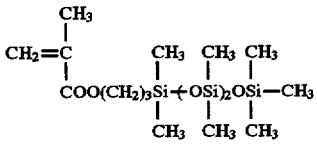 | 25 g | Glycidyl methacrylate | 15 g |

TABLE 8-continued

| Synthesis Example of Resin Grain (L) | (L) | Monomer (LM) | Amount | Other Monomer | Amount |
|---|---|---|---|---|---|
| 20 | L-20 | (LM-14) $CH_2{=}CH$ \| $COOCH_2CF_2CF_2H$ | 20 g | Acrylonitrile | 20 g |
| 21 | L-21 | (LM-15) 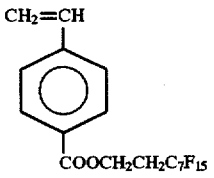 | 25 g | $CH_2{=}CH$ 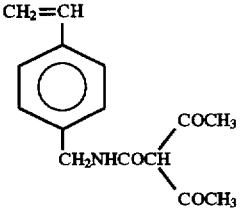 | 15 g |
| 22 | L-22 | $CH_2{=}C(CH_3)$ $COO(CH_2)_2OSi(CH_3)_2{-}C_6F_{13}$ | 20 g | Methyl methacrylate | 20 g |
| 23 | L-23 | $CH(CH_3){=}CH$ $COOCH_2CF_2CFHCF_3$ | 20 g | Vinyl acetate | 20 g |

Preparation Examples of Thermoplastic Resin Grain

PREPARATION EXAMPLE 1 OF THERMOPLASTIC RESIN GRAIN: (TL-1)

A mixed solution of 25 g of Dispersion Stabilizing Resin (Q-1) having the structure shown below, 35 g of methyl methacrylate, 50 g of methyl acrylate, 15 g of acrylic acid and 542 g of Isopar H was heated to a temperature of 60° C. under nitrogen gas stream while stirring. To the solution was added 0.8 g of 2,2'-azobis(isovaleronitrile) (abbreviated as AIVN) as a polymerization initiator, followed by reacting for 2 hours. Twenty minutes after the addition of the polymerization initiator, the reaction mixture became white turbid, and the reaction temperature rose to 88° C. Then, 0.5 g of the above-described initiator was added to the reaction mixture, the reaction were carried out for 2 hours and 0.3 g of the above-described initiator was further added thereto, followed by reacting for 3 hours. After cooling, the reaction mixture was passed through a nylon cloth of 200 mesh to obtain a white dispersion which was a monodispersed latex with a polymerization ratio of 90% and an average grain diameter of 0.25 μm. The grain diameter was measured by CAPA-500 manufactured by Horiba, Ltd. (hereinafter the same).

Dispersion Stabilizing Resin (Q-1)

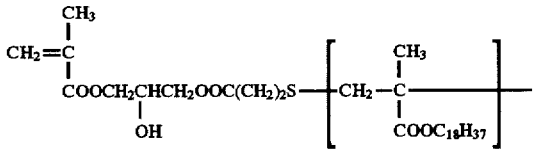

Mw $1.4\times10^4$

PREPARATION EXAMPLE 2 OF THERMOPLASTIC RESIN GRAIN: (TL-2)

(1) Preparation of Dispersion Stabilizing Resin (Q-2)

A mixed solution of 99.5 g of dodecyl methacrylate, 0.5 g of divinylbenzene and 200 g of toluene was heated to a temperature of 80° C. under nitrogen gas stream with stirring. To the solution was added 2 g of 2,2'-azobis (isobutyronitrile) (abbreviated as AIBN), followed by reaction for 3 hours, and 0.5 g of AIBN was further added thereto, followed by reacting for 4 hours. The resulting polymer had a solid content of 33.3% by weight and an Mw of $4\times10^4$.

(2) Preparation of Grain

A mixed solution of 18 g (as solid basis) of Dispersion Stabilizing Resin (Q-2) above, 95 g of vinyl acetate, 5 g of crotonic acid and 382 g of Isopar H was heated to a temperature of 80° C. under nitrogen gas stream with stirring. To the solution was added 1.6 g of AIVN, followed by reacting for 1.5 hours, 0.8 g of AIVN was added thereto, followed by reacting for 2 hours, and 0.5 g of AIVN was further added thereto, followed by reacting for 3 hours. Then, the temperature of the reaction mixture was raised to 100° C. and stirred for 2 hours to distil off the unreacted vinyl acetate. After cooling, the reaction mixture was passed through a nylon cloth of 200 mesh to obtain a white dispersion which was a monodispersed latex with a polymerization ratio of 87% and an average grain diameter of 0.26 μm.

PREPARATION EXAMPLE 3 OF THERMOPLASTIC RESIN GRAIN: (TL-3)

A mixed solution of 18 g of Dispersion Stabilizing Resin (Q-3) having the structure shown below, 10 g of acrylic acid, 50 g of methyl methacrylate, 40 g of ethyl acrylate, 2.6 g of methyl 3-mercaptopropionate and 546 g of Isopar H was reacted in the same procedure as in Preparation Example 1 of Thermoplastic Resin Grain above to obtain a white dispersion which was a monodispersed latex with a polymerization ratio of 93% and an average grain diameter of 0.20 μm.

Dispersion Stabilizing Resin (Q-3)

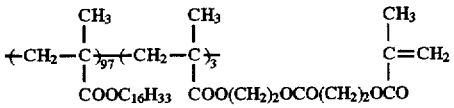

Mw 4 × 10⁴

PREPARATION EXAMPLE 4 OF THERMOPLASTIC RESIN GRAIN: (TL-4)

A mixed solution of 20 g of Dispersion Stabilizing Resin (Q-4) having the structure shown below, 135 g of Isopar H and 45 g of ethyl acetate was heated to a temperature of 60° C. under nitrogen gas stream with stirring. To the solution was dropwise added a mixed solution of 10 g of 2-phosphonoethyl methacrylate, 90 g of ethyl methacrylate, 1.5 g of thioglycolic acid, 0.6 g of AIVN, 75 g of Isopar H and 25 g of ethyl acetate over a period of one hour. After being reacted for one hour, 0.3 g of AIVN was added to the reaction mixture, followed by reacting for 2 hours, and 0.3 g of AIVN was further added thereto, followed by reacting for 3 hours. Then, the ethyl acetate was distilled off under a reduced pressure of 30 mm Hg and the equal volume of Isopar H to that of the removed ethyl acetate was added thereto. After cooling, the reaction mixture was passed through a nylon cloth of 200 mesh to obtain a white dispersion which was a monodispersed latex with a polymerization ratio of 93% and an average grain diameter of 0.28 μm.

Dispersion Stabilizing Resin (Q-4)

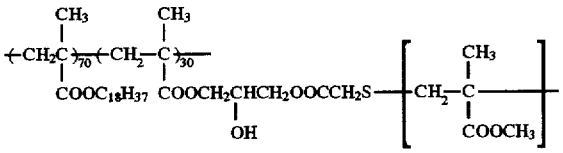

Mw 3.5 × 10⁴

PREPARATION EXAMPLES 5 TO 13 OF THERMOPLASTIC RESIN GRAIN: (TL-5) TO (TL-13)

Resin Grains (TL-5) to (TL-13) were prepared in the same procedure as in Preparation Example 3 of Thermoplastic Resin Grain above except for using the monomers shown in Table 9 below respectively. Each of the dispersions obtained exhibited a polymerization ratio of the latex grain of from 85 to 95% and an average grain diameter of from 0.15 to 0.25 μm with good monodispersity.

TABLE 9

| Preparation Example | Thermoplastic Resin Grain | Hydrophilic Group-Containing Monomer | Amount | Other Monomer | Amount |
|---|---|---|---|---|---|
| 5 | TL-5 | 2-Carboxyethyl methacrylate | 18 g | Methyl methacrylate<br>Methyl acrylate | 32 g<br>50 g |
| 6 | TL-6 | 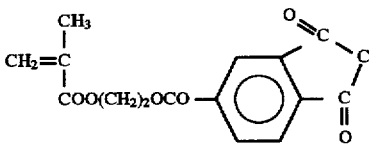 | 13 g | Ethyl methacrylate | 87 g |
| 7 | TL-7 | 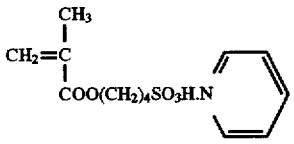 | 8 g | Ethyl methacrylate<br>Ethyl acrylate | 62 g<br>30 g |
| 8 | TL-8 | 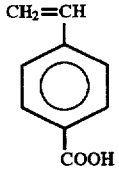 | 8 g | Styrene<br>4-Vinyltoluene | 30 g<br>62 g |
| 9 | TL-9 | Acrylic acid | 25 g | Ethyl methacrylate<br>Methyl acrylate | 25 g<br>50 g |
| 10 | TL-10 | Itaconic acid | 5 g | Methyl methacrylate<br>Methyl acrylate | 50 g<br>45 g |

TABLE 9-continued

| Preparation Example | Thermoplastic Resin Grain | Hydrophilic Group-Containing Monomer | Amount | Other Monomer | Amount |
|---|---|---|---|---|---|
| 11 | TL-11 | $CH_2{=}CH(COO(CH_2)_2O{-}P(=O)(OH){-}OCH_3)$ | 15 g | Ethyl methacrylate | 85 g |
| 12 | TL-12 | 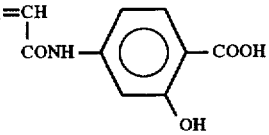 | 5 g | Ethyl methacrylate<br>Methyl acrylate | 45 g<br>50 g |
| 13 | TL-13 | Acrylic acid | 15 g | Butyl methacrylate | 85 g |

PREPARATION EXAMPLES 14 TO 17 OF THERMOPLASTIC RESIN GRAIN: (TL-14) TO (TL-17)

Resin Grains (TL-14) to (TL-17) were prepared in the same procedure as in Preparation Example 2 of Thermoplastic Resin Grain above except for using the monomers shown in Table 10 below respectively. Each of the dispersions obtained exhibited a polymerization ratio of the latex grain of from 85 to 95% and an average grain diameter of from 0.20 to 0.28 μm with good monodispersity.

TABLE 10

| Preparation Example | Thermoplastic Resin Grain | Hydrophilic Group-Containing Monomer | Amount | Other Monomer | Amount |
|---|---|---|---|---|---|
| 14 | TL-14 | $CH_2{=}CH(OCO(CH_2)_2COOH)$ | 8 g | Vinyl acetate | 92 g |
| 15 | TL-15 | Crotonic acid | 10 g | Vinyl acetate<br>Vinyl propionate | 70 g<br>20 g |
| 16 | TL-16 | 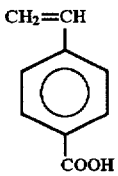 | 8 g | Vinyl acetate<br>Vinyl butyrate | 67 g<br>25 g |
| 17 | TL-17 | $CH_2{=}CH(OCO(CH_2)_2COOH)$ | 15 g | Vinyl acetate<br>Vinyl propionate | 60 g<br>25 g |

PREPARATION EXAMPLE 101 OF THERMOPLASTIC RESIN GRAIN: (TL-101)

A mixed solution of 10 g of Dispersion Stabilizing Resin (Q-1) described above, 15 g of Monomer (AM-1) having the structure shown below, 17.5 g of methyl methacrylate, and 273 g of Isopar H was heated to a temperature of 70° C. under nitrogen gas stream while stirring. To the solution was added 0.8 g of AIVN as a polymerization initiator, followed by reacting for 2 hours. Twenty minutes after the addition of the polymerization initiator, the reaction mixture became white turbid, and the reaction temperature rose to 88° C. Then, 0.5 g of the above-described initiator was added to the reaction mixture, the reaction were carried out for 2 hours and 0.3 g of the above-described initiator was further added thereto, followed by reacting for 3 hours. After cooling, the reaction mixture was passed through a nylon cloth of 200 mesh to obtain a white dispersion which was a monodispersed latex with a polymerization ratio of 90% and an average grain diameter of 0.25 μm.

Monomer (AM-1)

$$CH_2{=}CH(COOSi(iC_3H_7)_3)$$

PREPARATION EXAMPLE 102 OF THERMOPLASTIC RESIN GRAIN: (TL-102)

A mixed solution of 14 g (as solid basis) of Dispersion Stabilizing Resin (Q-2) described above, 80 g of vinyl acetate, 20 g of Monomer (AM-2) having the structure shown below, and 384 g of Isopar H was heated to a temperature of 80° C. under nitrogen gas stream with stirring. To the solution was added 1.6 g of AIVN, followed by reacting or 1.5 hours, 0.8 g of AIVN was added thereto, followed by reacting for 2 hours, and 0.5 g of AIVN was further added thereto, followed by reacting for 3 hours. Then, the temperature of the reaction mixture was raised to 100° C. and stirred for 2 hours to distil off the unreacted vinyl acetate. After cooling, the reaction mixture was passed through a nylon cloth of 200 mesh to obtain a white dispersion which was a monodispersed latex with a polymerization ratio of 87% and an average grain diameter of 0.22 μm.

Monomer (AM-2)

$CH_3—CH=CH—COO(CH_2)_2COCH_3$

PREPARATION EXAMPLE 103 OF THERMOPLASTIC RESIN GRAIN: (TL-103)

A mixed solution of 5 g of Dispersion Stabilizing Resin (Q-3) described above, 20 g of Monomer (AM-3) having the structure shown below, 14 g of methyl methacrylate, 14 g of methyl acrylate, 2 g of thioglycolic acid, and 278 g of Isopar H was reacted in the same procedure as in Preparation Example 101 of Thermoplastic Resin Grain above to obtain a white dispersion which was a monodispersed latex with a polymerization ratio of 93% and an average grain diameter of 0.26 μm.

Monomer (AM-3)

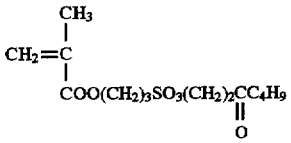

PREPARATION EXAMPLE 104 OF THERMOPLASTIC RESIN GRAIN: (TL-104)

A mixed solution of 20 g of Dispersion Stabilizing Resin (Q-4) described above, and 130 g of Isopar H was heated to a temperature of 75° C. under nitrogen gas stream with stirring. To the solution was dropwise added a mixed solution of 25 g of Monomer (AM-4) having the structure shown below, 25 g of butyl methacrylate, 0.6 g of AIBN, and 50 g of toluene over a period of one hour. After being reacted for one hour, 0.2 g of AIBN was added to the reaction mixture, followed by reacting for 2 hours, and 0.2 g of AIBN was further added thereto, followed by reacting for 3 hours. Then, the toluene was distilled off under a reduced pressure of 30 mm Hg and the equal volume of Isopar H to that of the removed toluene was added thereto. After cooling, the reaction mixture was passed through a nylon cloth of 200 mesh to obtain a white dispersion which was a monodispersed latex with a polymerization ratio of 93% and an average grain diameter of 0.19 μm.

Monomer (AM-4)

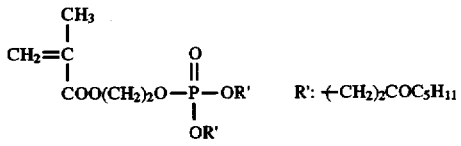

PREPARATION EXAMPLES 105 TO 117 OF THERMOPLASTIC RESIN GRAIN: (TL-105) TO (TL-117)

Resin Grains (TL-105) to (TL-117) were prepared in the same procedure as in Preparation Example 101 of Thermoplastic Resin Grain above except for using the monomers shown in Table 11 below respectively. Each of the dispersions obtained exhibited a polymerization ratio of the latex grain of from 85 to 95% and an average grain diameter of from 0.15 to 0.25 μm with good monodispersity.

TABLE 11

| Preparation Example | Thermoplastic Resin Grain | Monomer (AM) | Amount | Other Monomer | Amount |
|---|---|---|---|---|---|
| 105 | TL-105 | (AM-5) 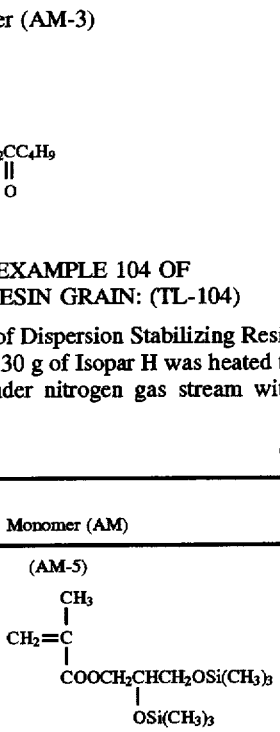 | 35 g | 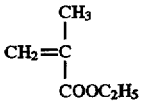 15 g | |
| 106 | TL-106 | (AM-6) 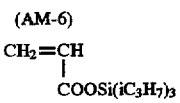 | 20 g | 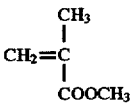 20 g | 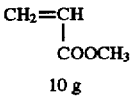 10 g |
| 107 | TL-107 | (AM-7) 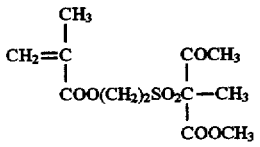 | 25 g | 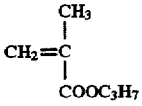 20 g | 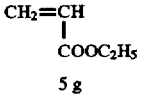 5 g |

TABLE 11-continued

| Preparation Example | Thermoplastic Resin Grain | Monomer (AM) | Amount | Other Monomer | Amount |
|---|---|---|---|---|---|
| 108 | TL-108 | (AM-8) 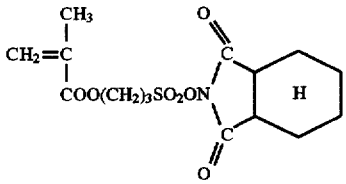 | 15 g | $CH_2=C(CH_3)COOC_4H_9$ 35 g | |
| 109 | TL-109 | (AM-9) $CH_2=C(CH_3)COO(CH_2)_3SO_2OCH(CH_3)C_6H_5$ | 20 g | $CH_2=C(CH_3)COOCH_3$ 15 g | $CH_2=CHCOOC_2H_5$ 15 g |
| 110 | TL-110 | (AM-10) $CH_2=CHCOO(CH_2)_2SO_2C_6H_{13}$ | 30 g | $CH_2=C(CH_3)COOC_2H_5$ 20 g | |
| 111 | TL-111 | (AM-11) $CH_2=C(CH_3)COOCH(CH_3)CH_2COC_4H_9$ | 40 g | $CH_2=CHCOOCH_3$ 10 g | |
| 112 | TL-112 | (AM-12) 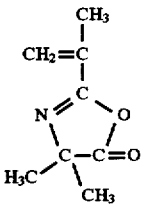 | 35 g | $CH_2=CHCOOC_2H_5$ 15 g | |
| 113 | TL-113 | (AM-13) $CH_2=CHCOO(CH_2)_2SO_3(CH_2)_2COOC_4H_9$ | 35 g | $CH_2=C(CH_3)COOC_4H_9$ 10 g | $CH_2=C(CH_3)COOC_2H_5$ 5 g |
| 114 | TL-114 | (AM-14) 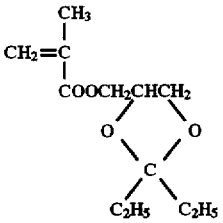 | 30 g | $CH_2=C(CH_3)COOC_2H_5$ 20 g | |

TABLE 11-continued

| Preparation Example | Thermoplastic Resin Grain | Monomer (AM) | Amount | Other Monomer | Amount |
|---|---|---|---|---|---|
| 115 | TL-115 | (AM-15) 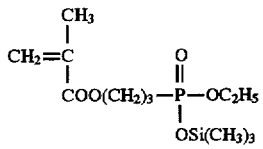 | 40 g | $CH_2=CH(COOC_2H_5)$ | 10 g |
| 116 | TL-116 | (AM-16) 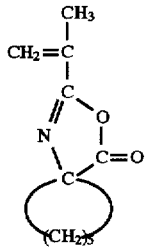 | 23 g | $CH_2=C(CH_3)COOCH_3$ | 25 g |
| | | | | $CH_2=C(CH_3)COOCH_2CH(C_2H_5)C_4H_9$ | 2 g |
| 117 | TL-117 | (AM-17) 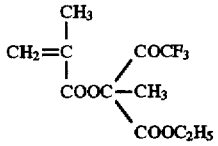 | 25 g | $CH_2=C(CH_3)COOC_3H_7$ | 25 g |

PREPARATION EXAMPLES 118 TO 128 OF THERMOPLASTIC RESIN GRAIN: (TL-118) TO (TL-128)

Resin Grains (TL-118) to (TL-128) were prepared in the same procedure as in Preparation Example 104 of Thermoplastic Resin Grain above except for replacing Dispersion Stabilizing Resin (Q-4), Monomer (AM-4) and butyl methacrylate with each of the dispersion stabilizing resins and monomers each shown in Table 12 below respectively. Each of the dispersions obtained exhibited a polymerization ratio of the latex grain of from 85 to 95% and an average grain diameter of from 0.15 to 0.25 μm with good monodispersity.

TABLE 12

Dispersion Stabilizing Resin (Q)

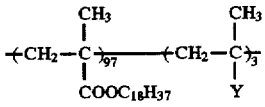

(Mw of each of Dispersion Stabilizing Resins (Q) was in a range of from $3 \times 10^4$ to $5 \times 10^4$)

| Preparation Example | Resin Grain | Chemical Structure of —Y— in Resin (Q) | Amount | Monomer | Amount |
|---|---|---|---|---|---|
| 118 | TL-118 | (Q-5) 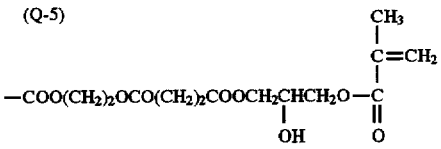 | 4 g | (AM-18) 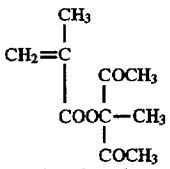 | 15 g |
| | | | | Butyl methacrylate | 35 g |

TABLE 12-continued

Dispersion Stabilizing Resin (Q)

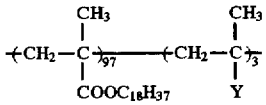

(Mw of each of Dispersion Stabilizing Resins (Q) was in a range of from $3 \times 10^4$ to $5 \times 10^4$)

| Preparation Example | Resin Grain | Chemical Structure of −Y− in Resin (Q) | Amount | Monomer | Amount |
|---|---|---|---|---|---|
| 119 | TL-119 | (Q-6)<br>$-CONH(CH_2)_{11}COOCH{=}CH_2$ | 3 g | (AM-19)<br>$CH_2{=}CH{-}OCO(CH_2)_2COO(CH_2)_2COC_2H_5$<br>Vinyl acetate | 10 g<br><br>40 g |
| 120 | TL-120 | (Q-7)<br> 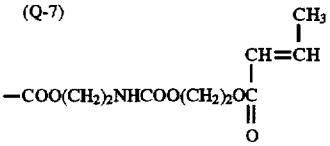 | 3 g | (AM-20)<br> 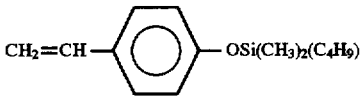 <br>Vinyl acetate | 35 g<br><br>15 g |
| 121 | TL-121 | (Q-8)<br> 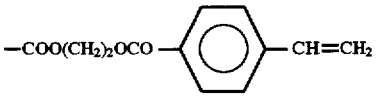 | 5 g | (AM-21)<br> 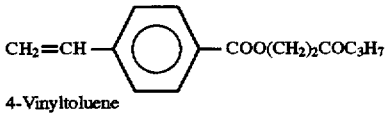 <br>4-Vinyltoluene | 15 g<br><br>35 g |
| 122 | TL-122 | (Q-8) | 6 g | (AM-22)<br> 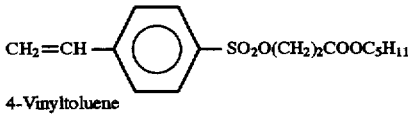 <br>4-Vinyltoluene | 20 g<br><br>30 g |
| 123 | TL-123 | (Q-9)<br>$-COO(CH_2)_2OCO(CH_2)_3COOCH_2CH{=}CH_2$ | 8 g | (AM-23)<br>$CH_3$<br>$CH{=}CH{-}COOSi(C_3H_7)_3$<br>Methyl methacrylate<br>Ethyl acrylate | 20 g<br><br><br>22 g<br>8 g |
| 124 | TL-124 | (Q-10)<br>$-COO(CH_2)_2NHCOO(CH_2)_2OOC{-}CH{=}CH_2$ | 5 g | (AM-24)<br> 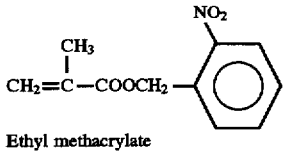 <br>Ethyl methacrylate<br>Methyl acrylate | 30 g<br><br>10 g<br>10 g |
| 125 | TL-125 | (Q-5) | 5 g | (AM-25)<br> 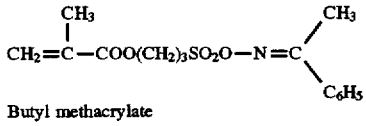 <br>Butyl methacrylate | 15 g<br><br>35 g |
| 126 | TL-126 | (Q-11)<br> 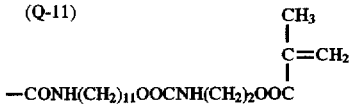 | 4.5 g | (AM-26)<br> 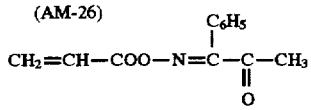 <br>Propyl methacrylate | 18 g<br><br>32 g |

TABLE 12-continued

Dispersion Stabilizing Resin (Q)

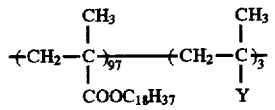

(Mw of each of Dispersion Stabilizing Resins (Q) was in a range of from $3 \times 10^4$ to $5 \times 10^4$)

| Preparation Example | Resin Grain | Chemical Structure of −Y− in Resin (Q) | Amount | Monomer | Amount |
|---|---|---|---|---|---|
| 127 | TL-127 (Q-5) | | 3.5 g | (AM-27) 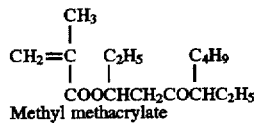 | 40 g |
| | | | | Methyl methacrylate | 10 g |
| 128 | TL-128 (Q-6) | | 4 g | (AM-28) 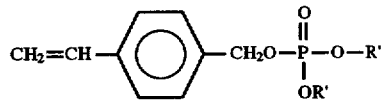 R' = $-(CH_2)_2COC_5H_{11}$ | 25 g |
| | | | | Vinyl acetate | 25 g |

EXAMPLE I-1

A mixture of 2 g of X-form metal-free phthalocyanine (manufactured by Dainippon Ink and Chemicals, Inc.), 10 g of Binder Resin (B-1) having the structure shown below, 0.15 g of Compound (A) having the structure shown below, and 80 g of tetrahydrofuran was put in a 500 ml-volume glass container together with glass beads and dispersed in a paint shaker (manufactured by Toyo Seiki Seisakusho Co.) for 60 minutes. To the dispersion were added 0.2 g of Resin (P-2), 0.03 g of phthalic anhydride, and 0.001 g of o-chlorophenol, followed by further dispersing for 2 minutes. The glass beads were separated by filtration to prepare a dispersion for a light-sensitive layer.

Binder Resin (B-1)

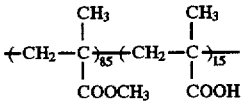

(weight ratio)

Mw $6.5 \times 10^4$

Compound (A)

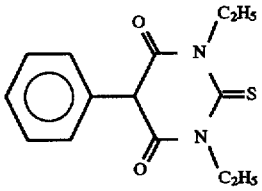

The dispersion was coated on a base paper for paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer further having a thickness of 8 μm.

A 3% by weight tetrahydrofuran solution of Resin (A-1) having the structure shown below was coated on the light-sensitive layer by a wire bar at a dry thickness of 3.5 μm and dried in an over at 120° C. for 20 seconds to form a transfer layer.

Resin (A-1)

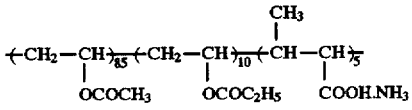

Mw $8 \times 10^4$ (weight ratio)

The resulting light-sensitive material was evaluated for image forming properties and transfer properties as follows.

The light-sensitive material was charged to +450 V with a corona discharge in dark and exposed to light of a gallium-aluminum-arsenic semiconductor laser (output: 5 mW; oscillation wavelength: 780 nm) at an irradiation dose (on the surface of the light-sensitive material) of 30 erg/cm$^2$, a pitch of 25 μm, and a scanning speed of 300 cm/sec. The scanning exposure was in a negative mirror image mode based on the digital image data of an original read by a color scanner and memorized in a hard disc.

Thereafter, the light-sensitive material was immersed in Liquid Developer (LD-1) prepared in the manner as described below in a developing machine having a pair of flat development electrodes, and a bias voltage of +400 V was applied to the electrode on the side of the light-sensitive material to thereby electrodeposit toner particles on the exposed areas (reversal development). The light-sensitive material was then rinsed in a bath of Isopar H to remove any stains on the non-image areas.

Preparation of Liquid Developer (LD-1)

1) Synthesis of Toner Particles

A mixed solution of 60 g of methyl methacrylate, 40 g of methyl acrylate, 20 g of a dispersion polymer having the structure shown below, and 680 g of Isopar H was heated to 65° C. under nitrogen gas stream with stirring. To the solution was added 1.2 g of 2,2'-azobis(isovaleronitrile) (AIVN), followed by allowing the mixture to react for 2 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95%, and the resulting dispersion had an average grain diameter of resin grain of 0.25 μm (grain diameter being measured by CAPA-500 manufactured by Horiba, Ltd.) and good monodispersity.

Chemical Structure of Dispersion Polymer

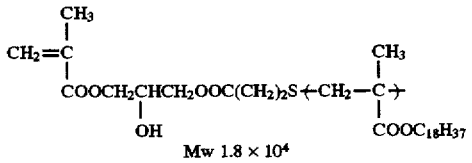

2) Preparation of Colored Particles

Ten grams of a tetradecyl methacrylate/methacrylic acid copolymer (95/5 ratio by weight), 10 g of nigrosine, and 30 g of isopar G were put in a paint shaker (manufactured by Toyo Seiki Seisakusho Co.) together with glass beads and dispersed for 4 hours to prepare a fine dispersion of nigrosine.

3) Preparation of Liquid Developer

A mixture of 45 g of the above-prepared toner particle dispersion, 25 g of the above-prepared nigrosine dispersion, 0.6 g of a hexadecene/maleic acid monooctadecylamide copolymer, and 15 g of FOC 1800 was diluted with 1 l of Isopar G to prepare a liquid developer for electrophotography.

The light-sensitive material was then subjected to fixing by means of a heat roll whereby the toner image thus-formed was fixed.

An aluminum substrate used for the production of FUJI PS-Plate, FPD (manufactured by Fuji Photo Film Co., Ltd.) and the thus-developed light-sensitive material were superposed each other, and they were passed through between a pair of rubber rollers having a nip pressure of 15 kgf/cm$^2$ at a speed of 10 mm/sec. The surface temperature of the rollers was controlled to maintain constantly at 140° C.

After cooling the both materials in contact with each other to room temperature, the aluminum substrate was stripped from the light-sensitive material. The image formed on the aluminum substrate was visually evaluated for fog and image quality. As a result it was found that the whole toner image on the light-sensitive material was heat-transferred together with the transfer layer onto the aluminum substrate to provide a clear image without background stain on the aluminum substrate which showed substantially no degradation in image quality as compared with the original.

It is believed that such an excellent transfer of the transfer layer is due to migration of the fluorine atom-containing copolymer in the photoconductive layer to its surface portion during the formation of the photoconductive layer and due to chemical bonding between the binder resin (B) and the resin (P) by the action of the crosslinking agent to form a cured film. Thus, a definite interface having a good release property was formed between the photoconductive layer surface and the transfer layer.

Then, the plate of the aluminum substrate having thereon the transfer layer was subjected to an oil-desensitizing treatment (i.e., removal of the transfer layer) to prepare a printing plate and its printing properties were evaluated. Specifically, the plate was immersed in Oil-Desensitizing Solution (E-1) having the composition shown below at 30° C. for 1 minute to remove the transfer layer, thoroughly washed with water, and gummed to obtain an offset printing plate.

Oil-Desensitizing Solution (E-1)

| | |
|---|---|
| Monoethanolamine | 60 g |
| Neosoap (manufactured by Matsumoto Yushi K. K.) | 8 g |
| Benzyl alcohol | 100 g |
| Distilled water | to make 1.0 l |
| Potassium hydroxide | to adjust to pH 13.0 |

The printing plate thus prepared was observed visually using an optical microscope (×200). It was found that the non-image areas had no residual transfer layer, and the image areas suffered no defects in high definition regions (i.e., cut of fine lines and fine letters).

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with a clear image free from background stains were obtained irrespective of the kind of color inks.

When the printing plate was exchanged for an ordinary PS plate and printing was continued under ordinary conditions, no trouble arose. It was thus confirmed that the printing plate of the present invention can share a printing machine with other offset printing plates such as PS plates.

As described above, the offset printing plate according to the present invention exhibits excellent performance in that an image formed by a scanning exposure system using semiconductor laser beam has excellent image reproducibility and the image of the plate can be reproduced on prints with satisfactory quality, in that the plate exhibits sufficient color ink receptivity without substantial ink-dependency to enable to perform full color printing with high printing durability, and in that it can share a printing machine in printing with other offset printing plates without any trouble.

EXAMPLES I-2 TO I-15

A printing plate was prepared in the same manner as in Example I-1, except for replacing Resin (A-1) in the transfer layer and Resin (P-2) in the photoconductive layer with each of the resins (A) and the resins (P), respectively, shown in Table I-1 below and replacing Oil-Desensitizing Solution (E-1) with a commercially available PS plate processing solution (DP-4 manufactured by Fuji Photo Film Co., Ltd.; hereinafter referred to as Oil-Desensitizing Solution (E-2)).

TABLE I-1

| Example | Resin (P) | Resin (A) | Chemical Structure of Resin (A) (weight ratio) |
|---|---|---|---|
| I-2 | P-11 | A-2 | $-(CH_2-CH)_{83}-(CH_2CH)_{10}-(CH_2CH)_{7}-$ ($OCOCH_3$, $OCOC_3H_7$, $CH_2COOH$) |
| I-3 | P-12 | A-3 | $-(CH_2CH)_{86}-(CH_2CH)_{8}-(CH-CH)_{6}-$ ($CH_3$; $OCOCH_3$, $OCOC_{11}H_{23}$, $COOH$) |
| I-4 | P-19 | A-4 | $-(CH_2CH)_{40}-(CH_2CH)_{50}-(CH_2-CH)_{10}-$ ($CH_3$, $COOH$) |
| I-5 | P-25 | A-5 | $-(CH_2-C)_{42}-(CH_2CH)_{50}-(CH_2-C)_{8}-$ ($CH_3$; $COOCH_3$, $COOCH_3$, $COOH$) |
| I-6 | P-30 | A-6 | $-(CH_2-C)_{30}-(CH_2CH)_{50}-(CH_2-CH)_{20}-$ ($CH_3$; $COOCH_3$, $COOCH_3$, $COOH$) |
| I-7 | P-31 | A-7 | $-(CH_2-C)_{27}-(CH_2CH)_{40}-(CH_2-CH)_{33}-$ ($CH_3$; $COOCH_3$, $COOC_2H_5$, $COO(CH_2)_2OCO(CH_2)_2COOH$) |
| I-8 | P-32 | A-8 | $-(CH_2-C)_{92}-(CH_2C)_{8}-$ ($CH_3$; $COOC_4H_9$, $COO(CH_2)_3SO_3H$) |
| I-9 | P-33 | A-9 | $-(CH_2-C)_{50}-(CH_2CH)_{40}-(CH_2-C)_{10}-$ ($CH_3$; $COOCH_2C_6H_5$, $COOCH_2C_6H_5$, $COO(CH_2)_2OP(=O)(OH)-OH$) |
| I-10 | P-34 | A-10 | $-(CH_2-C)_{45}-(CH_2CH)_{35}-(CH_2CH)_{20}-$ ($CH_3$; $COOC_2H_5$, $COOCH_3$, $OH$) |

TABLE I-1-continued

| Example | Resin (P) | Resin (A) | Chemical Structure of Resin (A) (weight ratio) |
|---|---|---|---|
| I-11 | P-35 | A-11 | $-(CH_2-CH)_{50}-(CH_2-C(CH_3))_{35}-(CH_2CH)_{15}-$ ($COOC_4H_9$; $COOCH_2C_6H_5$; $CONH-C_6H_3(OH)-COOH$) |
| I-12 | P-36 | A-12 | $-(CH_2-C(CH_3))_{45}-(CH_2CH)_{30}-(CH_2-C(CH_3))_{25}-$ ($COOC_2H_5$; $COOC_4H_9$; $COO(CH_2)_2OCO-C_6H_3$ 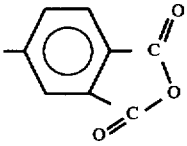 ) |
| I-13 | P-38 | A-13 | $-(CH_2-C(CH_3))_{25}-(CH_2CH)_{50}-(CH_2CH)_{25}-$ ($COOCH_3$; $COOC_2H_5$; $COO(CH_2)_2COOH$) |
| I-14 | P-1 | A-14 | $-(CH_2CH)_{65}-(CH_2CH)_{20}-(CH_2CH)_{15}-$ ($OCOCH_3$; $OC_2H_5$; $OCO(CH_2)_2COOH$) |
| I-15 | P-9 | A-15 | $-(CH_2CH)_{90}-(CH_2CH)_{5}-(CH(CH_3)-CH)_{5}-$ ($OCOCH_3$; $OCOC_5H_{11}$; $COOH$) |

Mw of each of the resins (A) in the table above was in a range of from $3 \times 10^4$ to $6 \times 10^4$.

Each of the resulting printing plates was evaluated for various properties in the same manner as in Example I-1. The results obtained were similar to those in Example I-1. Specifically, more than 60,000 prints with a clear image free from background stains were obtained.

EXAMPLE I-16

1.0 part of a trisazo compound having the structure shown below as a charge generating agent, 2.0 parts of a hydrazone compound having the structure shown below as an organic photoconductive compound, 10 parts of Copolymer (B-2) having the structure shown below, 1 part of Resin (P-30), and 100 parts of tetrahydrofuran were put in a 500 ml-volume glass container together with glass beads and dispersed in a paint shaker for 60 minutes. To the dispersion were added 0.02 part of phthalic anhydride and 0.001 part of o-chlorophenol, and the mixture was further dispersed for 10 minutes. The glass beads were separated by filtration to prepare a dispersion for a photoconductive layer.

Trisazo Compound

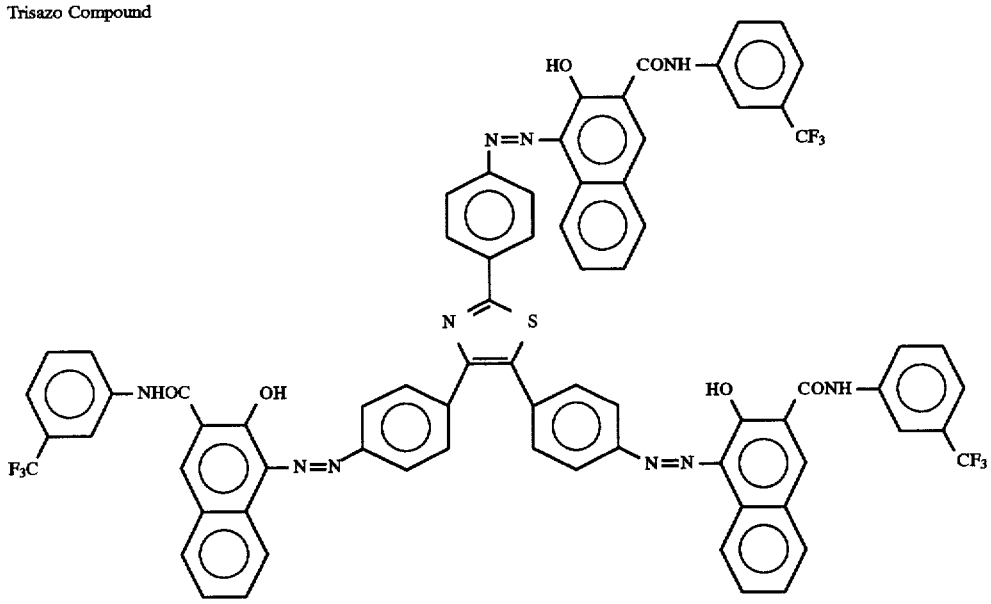

Hydrazone Compound

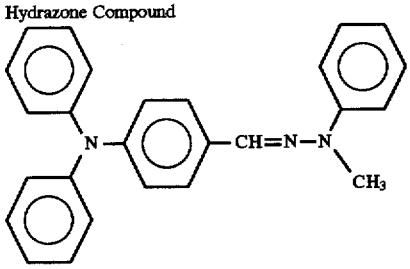

Copolymer (B-2)

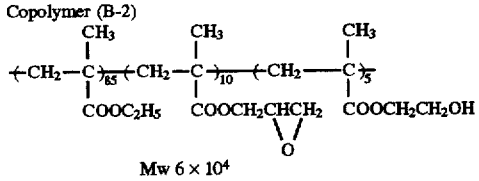

Mw $6 \times 10^4$

The dispersion for photoconductive layer was coated on an aluminum plate having a thickness of 0.25 mm, which had been surface-grained, dried at 100° C. for 30 seconds and then heated at 140° C. for 1 hour to prepare an electrophotographic light-sensitive element having a photoconductive layer having a dry thickness of 5.1 μm.

A mixed solution of 3 g of Resin (A-16) having the structure shown below, 1 g of polyvinyl acetate, and 100 ml of tetrahydrofuran was coated on the photoconductive layer with a wire bar at a dry thickness of 4 μm and dried at 100° C. for 20 seconds to form a transfer layer.

Resin (A-16)

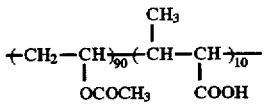

Mw $7 \times 10^4$

The light-sensitive material was charged to a surface potential of +450 V in dark, exposed to light of an He—Ne laser (oscillation wavelength: 633 nm) in an exposure amount of 30 erg/cm$^2$ (on the surface thereof), and developed using Liquid Developer (LD-2) prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent with a bias voltage of 30 V applied to the counter electrode to form a toner image thereon. The toner image was fixed by heating at 100° C. for 30 minutes.

The toner image and the transfer layer were transferred onto an aluminum substrate of PS plate (FPD) and then subjected to an oil-desensitizing treatment in the same manner as in Example I-1 to obtain a printing plate.

Printing was performed using the printing plate thus-obtained in the same manner as in Example I-1. As a result, 60,000 prints of a clear image free from background stains were obtained. When printing test was carried out using various printing inks as in Example I-1, the printing performances were equally good and color ink-dependency was not observed.

EXAMPLE I-17

5 g of 4,4'-bis(diethylamino)-2,2'-dimethyltriphenylmethane as an organic photoconductive substance, 5 g of a polyester resin (Vylon 200 manufactured by Toyobo Co., Ltd.), 40 mg of Dye (D-1) having the structure shown below, and 0.2 g of Anilide Compound (B) having the structure shown below as a chemical sensitizer were dissolved in a mixed solvent of 30 ml of methylene chloride and 30 ml of ethylene chloride to prepare a light-sensitive solution.

Dye (D-1)

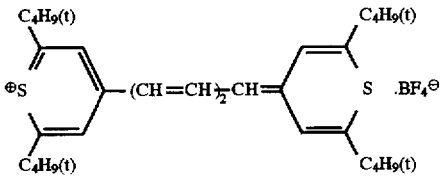

Anilide Compound (B)

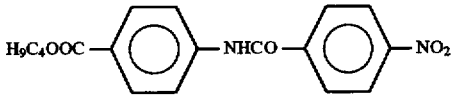

The light-sensitive solution was coated on a conductive transparent substrate composed of a 100 μm thick polyethylene terephthalate film having a deposited layer of indium oxide thereon (surface resistivity: $10^3\Omega$) by a wire round rod to prepare a light-sensitive element having an organic light-sensitive layer having a thickness of about 4 μm.

A solution having the composition shown below was coated on the light-sensitive layer with a wire bar at a dry thickness of 2.0 μm, dried in an oven at 100° C. for 20 seconds and then heated at 120° C. for 1 hour. The coating film was allowed to stand in dark at 20° C. and 65% RH for 24 hours to prepare an electrophotographic light-sensitive element having an overcoat layer for imparting a release property.

Overcoat Solution

| | |
|---|---|
| Methyl methacrylate/3-(trimethoxysilyl)-propyl methacrylate (70/30) copolymer (Mw: $4\times10^4$) | 3 g |
| Resin (P-2) | 0.15 g |
| Crosslinking compound having the following structure: | 0.01 g |
| 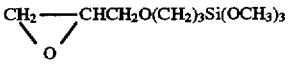 | |
| Dibutyltin dilaurate | 0.002 g |
| Toluene | 100 g |

On the surface of the thus-prepared light-sensitive element was coated a 3% by weight tetrahydrofuran solution of Resin (A-17) having the structure shown below with a wire bar at a dry thickness of 2.0 μm and dried at 100° C. for 20 seconds.

Resin (A-17)

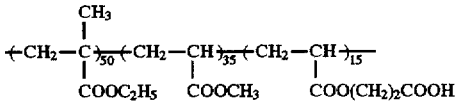

Mw $2\times10^4$

The resulting light-sensitive material was subjected to image formation, oil-desensitizing treatment and printing in the same manner as in Example I-16. The excellent results similar to those of Example I-16 were obtained.

EXAMPLE I-18

A mixture of 200 g of photoconductive zinc oxide, 80 g of Binder Resin (B-3) having the structure shown below, 8 g of Resin (P-25), 0.018 g of Dye (D-2) having the structure shown below, 0.20 g of N-hydroxysuccinimide, and 300 g of toluene was dispersed in a homogenizer (manufactured by Nippon Seiki K.K.) at a rotation of $1\times10^3$ rpm for one minute.

Binder Resin (B-3)

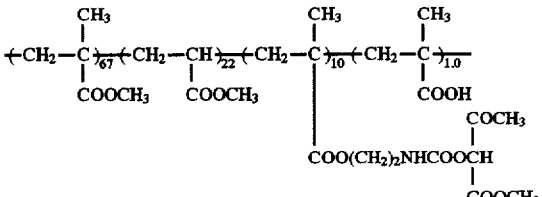

Mw $7.6\times10^4$

Dye (D-2)

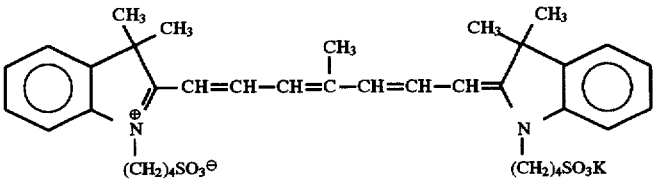

The dispersion was coated on a base paper for paper master having a thickness of 0.2 mm, which had been subjected to electrically conductive treatment and solvent-resistant treatment, by a wire bar, set to touch, and heated in an circulating oven at 110° C. for 1 hour to form a light-sensitive layer having a thickness of 10 μm.

In order to confirm localization of the block copolymer according to the present invention in the surface portion of the light-sensitive layer, an adhesion test using an adhesive tape was conducted. It was found as a result that the adhesion of the light-sensitive layer was one-sixtieth that of a sample prepared in the same manner but containing no block copolymer (P-25).

A solution of 3 g of Resin (A-6) described above, 0.3 g of cellulose acetate butyrate (Cellidor Bsp manufactured by Bayer A.G.), and 100 ml of tetrahydrofuran was coated on the light-sensitive layer by a wire rod at a dry thickness of 2.2 μm and dried at 100° C. for 15 seconds to form a transfer layer.

When an adhesive tape was adhered on the surface of the transfer layer and then stripped, the transfer layer was easily released from the surface of the light-sensitive layer without any perceptible resistance.

The resulting light-sensitive material was charged to −600 V with a corona discharge in dark and exposed to a semiconductor laser beam (780 nm) at a surface exposure amount of 25 erg/cm$^2$ using the same digital image data as in Example I-1. The residual potential of the exposed area was −120 V. The light-sensitive material was developed with Liquid Developer (LD-1) described above in a developing machine having a pair of flat development electrodes with a bias voltage of −200 V being applied to the electrode on the light-sensitive material side to thereby electrodeposit the toner particles on the non-exposed areas (normal development). The light-sensitive material was then rinsed in a bath of Isopar H to remove-stains on the non-image areas.

A straight master (manufactured by Mitsubishi Paper Mills, Ltd.), as a receiving material, was superposed on the developed light-sensitive material with its image-receiving layer side being in contact with the light-sensitive material, and they were passed through a pair of rubber rollers whose surface temperature was kept constantly at 120° C. at a speed of 6 mm/sec under a nip pressure of 10 kgf/cm$^2$.

After cooling the both materials while in contact with each other to room temperature, the straight master was stripped from the light-sensitive material whereby the whole toner image on the light-sensitive material was thermally transferred together with the transfer layer to the straight master. There was observed little difference in image quality between the toner image before the heat-transfer and that transferred on the straight master.

The straight master was then treated with Oil-Desensitizing Solution (E-3) prepared by adding 50 g of dimethylethanolamine to 1 liter of PS plate processing solution (DP-4) described above at a temperature of 35° C. for 2 minutes to remove the transfer layer.

The non-image areas and toner image areas of the thus obtained printing plate were visually observed using an optical microscope (×200). No residual transfer layer was observed on the non-image areas, and no image defect was observed in high definition regions (i.e., cut of fine lines and fine letters).

The printing plate was subjected to printing on neutral paper with various offset printing color inks using an offset printing machine (Ryobi 3200 MCD manufactured by Ryobi K.K.), and an aqueous solution (pH: 7.0) prepared by diluting dampening water for PS plate (SG-23 manufactured by Tokyo Ink K.K.) 130-fold with distilled water, as dampening water. As a result, more than 3,000 prints with a clear image free from background stains were obtained irrespective of the kind of color inks.

EXAMPLES I-19 TO I-25

An electrophotographic light-sensitive material having provided with a transfer layer was prepared in the same manner as in Example I-18, except for using 60 g of Binder Resin (B), 7 g of Resin (P), and the prescribed amount of crosslinking compound each shown in Table I-2 below. A printing plate was then prepared in the same manner as in Example I-18. As a result of evaluating the performances of the resulting printing plates, excellent results similar to those of Example I-18 were obtained.

TABLE I-2

| Example | Binder Resin (B) | Resin (P) | Crosslinking Compound | |
|---|---|---|---|---|
| I-19 | (B-4) 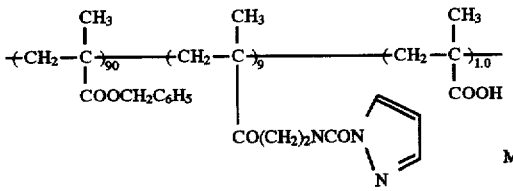 Mw 8 × 10$^4$ | P-5 | 1,6-Hexanediamine | 0.4 g |

TABLE I-2-continued

| Example | Binder Resin (B) | Resin (P) | Crosslinking Compound | |
|---|---|---|---|---|
| I-20 | (B-5) 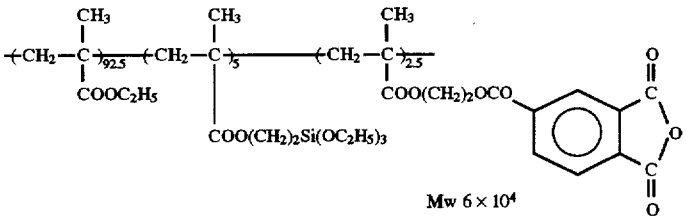 Mw $6\times10^4$ | P-12 | γ-Glycidopropyl-trimethoxysilane | 0.6 g |
| I-21 | (B-6) 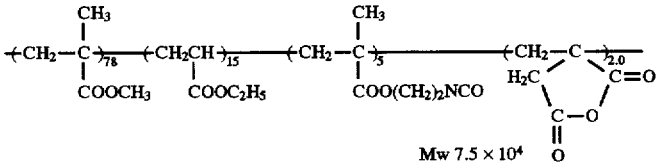 Mw $7.5\times10^4$ | P-25 | 1,4-Butanediol<br>Dibutoxytin dilaurate | 0.3 g<br>0.001 g |
| I-22 | (B-7) 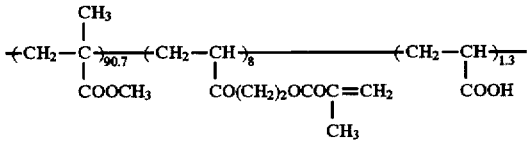 Mw $9\times10^4$ | P-13 | Ethylene glycol dimethacrylate | 2.0 g |
| | | | 2,2'-Azobis(iso-valeronitrile) | 0.03 g |
| I-23 | (B-8) 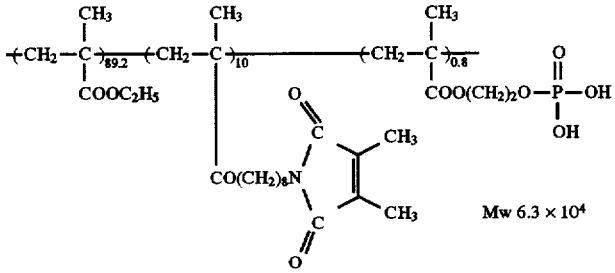 Mw $6.3\times10^4$ | P-16 | Benzoyl peroxide | 0.008 g |
| I-24 | (B-9) 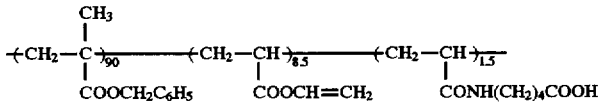 Mw $9.5\times10^4$ | P-15 | Divinyl adipate<br>2,2'-Azobis(iso-butyronitrile) | 2.2 g<br>0.01 g |
| I-25 | (B-10) 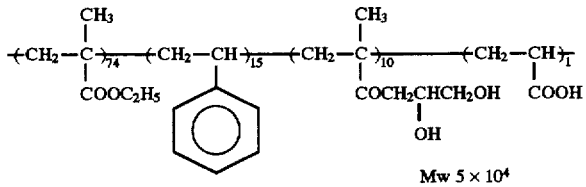 Mw $5\times10^4$ | P-4 | Block isocyanate (Barnock D-500 manufactured by DIK K.K.) | 3 g |
| | | | Butyl titanate dimer | 0.02 g |

EXAMPLES I-26 TO I-29

An electrophotographic light-sensitive material having provided with a transfer layer was prepared in the same manner as in Examples I-1, I-16, I-17, and I-18, except that Resin Grain (L) shown in Table I-3 below was used in place of Resin (P) used in the respective Example and that the transfer layer was formed as follows.

Formation of Transfer Layer

A solution of 3 g of Resin (A-1) described above, 0.08 g of a silicone oil (KF-69 manufactured by Shin-etsu Silicone K.K.), and 100 ml of toluene was coated by a wire rod at a dry thickness of 2.0 μm and dried at 110° C. for 10 seconds.

With each light-sensitive material the toner image formation and heat transfer of the transfer layer were conducted in the same manner as in the respective Example. The resulting printing plate precursor was treated with Oil-Desensitizing Solution (E-4) prepared as follows at 40° C. for 2 minutes to remove the transfer layer.

Oil-Desensitizing Solution E-4

A mixture of 30 g of N,N-di(2-hydroxyethyl)amine and 80 g of pyrrolidone was diluted with distilled water to make 1.0 l and then adjusted to pH of 13.5 with sodium hydroxide.

Printing was carried out using each of the resulting printing plates under the same conditions as in the respective Example. The number of the prints obtained with a clear image free from background stains (printing durability) is also shown in Table I-3.

TABLE I-3

| Example | Basis Example | Resin Grain (L) | Amount | Printing Durability |
|---|---|---|---|---|
| I-26 | I-1 | L-3 | 0.5 g | 60,000 |
| I-27 | I-16 | L-19 | 1 g | 60,000 |
| I-28 | I-17 | L-17 | 0.2 g | 60,000 |
| I-29 | I-18 | L-21 | 5 g | 3,500 |

EXAMPLES I-30 TO I-41

An electrophotographic light-sensitive material was prepared in the same manner as in Example I-29, except for replacing 5 g of Resin Grain (L-21) with 4 g (solid basis) of each of Resin Grains (L) shown in Table I-4 below.

TABLE I-4

| Example | Resin Grain (L) | Example | Resin Grain (L) |
|---|---|---|---|
| I-30 | L-3 | I-36 | L-14 |
| I-31 | L-4 | I-37 | L-15 |
| I-32 | L-6 | I-38 | L-16 |
| I-33 | L-9 | I-39 | L-18 |
| I-34 | L-10 | I-40 | L-19 |
| I-35 | L-11 | I-41 | L-22 |

Each of the resulting light-sensitive materials was processed in the same manner as in Example I-18 to prepare a printing plate. As a result of evaluating the performances of the resulting printing plates, excellent results similar to those of Example I-18 were obtained.

EXAMPLES I-42 TO I-52

A mixture of 40 g of Binder Resin B-11 having the structure shown below, 4 g of Resin (P) or Resin Grain (L) shown in Table I-5 below, 200 g of photoconductive zinc oxide, 0.02 g of uranine, 0.04 g of Rose Bengale, 0.03 g of Bromophenol Blue, 0.15 g of salicylic acid, and 300 g of toluene was dispersed in a homogenizer (manufactured by Nippon Seiki K.K.) at a rotation of $9\times10^3$ rpm for 10 minutes.

Binder Resin (B-11)

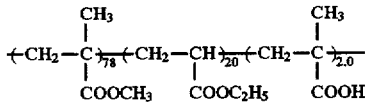

Mw $6.5\times10^4$

To the dispersion was added each of the crosslinking compounds shown in Table I-5 below, and the mixture was dispersed at a rotation of $1\times10^3$ rpm for 1 minute to prepare a coating composition for a light-sensitive layer. The coating composition was coated on paper, which had been subjected to electrically conductive treatment, by a wire bar at a dry coverage of 25 g/m$^2$, dried at 100° C. for 30 seconds and then heated at 140° C. for 1 hour to prepare an electrophotographic light-sensitive element.

TABLE I-5

| Example | Resin (P) or Resin Grain (L) | Crosslinking Compound | Amount |
|---|---|---|---|
| I-42 | P-19 | Phthalic anhydride | 0.2 g |
| | | Acetylacetonatozirconium | 0.01 g |
| I-43 | P-22 | Gluconic acid | 0.008 g |
| I-44 | P-25 | N-Methylaminopropanol | 0.25 g |
| | | Dibutyltin dilaurate | 0.001 g |
| I-45 | P-9 | N,N'-Dimethylaminopropylamine | 0.3 g |
| I-46 | P-7 | Propylene glycol | 0.2 g |
| | | Tetrakis(2-ethylhexane-diolato)titanium | 0.008 g |
| I-47 | L-18 | — | |
| I-48 | L-15 | N,N-Dimethylpropylamine | 0.25 g |
| I-49 | I-13 | Divinyl adipate | 0.3 g |
| | | 2,2'-Azobis(isobutyronitrile) | 0.001 g |
| I-50 | P-6 | Propyltriethoxysilane | 0.01 g |
| I-51 | L-21 | N,N-Diethylbutanediamine | 0.3 g |
| I-52 | P-22 | Ethylene diglycidyl ether | 0.2 g |
| | | o-Chlorophenol | 0.001 g |

A solution consisting of 3 g of Resin (A-7) described above, and 100 ml of ethylene glycol monomethyl ether was coated on the surface of the resulting light-sensitive element by a wire rod at a dry thickness of 4.0 μm and dried to form a transfer layer. The coated light-sensitive material was allowed to stand in dark at 20° C. and 65% RH for 24 hours.

The light-sensitive material was charged to −600 V with a corona discharge in dark and subjected to contact exposure to visible light through a positive image film. Then it was developed with Liquid Developer (LD-1) described above using the same liquid developing machine as used in Example I-18 with a bias voltage of −250 V applied to the electrode of the light-sensitive material side. The light-sensitive material was rinsed in a bath of Isopar G to remove stains on the non-image areas and then heated at a temperature of 80° C. for 1 minute to fix the toner image.

A printing plate was prepared by conducting transfer using the resulting developed light-sensitive material and a straight master as a receiving material and oil-desensitizing treatment in the same manner as in Example I-18. As a result of evaluation on printing properties in the same manner as in Example I-18, each printing plate of Examples I-42 to I-52 exhibited good results similar to those of Example I-18, and printing durability of at least 3,000 prints.

EXAMPLES I-53 TO I-60

A 3% by weight tetrahydrofuran solution of each of Resins (A) shown in Table I-6 shown below was coated on the surface of an amorphous silicon electrophotographic light-sensitive element by a wire rod at a dry thickness of 4.5 μm and set to touch to form a transfer layer.

TABLE I-6

| Example | Resin (A) | Example | Resin (A) |
|---|---|---|---|
| I-53 | A-2 | I-57 | A-9 |
| I-54 | A-5 | I-58 | A-11 |
| I-55 | A-7 | I-59 | A-14 |
| I-56 | A-8 | I-60 | A-17 |

A toner image was formed on each of the light-sensitive materials in the same manner as the evaluation of image forming properties in Example I-1. A receiving material comprising a polyethylene terephthalate-laminated support (a support practically used for ELP-II (electrophotographic lithographic printing plate precursor manufactured by Fuji Photo Film Co., Ltd.)) having provided thereon an image receiving layer known as a direct image type lithographic printing plate precursor similar to the above-described straight master and the light-sensitive material having the toner image thereon were brought into contact with each other and passed through a pair of rubber rollers whose surface temperature was kept constantly at 110° C. under a nip pressure of 12 kgf/cm$^2$ at a speed of 7 mm/sec. After cooling the two materials while in contact with each other to room temperature, the receiving material was stripped from the light-sensitive material to transfer the transfer layer onto the receiving material.

The receiving material was then immersed in Oil-Desensitizing Solution (E-3) described above at a temperature of 40° C. for 1.5 minutes to remove the transfer layer. When observed using an optical microscope (×200), the resulting printing plate had neither residual transfer layer on the non-image areas nor defects in the toner image areas.

The printing plate was subjected to printing on neutral paper with various offset printing color inks using an offset printing machine (Oliver 94 Model) and an aqueous solution (pH: 9.5) prepared by diluting dampening water for PS plate (Alky A manufactured by Toyo Ink Mfg. Co., Ltd.) 200-fold with distilled water, as a dampening water. As a result, more than 20,000 prints with a clear image free from background stains were obtained irrespective of the kind of color inks.

EXAMPLE II-1

A mixture of 2 g of X-form metal-free phthalocyanine (manufactured by Dainippon Ink and Chemicals, Inc.), 10 g of Binder Resin (B-1) described above, 0.15 g of Compound (A) described above, and 80 g of tetrahydrofuran was put in a 500 ml-volume glass container together with glass beads and dispersed in a paint shaker (manufactured by Toyo Seiki Seisakusho Co.) for 60 minutes. To the dispersion were added 0.2 g of Resin (P-2), 0.03 g of phthalic anhydride, and 0.001 g of o-chlorophenol, followed by further dispersing for 2 minutes. The glass beads were separated by filtration to prepare a dispersion for a light-sensitive layer.

The dispersion was coated on a base paper for paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 8 μm.

A 3% by weight tetrahydrofuran solution of Resin (A-101) having the structure shown below was coated on the light-sensitive layer by a wire bar at a dry thickness of 1.3 μm and dried in an over at 120° C. for 20 seconds to form a transfer layer.

Resin (A-101)

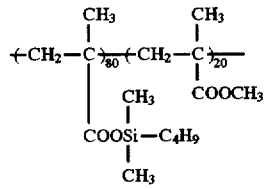

Mw 4 × 10$^4$ (weight ratio)

The resulting light-sensitive material was evaluated for image forming properties and transfer properties as follows.

The light-sensitive material was charged to +450 V with a corona discharge in dark and exposed to light of a gallium-aluminum-arsenic semiconductor laser (output: 5 mW; oscillation wavelength: 780 nm) at an irradiation dose (on the surface of the light-sensitive material) of 30 erg/cm$^2$, a pitch of 25 μm, and a scanning speed of 300 cm/sec. The scanning exposure was in a negative mirror image mode based on the digital image data of an original read by a color scanner and memorized in a hard disc.

Thereafter, the light-sensitive material was immersed in Liquid Developer (LD-1) prepared in the same manner as described in Example I-1 above in a developing machine having a pair of flat development electrodes, and a bias voltage of +400 V was applied to the electrode on the side of the light-sensitive material to thereby electrodeposit toner particles on the exposed areas (reversal development). The light-sensitive material was then rinsed in a bath of Isopar H to remove any stains on the non-image areas.

The light-sensitive material was then subjected to fixing by means of a heat roll whereby the toner image thus-formed was fixed.

An aluminum substrate used for the production of FUJI PS-Plate, FPD (manufactured by Fuji Photo Film Co., Ltd.) and the thus-developed light-sensitive material were superposed each other, and they were passed through between a pair of rubber rollers having a nip pressure of 15 kgf/cm$^2$ at a speed of 10 mm/sec. The surface temperature of the rollers was controlled to maintain constantly at 120° C.

After cooling the both materials in contact with each other to room temperature, the aluminum substrate was stripped from the light-sensitive material. The image formed on the aluminum substrate was visually evaluated for fog and image quality. As a result it was found that the whole toner image on the light-sensitive material was heat-transferred together with the transfer layer onto the aluminum substrate to provide a clear image without background stain on the aluminum substrate which showed substantially no degradation in image quality as compared with the original.

It is believed that such an excellent transfer of the transfer layer is due to migration of the fluorine atom-containing copolymer in the photoconductive layer to its surface portion during the formation of the photoconductive layer and due to chemical bonding between the binder resin (B) and the resin (P) by the action of the crosslinking agent to form a cured film. Thus, a definite interface having a good release property was formed between the photoconductive layer surface and the transfer layer.

Then, the plate of the aluminum substrate having thereon the transfer layer was subjected to an oil-desensitizing treatment (i.e., removal of the transfer layer) to prepare a printing plate and its printing properties were evaluated. Specifically, the plate was immersed in Oil-Desensitizing Solution (E-1) described in Example I-1 above at 40° C. for 3 minutes to remove the transfer layer, thoroughly washed with water, and gummed to obtain an offset printing plate.

The printing plate thus prepared was observed visually using an optical microscope (×200). It was found that the non-image areas had no residual transfer layer, and the image areas suffered no defects in high definition regions (i.e., cut of fine lines and fine letters).

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with a clear image free from background stains were obtained irrespective of the kind of color inks.

When the printing plate was exchanged for an ordinary PS plate and printing was continued under ordinary conditions, no trouble arose. It was thus confirmed that the printing plate of the present invention can share a printing machine with other offset printing plates such as PS plates.

As described above, the offset printing plate according to the present invention exhibits excellent performance in that an image formed by a scanning exposure system using semiconductor laser beam has excellent image reproducibility and the image of the plate can be reproduced on prints with satisfactory quality, in that the plate exhibits sufficient color ink receptivity without substantial ink-dependency to enable to perform full color printing with high printing durability, and in that it can share a printing machine in printing with other offset printing plates without any trouble.

EXAMPLES II-2 TO II-18

A printing plate was prepared in the same manner as in Example II-1, except for replacing Resin (A-101) in the transfer layer and Resin (P-2) in the photoconductive layer with each of the resins (A) and the resins (P), respectively, shown in Table II-1 below and replacing Oil-Desensitizing Solution (E-1) with a commercially available PS plate processing solution (DP-4 manufactured by Fuji Photo Film Co., Ltd.; hereinafter referred to as Oil-Desensitizing Solution (E-2)).

TABLE II-1

Resin (A)

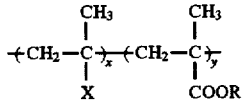

(Mw of each of the resins was in a range of from $2\times10^4$ to $5\times10^4$)

| Example | Resin (P) | Resin (A) | −X | −R | x/y |
|---|---|---|---|---|---|
| II-2 | P-11 | A-102 | $-COO(CH_2)_2COCH_3$ | $-C_4H_9$ | 85/15 |
| II-3 | P-12 | A-103 | $-COOC(CH_3)_2CH_2COCH_3$ | $-C_2H_5$ | 80/20 |
| II-4 | P-19 | A-104 | $-COOCH(CF_3)_2$ | $-CH_3$ | 70/30 |
| II-5 | P-25 | A-105 | $-COOC(COOCH_3)_2-CH_3$ | $-CH_3$ | 80/20 |
| II-6 | P-30 | A-106 | $-COOC(COCF_3)(COOCH_3)-CH_3$ | $-CH_3$ | 80/20 |
| II-7 | P-30 | A-107 | $-COO(CH_2)_2SO_2CH_2OCH_3$ | $-C_4H_9$ | 60/40 |
| II-8 | P-31 | A-108 | $-COOCH_2CH(OSi(CH_3)_3)CH_2OSi(CH_3)_3$ | $-CH_3$ | 80/20 |
| II-9 | P-32 | A-109 | $-COO(CH_2)_2O-P(=O)(O(CH_2)_2COC_2H_5)-O(CH_2)_2COC_2H_5$ | $-C_2H_5$ | 70/30 |

TABLE II-1-continued

Resin (A)

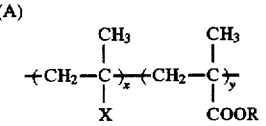

(Mw of each of the resins was in a range of from $2 \times 10^4$ to $5 \times 10^4$)

| Example | Resin (P) | Resin (A) | −X | −R | x/y |
|---|---|---|---|---|---|
| II-10 | P-33 | A-110 | 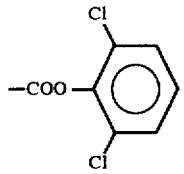 | $-C_4H_9$ | 80/20 |
| II-11 | P-34 | A-111 | 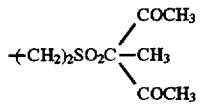 | $-C_2H_5$ | 75/25 |
| II-12 | P-35 | A-112 | 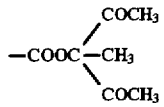 | $-CH_3$ | 80/20 |
| II-13 | P-36 | A-113 | $-COOSi(iC_3H_7)_3$ | $-CH_3$ | 75/25 |
| II-14 | P-38 | A-114 | 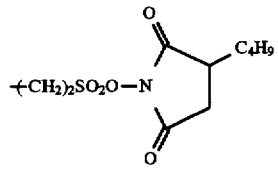 | $-C_4H_9$ | 75/25 |
| II-15 | P-1 | A-115 | 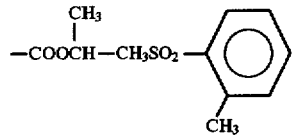 | $-C_2H_5$ | 80/20 |
| II-16 | P-4 | A-116 | 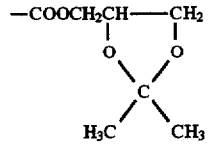 | $-C_3H_7$ | 85/15 |
| II-17 | P-5 | A-117 | 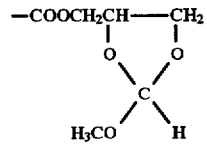 | $-C_2H_5$ | 85/15 |
| II-18 | P-9 | A-118 | 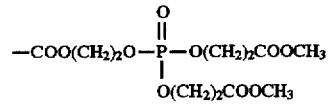 | $-C_3H_7$ | 70/30 |

Each of the resulting printing plates was evaluated for various properties in the same manner as in Example II-1. The results obtained were similar to those in Example II-1. Specifically, more than 60,000 prints with a clear image free from background stains were obtained.

EXAMPLE II-19

1.0 part of the trisazo compound described above as a charge generating agent, 2.0 parts of the hydrazone compound described above as an organic photoconductive compound, 10 parts of Copolymer (B-2) described above, 1 part of Resin (P-30), and 100 parts of tetrahydrofuran were put in a 500 ml-volume glass container together with glass beads and dispersed in a paint shaker for 60 minutes. To the dispersion were added 0.02 part of phthalic anhydride and 0.001 part of o-chlorophenol, and the mixture was further dispersed for 10 minutes. The glass beads were separated by filtration to prepare a dispersion for a photoconductive layer.

The dispersion for photoconductive layer was coated on an aluminum plate having a thickness of 0.25 mm, which had been surface-grained, dried at 100° C. for 30 seconds and then heated at 140° C. for 1 hour to prepare an electrophotographic light-sensitive element having a photoconductive layer having a dry thickness of 5.1 μm.

A mixed solution of 3 g of Resin (A-119) having the structure shown below, 1 g of polyvinyl acetate, and 100 ml of tetrahydrofuran was coated on the photoconductive layer with a wire bar at a dry thickness of 1.5 μm and dried at 100° C. for 20 seconds to form a transfer layer.

Resin (A-119)

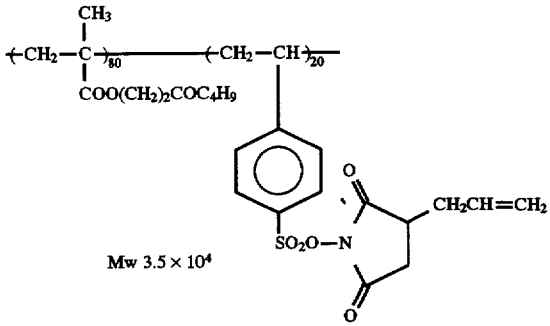

The light-sensitive material was charged to a surface potential of +450 V in dark, exposed to light of an He—Ne laser (oscillation wavelength: 633 nm) in an exposure amount of 30 erg/cm$^2$ (on the surface thereof), and developed using Liquid Developer (LD-2) prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent with a bias voltage of 30 V applied to the counter electrode to form a toner image thereon. The toner image was fixed by heating at 100° C. for 30 minutes.

The toner image and the transfer layer were transferred onto an aluminum substrate of PS plate (FPD) and then subjected to an oil-desensitizing treatment in the same manner as in Example II-1 to obtain a printing plate.

Printing was performed using the printing plate thus-obtained in the same manner as in Example II-1. As a result, 60,000 prints of a clear image free from background stains were obtained. When printing test was carried out using various printing inks as in Example II-1, the printing performances were equally good and color ink-dependency was not observed.

EXAMPLE II-20

5 g of 4,4'-bis(diethylamino)-2,2'-dimethyltriphenylmethane as an organic photoconductive substance, 5 g of a polyester resin (Vylon 200 manufactured by Toyobo Co., Ltd.), 40 mg of Dye (D-1) described above, and 0.2 g of Anilide Compound (B) described above as a chemical sensitizer were dissolved in a mixed solvent of 30 ml of methylene chloride and 30 ml of ethylene chloride to prepare a light-sensitive solution.

The light-sensitive solution was coated on a conductive transparent substrate composed of a 100 μm thick polyethylene terephthalate film having a deposited layer of indium oxide thereon (surface resistivity: $10^3\Omega$) by a wire round rod to prepare a light-sensitive element having an organic light-sensitive layer having a thickness of about 4 μm.

Then, the overcoat layer for imparting a release property same as in Example I-17 was formed on the light-sensitive layer to prepare an electrophotographic light-sensitive element.

On the surface of the thus-prepared light-sensitive element was coated a 3% by weight tetrahydrofuran solution of Resin (A-120) having the structure shown below with a wire bar at a dry thickness of 2.0 μm and dried at 100° C. for 20 seconds.

Resin (A-120)

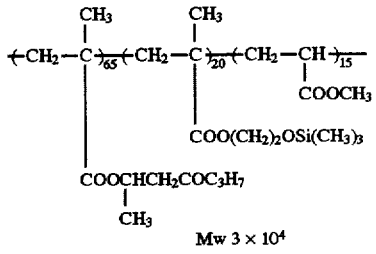

The resulting light-sensitive material was subjected to image formation, oil-desensitizing treatment and printing in the same manner as in Example II-19. The excellent results similar to those of Example II-19 were obtained.

EXAMPLE II-21

A mixture of 200 g of photoconductive zinc oxide, 80 g of Binder Resin (B-3) described above, 8 g of Resin (P-25), 0.018 g of Dye (D-2) described above, 0.20 g of N-hydroxysuccinimide, and 300 g of toluene was dispersed in a homogenizer (manufactured by Nippon Seiki K.K.) at a rotation of $1\times10^3$ rpm for one minute.

The dispersion was coated on a base paper for paper master having a thickness of 0.2 mm, which had been subjected to electrically conductive treatment and solvent-resistant treatment, by a wire bar, set to touch, and heated in an circulating oven at 110° C. for 1 hour to form a light-sensitive layer having a thickness of 10 μm.

In order to confirm localization of the block copolymer according to the present invention in the surface portion of the light-sensitive layer, an adhesion test using an adhesive tape was conducted. It was found as a result that the adhesion of the light-sensitive layer was one-sixtieth that of a sample prepared in the same manner but containing no block copolymer (P-25).

A solution of 3 g of Resin (A-121) having the structure shown below, 0.3 g of cellulose acetate butyrate (Cellidor Bsp manufactured by Bayer A.G.), and 100 ml of tetrahydrofuran was coated on the light-sensitive layer by a wire rod at a dry thickness of 2.2 μm and dried at 100° C. for 15 seconds to form a transfer layer.

Resin (A-121)

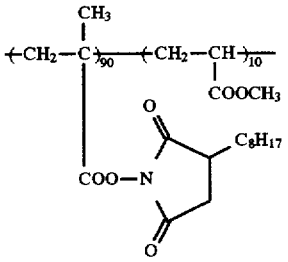

Mw 3.5 × 10⁴

When an adhesive tape was adhered on the surface of the transfer layer and then stripped, the transfer layer was easily released from the surface of the light-sensitive layer without any perceptible resistance.

The resulting light-sensitive material was charged to −600 V with a corona discharge in dark and exposed to a semiconductor laser beam (780 nm) at a surface exposure amount of 25 erg/cm$^2$ using the same digital image data as in Example II-1. The residual potential of the exposed area was −120 V. The light-sensitive material was developed with Liquid Developer (LD-1) described above in a developing machine having a pair of flat development electrodes with a bias voltage of −200 V being applied to the electrode on the light-sensitive material side to thereby electrodeposit the toner particles on the non-exposed areas (normal development). The light-sensitive material was then rinsed in a bath of Isopar H to remove stains on the non-image areas.

A straight master (manufactured by Mitsubishi Paper Mills, Ltd.), as a receiving material, was superposed on the developed light-sensitive material with its image-receiving layer side being in contact with the light-sensitive material, and they were passed through a pair of rubber rollers whose surface temperature was kept constantly at 120° C. at a speed of 6 mm/sec under a nip pressure of 10 kgf/cm$^2$.

After cooling the both materials while in contact with each other to room temperature, the straight master was stripped from the light-sensitive material whereby the whole toner image on the light-sensitive material was thermally transferred together with the transfer layer to the straight master. There was observed little difference in image quality between the toner image before the heat-transfer and that transferred on the straight master.

The straight master was then treated with Oil-Desensitizing Solution (E-3) prepared by adding 50 g of dimethylethanolamine to 1 liter of PS plate processing solution (DP-4) described above at a temperature of 35° C. for 2 minutes to remove the transfer layer.

The non-image areas and toner image areas of the thus obtained printing plate were visually observed using an optical microscope (×200). No residual transfer layer was observed on the non-image areas, and no image defect was observed in high definition regions (i.e., cut of fine lines and fine letters).

The printing plate was subjected to printing on neutral paper with various offset printing color inks using an offset printing machine (Ryobi 3200 MCD manufactured by Ryobi K.K.), and an aqueous solution (pH: 7.0) prepared by diluting dampening water for PS plate (SG-23 manufactured by Tokyo Ink K.K.) 130-fold with distilled water, as dampening water. As a result, more than 3,000 prints with a clear image free from background stains were obtained irrespective of the kind of color inks.

EXAMPLES II-22 TO II-28

An electrophotographic light-sensitive material having provided with a transfer layer was prepared in the same manner as in Example II-21, except for using 60 g of Binder Resin (B), 7 g of Resin (P), and the prescribed amount of crosslinking compound each shown in Table I-2 of Examples I-19 to I-25 described above. A printing plate was then prepared in the same manner as in Example II-21. As a result of evaluating the performances of the resulting printing plates, excellent results similar to those of Example II-21 were obtained.

EXAMPLES II-29 TO II-32

An electrophotographic light-sensitive material having provided with a transfer layer was prepared in the same manner as in Examples II-1, II-19, II-20, and II-21, except that Resin Grain (L) shown in Table II-2 below was used in place of Resin (P) used in the respective Example and that the transfer layer was formed as follows.

Formation of Transfer Layer

A solution of 3 g of Resin (A-122) having structure shown below, 0.08 g of a silicone oil (KF-69 manufactured by Shin-etsu Silicone K.K.), and 100 ml of toluene was coated by a wire rod at a dry thickness of 2.0 μm and dried at 110° C. for 10 seconds.

Resin (A-122)

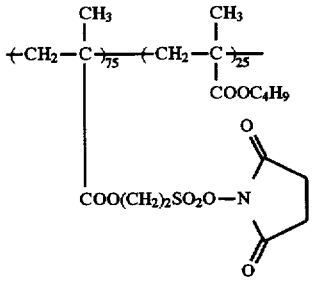

Mw 2.5 × 10⁴

With each light-sensitive material the toner image formation and heat transfer of the transfer layer were conducted in the same manner as in the respective Example. The resulting printing plate precursor was treated with Oil-Desensitizing Solution (E-4) prepared as follows at 40° C. for 2 minutes to remove the transfer layer.

Oil-Desensitizing Solution E-4

A mixture of 75 g of N,N-di(2-hydroxyethyl)amine and 80 g of dioxane was diluted with distilled water to make 1.0 l and then adjusted to pH of 13.0 with sodium hydroxide.

Printing was carried out using each of the resulting printing plates under the same conditions as in the respective Example. The number of the prints obtained with a clear image free from background stains (printing durability) is also shown in Table II-2.

TABLE II-2

| Example | Basis Example | Resin Grain (L) | Amount | Printing Durability |
|---|---|---|---|---|
| II-29 | II-1 | L-3 | 0.5 g | 60,000 |
| II-30 | II-19 | L-19 | 1 g | 60,000 |
| II-31 | II-20 | L-17 | 0.2 g | 60,000 |
| II-32 | II-21 | L-21 | 5 g | 3,500 |

EXAMPLES II-33 TO II-44

An electrophotographic light-sensitive material was prepared in the same manner as in Example II-32, except for replacing 5 g of Resin Grain (L-21) with 4 g (solid basis) of each of Resin Grains (L) shown in Table II-3 below.

TABLE II-3

| Example | Resin Grain (L) | Example | Resin Grain (L) |
|---|---|---|---|
| II-33 | L-3 | II-39 | L-14 |
| II-34 | L-4 | II-40 | L-15 |
| II-35 | L-6 | II-41 | L-16 |
| II-36 | L-9 | II-42 | L-18 |
| II-37 | L-10 | II-43 | L-19 |
| II-38 | L-11 | II-44 | L-22 |

Each of the resulting light-sensitive materials was processed in the same manner as in Example II-21 to prepare a printing plate. As a result of evaluating the performances of the resulting printing plates, excellent results similar to those of Example II-21 were obtained.

EXAMPLES II-45 TO II-55

A mixture of 40 g of Binder Resin B-11 described above, 4 g of Resin (P) or Resin Grain (L) shown in Table I-5 of Examples I-42 to I-52 described above, 200 g of photoconductive zinc oxide, 0.02 g of uranine, 0.04 g of Rose Bengale, 0.03 g of Bromophenol Blue, 0.15 g of salicylic acid, and 300 g of toluene was dispersed in a homogenizer (manufactured by Nippon Seiki K.K.) at a rotation of $9\times10^3$ rpm for 10 minutes.

To the dispersion was added each of the crosslinking compounds shown in Table I-5 above, and the mixture was dispersed at a rotation of $1\times10^3$ rpm for 1 minute to prepare a coating composition for a light-sensitive layer. The coating composition was coated on paper, which had been subjected to electrically conductive treatment, by a wire bar at a dry coverage of 25 g/m$^2$, and dried at 100° C. for 30 seconds and then heated at 140° C. for 1 hour to prepare an electrophotographic light-sensitive element.

A solution consisting of 2.7 g of Resin (A-123) having structure shown below, 0.3 g of a vinyl acetate/crotonic acid copolymer (99/1 molar ratio) and 100 ml of tetrahydrofuran was coated on the surface of the resulting light-sensitive element by a wire rod at a dry thickness of 2.5 μm and dried to form a transfer layer. The coated light-sensitive material was allowed to stand in dark at 20° C. and 65% RH for 24 hours.

Resin (A-123)

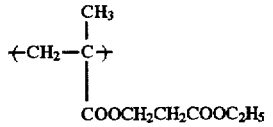

Mw $3.5\times10^4$

The light-sensitive material was charged to −600 V with a corona discharge in dark and subjected to contact exposure to visible light through a positive image film. Then it was developed with Liquid Developer (LD-1) described above using the same liquid developing machine as used in Example II-21 with a bias voltage of −250 V applied to the electrode of the light-sensitive material side. The light-sensitive material was rinsed in a bath of Isopar G to remove stains on the non-image areas and then heated at a temperature of 80° C. for 1 minute to fix the toner image.

A printing plate was prepared by conducting transfer using the resulting developed light-sensitive material and a straight master as a receiving material and oil-desensitizing treatment in the same manner as in Example II-21. As a result of evaluation on printing properties in the same manner as in Example II-21, each printing plate of Examples II-45 to II-55 exhibited good results similar to those of Example II-21, and printing durability of at least 3,000 prints.

EXAMPLES II-56 TO II-60

A printing plate was prepared in the same manner as in Example II-1, except for replacing Resin (A-101) used in the transfer layer with each of Resins (A) shown in Table II-4 below and conducting oil-desensitizing treatment of the transfer layer as follows.

Oil-Desensitizing Treatment

The transfer layer was irradiated with light having a wavelength of 310 nm or more, which was emitted from a 100 W high-pressure mercury lamp set 7 cm apart from the transfer layer and cut through a filter, for 3 minutes to cause a photodecomposition reaction. The printing plate precursor was then immersed in the PS plate processing solution (DP-4) described above for 2 minutes to remove the transfer layer, thoroughly washed with water, and gummed.

TABLE II-4

| Example | Resin (A) | Chemical Structure of Resin (A) (weight ratio) |
|---|---|---|
| II-56 | A-124 | 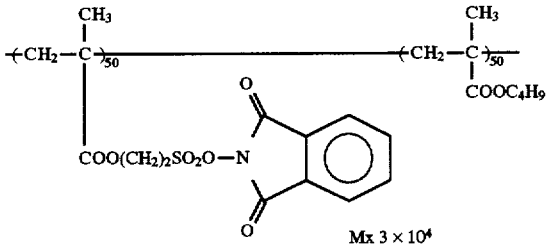 Mx $3 \times 10^4$ |
| II-57 | A-125 | 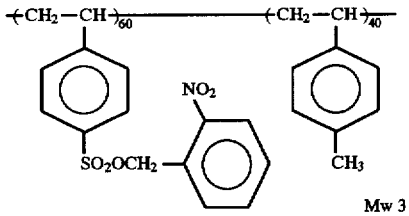 Mw $3 \times 10^4$ |
| II-58 | A-126 | 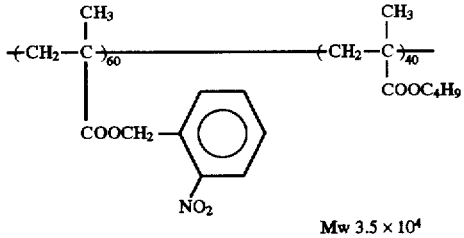 Mw $3.5 \times 10^4$ |
| II-59 | A-127 | 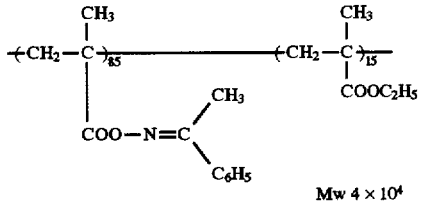 Mw $4 \times 10^4$ |
| II-60 | A-128 | 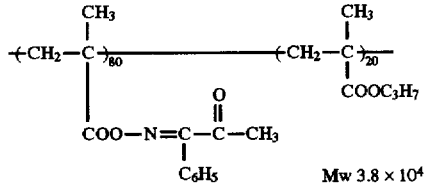 Mw $3.8 \times 10^4$ |

As a result of the evaluation on printing properties in the same manner as in Example II-1, each printing plate exhibited printing durability of more than 60,000 prints.

EXAMPLES II-61 TO II-75

A 3% by weight tetrahydrofuran solution of each of Resins (A) shown in Table II-5 shown below was coated on the surface of an amorphous silicon electrophotographic light-sensitive element by a wire rod at a dry thickness of 2.0 μm and set to touch to form a transfer layer.

TABLE II-5

| Example | Resin (A) | Example | Resin (A) |
|---|---|---|---|
| II-61 | A-102 | II-65 | A-109 |
| II-62 | A-105 | II-66 | A-111 |
| II-63 | A-107 | II-67 | A-114 |
| II-64 | A-108 | II-68 | A-118 |

TABLE II-5-continued

| Example | Resin (A) | Chemical Structure of Resin (A) (weight ratio) |
|---|---|---|
| II-69 | A-129 | 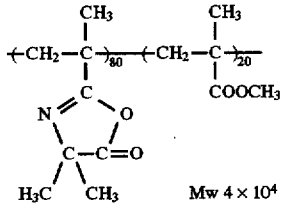 Mw 4 × 10⁴ |
| II-70 | A-130 | 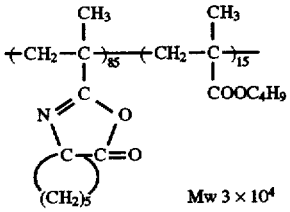 Mw 3 × 10⁴ |
| II-71 | A-131 | 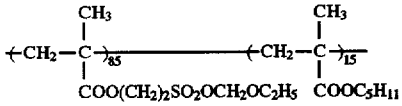 Mw 4.5 × 10⁴ |
| II-72 | A-132 | 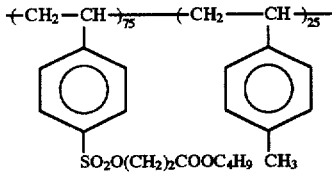 Mw 3.5 × 10⁴ |
| II-73 | A-133 | 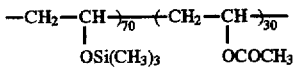 Mw 5 × 10⁴ |
| II-74 | A-134 | 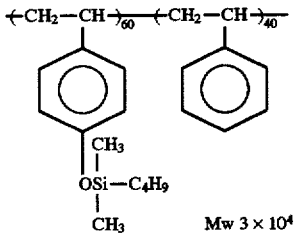 Mw 3 × 10⁴ |
| II-75 | A-135 | 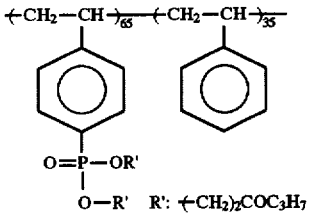 Mw 3.5 × 10⁴ |

A toner image was formed on each of the light-sensitive materials in the same manner as the evaluation of image forming properties in Example II-1. A receiving material comprising a polyethylene terephthalate-laminated support (a support practically used for ELP-II (electrophotographic lithographic printing plate precursor manufactured by Fuji Photo Film Co., Ltd.)) having provided thereon an image receiving layer known as a direct image type lithographic printing plate precursor similar to the above-described straight master and the light-sensitive material having the toner image thereon were brought into contact with each other and passed through a pair of rubber rollers whose surface temperature was kept constantly at 110° C. under a nip pressure of 12 kgf/cm$^2$ at a speed of 7 mm/sec. After cooling the two materials while in contact with each other to room temperature, the receiving material was stripped from the light-sensitive material to transfer the transfer layer onto the receiving material.

The receiving material was then immersed in Oil-Desensitizing Solution (E-3) described above at a temperature of 40° C. for 1.5 minutes to remove the transfer layer. When observed using an optical microscope (×200), the resulting printing plate had neither residual transfer layer on the non-image areas nor defects in the toner image areas.

The printing plate was subjected to printing on neutral paper With various offset printing color inks using an offset printing machine (Oliver 94 Model) and an aqueous solution (pH: 9.5) prepared by diluting dampening water for PS plate (Alky A manufactured by Toyo Ink Mfg. Co., Ltd.) 200-fold with distilled water, as a dampening water. As a result, more than 20,000 prints with a clear image free from background stains were obtained irrespective of the kind of color inks.

EXAMPLES II-76 TO II-87

An offset printing plate was prepared by subjecting some of the light-sensitive materials used in Examples II-1 to II-75 to the following oil-desensitizing treatment. Specifically, to 0.2 mol of each of the nucleophilic compound shown in Table II-6 below, 100 g of each of the organic solvent shown in Table II-6 below, and 2 g of Newcol B4SN (manufactured by Nippon Nyukazai K.K.) was added distilled water to make 1 l, and the solution was adjusted to a pH of 13.5. Each printing plate precursor was immersed in the resulting treating solution at a temperature of 35° C. for 3 minutes to remove the transfer layer.

Printing was carried out using the resulting printing plate under the same conditions as in Example II-1. Each plate exhibited excellent characteristics similar to those of Example II-1.

TABLE II-6

| Example | Basis Example of Light-sensitive Material | Nucleophilic Compound | Organic Solvent |
|---|---|---|---|
| II-76 | Example II-4 | Sodium sulfite | Benzyl alcohol |
| II-77 | Example II-5 | Monoethanolamine | Benzyl alcohol |
| II-78 | Example II-10 | Diethanolamine | Methyl ethyl ketone |
| II-79 | Example II-11 | Thiomalic acid | Ethylene glycol |
| II-80 | Example II-19 | Thiosalicylic acid | Benzyl alcohol |
| II-81 | Example II-20 | Taurine | Isopropyl alcohol |
| II-82 | Example II-22 | 4-Sulfobenzenesulfinic acid | Benzyl alcohol |
| II-83 | Example II-29 | Thioglycolic acid | Ethanol |
| II-84 | Example II-30 | 2-Mercaptoethylphosphonic acid | Dioxane |
| II-85 | Example II-32 | Serine | — |
| II-86 | Example II-43 | Sodium thiosulfate | Methyl ethyl ketone |
| II-87 | Example II-70 | Ammonium sulfite | Benzyl alcohol |

EXAMPLE III-1

Figure 3:
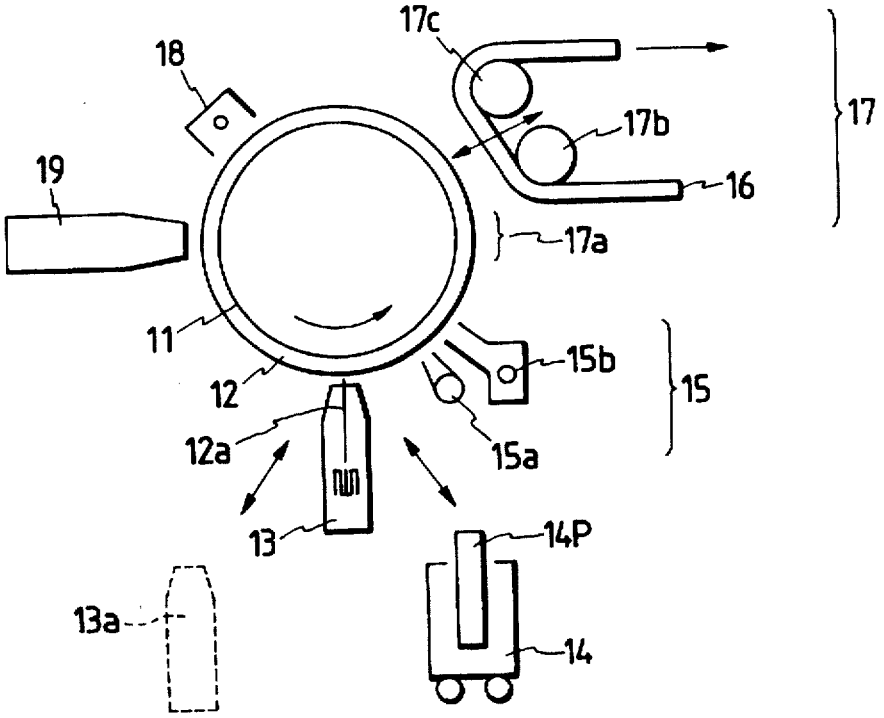
FIG. 3 is a schematic view of the electrophotographic plate making apparatus using the hot-melt coating method for the formation of transfer layer.

In the apparatus shown in FIG. 3, amorphous silicone was used as the electrophotographic light-sensitive element. Resin (A-201) having the structure shown below was coated on the surface of light-sensitive layer at a rate of 20 mm/sec. by the hot-melt coater adjusted at 120° C. and cooled by blowing cooling air from the suction/exhaust unit, followed by maintaining the surface temperature of light-sensitive element at 30° C. to prepare a transfer layer having a thickness of 3 μm.

Resin (A-201)

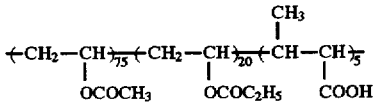

Mw $3.5 \times 10^4$ (weight ratio)

The resulting light-sensitive material was evaluated for image forming properties and transfer properties as follows.

The light-sensitive material was charged to +450 V with a corona discharge in dark and exposed to light of a gallium-aluminum-arsenic semiconductor laser (output: 5 mW; oscillation wavelength: 780 nm) at an irradiation dose (on the surface of the light-sensitive material) of 30 erg/cm$^2$, a pitch of 25 μm, and a scanning speed of 300 cm/sec. The scanning exposure was in a negative mirror image mode based on the digital image data of an original read by a color scanner and memorized in a hard disc.

Thereafter, the light-sensitive material was immersed in Liquid Developer (LD-1) prepared in the same manner as described in Example I-1 above in a developing machine having a pair of flat development electrodes, and a bias voltage of +400 V was applied to the electrode on the side of the light-sensitive material to thereby electrodeposit toner particles on the exposed areas (reversal development). The light-sensitive material was then rinsed in a bath of Isopar H to remove any stains on the non-image areas.

The light-sensitive material was then subjected to fixing by means of a heat roll whereby the toner image thus-formed was fixed.

An aluminum substrate used for the production of FUJI PS-Plate, FPD (manufactured by Fuji Photo Film Co., Ltd.) and the thus-developed light-sensitive material were superposed each other, and they were passed through between a pair of rubber rollers having a nip pressure of 15 kgf/cm$^2$ at a speed of 10 mm/sec. The surface temperature of the rollers was controlled to maintain constantly at 120° C.

After cooling the both materials in contact with each other to room temperature, the aluminum substrate was stripped from the light-sensitive material. The image formed on the aluminum substrate was visually evaluated for fog and image quality. As a result it was found that the whole toner image on the light-sensitive material was heat-transferred together with the transfer layer onto the aluminum substrate to provide a clear image without background stain on the aluminum substrate which showed substantially no degradation in image quality as compared with the original.

Then, the plate of the aluminum substrate having thereon the transfer layer was subjected to an oil-desensitizing treatment (i.e., removal of the transfer layer) to prepare a printing plate and its printing properties were evaluated. Specifically, the plate was immersed in Oil-Desensitizing Solution (E-III-1) having the composition shown below at 25° C. for 1 minute to remove the transfer layer, thoroughly washed with water, and gummed to obtain an offset printing plate.

Oil-Desensitizing Solution (E-III-1)

| | |
|---|---|
| Monoethanolamine | 10 g |
| Neosoap (manufactured by Matsumoto Yushi K. K.) | 8 g |
| N,N-Dimethylacetamide | 20 g |
| Distilled water | to make 1.0 l |
| Sodium hydroxide | to adjust to pH 13.0 |

The printing plate thus prepared was observed visually using an optical microscope (×200). It was found that the non-image areas had no residual transfer layer, and the image areas suffered no defects in high definition regions (i.e., cut of fine lines and fine letters).

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with a clear image free from background stains were obtained irrespective of the kind of color inks.

When the printing plate was exchanged for an ordinary PS plate and printing was continued under ordinary conditions, no trouble arose. It was thus confirmed that the printing plate of the present invention can share a printing machine with other offset printing plates such as PS plates.

As described above, the offset printing plate according to the present invention exhibits excellent performance in that an image formed by a scanning exposure system using semiconductor laser beam has excellent image reproducibility and the image of the plate can be reproduced on prints with satisfactory quality, in that the plate exhibits sufficient color ink receptivity without substantial ink-dependency to enable to perform full color printing with high printing durability, and in that it can share a printing machine in printing with other offset printing plates without any trouble.

EXAMPLES III-2 TO III-20

A printing plate was prepared in the same manner as in Example III-1, except for replacing Resin (A-201) of the transfer layer with each of the resins (A) shown in Table III-1 below and replacing Oil-Desensitizing Solution (E-III-1) with a processing solution having a pH of 13.1 prepared by diluting a commercially available PS plate processing solution (DP-4 manufactured by Fuji Photo Film Co., Ltd.) 7-fold with distilled water (hereinafter referred to as Oil-Desensitizing Solution (E-III-2)).

TABLE III-1

| Example | Resin (A) | Chemical Structure of Resin (A) |
|---|---|---|
| III-2 | A-202 | 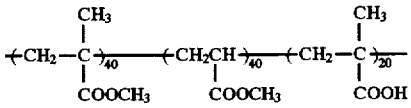 Mw $3\times10^4$ |
| III-3 | A-203 | 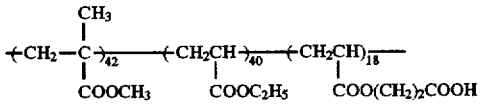 Mw $3.5\times10^4$ |
| III-4 | A-204 | 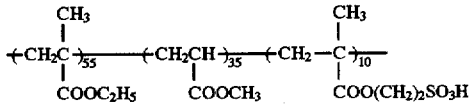 Mw $2.8\times10^4$ |
| III-5 | A-205 | 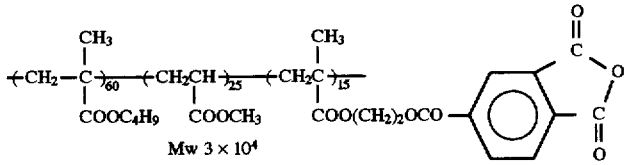 Mw $3\times10^4$ |
| III-6 | A-206 | 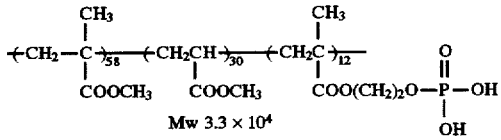 Mw $3.3\times10^4$ |
| III-7 | A-207 | 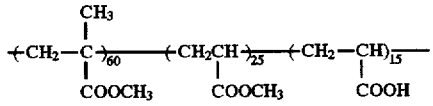 Mw $9\times10^3$ |
| III-8 | A-208 | 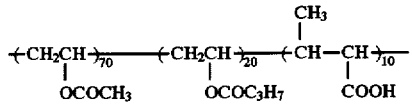 Mw $1.2\times10^4$ |
| III-9 | A-209 | 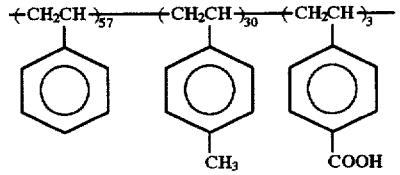 Mw $2.5\times10^4$ |

TABLE III-1-continued

| Example | Resin (A) | Chemical Structure of Resin (A) |
|---|---|---|
| III-10 | A-210 | $\text{-}(CH_2CH)_{90}\text{-}(CH_2CH)_{10}\text{-}$ ($OC_3H_7$; $O(CH_2)_3COOH$) Mw $1.8 \times 10^4$ |
| III-11 | A-211 | $\text{-}(CH_2C(CH_3))_{65}\text{-}(CH_2CH)_{25}\text{-}(CH_2CH)_{10}\text{-}$ ($COOC_3H_7$; $COOCH_3$; CONH–C6H4–COOH, OH) Mw $2 \times 10^4$ |
| III-12 | A-212 | $\text{-}(CH_2C(CH_3))_{65}\text{-}(CH_2\text{-}CH)_{20}\text{-}(CH_2C(CH_3))_{15}\text{-}$ ($COOC_2H_5$; $COOC_2H_5$; $COO(CH_2)_2OP(=O)(OH)\text{-}OCH_3$) Mw $2.3 \times 10^4$ |
| III-13 | A-213 | $\text{-}(CH_2C(CH_3))_{45}\text{-}(CH_2CH)_{40}\text{-}(CH_2CH)_{15}\text{-}$ ($COOCH_3$; $COOCH_3$; $CO(CH_2)_2$–C6H4–OH, OH) Mw $1.5 \times 10^4$ |
| III-14 | A-214 | $\text{-}(CH_2CH)_{92}\text{-}(CH_2CH)_{8}\text{-}$ ($OCOCH_3$; $OCO(CH_2)_2COOH$) Mw $1 \times 10^4$ |
| III-15 | A-215 | $\text{-}(CH_2C(CH_3))_{85}\text{-}(CH_2C(CH_3))_{15}\text{-}$ ($COOCH_2C_6H_5$; COOH) Mw $8.0 \times 10^3$ |
| III-16 | A-216 | $\text{-}(CH_2C(CH_3))_{90}\text{-}(CH_2\text{-}C)_{10}\text{-}$ ($COOC_2H_5$; O=C, $CH_2$, O–C=O) Mw $2 \times 10^4$ |
| III-17 | A-217 | $\text{-}(CH_2CH)_{50}\text{-}(CH\text{-}CH)_{50}\text{-}$ ($C_8H_{17}$; COOH; $COOC_2H_5$) Mw $1 \times 10^4$ |
| III-18 | A-218 | $\text{-}(CH_2\text{-}C(CH_3))_{60}\text{-}(CH_2CH)_{32}\text{-}(CH_2C(CH_3))_{8}\text{-}$ ($COOC_2H_5$; $COOCH_3$; $CONHSO_2$–C6H4–COOH) Mw $8.5 \times 10^3$ |

TABLE III-1-continued

| Example | Resin (A) | Chemical Structure of Resin (A) |
|---|---|---|
| III-19 | A-219 | 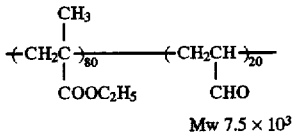 Mw 7.5 × 10³ |
| III-20 | A-220 | 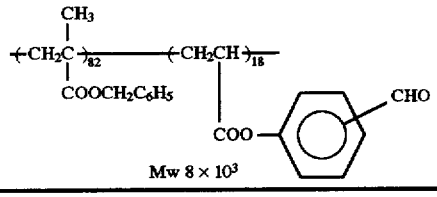 Mw 8 × 10³ |

Each of the resulting printing plates was evaluated for various properties in the same manner as in Example III-1. The results obtained were similar to those in Example III-1. Specifically, more than 60,000 prints with a clear image free from background stains were obtained.

EXAMPLE III-21

A mixture of 2 g of X-form metal-free phthalocyanine (manufactured by Dainippon Ink and Chemicals, Inc.), 10 g of Binder Resin (B-1) described above, 0.15 g of Compound (A) described above, and 80 g of tetrahydrofuran was put in a 500 ml-volume glass container together with glass beads and dispersed in a paint shaker (manufactured by Toyo Seiki Seisakusho Co.) for 60 minutes. To the dispersion were added 0.2 g of Resin (P-2), 0.03 g of phthalic anhydride, and 0.001 g of o-chlorophenol, followed by further dispersing for 2 minutes. The glass beads were separated by filtration to prepare a dispersion for a light-sensitive layer.

The dispersion was coated on a base paper for paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 8 μm.

The resulting light-sensitive element was equipped on the same apparatus as in Example III-1. As the thermoplastic resin, Resin (A-207) described above was coated on the surface of light-sensitive layer at a rate of 20 mm/sec. by the hot-melt coater adjusted at 100° C. and cooled by blowing cooling air from the suction/exhaust unit, followed by maintaining the surface temperature of light-sensitive element at 30° C. to prepare a transfer layer having a thickness of 4 μm.

The light-sensitive material was exposed in the same manner as in Example III-1, and developed using Liquid Developer (LD-2) prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent with a bias voltage of 30 V applied to the counter electrode to form a toner image thereon. The toner image was fixed by heating at 100° C. for 30 minutes.

The toner image and the transfer layer were transferred onto an aluminum substrate of PS plate (FPD) and then subjected to an oil-desensitizing treatment in the same manner as in Example III-1 to obtain a printing plate.

Printing was performed using the printing plate thus-obtained in the same manner as in Example III-1. As a result, 60,000 prints of a clear image free from background stains were obtained. When printing test was carried out using various printing inks as in Example I-1, the printing performances were equally good and color ink-dependency was not observed.

EXAMPLE III-22

5 g of 4,4'-bis(diethylamino)-2,2'-dimethyltriphenylmethane as an organic photoconductive substance, 5 g of a polyester resin (Vylon 200 manufactured by Toyobo Co., Ltd.), 40 mg of Dye (D-1) described above, and 0.2 g of Anilide Compound (B) described above as a chemical sensitizer were dissolved in a mixed solvent of 30 ml of methylene chloride and 30 ml of ethylene chloride to prepare a light-sensitive solution.

The light-sensitive solution was coated on a conductive transparent substrate composed of a 100 μm thick polyethylene terephthalate film having a deposited layer of indium oxide thereon (surface resistivity: $10^3$ Ω) by a wire round rod to prepare a light-sensitive element having an organic light-sensitive layer having a thickness of about 4 μm.

Then, the overcoat layer for imparting a release property same as in Example I-17 was formed on the light-sensitive layer to prepare an electrophotographic light-sensitive element.

On the surface of the thus-prepared light-sensitive element, a transfer layer having a thickness of 4.5 μm was formed in the same manner as in Example III-21 except for using Resin (A-214) described above in place of Resin (A-207).

The resulting light-sensitive material was subjected to image formation, oil-desensitizing treatment and printing in the same manner as in Example III-21. The excellent results similar to those of Example III-21 were obtained.

EXAMPLE III-23

1.0 part of the trisazo compound described above as a charge generating agent, 2.0 parts of the hydrazone compound described above as an organic photoconductive compound, 10 parts of Copolymer (B-2) described above, 1 part of Resin (P-30), and 100 parts of tetrahydrofuran were put in a 500 ml-volume glass container together with glass beads and dispersed in a paint shaker for 60 minutes. To the dispersion were added 0.02 part of phthalic anhydride and 0.001 part of o-chlorophenol, and the mixture was further dispersed for 10 minutes. The glass beads were separated by filtration to prepare a dispersion for a photoconductive layer.

The dispersion for photoconductive layer was coated on an aluminum plate having a thickness of 0.25 mm, which had been surface-grained, dried at 100° C. for 30 seconds and then heated at 140° C. for 1 hour to prepare an electrophotographic light-sensitive element having a photoconductive layer having a dry thickness of 5.1 μm.

Using the apparatus same as in Example III-1, Resin (A-205) was coated on the surface of light-sensitive layer at a rate of 15 mm/sec. by the hot-melt coater adjusted at 125° C. and cooled by blowing cooling air from the suction/exhaust unit, followed by maintaining the surface temperature of light-sensitive element at 30° C. to prepare a transfer layer having a thickness of 4 μm.

The light-sensitive material was charged to a surface potential of +500 V in dark, exposed to light of an He-Ne laser (oscillation wavelength: 633 nm) in an exposure amount of 30 erg/cm$^2$ (on the surface thereof), subjected to normal development using Liquid Developer (LD-1) described above with a bias voltage of +200 V, and then rinsed in a bath of Isopar H to remove stains on the non-image areas.

The toner image and the transfer layer were heat-transferred onto an aluminum substrate of PS plate (FPD) and then subjected to an oil-desensitizing treatment in the same manner as in Example III-1 to obtain a printing plate. Printing was performed using the printing plate thus-obtained in the same manner as in Example III-1. As a result, 60,000 prints of a clear image free from background stains were obtained. When printing test was carried out using various printing inks as in Example III-1, the printing performances were equally good and color ink-dependency was not observed.

EXAMPLE III-24

A mixture of 200 g of photoconductive zinc oxide, 80 g of Binder Resin (B-3) described above, 8 g of Resin (P-25), 0.018 g of Dye (D-2) described above, 0.20 g of N-hydroxysuccinimide, and 300 g of toluene was dispersed in a homogenizer (manufactured by Nippon Seiki K.K.) at a rotation of $1\times10^3$ rpm for one minute.

The dispersion was coated on a base paper for paper master having a thickness of 0.2 mm, which had been subjected to electrically conductive treatment and solvent-resistant treatment, by a wire bar, set to touch, and heated in an circulating oven at 110° C. for 1 hour to form a light-sensitive layer having a thickness of 10 μm.

In order to confirm localization of the block copolymer according to the present invention in the surface portion of the light-sensitive layer, an adhesion test using an adhesive tape was conducted. It was found as a result that the adhesion of the light-sensitive layer was one-sixtieth that of a sample prepared in the same manner but containing no block copolymer (P-25).

A transfer layer having a thickness of 4 μm was formed on the light-sensitive layer in the same manner as in Example III-1 using Resin (A-217) described above and cellulose acetate butyrate (Cellidor Bsp manufactured by Bayer A.G.) in a weight ratio of 3:1.

When an adhesive tape was adhered on the surface of the transfer layer and then stripped, the transfer layer was easily released from the surface of the light-sensitive layer without any perceptible resistance.

The resulting light-sensitive material was charged to −600 V with a corona discharge in dark and exposed to a semiconductor laser beam (780 nm) at a surface exposure amount of 25 erg/cm$^2$ using the same digital image data as in Example III-1. The residual potential of the exposed area was −120 V. The light-sensitive material was developed with Liquid Developer (LD-1) described above in a developing machine having a pair of flat development electrodes with a bias voltage of −200 V being applied to the electrode on the light-sensitive material side to thereby electrodeposit the toner particles on the non-exposed areas (normal development). The light-sensitive material was then rinsed in a bath of Isopar H to remove stains on the non-image areas.

A straight master (manufactured by Mitsubishi Paper Mills, Ltd.), as a receiving material, was superposed on the developed light-sensitive material with its image-receiving layer side being in contact with the light-sensitive material, and they were passed through a pair of rubber rollers whose surface temperature was kept constantly at 120° C. at a speed of 6 mm/sec under a nip pressure of 10 kgf/cm$^2$.

After cooling the both materials while in contact with each other to room temperature, the straight master was stripped from the light-sensitive material whereby the whole toner image on the light-sensitive material was thermally transferred together with the transfer layer to the straight master. There was observed little difference in image quality between the toner image before the heat-transfer and that transferred on the straight master.

The straight master was then treated with Oil-Desensitizing Solution (E-3) prepared by adding 50 g of dimethylethanolamine to 1 liter of PS plate processing solution (DP-4) described above at a temperature of 35° C. for 2 minutes to remove the transfer layer.

The non-image areas and toner image areas of the thus obtained printing plate were visually observed using an optical microscope (X 200). No residual transfer layer was observed on the non-image areas, and no image defect was observed in high definition regions (i.e., cut of fine lines and fine letters).

The printing plate was subjected to printing on neutral paper with various offset printing color inks using an offset printing machine (Ryobi 3200 MCD manufactured by Ryobi K.K.), and an aqueous solution (pH: 7.0) prepared by diluting dampening water for PS plate (SG-23 manufactured by Tokyo Ink K.K.) 130-fold with distilled water, as dampening water. As a result, more than 3,000 prints with a clear image free from background stains were obtained irrespective of the kind of color inks.

EXAMPLES III-25 TO III-31

An electrophotographic light-sensitive material having provided thereon a transfer layer was prepared in the same manner as in Example III-24, except for using 60 g of Binder Resin (B), 7 g of Resin (P), and the prescribed amount of crosslinking compound each shown in Table I-2 of Examples I-19 to I-25 described above. A printing plate was then prepared in the same manner as in Example III-24. As a result of evaluating the performances of the resulting printing plates, excellent results similar to those of Example III-24 were obtained.

EXAMPLES III-32 TO III-35

An electrophotographic light-sensitive material having provided with a transfer layer was prepared in the same manner as in Examples III-21, III-22, III-23, and III-24, except that Resin Grain (L) shown in Table III-2 below was used in place of Resin (P) used in the respective Example and that the transfer layer having a thickness of 4 μm was formed in the same manner as in Example III-1 using Resin (A-202) described above.

With each light-sensitive material the toner image formation and heat transfer of the transfer layer were conducted in the same manner as in the respective Example. The resulting printing plate precursor was treated with Oil-Desensitizing Solution (E-4) prepared as follows for 2 minutes to remove the transfer layer.

Oil-Desensitizing Solution E-4

A mixture of 75 g of N,N-di(2-hydroxyethyl)amine and 80 g of N,N-dimethylacetamide was diluted with distilled water to make 1.0 l and then adjusted to a pH of 13.0 with sodium hydroxide.

Printing was carried out using each of the resulting printing plates under the same conditions as in the respective Example. The number of the prints obtained with a clear image free from background stains (printing durability) is also shown in Table III-2.

TABLE III-2

| Example | Basis Example | Resin Grain (L) | Amount | Printing Durability |
|---|---|---|---|---|
| III-32 | III-21 | L-3 | 0.5 g | 60,000 |
| III-33 | III-22 | L-19 | 1 g | 60,000 |
| III-34 | III-23 | L-17 | 0.2 g | 60,000 |
| III-35 | III-24 | L-21 | 5 g | 3,500 |

EXAMPLES III-36 TO III-47

An electrophotographic light-sensitive material was prepared in the same manner as in Example III-35, except for replacing 5 g of Resin Grain (L-21) with 4 g (solid basis) of each of Resin Grains (L) shown in Table III-3 below.

Each of the resulting light-sensitive materials was processed in the same manner as in Example III-22 to prepare a printing plate. As a result of evaluating the performances of the resulting printing plates, excellent results similar to those of Example III-22 were obtained.

TABLE III-3

| Example | Resin Grain (L) | Example | Resin Grain (L) |
|---|---|---|---|
| III-36 | L-3 | III-42 | L-14 |
| III-37 | L-4 | III-43 | L-15 |
| III-38 | L-6 | III-44 | L-16 |
| III-39 | L-9 | III-45 | L-18 |
| III-40 | L-10 | III-46 | L-19 |
| III-41 | L-11 | III-47 | L-22 |

EXAMPLES III-48 TO III-58

A mixture of 40 g of Binder Resin B-11 described above, 4 g of Resin (P) or Resin Grain (L) shown in Table I-5 of Examples I-42 to I-52 described above, 200 g of photoconductive zinc oxide, 0.02 g of uranine, 0.04 g of Rose Bengale, 0.03 g of Bromophenol Blue, 0.15 g of salicylic acid, and 300 g of toluene was dispersed in a homogenizer (manufactured by Nippon Seiki K.K.) at a rotation of $9\times10^3$ rpm for 10 minutes.

To the dispersion was added each of the crosslinking compounds shown in Table I-5 above, and the mixture was dispersed at a rotation of $1\times10^3$ rpm for 1 minute to prepare a coating composition for a light-sensitive layer. The coating composition was coated on paper, which had been subjected to electrically conductive treatment, by a wire bar at a dry coverage of 25 g/m$^2$, dried at 100° C. for 30 seconds and then heated at 140° C. for 1 hour to prepare an electrophotographic light-sensitive element.

On the surface of the resulting light-sensitive element, a transfer layer was formed in the same manner as in Example III-24.

The light-sensitive material was charged to −600 V with a corona discharge in dark and subjected to contact exposure to visible light through a positive image film. Then it was developed with Liquid Developer (LD-1) described above using the same liquid developing machine as used in Example III-23 with a bias voltage of −250 V applied to the electrode of the light-sensitive material side. The light-sensitive material was rinsed in a bath of Isopar G to remove stains on the non-image areas and then heated at a temperature of 80° C. for 1 minute to fix the toner image.

A printing plate was prepared by conducting transfer using the resulting developed light-sensitive material and a straight master as a receiving material and oil-desensitizing treatment in the same manner as in Example III-24. As a result of evaluation on printing properties in the same manner as in Example III-24, each printing plate of Examples III-48 to III-58 exhibited good results similar to those of Example III-24, and printing durability of at least 3,000 prints.

EXAMPLE IV-1

In the apparatus shown in FIG. 3, amorphous silicone was used as the electrophotographic light-sensitive element. Resin (A-301) having the structure shown below was coated on the surface of light-sensitive layer at a rate of 20 mm/sec. by the hot-melt coater adjusted at 120° C. and cooled by blowing cooling air from the suction/exhaust unit, followed by maintaining the surface temperature of light-sensitive element at 30° C. to prepare a transfer layer having a thickness of 3 μm.

Resin (A-301)

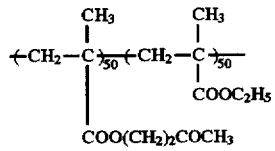

Mw $3\times10^4$ (weight ratio)

The resulting light-sensitive material was evaluated for image forming properties and transfer properties as follows.

The light-sensitive material was charged to +450 V with a corona discharge in dark and exposed to light of a gallium-aluminum-arsenic semiconductor laser (output: 5 mW; oscillation wavelength: 780 nm) at an irradiation dose (on the surface of the light-sensitive material) of 30 erg/cm$^2$, a pitch of 25 μm, and a scanning speed of 300 cm/sec. The scanning exposure was in a negative mirror image mode based on the digital image data of an original read by a color scanner and memorized in a hard disc.

Thereafter, the light-sensitive material was immersed in Liquid Developer (LD-1) prepared in the same manner as described in Example I-1 above in a developing machine having a pair of flat development electrodes, and a bias voltage of +400 V was applied to the electrode on the side of the light-sensitive material to thereby electrodeposit toner particles on the exposed areas (reversal development). The light-sensitive material was then rinsed in a bath of Isopar H to remove any stains on the non-image areas.

The light-sensitive material was then subjected to fixing by means of a heat roll whereby the toner image thus-formed was fixed.

An aluminum substrate used for the production of FUJI PS-Plate, FPD (manufactured by Fuji Photo Film Co., Ltd.) and the thus-developed light-sensitive material were superposed each other, and they were passed through between a pair of rubber rollers having a nip pressure of 15 kgf/cm$^2$ at a speed of 10 mm/sec. The surface temperature of the rollers was controlled to maintain constantly at 120° C.

After cooling the both materials in contact with each other to room temperature, the aluminum substrate was stripped from the light-sensitive material. The image formed on the aluminum substrate was visually evaluated for fog and image quality. As a result it was found that the whole toner image on the light-sensitive material was heat-transferred together with the transfer layer onto the aluminum substrate to provide a clear image without background stain on the aluminum substrate which showed substantially no degradation in image quality as compared with the original.

Then, the plate of the aluminum substrate having thereon the transfer layer was subjected to an oil-desensitizing treatment (i.e., removal of the transfer layer) to prepare a printing plate and its printing properties were evaluated. Specifically, the plate was immersed in Oil-Desensitizing Solution (E-1) having the composition shown below at 40° C. for 3 minutes to remove the transfer layer, thoroughly washed with water, and gummed to obtain an offset printing plate.

Oil-Desensitizing Solution (E-1)

| | |
|---|---|
| Monoethanolamine | 60 g |
| Neosoap (manufactured by Matsumoto Yushi K. K.) | 8 g |
| Benzyl alcohol | 100 g |
| Distilled water | to make 1.0 l |
| Potassium hydroxide | to adjust to pH 13.0 |

The printing plate thus prepared was observed visually using an optical microscope (X 200). It was found that the non-image areas had no residual transfer layer, and the image areas suffered no defects in high definition regions (i.e., cut of fine lines and fine letters).

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with a clear image free from background stains were obtained irrespective of the kind of color inks.

When the printing plate was exchanged for an ordinary PS plate and printing was continued under ordinary conditions, no trouble arose. It was thus confirmed that the printing plate of the present invention can share a printing machine with other offset printing plates such as PS plates.

As described above, the offset printing plate according to the present invention exhibits excellent performance in that an image formed by a scanning exposure system using semiconductor laser beam has excellent image reproducibility and the image of the plate can be reproduced on prints with satisfactory quality, in that the plate exhibits sufficient color ink receptivity without substantial ink-dependency to enable to perform full color printing with high printing durability, and in that it can share a printing machine in printing with other offset printing plates without any trouble.

EXAMPLES IV-2 TO IV-18

A printing plate was prepared in the same manner as in Example IV-1, except for replacing Resin (A-301) of the transfer layer with each of the resins (A) shown in Table IV-1 below and replacing Oil-Desensitizing Solution (E-1) with a commercially available PS plate processing solution (DP-4 manufactured by Fuji Photo Film Co., Ltd.; hereinafter referred to as Oil-Desensitizing Solution (E-2)).

TABLE IV-1

Resin (A)

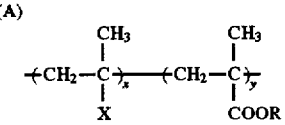

(Mw of each of the resins was in a range of from $2 \times 10^4$ to $5 \times 10^4$)

| Example | Resin (A) | −X | −R | x/y |
|---|---|---|---|---|
| IV-2 | A-302 | $-COOCH(CH_3)CH_2COC_4H_9$ | $-C_2H_5$ | 80/20 |
| IV-3 | A-303 | $-COOC(CH_3)_2CH_2COCH_3$ | $-C_2H_5$ | 70/30 |
| IV-4 | A-304 | $-COOCH(CF_3)_2$ | $-CH_3$ | 70/30 |

TABLE IV-1-continued
Resin (A)
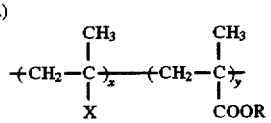
(Mw of each of the resins was in a range of from $2 \times 10^4$ to $5 \times 10^4$)
| Example | Resin (A) | −X | −R | x/y |
|---|---|---|---|---|
| IV-5 | A-305 | 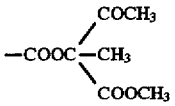 | $-CH_3$ | 80/20 |
| IV-6 | A-306 | 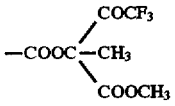 | $-CH_3$ | 80/20 |
| IV-7 | A-307 | $-COO(CH_2)_2SO_2CH_2OCH_3$ | $-C_4H_9$ | 60/40 |
| IV-8 | A-308 | $-COOCH_2CH(OSi(CH_3)_3)CH_2OSi(CH_3)_3$ | $-CH_3$ | 80/20 |
| IV-9 | A-309 | 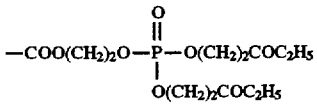 | $-C_2H_5$ | 70/30 |
| IV-10 | A-310 | 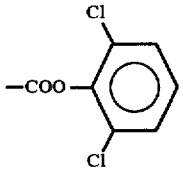 | $-C_4H_9$ | 80/20 |
| IV-11 | A-311 | 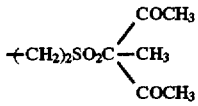 | $-C_2H_5$ | 75/25 |
| IV-12 | A-312 | 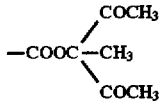 | $-CH_3$ | 80/20 |
| IV-13 | A-313 | $-COOSi(iC_3H_7)_3$ | $-CH_3$ | 75/25 |
| IV-14 | A-314 | 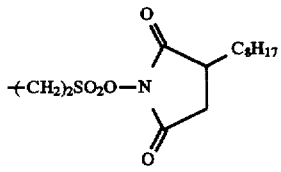 | $-C_4H_9$ | 75/25 |
| IV-15 | A-315 | 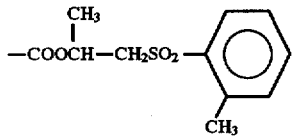 | $-C_2H_5$ | 80/20 |
| IV-16 | A-316 | 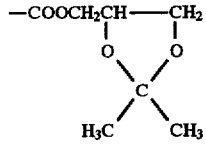 | $-C_3H_7$ | 85/15 |

TABLE IV-1-continued

Resin (A)

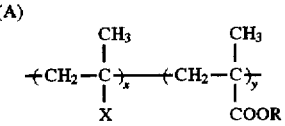

(Mw of each of the resins was in a range of from $2 \times 10^4$ to $5 \times 10^4$)

| Example | Resin (A) | −X | −R | x/y |
|---|---|---|---|---|
| IV-17 | A-317 | 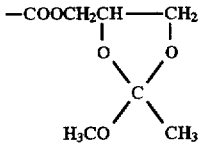 | $-C_2H_5$ | 85/15 |
| IV-18 | A-318 | 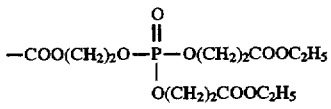 | $-C_3H_7$ | 70/30 |

Each of the resulting printing plates was evaluated for various properties in the same manner as in Example IV-1. The results obtained were similar to those in Example IV-1. Specifically, more than 60,000 prints with a clear image free from background stains were obtained.

EXAMPLE IV-19

A mixture of 2 g of X-form metal-free phthalocyanine (manufactured by Dainippon Ink and Chemicals, Inc.), 10 g of Binder Resin (B-1) described above, 0.15 g of Compound (A) described above, and 80 g of tetrahydrofuran was put in a 500 ml-volume glass container together with glass beads and dispersed in a paint shaker (manufactured by Toyo Seiki Seisakusho Co.) for 60 minutes. To the dispersion were added 0.2 g of Resin (P-2), 0.03 g of phthalic anhydride, and 0.001 g of o-chlorophenol, followed by further dispersing for 2 minutes. The glass beads were separated by filtration to prepare a dispersion for a light-sensitive layer.

The dispersion was coated on a base paper for paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 8 μm.

The resulting light-sensitive element was equipped on the same apparatus as in Example IV-1. As the thermoplastic resin, Resin (A-319) shown below was coated on the surface of light-sensitive layer at a rate of 20 mm/sec. by the hot-melt coater adjusted at 100° C. and cooled by blowing cooling air from the suction/exhaust unit, followed by maintaining the surface temperature of light-sensitive element at 30° C. to prepare a transfer layer having a thickness of 2 μm.

Resin (A-319)

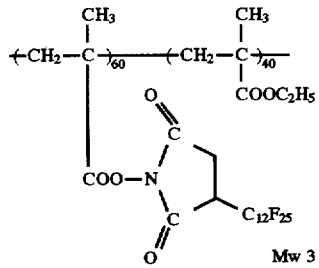

Mw $3 \times 10^4$

The light-sensitive material was exposed in the same manner as in Example IV-1, and developed using Liquid Developer (LD-2) prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent with a bias voltage of 30 V applied to the counter electrode to form a toner image thereon. The toner image was fixed by heating at 100° C. for 30 seconds.

The toner image and the transfer layer were transferred onto an aluminum substrate of PS plate (FPD) and then subjected to an oil-desensitizing treatment in the same manner as in Example IV-1 to obtain a printing plate.

Printing was performed using the printing plate thus-obtained in the same manner as in Example IV-1. As a result, 60,000 prints of a clear image free from background stains were obtained. When printing test was carried out using various printing inks as in Example IV-1, the printing performances were equally good and color ink-dependency was not observed.

EXAMPLE IV-20

5 g of 4,4'-bis(diethylamino)-2,2'-dimethyltriphenylmethane as an organic photoconductive substance, 5 g of a polyester resin (Vylon 200 manufactured by Toyobo Co., Ltd.), 40 mg of Dye (D-1) described above, and 0.2 g of Anilide Compound (B) described above as a chemical sensitizer were dissolved in a mixed solvent of 30 ml of methylene chloride and 30 ml of ethylene chloride to prepare a light-sensitive solution.

The light-sensitive solution was coated on a conductive transparent substrate composed of a 100 μm thick polyethylene terephthalate film having a deposited layer of indium oxide thereon (surface resistivity: $10^3$ Ω) by a wire round rod to prepare a light-sensitive element having an organic light-sensitive layer having a thickness of about 4 μm.

Then, the overcoat layer for imparting a release property same as in Example I-17 was formed on the light-sensitive layer to prepare an electrophotographic light-sensitive element.

On the surface of the thus-prepared light-sensitive element, a transfer layer having a thickness of 3.0 μm was formed in the same manner as in Example IV-19 except for using Resin (A-320) having the structure shown below in place of Resin (A-319).

Resin (A-320)

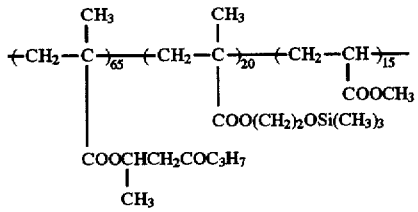

Mw 3 × $10^4$

The resulting light-sensitive material was subjected to image formation, oil-desensitizing treatment and printing in the same manner as in Example IV-19. The excellent results similar to those of Example IV-19 were obtained.

EXAMPLE IV-21

1.0 part of the trisazo compound described above as a charge generating agent, 2.0 parts of the hydrazone compound described above as an organic photoconductive compound, 10 parts of Copolymer (B-2) described above, 1 part of Resin (P-30), and 100 parts of tetrahydrofuran were put in a 500 ml-volume glass container together with glass beads and dispersed in a paint shaker for 60 minutes. To the dispersion were added 0.02 part of phthalic anhydride and 0.001 part of o-chlorophenol, and the mixture was further dispersed for 10 minutes. The glass beads were separated by filtration to prepare a dispersion for a photoconductive layer.

The dispersion for photoconductive layer was coated on an aluminum plate having a thickness of 0.25 mm, which had been surface-grained, dried at 100° C. for 30 seconds and then heated at 140° C. for 1 hour to prepare an electrophotographic light-sensitive element having a photoconductive layer having a dry thickness of 5.1 μm.

Using the apparatus same as in Example IV-1, Resin (A-321) having the structure shown below was coated on the surface of light-sensitive layer at a rate of 15 mm/sec. by the hot-melt coater adjusted at 125° C. and cooled by blowing cooling air from the suction/exhaust unit, followed by maintaining the surface temperature of light-sensitive element at 30° C. to prepare a transfer layer having a thickness of 4 μm.

Resin (A-321)

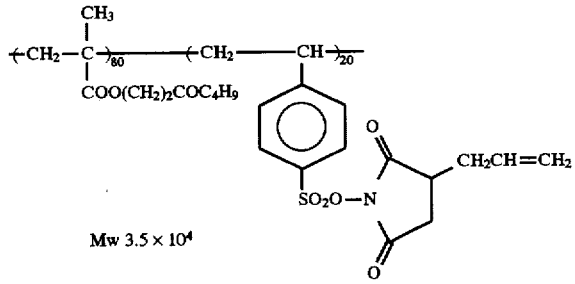

Mw 3.5 × $10^4$

The light-sensitive material was charged to a surface potential of +500 V in dark, exposed to light of an He-Ne laser (oscillation wavelength: 633 nm) in an exposure amount of 30 erg/$cm^2$ (on the surface thereof), subjected to normal development using Liquid Developer (LD-1) described above with a bias voltage of +200 V, and then rinsed in a bath of Isopar H to remove stains on the non-image areas.

The toner image and the transfer layer were heat-transferred onto an aluminum substrate of PS plate (FPD) and then subjected to an oil-desensitizing treatment in the same manner as in Example IV-1 to obtain a printing plate. Printing was performed using the printing plate thus-obtained in the same manner as in Example IV-1. As a result, 60,000 prints of a clear image free from background stains were obtained. When printing test was carried out using various printing inks as in Example IV-1, the printing performances were equally good and color ink-dependency was not observed.

EXAMPLE IV-22

A mixture of 200 g of photoconductive zinc oxide, 80 g of Binder Resin (B-3) described above, 8 g of Resin (P-25), 0.018 g of Dye (D-2) described above, 0.20 g of N-hydroxysuccinimide, and 300 g of toluene was dispersed in a homogenizer (manufactured by Nippon Seiki K.K.) at a rotation of 1×$10^3$ rpm for one minute.

The dispersion was coated on a base paper for paper master having a thickness of 0.2 mm, which had been subjected to electrically conductive treatment and solvent-resistant treatment, by a wire bar, set to touch, and heated in an circulating oven at 110° C. for 1 hour to form a light-sensitive layer having a thickness of 10 μm.

In order to confirm localization of the block copolymer according to the present invention in the surface portion of the light-sensitive layer, an adhesion test using an adhesive tape was conducted. It was found as a result that the adhesion of the light-sensitive layer was one-sixtieth that of a sample prepared in the same manner but containing no block copolymer (P-25).

A transfer layer having a thickness of 4 μm was formed on the light-sensitive layer in the same manner as in Example IV-1 using Resin (A-322) having the structure shown below and cellulose acetate butyrate (Cellidor Bsp manufactured by Bayer A.G.) in a weight ratio of 3:1.

Resin (A-322)

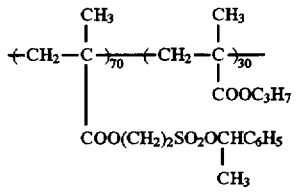

Mw $3 \times 10^4$

When an adhesive tape was adhered on the surface of the transfer layer and then stripped, the transfer layer was easily released from the surface of the light-sensitive layer without any perceptible resistance.

The resulting light-sensitive material was charged to −600 V with a corona discharge in dark and exposed to a semiconductor laser beam (780 nm) at a surface exposure amount of 25 erg/cm$^2$ using the same digital image data as in Example IV-1. The residual potential of the exposed area was −120 V. The light-sensitive material was developed with Liquid Developer (LD-1) described above in a developing machine having a pair of flat development electrodes with a bias voltage of −200 V being applied to the electrode on the light-sensitive material side to thereby electrodeposit the toner particles on the non-exposed areas (normal development). The light-sensitive material was then rinsed in a bath of isopar H to remove stains on the non-image areas.

A straight master (manufactured by Mitsubishi Paper Mills, Ltd.), as a receiving material, was superposed on the developed light-sensitive material with its image-receiving layer side being in contact with the light-sensitive material, and they were passed through a pair of rubber rollers whose surface temperature was kept constantly at 120° C. at a speed of 6 mm/sec under a nip pressure of 10 kgf/cm$^2$.

After cooling the both materials while in contact with each other to room temperature, the straight master was stripped from the light-sensitive material whereby the whole toner image on the light-sensitive material was thermally transferred together with the transfer layer to the straight master. There was observed little difference in image quality between the toner image before the heat-transfer and that transferred on the straight master.

The straight master was then treated with Oil-Desensitizing Solution (E-3) prepared by adding 50 g of dimethylethanolamine to 1 liter of PS plate processing solution (DP-4) described above at a temperature of 35° C. for 2 minutes to remove the transfer layer.

The non-image areas and toner image areas of the thus obtained printing plate were visually observed using an optical microscope (X 200). No residual transfer layer was observed on the non-image areas, and no image defect was observed in high definition regions (i.e., cut of fine lines and fine letters).

The printing plate was subjected to printing on neutral paper with various offset printing color inks using an offset printing machine (Ryobi 3200 MCD manufactured by Ryobi K.K.), and an aqueous solution (pH: 7.0) prepared by diluting dampening water for PS plate (SG-23 manufactured by Tokyo Ink K.K.) 130-fold with distilled water, as dampening water. As a result, more than 3,000 prints with a clear image free from background stains were obtained irrespective of the kind of color inks.

EXAMPLES IV-23 TO IV-29

An electrophotographic light-sensitive material having provided thereon a transfer layer was prepared in the same manner as in Example IV-22, except for using 60 g of Binder Resin (B), 7 g of Resin (P), and the prescribed amount of crosslinking compound each shown in Table I-2 of Examples I-19 to I-25 described above. A printing plate was then prepared in the same manner as in Example IV-22. As a result of evaluating the performances of the resulting printing plates, excellent results similar to those of Example IV-22 were obtained.

EXAMPLES IV-30 TO IV-33

An electrophotographic light-sensitive material having provided with a transfer layer was prepared in the same manner as in Examples IV-19, IV-20, IV-21, and IV-22, except that Resin Grain (L) shown in Table VI-2 below was used in place of Resin (P) used in the respective Example and that the transfer layer was formed as follows.

Formation of Transfer Layer

Using Resin (A-323) having structure shown below, the transfer layer having a thickness of 3 μm was formed in the same manner as in Example IV-1.

Resin (A-323)

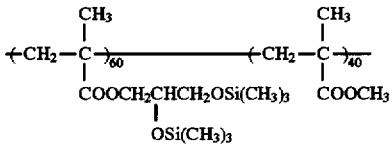

Mw $3.5 \times 10^4$

With each light-sensitive material the toner image formation and heat transfer of the transfer layer were conducted in the same manner as in the respective Example. The resulting printing plate precursor was treated with Oil-Desensitizing Solution (E-4) prepared as follows at 40° C. for 2 minutes to remove the transfer layer.

Oil-Desensitizing Solution E-4

A mixture of 75 g of N,N-di(2-hydroxyethyl)amine and 80 g of N,N-dimethylacetamide was diluted with distilled water to make 1.0 l and then adjusted to a pH of 13.0 with sodium hydroxide.

Printing was carried out using each of the resulting printing plates under the same conditions as in the respective Example. The number of the prints obtained with a clear image free from background stains (printing durability) is also shown in Table IV-2.

TABLE IV-2

| Example | Basis Example | Resin Grain (L) | Amount | Printing Durability |
|---|---|---|---|---|
| IV-30 | IV-19 | L-3 | 0.5 g | 60,000 |
| IV-31 | IV-20 | L-19 | 1 g | 60,000 |
| IV-32 | IV-21 | L-17 | 0.2 g | 60,000 |
| IV-33 | IV-22 | L-21 | 5 g | 3,500 |

EXAMPLES IV-34 TO IV-45

An electrophotographic light-sensitive material was prepared in the same manner as in Example IV-33, except for replacing 5 g of Resin Grain (L-21) with 4 g (solid basis) of each of Resin Grains (L) shown in Table IV-33 below.

TABLE IV-3

| Example | Resin Grain (L) | Example | Resin Grain (L) |
|---|---|---|---|
| IV-34 | L-3 | IV-40 | L-14 |
| IV-35 | L-4 | IV-41 | L-15 |
| IV-36 | L-6 | IV-42 | L-16 |
| IV-37 | L-9 | IV-43 | L-18 |
| IV-38 | L-10 | IV-44 | L-19 |
| IV-39 | L-11 | IV-45 | L-21 |

Each of the resulting light-sensitive materials was processed in the same manner as in Example IV-20 to prepare a printing plate. As a result of evaluating the performances of the resulting printing plates, excellent results similar to those of Example IV-20 were obtained.

EXAMPLES IV-46 TO IV-56

A mixture of 40 g of Binder Resin (B-11) described above, 4 g of Resin (P) or Resin Grain (L) shown in Table I-5 of Examples I-42 to I-52 described above, 200 g of photoconductive zinc oxide, 0.02 g of uranine, 0.04 g of Rose Bengale, 0.03 g of Bromophenol Blue, 0.15 g of salicylic acid, and 300 g of toluene was dispersed in a homogenizer (manufactured by Nippon Seiki K.K.) at a rotation of $9\times10^3$ rpm for 10 minutes.

To the dispersion was added each of the cross-linking compounds shown in Table I-5 above, and the mixture was dispersed at a rotation of $1\times10^3$ rpm for 1 minute to prepare a coating composition for a light-sensitive layer. The coating composition was coated on paper, which had been subjected to electrically conductive treatment, by a wire bar at a dry coverage of 25 g/m$^2$, and dried at 100° C. for 30 seconds and then heated at 140° C. for 1 hour to prepare an electrophotographic light-sensitive element.

On the surface of the resulting light-sensitive element, a transfer layer was formed in the same manner as in Example IV-22.

The light-sensitive material was charged to −600 V with a corona discharge in dark and subjected to contact exposure to visible light through a positive image film. Then it was developed with Liquid Developer (LD-1) described above using the same liquid developing machine as used in Example IV-22 with a bias voltage of −250 V applied to the electrode of the light-sensitive material side. The light-sensitive material was rinsed in a bath of Isopar G to remove stains on the non-image areas and then heated at a temperature of 80° C. for 1 minute to fix the toner image.

A printing plate was prepared by conducting transfer using the resulting developed light-sensitive material and a straight master as a receiving material and oil-desensitizing treatment in the same manner as in Example IV-22. As a result of evaluation on printing properties in the same manner as in Example IV-22, each printing plate of Examples IV-46 to IV-56 exhibited good results similar to those of Example IV-22, and printing durability of at least 3,000 prints.

EXAMPLES IV-57 TO IV-61

A printing plate was prepared in the same manner as in Example IV-1, except for replacing Resin (A-301) used in the transfer layer with each of Resins (A) shown in Table IV-4 below and conducting oil-desensitizing treatment of the transfer layer as follows.

Oil-Desensitizing Treatment

The transfer layer was irradiated with light having a wavelength of 310 nm or more, which was emitted from a 100 W high-pressure mercury lamp set 7 cm apart from the transfer layer and cut through a filter, for 3 minutes to cause a photodecomposition reaction. The printing plate precursor was then immersed in the PS plate processing solution (DP-4) described above for 2 minutes to remove the transfer layer, thoroughly washed with water, and gummed.

TABLE IV-4

| Example | Resin (A) | Chemical Structure of Resin (A) (weight ratio) |
|---|---|---|
| IV-57 | A-324 | 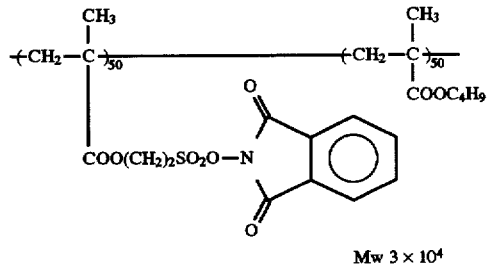 Mw $3\times10^4$ |
| IV-58 | A-325 | 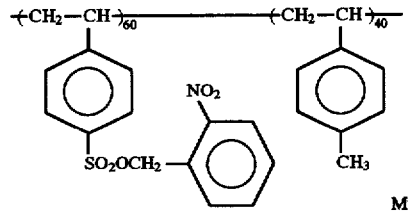 Mw $3\times10^4$ |

TABLE IV-4-continued

| Example | Resin (A) | Chemical Structure of Resin (A) (weight ratio) |
|---|---|---|
| IV-59 | A-326 | 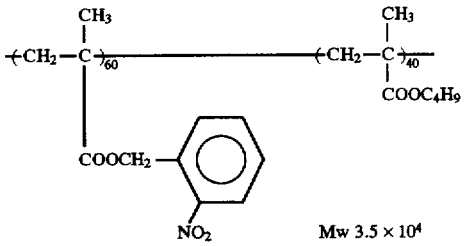 Mw $3.5 \times 10^4$ |
| IV-60 | A-327 | 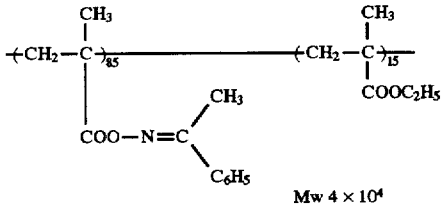 Mw $4 \times 10^4$ |
| IV-61 | A-328 | 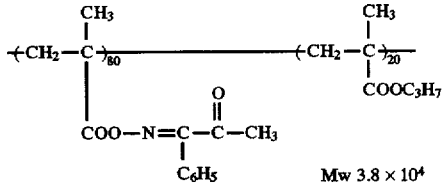 Mw $3.8 \times 10^4$ |

As a result of the evaluation on printing properties in the same manner as in Example IV-1, each printing plate exhibited printing durability of more than 60,000 prints.

EXAMPLES IV-62 TO IV-76

Each of Resins (A) shown in Table IV-5 shown below was applied onto the surface of an amorphous silicon electrophotographic light-sensitive element in the same manner as in Example IV-1 to form a transfer layer.

TABLE IV-5

| Example | Resin (A) | Example | Resin (A) |
|---|---|---|---|
| IV-62 | A-302 | IV-66 | A-309 |
| IV-63 | A-305 | IV-67 | A-311 |
| IV-64 | A-307 | IV-68 | A-314 |
| IV-65 | A-308 | IV-69 | A-318 |

| Example | Resin (A) | Chemical Structure of Resin (A) (weight ratio) |
|---|---|---|
| IV-70 | A-329 | 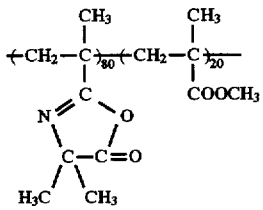 Mw $4 \times 10^4$ |

TABLE IV-5-continued

| | | | |
|---|---|---|---|
| IV-71 | A-330 | 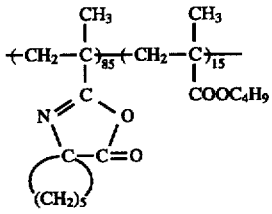 | Mw $3\times10^4$ |
| IV-72 | A-331 | 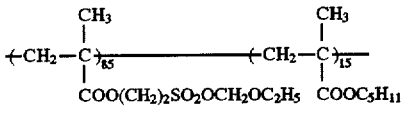 | Mw $4.5\times10^4$ |
| IV-73 | A-332 | 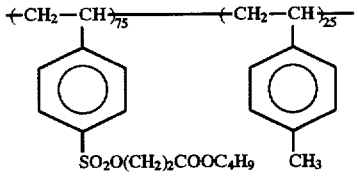 | Mw $3.5\times10^4$ |
| IV-74 | A-333 | 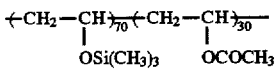 | Mw $5\times10^4$ |
| IV-75 | A-334 | 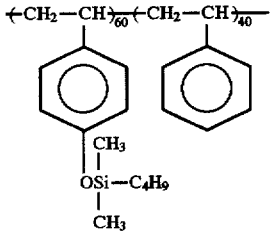 | Mw $3\times10^4$ |
| IV-76 | A-335 | 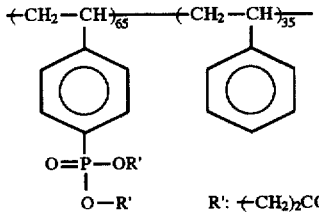 | Mw $3.5\times10^4$ |

A toner image was formed on each of the light-sensitive materials in the same manner as the evaluation of image forming properties in Example IV-1. A receiving material comprising a polyethylene terephthalate-laminated support (a support practically used for ELP-II (electrophotographic lithographic printing plate precursor manufactured by Fuji Photo Film Co., Ltd.)) having provided thereon an image receiving layer known as a direct image type lithographic printing plate precursor similar to the above-described straight master and the light-sensitive material having the toner image thereon were brought into contact with each other and passed through a pair of rubber rollers whose surface temperature was kept constantly at 110° C. under a nip pressure of 12 kgf/cm$^2$ at a speed of 7 mm/sec. After cooling the two materials while in contact with each other to room temperature, the receiving material was stripped from the light-sensitive material to transfer the transfer layer onto the receiving material.

The receiving material was then immersed in Oil-Desensitizing Solution (E-3) described above at a temperature of 40° C. for 1.5 minutes to remove the transfer layer. When observed using an optical microscope (X 200), the resulting printing plate had neither residual transfer layer on the non-image areas nor defects in the toner image areas.

The printing plate was subjected to printing on neutral paper with various offset printing color inks using an offset printing machine (Oliver 94 Model) and an aqueous solution (pH: 9.5) prepared by diluting dampening water for PS plate (Alky A manufactured by Toyo Ink Mfg. Co., Ltd.) 200-fold with distilled water, as a dampening water. As a result, more than 20,000 prints with a clear image free from background stains were obtained irrespective of the kind of color inks.

EXAMPLES IV-77 TO IV-88

An offset printing plate was prepared by subjecting some of the light-sensitive materials used in Examples IV-1 to IV-76 to the following oil-desensitizing treatment. Specifically, to 0.2 mol of each of the nucleophilic compound shown in Table IV-6 below, 100 g of each of the organic solvent shown in Table IV-6 below, and 2 g of Newcol B4SN (manufactured by Nippon Nyukazai K.K.) was added distilled water to make 1 l, and the solution was adjusted to a pH of 13.5. Each printing plate precursor was immersed in the resulting treating solution at a temperature of 35° C. for 2 minutes to remove the transfer layer.

Printing was carried out using the resulting printing plate under the same conditions as in Example IV-1. Each plate exhibited excellent characteristics similar to those of Example IV-1.

TABLE IV-6

| Example | Basis Example of Light-sensitive Material | Nucleophilic Compound | Organic Solvent |
|---|---|---|---|
| IV-77 | Example IV-4 | Sodium sulfite | N,N-Dimethylformamide |
| IV-78 | Example IV-5 | Monoethanolamine | Sulfolane |
| IV-79 | Example IV-10 | Diethanolamine | Tetrahydrofuran |
| IV-80 | Example IV-11 | Thiomalic acid | Ethylene glycol dimethyl ether |
| IV-81 | Example IV-19 | Thiosalicylic acid | Benzyl alcohol |
| IV-82 | Example IV-20 | Taurine | Ethylene glycol monomethyl ether |
| IV-83 | Example IV-22 | 4-Sulfobenzenesulfinic acid | Benzyl alcohol |
| IV-84 | Example IV-29 | Thioglycolic acid | Tetramethylurea |
| IV-85 | Example IV-30 | 2-Mercaptoethylphosphonic acid | Dioxane |
| IV-86 | Example IV-32 | Serine | N-Methylacetamide |
| IV-87 | Example IV-43 | Sodium thiosulfate | Methyl ethyl ketone |
| IV-88 | Example IV-69 | Ammonium sulfite | N,N-Dimethylacetamide |

EXAMPLE V-1

Figure 4:
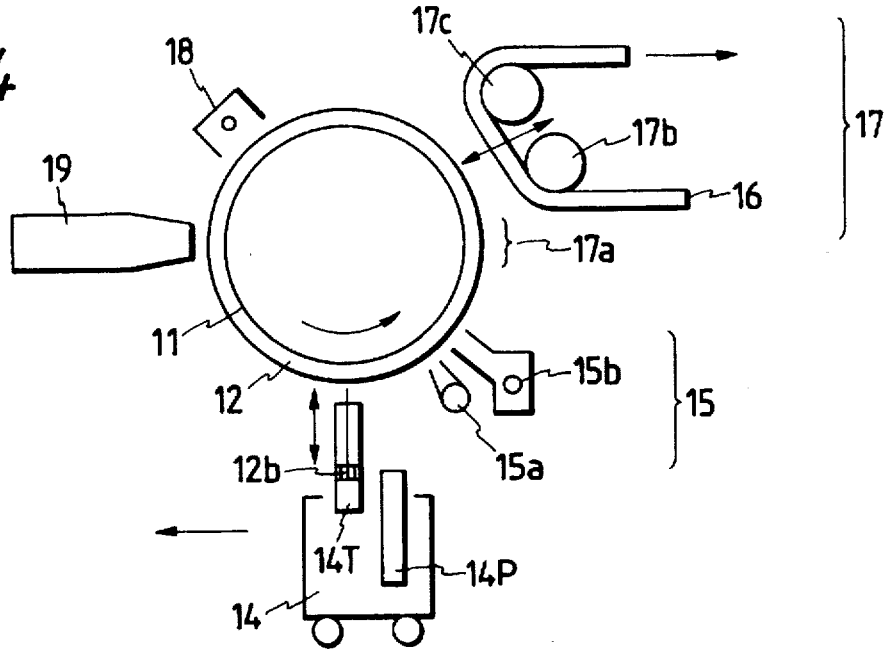
FIG. 4 is a schematic view of the electrophotographic plate making apparatus using the electrodeposition coating method for the formation of transfer layer.

In the apparatus shown in FIG. 4, amorphous silicone was used as the eletrophotographic light-sensitive element.

10 g (solid basis) of Thermoplastic Resin Grain (TL-3) described above and 0.001 g of zirconium naphthenate were added to 1 liter of Isopar H (manufactured by Esso Standard Co.) to prepare a dispersion of positively charged resin grains.

The light-sensitive element on the drum was rotated at a circumferential speed of 10 mm/sec while supplying the dispersion on the surface of light sensitive element using a slit electrodeposition device, putting the light-sensitive element to earth and applying an electric voltage of +200 V to an electrode of the slit electrodeposition device, thereby the resin grains were electrodeposited. Then, the excessive dispersion was removed with air squeezing and the resin grains deposited were fused to form a film by an infrared line heater, whereby the transfer layer composed of the thermoplastic resin having a thickness of 4 μm was formed.

The resulting light-sensitive material was evaluated for image forming properties and transfer properties as follows.

The light-sensitive material was charged to +450 V with a corona discharge in dark and exposed to light of a gallium-aluminum-arsenic semiconductor laser (output: 5 mW; oscillation wavelength: 780 nm) at an irradiation dose (on the surface of the light-sensitive material) of 30 erg/cm$^2$, a pitch of 25 μm, and a scanning speed of 300 cm/sec. The scanning exposure was in a negative mirror image mode based on the digital image data of an original read by a color scanner and memorized in a hard disc.

Thereafter, the light-sensitive material was immersed in Liquid Developer (LD-1) prepared in the same manner as described in Example I-1 above in a developing machine having a pair of flat development electrodes, and a bias voltage of +400 V was applied to the electrode on the side of the light-sensitive material to thereby electrodeposit toner particles on the exposed areas (reversal development). The light-sensitive material was then rinsed in a bath of Isopar H to remove any stains on the non-image areas.

The light-sensitive material was then subjected to fixing by means of a heat roll whereby the toner image thus-formed was fixed.

An aluminum substrate used for the production of FUJI PS-Plate, FPD (manufactured by Fuji Photo Film Co., Ltd.) and the thus-developed light-sensitive material were superposed each other, and they were passed through between a pair of rubber rollers having a nip pressure of 15 kgf/cm$^2$ at a speed of 10 mm/sec. The surface temperature of the rollers was controlled to maintain constantly at 120° C.

After cooling the both materials in contact with each other to room temperature, the aluminum substrate was stripped from the light-sensitive material. The image formed on the aluminum substrate was visually evaluated for fog and image quality. As a result it was found that the whole toner image on the light-sensitive material was heat-transferred together with the transfer layer onto the aluminum substrate to provide a clear image without background stain on the aluminum substrate which showed substantially no degradation in image quality as compared with the original.

Then, the plate of the aluminum substrate having thereon the transfer layer was subjected to an oil-desensitizing treatment (i.e., removal of the transfer layer) to prepare a printing plate and its printing properties were evaluated. Specifically, the plate was immersed in a processing solution having a pH of 13.1 prepared by diluting a commercially available PS plate processing solution (DP-4 manufactured by Fuji Photo Film Co., Ltd.) 7-fold with distilled water for 1 minute to remove the transfer layer, thoroughly washed with water, and gummed to obtain an offset printing plate.

The printing plate thus prepared was observed visually using an optical microscope (X 200). It was found that the non-image areas had no residual transfer layer, and the image areas suffered no defects in high definition regions (i.e., cut of fine lines and fine letters).

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with a clear image free from background stains were obtained irrespective of the kind of color inks.

When the printing plate was exchanged for an ordinary PS plate and printing was continued under ordinary conditions, no trouble arose. It was thus confirmed that the printing plate of the present invention can share a printing machine with other offset printing plates such as PS plates.

As described above, the offset printing plate according to the present invention exhibits excellent performance in that an image formed by a scanning exposure system using semiconductor laser beam has excellent image reproducibility and the image of the plate can be reproduced on prints with satisfactory quality, in that the plate exhibits sufficient color ink receptivity without substantial ink-dependency to enable to perform full color printing with high printing durability, and in that it can share a printing machine in printing with other offset printing plates without any trouble.

EXAMPLES V-2 TO V-13

A printing plate was prepared in the same manner as in Example V-1, except for replacing Resin Grain (TL-3) of the transfer layer with each of the resin grains (TL) shown in Table V-1 below.

Each of the resulting printing plates was evaluated for various properties in the same manner as in Example V-1. The results obtained were similar to those in Example V-1. Specifically, more than 60,000 prints with a clear image free from background stains were obtained.

TABLE V-1

| Example | Thermoplastic Resin Grain (TL) |
|---|---|
| V-2 | TL-1 |
| V-3 | TL-2 |
| V-4 | TL-4 |
| V-5 | TL-5 |
| V-6 | TL-6 |
| V-7 | TL-7 |
| V-8 | TL-8 |
| V-9 | TL-10 |
| V-10 | TL-11 |
| V-11 | TL-14 |
| V-12 | TL-15 |
| V-13 | TL-17 |

EXAMPLE V-14

A mixture of 2 g of X-form metal-free phthalocyanine (manufactured by Dainippon Ink and Chemicals, Inc.), 10 g of Binder Resin (B-1) described above, 0.15 g of Compound (A) described above, and 80 g of tetrahydrofuran was put in a 500 ml-volume glass container together with glass beads and dispersed in a paint shaker (manufactured by Toyo Seiki Seisakusho Co.) for 60 minutes. To the dispersion were added 0.2 g of Resin (P-2), 0.03 g of phthalic anhydride, and 0.001 g of o-chlorophenol, followed by further dispersing for 2 minutes. The glass beads were separated by filtration to prepare a dispersion for a light-sensitive layer.

The dispersion was coated on a base paper for paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 8 μm.

The resulting light-sensitive element was equipped on the same apparatus as in Example V-1. Using as the thermoplastic resin grain, Resin Grain (TL-2) described above, a transfer layer having a thickness of 4 μm was formed in the same manner as in Example V-1.

The light-sensitive material was exposed in the same manner as in Example V-1, and developed using Liquid Developer (LD-2) prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent with a bias voltage of 30 V applied to the counter electrode to form a toner image thereon. The toner image was fixed by heating at 100° C. for 30 seconds.

The toner image and the transfer layer were transferred onto an aluminum substrate of PS plate (FPD) and then subjected to an oil-desensitizing treatment in the same manner as in Example V-1 to obtain a printing plate.

Printing was performed using the printing plate thus-obtained in the same manner as in Example V-1. As a result, 60,000 prints of a clear image free from background stains were obtained. When printing test was carried out using various printing inks as in Example V-1, the printing performances were equally good and color ink-dependency was not observed.

EXAMPLE V-15

5 g of 4,4'-bis(diethylamino)-2,2'-dimethyltriphenylmethane as an organic photoconductive substance, 5 g of a polyester resin (Vylon 200 manufactured by Toyobo Co., Ltd.), 40 mg of Dye (D-1) described above, and 0.2 g of Anilide Compound (B) described above as a chemical sensitizer were dissolved in a mixed solvent of 30 ml of methylene chloride and 30 ml of ethylene chloride to prepare a light-sensitive solution.

The light-sensitive solution was coated on a conductive transparent substrate composed of a 100 μm thick polyethylene terephthalate film having a deposited layer of indium oxide thereon (surface resistivity: $10^3$ Ω) by a wire round rod to prepare a light-sensitive element having an organic light-sensitive layer having a thickness of about 4 μm.

Then, the overcoat layer for imparting a release property same as in Example I-17 was formed on the light-sensitive layer to prepare an electrophotographic light-sensitive element.

On the surface of the thus-prepared light-sensitive element, a transfer layer having a thickness of 5.0 μm was formed in the same manner as in Example V-1 except for using Resin Grain (TL-17) described above in place of Resin Grain (TL-3).

The resulting light-sensitive material was subjected to image formation, oil-desensitizing treatment and printing in the same manner as in Example V-14. The excellent results similar to those of Example V-14 were obtained.

EXAMPLE V-16

1.0 part of the trisazo compound described above as a charge generating agent, 2.0 parts of the hydrazone compound described above as an organic photoconductive compound, 10 parts of Copolymer (B-2) described above, 1 part of Resin (P-30), and 100 parts of tetrahydrofuran were put in a 500 ml-volume glass container together with glass beads and dispersed in a paint shaker for 60 minutes. To the dispersion were added 0.02 part of phthalic anhydride and 0.001 part of o-chlorophenol, and the mixture was further dispersed for 10 minutes. The glass beads were separated by filtration to prepare a dispersion for a photoconductive layer.

The dispersion for photoconductive layer was coated on an aluminum plate having a thickness of 0.25 mm, which had been surface-grained, dried at 100° C. for 30 seconds and then heated at 140° C. for 1 hour to prepare an electrophotographic light-sensitive element having a photoconductive layer having a dry thickness of 5.1 μm.

Using the apparatus same as in Example V-1, Resin Grain (TL-5) was applied onto the surface of light-sensitive layer to prepare a transfer layer having a thickness of 4.5 μm.

The light-sensitive material was charged to a surface potential of +500 V in dark, exposed to light of an He-Ne laser (oscillation wavelength: 633 nm) in an exposure amount of 30 erg/cm$^2$ (on the surface thereof), subjected to normal development using Liquid Developer (LD-1) described above with a bias voltage of +200 V, and then rinsed in a bath of Isopar H to remove stains on the non-image areas.

The toner image and the transfer layer were heat-transferred onto an aluminum substrate of PS plate (FPD) and then subjected to an oil-desensitizing treatment in the same manner as in Example V-1 to obtain a printing plate. Printing was performed using the printing plate thus-obtained in the same manner as in Example V-1. As a result, 60,000 prints of a clear image free from background stains were obtained. When printing test was carried out using various printing inks as in Example V-1, the printing performances were equally good and color ink-dependency was not observed.

EXAMPLE V-17

A mixture of 200 g of photoconductive zinc oxide, 80 g of Binder Resin (B-3) described above, 8 g of Resin (P-25), 0.018 g of Dye (D-2) described above, 0.20 g of N-hydroxysuccinimide, and 300 g of toluene was dispersed in a homogenizer (manufactured by Nippon Seiki K.K.) at a rotation of $1\times10^4$ rpm for 5 minutes.

The dispersion was coated on a base paper for paper master having a thickness of 0.2 mm, which had been subjected to electrically conductive treatment and solvent-resistant treatment, by a wire bar, set to touch, and heated in an circulating oven at 110° C. for 1 hour to form a light-sensitive layer having a thickness of 12 μm.

In order to confirm localization of the block copolymer according to the present invention in the surface portion of the light-sensitive layer, an adhesion test using an adhesive tape was conducted. It was found as a result that the adhesion of the light-sensitive layer was one-sixtieth that of a sample prepared in the same manner but containing no block copolymer (P-25).

A transfer layer having a thickness of 4 μm was formed on the light-sensitive layer in the same manner as in Example V-1 using Resin Grain (TL-15) described above.

When an adhesive tape was adhered on the surface of the transfer layer and then stripped, the transfer layer was easily released from the surface of the light-sensitive layer without any perceptible resistance.

The resulting light-sensitive material was charged to −600 V with a corona discharge in dark and exposed to a semiconductor laser beam (780 nm) at a surface exposure amount of 25 erg/cm$^2$ using the same digital image data as in Example V-1. The residual potential of the exposed area was −120 V. The light-sensitive material was developed with Liquid Developer (LD-1) described above in a developing machine having a pair of flat development electrodes with a bias voltage of −200 V being applied to the electrode on the light-sensitive material side to thereby electrodeposit the toner particles on the non-exposed areas (normal development). The light-sensitive material was then rinsed in a bath of Isopar H to remove stains on the non-image areas.

A straight master (manufactured by Mitsubishi Paper Mills, Ltd.), as a receiving material, was superposed on the developed light-sensitive material with its image-receiving layer side being in contact with the light-sensitive material, and they were passed through a pair of rubber rollers whose surface temperature was kept constantly at 120° C. at a speed of 6 mm/sec under a nip pressure of 10 kgf/cm$^2$.

After cooling the both materials while in contact with each other to room temperature, the straight master was stripped from the light-sensitive material whereby the whole toner image on the light-sensitive material was thermally transferred together with the transfer layer to the straight master. There was observed little difference in image quality between the toner image before the heat-transfer and that transferred on the straight master.

The straight master was then treated with Oil-Desensitizing Solution (E-3) prepared by adding 50 g of dimethylethanolamine to 1 liter of PS plate processing solution (DP-4) described above at a temperature of 35° C. for 2 minutes to remove the transfer layer.

The non-image areas and toner image areas of the thus obtained printing plate were visually observed using an optical microscope (X 200). No residual transfer layer was observed on the non-image areas, and no image defect was observed in high definition regions (i.e., cut of fine lines and fine letters).

The printing plate was subjected to printing on neutral paper with various offset printing color inks using an offset printing machine (Ryobi 3200 MCD manufactured by Ryobi K.K.), and an aqueous solution (pH: 7.0) prepared by diluting dampening water for PS plate (SG-23 manufactured by Tokyo Ink K.K.) 130-fold with distilled water, as dampening water. As a result, more than 3,000 prints with a clear image free from background stains were obtained irrespective of the kind of color inks.

EXAMPLES V-18 TO V-24

An electrophotographic light-sensitive material having provided thereon a transfer layer was prepared in the same manner as in Example V-17, except for using 60 g of Binder Resin (B), 7 g of Resin (P), and the prescribed amount of crosslinking compound each shown in Table I-2 of Examples I-19 to I-25 described above. A printing plate was then prepared in the same manner as in Example V-17. As a result of evaluating the performances of the resulting printing plates, excellent results similar to those of Example V-17 were obtained.

EXAMPLES V-25 TO V-28

An electrophotographic light-sensitive material having provided with a transfer layer was prepared in the same manner as in Examples V-14, V-15, V-16, and V-17, except that Resin Grain (L) shown in Table V-2 below was used in place of Resin (P) used in the respective Example and that the transfer layer having a thickness of 4 μm was formed in the same manner as in Example V-1 using Resin Grain (TL-4) described above.

With each light-sensitive material the toner image formation and heat transfer of the transfer layer were conducted in the same manner as in the respective Example. The resulting printing plate precursor was treated with Oil-Desensitizing Solution (E-4) prepared as follows for 1 minute to remove the transfer layer.

Oil-Desensitizing Solution E-4

A mixture of 75 g of N,N-di(2-hydroxyethyl)amine and 80 g of N,N-dimethylacetamide was diluted with distilled water to make 1.0 l and then adjusted to a pH of 13.0 with sodium hydroxide.

Printing was carried out using each of the resulting printing plates under the same conditions as in the respective Example. The number of the prints obtained with a clear image free from background stains (printing durability) is also shown in Table V-2.

TABLE V-2

| Example | Basis Example | Resin Grain (L) | Amount | Printing Durability |
|---|---|---|---|---|
| V-25 | V-14 | L-3 | 0.5 g | 60,000 |
| V-26 | V-15 | L-19 | 1 g | 60,000 |
| V-27 | V-16 | L-17 | 0.2 g | 60,000 |
| V-28 | V-17 | L-21 | 5 g | 3,500 |

EXAMPLES V-29 TO V-40

An electrophotographic light-sensitive material was prepared in the same manner as in Example V-28, except for replacing 5 g of Resin Grain (L-21) with 4 g (solid basis) of each of Resin Grains (L) shown in Table V-3 below.

Each of the resulting light-sensitive materials was processed in the same manner as in Example V-15 to prepare a printing plate. As a result of evaluating the performances of the resulting printing plates, excellent results similar to those of Example V-15 were obtained.

TABLE V-3

| Example | Resin Grain (L) | Example | Resin Grain (L) |
|---|---|---|---|
| V-29 | L-3 | V-35 | L-14 |
| V-30 | L-4 | V-36 | L-15 |
| V-31 | L-6 | V-37 | L-16 |
| V-32 | L-9 | V-38 | L-18 |
| V-33 | L-10 | V-39 | L-19 |
| V-34 | L-11 | V-40 | L-21 |

EXAMPLES V-41 TO V-51

A mixture of 40 g of Binder Resin (B-11) described above, 4 g of Resin (P) or Resin Grain (L) shown in Table I-5 of Examples I-42 to I-52 described above, 200 g of photoconductive zinc oxide, 0.02 g of uranine, 0.04 g of Rose Bengale, 0.03 g of Bromophenol Blue, 0.15 g of salicylic acid, and 300 g of toluene was dispersed in a homogenizer (manufactured by Nippon Seiki K.K.) at a rotation of $9\times10^3$ rpm for 10 minutes.

To the dispersion was added each of the cross-linking compounds shown in Table I-5 above, and the mixture was dispersed at a rotation of $1\times10^3$ rpm for 1 minute to prepare a coating composition for a light-sensitive layer. The coating composition was coated on paper, which had been subjected to electrically conductive treatment, by a wire bar at a dry coverage of 25 g/m$^2$, dried at 100° C. for 30 seconds and then heated at 140° C. for 1 hour to prepare an electrophotographic light-sensitive element.

On the surface of the resulting light-sensitive element, a transfer layer was formed in the same manner as in Example V-17.

The light-sensitive material was charged to −600 V with a corona discharge in dark and subjected to contact exposure to visible light through a positive image film. Then it was developed with Liquid Developer (LD-1) described above using the same liquid developing machine as used in Example V-17 with a bias voltage of −250 V applied to the electrode of the light-sensitive material side. The light-sensitive material was rinsed in a bath of Isopar G to remove stains on the non-image areas and then heated at a temperature of 80° C. for 1 minute to fix the toner image.

A printing plate was prepared by conducting transfer using the resulting developed light-sensitive material and a straight master as a receiving material and oil-desensitizing treatment in the same manner as in Example V-17. As a result of evaluation on printing properties in the same manner as in Example V-17, each printing plate of Examples V-41 to V-51 exhibited good results similar to those of Example V-17, and printing durability of at least 3,000 prints.

EXAMPLES V-52 TO V-55

A printing plate was prepared in the same manner as in Example V-1, except for replacing Resin Grain (TL-2) used in the transfer layer with each of Resin Grains (TL) shown in Table V-4 below and conducting oil-desensitizing treatment of the transfer layer as follows.

Oil-Desensitizing Treatment

The transfer layer was irradiated with light having a wavelength of 310 nm or more, which was emitted from a 100 W high-pressure mercury lamp set 7 cm apart from the transfer layer and cut through a filter, for 3 minutes to cause a photodecomposition reaction. The printing plate precursor was then immersed in the PS plate processing solution (DP-4) described above for 2 minutes to remove the transfer layer, thoroughly washed with water, and gummed.

As a result of the evaluation on printing properties in the same manner as in Example V-1, each printing plate exhibited printing durability of more than 60,000 prints.

TABLE V-4

| Example | Resin Grain (TL) |
|---|---|
| V-52 | TL-6 |
| V-53 | TL-7 |
| V-54 | TL-11 |
| V-55 | TL-14 |

EXAMPLES V-56 TO V-65

Each of Resin Grains (TL) shown in Table V-5 shown below was applied onto the surface of an amorphous silicon electrophotographic light-sensitive element in the same manner as in Example V-1 to form a transfer layer.

TABLE V-5

| Example | Resin Grain (TL) |
|---|---|
| V-56 | TL-3 |
| V-57 | TL-5 |
| V-58 | TL-6 |
| V-59 | TL-8 |
| V-60 | TL-9 |
| V-61 | TL-2 |
| V-62 | TL-12 |
| V-63 | TL-13 |
| V-64 | TL-15 |
| V-65 | TL-16 |

A toner image was formed on each of the light-sensitive materials in the same manner as the evaluation of image forming properties in Example V-1. A receiving material comprising a polyethylene terephthalate-laminated support (a support practically used for ELP-II (electrophotographic lithographic printing plate precursor manufactured by Fuji Photo Film Co., Ltd.)) having provided thereon an image receiving layer known as a direct image type lithographic printing plate precursor similar to the above-described straight master and the light-sensitive material having the toner image thereon were brought into contact with each other and passed through a pair of rubber rollers whose surface temperature was kept constantly at 110° C. under a nip pressure of 12 kgf/cm$^2$ at a speed of 7 mm/sec. After cooling the two materials while in contact with each other to room temperature, the receiving material was stripped from the light-sensitive material to transfer the transfer layer onto the receiving material.

The receiving material was then immersed in Oil-Desensitizing Solution (E-3) described above at a temperature of 30° C. for 1 minute, while slowly rubbing the surface with a brush, to remove the transfer layer. When observed using an optical microscope (X 200), the resulting printing plate had neither residual transfer layer on the non-image areas nor defects in the toner image areas.

The printing plate was subjected to printing on neutral paper with various offset printing color inks using an offset printing machine (Oliver 94 Model) and an aqueous solution (pH: 9.5) prepared by diluting dampening water for PS plate (Alky A manufactured by Toyo Ink Mfg. Co., Ltd.) 200-fold with distilled water, as a dampening water. As a result, more than 20,000 prints with a clear image free from background stains were obtained irrespective of the kind of color inks.

EXAMPLE VI-1

In the apparatus shown in FIG. 4, amorphous silicone was used as the eletrophotographic light-sensitive element.

10 g (solid basis) of Thermoplastic Resin Grain (TL-101) described above and 0.001 g of zirconium naphthenate were added to 1 liter of Isopar H (manufactured by Esso Standard Co.) to prepare a dispersion of positively charged resin grains.

The light-sensitive element on the drum was rotated at a circumferential speed of 10 mm/sec while supplying the dispersion on the surface of light sensitive element using a slit electrodeposition device, putting the light-sensitive element to earth and applying an electric voltage of +200 V to an electrode of the slit electrodeposition device, thereby the resin grains were electrodeposited. Then, the excessive dispersion was removed with air squeezing and the resin grains deposited were fused to form a film by an infrared line heater, whereby the transfer layer composed of the thermoplastic resin having a thickness of 4 μm was formed.

The resulting light-sensitive material was evaluated for image forming properties and transfer properties as follows.

The light-sensitive material was charged to +450 V with a corona discharge in dark and exposed to light of a gallium-aluminum-arsenic semiconductor laser (output: 5 mW; oscillation wavelength: 780 nm) at an irradiation dose (on the surface of the light-sensitive material) of 30 erg/cm$^2$, a pitch of 25 μm, and a scanning speed of 300 cm/sec. The scanning exposure was in a negative mirror image mode based on the digital image data of an original read by a color scanner and memorized in a hard disc.

Thereafter, the light-sensitive material was immersed in Liquid Developer (LD-1) prepared in the same manner as described in Example I-1 above in a developing machine having a pair of flat development electrodes, and a bias voltage of +400 V was applied to the electrode on the side of the light-sensitive material to thereby electrodeposit toner particles on the exposed areas (reversal development). The light-sensitive material was then rinsed in a bath of Isopar H to remove any stains on the non-image areas.

The light-sensitive material was then subjected to fixing by means of a heat roll whereby the toner image thus-formed was fixed.

An aluminum substrate used for the production of FUJI PS-Plate, FPD (manufactured by Fuji Photo Film Co., Ltd.) and the thus-developed light-sensitive material were superposed each other, and they were passed through between a pair of rubber rollers having a nip pressure of 15 kgf/cm$^2$ at a speed of 10 mm/sec. The surface temperature of the rollers was controlled to maintain constantly at 120° C.

After cooling the both materials in contact with each other to room temperature, the aluminum substrate was stripped from the light-sensitive material. The image formed on the aluminum substrate was visually evaluated for fog and image quality. As a result it was found that the whole toner image on the light-sensitive material was heat-transferred together with the transfer layer onto the aluminum substrate to provide a clear image without background stain on the aluminum substrate which showed substantially no degradation in image quality as compared with the original.

Then, the plate of the aluminum substrate having thereon the transfer layer was subjected to an oil-desensitizing treatment (i.e., removal of the transfer layer) to prepare a printing plate and its printing properties were evaluated. Specifically, the plate was immersed in Oil-Desensitizing Solution (E-1) having the composition shown below at 40° C. for 3 minutes to remove the transfer layer, thoroughly washed with water, and gummed to obtain an offset printing plate.

Oil-Desensitizing Solution (E-1)

| | |
|---|---|
| Monoethanolamine | 60 g |
| Neosoap (manufactured by Matsumoto Yushi K. K.) | 8 g |
| Benzyl alcohol | 100 g |
| Distilled water | to make 1.0 l |
| Potassium hydroxide | to adjust to pH 13.0 |

The printing plate thus prepared was observed visually using an optical microscope (X 200). It was found that the non-image areas had no residual transfer layer, and the image areas suffered no defects in high definition regions (i.e., cut of fine lines and fine letters).

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with a clear image free from background stains were obtained irrespective of the kind of color inks.

When the printing plate was exchanged for an ordinary PS plate and printing was continued under ordinary conditions, no trouble arose. It was thus confirmed that the printing plate of the present invention can share a printing machine with other offset printing plates such as PS plates.

As described above, the offset printing plate according to the present invention exhibits excellent performance in that an image formed by a scanning exposure system using semiconductor laser beam has excellent image reproducibility and the image of the plate can be reproduced on prints with satisfactory quality, in that the plate exhibits sufficient color ink receptivity without substantial ink-dependency to enable to perform full color printing with high printing durability, and in that it can share a printing machine in printing with other offset printing plates without any trouble.

EXAMPLES VI-2 TO VI-13

A printing plate was prepared in the same manner as in Example VI-1, except for replacing Resin Grain (TL-101) of the transfer layer with each of the resin grains (TL) shown in Table VI-1 below and replacing Oil-Desensitizing Solution (E-1) with a commercially available PS plate processing solution (DP-4 manufactured by Fuji Photo Film Co., Ltd.; hereinafter referred to as Oil-Desensitizing Solution (E-2)).

Each of the resulting printing plates was evaluated for various properties in the same manner as in Example VI-1. The results obtained were similar to those in Example VI-1. Specifically, more than 60,000 prints with a clear image free from background stains were obtained.

TABLE VI-1

| Example | Thermoplastic Resin Grain (TL) |
|---|---|
| VI-2 | TL-102 |
| VI-3 | TL-103 |
| VI-4 | TL-104 |
| VI-5 | TL-105 |
| VI-6 | TL-106 |
| VI-7 | TL-108 |
| VI-8 | TL-112 |
| VI-9 | TL-114 |
| VI-10 | TL-115 |
| VI-11 | TL-116 |
| VI-12 | TL-120 |
| VI-13 | TL-119 |

EXAMPLE VI-14

A mixture of 2 g of X-form metal-free phthalocyanine (manufactured by Dainippon Ink and Chemicals, Inc.), 10 g of Binder Resin (B-1) described above, 0.15 g of Compound (A) described above, and 80 g of tetrahydrofuran was put in a 500 ml-volume glass container together with glass beads and dispersed in a paint shaker (manufactured by Toyo Seiki Seisakusho Co.) for 60 minutes. To the dispersion were added 0.2 g of Resin (P-2), 0.03 g of phthalic anhydride, and 0.001 g of o-chlorophenol, followed by further dispersing for 2 minutes. The glass beads were separated by filtration to prepare a dispersion for a light-sensitive layer.

The dispersion was coated on a base paper for paper master having a thickness of 0.2 mm, which had been subjected to electrically conductive treatment and solvent-resistant treatment, by a wire bar, set to touch, heated in a circulating oven at 110° C. for 20 seconds, and then further heated at 140° C. for 1 hour to form a light-sensitive layer having a thickness of 8 μm.

The resulting light-sensitive element was equipped on the same apparatus as in Example VI-1. Using as the thermoplastic resin grain, Resin Grain (TL-127) described above, a transfer layer having a thickness of 4.3 μm was formed in the same manner as in Example VI-1.

The light-sensitive material was exposed in the same manner as in Example VI-1, and developed using Liquid Developer (LD-2) prepared by dispersing 5 g of polymethyl methacrylate particles having a particle size of 0.3 μm in 1 l of Isopar H (manufactured by Esso Standard Co.), and adding 0.01 g of soybean oil lecithin thereto as a charge control agent with a bias voltage of 30 V applied to the counter electrode to form a toner image thereon. The toner image was fixed by heating at 100° C. for 30 seconds.

The toner image and the transfer layer were transferred onto an aluminum substrate of PS plate (FPD) and then subjected to an oil-desensitizing treatment in the same manner as in Example VI-1 to obtain a printing plate.

Printing was performed using the printing plate thus-obtained in the same manner as in Example VI-1. As a result, 60,000 prints of a clear image free from background stains were obtained. When printing test was carried out using various printing inks as in Example VI-1, the printing performances were equally good and color ink-dependency was not observed.

EXAMPLE VI-15

5 g of 4,4'-bis(diethylamino)-2,2'-dimethyltriphenylmethane as an organic photoconductive substance, 5 g of a polyester resin (Vylon 200 manufactured by Toyobo Co., Ltd.), 40 mg of Dye (D-1) described above, and 0.2 g of Anilide Compound (B) described above as a chemical sensitizer were dissolved in a mixed solvent of 30 ml of methylene chloride and 30 ml of ethylene chloride to prepare a light-sensitive solution.

The light-sensitive solution was coated on a conductive transparent substrate composed of a 100 μm thick polyethylene terephthalate film having a deposited layer of indium oxide thereon (surface resistivity: $10^3$ Ω) by a wire round rod to prepare a light-sensitive element having an organic light-sensitive layer having a thickness of about 4 μm.

Then, the overcoat layer for imparting a release property same as in Example I-17 was formed on the light-sensitive layer to prepare an electrophotographic light-sensitive element.

On the surface of the thus-prepared light-sensitive element, a transfer layer having a thickness of 3.0 μm was formed in the same manner as in Example VI-1 except for using Resin Grain (TL-102) described above in place of Resin Grain (TL-101).

The resulting light-sensitive material was subjected to image formation, oil-desensitizing treatment and printing in the same manner as in Example VI-14. The excellent results similar to those of Example VI-14 were obtained.

EXAMPLE VI-16

1.0 part of the trisazo compound described above as a charge generating agent, 2.0 parts of the hydrazone compound described above as an organic photoconductive compound, 10 parts of Copolymer (B-2) described above, 1 part of Resin (P-30), and 100 parts of tetrahydrofuran were put in a 500 ml-volume glass container together with glass beads and dispersed in a paint shaker for 60 minutes. To the dispersion were added 0.02 part of phthalic anhydride and 0.001 part of o-chlorophenol, and the mixture was further dispersed for 10 minutes. The glass beads were separated by filtration to prepare a dispersion for a photoconductive layer.

The dispersion for photoconductive layer was coated on an aluminum plate having a thickness of 0.25 mm, which had been surface-grained, dried at 100° C. for 30 seconds and then heated at 140° C. for 1 hour to prepare an electrophotographic light-sensitive element having a photoconductive layer having a dry thickness of 5.1 μm.

Using the apparatus same as in Example VI-1, Resin Grain (TL-104) was applied onto the surface of light-sensitive layer to prepare a transfer layer having a thickness of 4.5 μm.

The light-sensitive material was charged to a surface potential of +500 V in dark, exposed to light of an He-Ne laser (oscillation wavelength: 633 nm) in an exposure amount of 30 erg/cm$^2$ (on the surface thereof), subjected to normal development using Liquid Developer (LD-1) described above with a bias voltage of +200 V, and then rinsed in a bath of Isopar H to remove stains on the non-image areas.

The toner image and the transfer layer were heat-transferred onto an aluminum substrate of PS plate (FPD) and then subjected to an oil-desensitizing treatment in the same manner as in Example VI-1 to obtain a printing plate. Printing was performed using the printing plate thus-obtained in the same manner as in Example VI-1. As a result, 60,000 prints of a clear image free from background stains were obtained. When printing test was carried out using various printing inks as in Example VI-1, the printing performances were equally good and color ink-dependency was not observed.

EXAMPLE VI-17

A mixture of 200 g of photoconductive zinc oxide, 80 g of Binder Resin (B-3) described above, 8 g of Resin (P-25), 0.018 g of Dye (D-2) described above, 0.20 g of N-hydroxysuccinimide, and 300 g of toluene was dispersed in a homogenizer (manufactured by Nippon Seiki K.K.) at a rotation of $1\times10^4$ rpm for 5 minutes.

The dispersion was coated on a base paper for paper master having a thickness of 0.2 mm, which had been subjected to electrically conductive treatment and solvent-resistant treatment, by a wire bar, set to touch, and heated in an circulating oven at 110° C. for 1 hour to form a light-sensitive layer having a thickness of 12 μm.

In order to confirm localization of the block copolymer according to the present invention in the surface portion of the light-sensitive layer, an adhesion test using an adhesive tape was conducted. It was found as a result that the adhesion of the light-sensitive layer was one-sixtieth that of a sample prepared in the same manner but containing no block copolymer (P-25).

A transfer layer having a thickness of 4 μm was formed on the light-sensitive layer in the same manner as in Example VI-1 using Resin Grain (TL-122) described above.

When an adhesive tape was adhered on the surface of the transfer layer and then stripped, the transfer layer was easily released from the surface of the light-sensitive layer without any perceptible resistance.

The resulting light-sensitive material was charged to −600 V with a corona discharge in dark and exposed to a semi-conductor laser beam (780 nm) at a surface exposure amount of 25 erg/cm$^2$ using the same digital image data as in Example VI-1. The residual potential of the exposed area was −120 V. The light-sensitive material was developed with Liquid Developer (LD-1) described above in a developing machine having a pair of flat development electrodes with a bias voltage of −200 V being applied to the electrode on the light-sensitive material side to thereby electrodeposit the toner particles on the non-exposed areas (normal development). The light-sensitive material was then rinsed in a bath of Isopar H to remove stains on the non-image areas.

A straight master (manufactured by Mitsubishi Paper Mills, Ltd.), as a receiving material, was superposed on the developed light-sensitive material with its image-receiving layer side being in contact with the light-sensitive material, and they were passed through a pair of rubber rollers whose surface temperature was kept constantly at 120° C. at a speed of 6 mm/sec under a nip pressure of 10 kgf/cm$^2$.

After cooling the both materials while in contact with each other to room temperature, the straight master was stripped from the light-sensitive material whereby the whole toner image on the light-sensitive material was thermally transferred together with the transfer layer to the straight master. There was observed little difference in image quality between the toner image before the heat-transfer and that transferred on the straight master.

The straight master was then treated with Oil-Desensitizing Solution (E-3) prepared by adding 50 g of dimethylethanolamine to 1 liter of PS plate processing solution (DP-4) described above at a temperature of 35° C. for 2 minutes to remove the transfer layer.

The non-image areas and toner image areas of the thus obtained printing plate were visually observed using an optical microscope (X 200). No residual transfer layer was observed on the non-image areas, and no image defect was observed in high definition regions (i.e., cut of fine lines and fine letters).

The printing plate was subjected to printing on neutral paper with various offset printing color inks using an offset printing machine (Ryobi 3200 MCD manufactured by Ryobi K.K.), and an aqueous solution (pH: 7.0) prepared by diluting dampening water for PS plate (SG-23 manufactured by Tokyo Ink K.K.) 130-fold with distilled water, as dampening water. As a result, more than 3,000 prints with a clear image free from background stains were obtained irrespective of the kind of color inks.

EXAMPLES VI-18 TO VI-24

An electrophotographic light-sensitive material having provided thereon a transfer layer was prepared in the same manner as in Example VI-17, except for using 60 g of Binder Resin (B), 7 g of Resin (P), and the prescribed amount of crosslinking compound each shown in Table I-2 of Examples I-19 to I-25 described above. A printing plate was then prepared in the same manner as in Example VI-17. As a result of evaluating the performances of the resulting printing plates, excellent results similar to those of Example VI-17 were obtained.

EXAMPLES VI-25 TO VI-28

An electrophotographic light-sensitive material having provided with a transfer layer was prepared in the same manner as in Examples VI-14, VI-15, VI-16, and VI-17, except that Resin Grain (L) shown in Table VI-2 below was used in place of Resin (P) used in the respective Example and that the transfer layer was formed as follows.

Formation of Transfer Layer

Using Resin Grain (TL-119) described above, the transfer layer having a thickness of 3 μm was formed in the same as in Example VI-1.

With each light-sensitive material the toner image formation and heat transfer of the transfer layer were conducted in the same manner as in the respective Example. The resulting printing plate precursor was treated with Oil-Desensitizing Solution (E-4) prepared as follows at 40° C. for 2 minutes to remove the transfer layer.

Oil-Desensitizing Solution E-4

A mixture of 75 g of N,N-di(2-hydroxyethyl)amine and 80 g of N,N-dimethylacetamide was diluted with distilled water to make 1.0 l and then adjusted to a pH of 13.0 with sodium hydroxide.

Printing was carried out using each of the resulting printing plates under the same conditions as in the respective Example. The number of the prints obtained with a clear image free from background stains (printing durability) is also shown in Table VI-2.

TABLE VI-2

| Example | Basis Example | Resin Grain (L) | Amount | Printing Durability |
|---|---|---|---|---|
| VI-25 | VI-14 | L-3 | 0.5 g | 60,000 |
| VI-26 | VI-15 | L-19 | 1 g | 60,000 |
| VI-27 | VI-16 | L-17 | 0.2 g | 60,000 |
| VI-28 | VI-17 | L-21 | 5 g | 3,500 |

EXAMPLES VI-29 TO VI-40

An electrophotographic light-sensitive material was prepared in the same manner as in Example VI-28, except for replacing 5 g of Resin Grain (L-21) with 4 g (solid basis) of each of Resin Grains (L) shown in Table VI-3 below.

Each of the resulting light-sensitive materials was processed in the same manner as in Example VI-15 to prepare a printing plate. As a result of evaluating the performances of the resulting printing plates, excellent results similar to those of Example VI-15 were obtained.

TABLE VI-3

| Example | Resin Grain (L) | Example | Resin Grain (L) |
|---|---|---|---|
| VI-29 | L-3 | VI-35 | L-14 |
| VI-30 | L-4 | VI-36 | L-15 |
| VI-31 | L-6 | VI-37 | L-16 |
| VI-32 | L-9 | VI-38 | L-18 |
| VI-33 | L-10 | VI-39 | L-19 |
| VI-34 | L-11 | VI-40 | L-21 |

EXAMPLES VI-41 TO VI-51

A mixture of 40 g of Binder Resin (B-11) described above, 4 g of Resin (P) or Resin Grain (L) shown in Table I-5 of Examples I-42 to I-52 described above, 200 g of photoconductive zinc oxide, 0.02 g of uranine, 0.04 g of Rose Bengale, 0.03 g of Bromophenol Blue, 0.15 g of salicylic acid, and 300 g of toluene was dispersed in a homogenizer (manufactured by Nippon Seiki K.K.) at a rotation of $9\times10^3$ rpm for 10 minutes.

To the dispersion was added each of the crosslinking compounds shown in Table I-5 above, and the mixture was dispersed at a rotation of $1\times10^3$ rpm for 1 minute to prepare a coating composition for a light-sensitive layer. The coating composition was coated on paper, which had been subjected to electrically conductive treatment, by a wire bar at a dry coverage of 25 g/m$^2$, dried at 100° C. for 30 seconds and then heated at 140° C. for 1 hour to prepare an electrophotographic light-sensitive element.

On the surface of the resulting light-sensitive element, a transfer layer was formed in the same manner as in Example VI-17.

The light-sensitive material was charged to −600 V with a corona discharge in dark and subjected to contact exposure to visible light through a positive image film. Then it was developed with Liquid Developer (LD-1) described above using the same liquid developing machine as used in Example VI-17 with a bias voltage of −250 V applied to the electrode of the light-sensitive material side. The light-sensitive material was rinsed in a bath of Isopar G to remove stains on the non-image areas and then heated at a temperature of 80° C. for 1 minute to fix the toner image.

A printing plate was prepared by conducting transfer using the resulting developed light-sensitive material and a straight master as a receiving material and oil-desensitizing treatment in the same manner as in Example VI-17. As a result of evaluation on printing properties in the same manner as in Example VI-17, each printing plate of Examples VI-41 to VI-51 exhibited good results similar to those of Example VI-17, and printing durability of at least 3,000 prints.

EXAMPLES VI-52 TO VI-54

A printing plate was prepared in the same manner as in Example VI-1, except for replacing Resin Grain (TL-101) used in the transfer layer with each of Resin Grains (TL) shown in Table VI-4 below and conducting oil-desensitizing treatment of the transfer layer as follows.

Oil-Desensitizing Treatment

The transfer layer was irradiated with light having a wavelength of 310 nm or more, which was emitted from a 100 W high-pressure mercury lamp set 7 cm apart from the transfer layer and cut through a filter, for 3 minutes to cause a photodecomposition reaction. The printing plate precursor was then immersed in the PS plate processing solution (DP-4) described above for 2 minutes to remove the transfer layer, thoroughly washed with water, and gummed.

As a result of the evaluation on printing properties in the same manner as in Example VI-1, each printing plate exhibited printing durability of more than 60,000 prints.

TABLE VI-4

| Example | Resin Grain (TL) |
|---|---|
| VI-52 | TL-124 |
| VI-53 | TL-125 |
| VI-54 | TL-126 |

EXAMPLES VI-55 TO VI-64

Each of Resin Grains (TL) shown in Table VI-5 shown below was applied onto the surface of an amorphous silicon electrophotographic light-sensitive element in the same manner as in Example VI-1 to form a transfer layer.

TABLE VI-5

| Example | Resin Grain (TL) |
|---|---|
| VI-55 | TL-106 |
| VI-56 | TL-107 |
| VI-57 | TL-112 |
| VI-58 | TL-117 |
| VI-59 | TL-122 |
| VI-60 | TL-123 |
| VI-61 | TL-120 |
| VI-62 | TL-127 |
| VI-63 | TL-128 |
| VI-64 | TL-116 |

A toner image was formed on each of the light-sensitive materials in the same manner as the evaluation of image forming properties in Example VI-1. A receiving material comprising a polyethylene terephthalate-laminated support (a support practically used for ELP-II (electrophotographic lithographic printing plate precursor manufactured by Fuji Photo Film Co., Ltd.)) having provided thereon an image receiving layer known as a direct image type lithographic printing plate precursor similar to the above-described straight master and the light-sensitive material having the toner image thereon were brought into contact with each other and passed through a pair of rubber rollers whose surface temperature was kept constantly at 110° C. under a nip pressure of 12 kgf/cm$^2$ at a speed of 7 mm/sec. After cooling the two materials while in contact with each other to room temperature, the receiving material was stripped from the light-sensitive material to transfer the transfer layer onto the receiving material.

The receiving material was then immersed in Oil-Desensitizing Solution (E-3) described above at a temperature of 30° C. for 1 minute, while slowly rubbing the surface with a brush, to remove the transfer layer. When observed using an optical microscope (X 200), the resulting printing plate had neither residual transfer layer on the non-image areas nor defects in the toner image areas.

The printing plate was subjected to printing on neutral paper with various offset printing color inks using an offset printing machine (Oliver 94 Model) and an aqueous solution (pH: 9.5) prepared by diluting dampening water for PS plate (Alky A manufactured by Toyo Ink Mfg. Co., Ltd.) 200-fold with distilled water, as a dampening water. As a result, more than 20,000 prints with a clear image free from background stains were obtained irrespective of the kind of color inks.

EXAMPLES VI-65 TO VI-76

An offset printing plate was prepared by subjecting some of the light-sensitive materials used in Examples VI-1 to VI-64 to the following oil-desensitizing treatment. Specifically, to 0.2 mol of each of the nucleophilic compound shown in Table VI-6 below, 100 g of each of the organic solvent shown in Table VI-6 below, and 2 g of Newcol B4SN (manufactured by Nippon Nyukazai K.K.) was added distilled water to make 1 l, and the solution was adjusted to a pH of 13.5. Each printing plate precursor was immersed in the resulting treating solution at a temperature of 35° C. for 2 minutes to remove the transfer layer.

Printing was carried out using the resulting printing plate under the same conditions as in Example VI-1. Each plate exhibited excellent characteristics similar to those of Example VI-1.

TABLE VI-6

| Example | Basis Example of Light-sensitive Material | Nucleophilic Compound | Organic Solvent |
|---|---|---|---|
| VI-65 | Example VI-4 | Sodium sulfite | N,N-Dimethylformamide |
| VI-66 | Example VI-5 | Monoethanolamine | Sulfolane |
| VI-67 | Example VI-10 | Diethanolamine | Tetrahydrofuran |
| VI-68 | Example VI-11 | Thiomalic acid | Ethylene glycol dimethyl ether |
| VI-69 | Example VI-19 | Thiosalicylic acid | Benzyl alcohol |
| VI-70 | Example VI-20 | Taurine | Ethylene glycol monomethyl ether |
| VI-71 | Example VI-22 | 4-Sulfobenzenesulfinic acid | Benzyl alcohol |
| VI-72 | Example VI-29 | Thioglycolic acid | Tetramethylurea |
| VI-73 | Example VI-30 | 2-Mercaptoethylphosphonic acid | Dioxane |
| VI-74 | Example VI-33 | Serine | N-Methylacetamide |
| VI-75 | Example VI-45 | Sodium thiosulfate | Methyl ethyl ketone |
| VI-76 | Example VI-62 | Ammonium sulfite | N,N-Dimethylacetamide |

EXAMPLE VII-1

Figure 5:
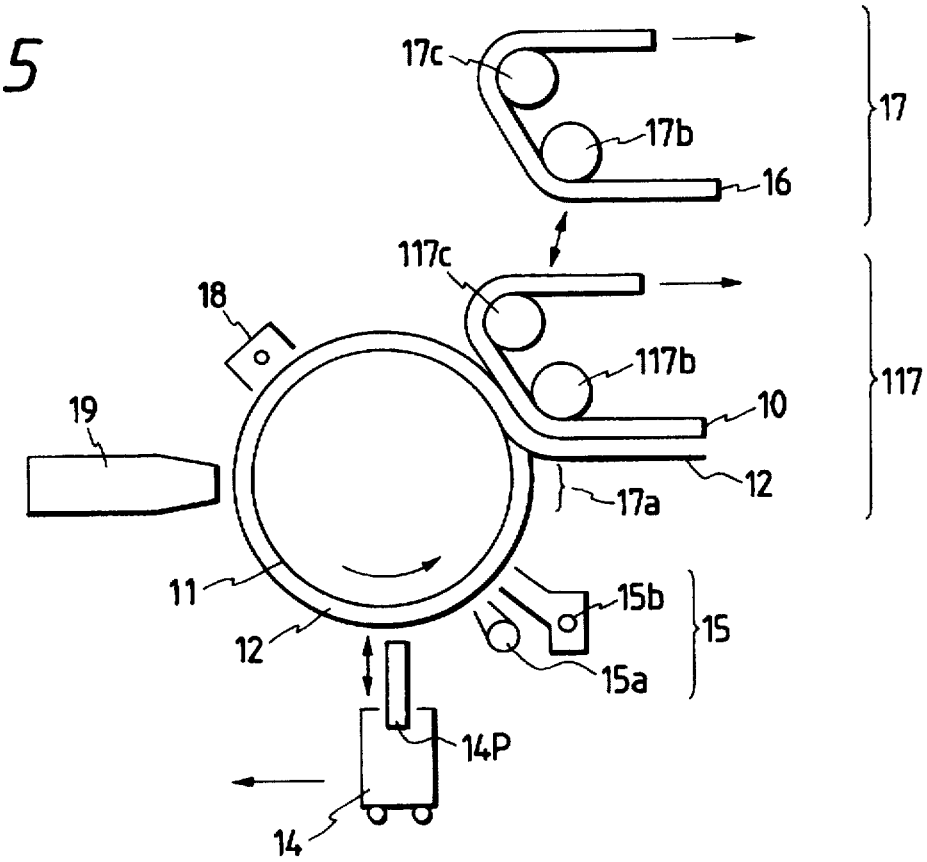
FIG. 5 is a schematic view of the electrophotographic plate making apparatus using the transfer method for the formation of transfer layer.
Figure 6:
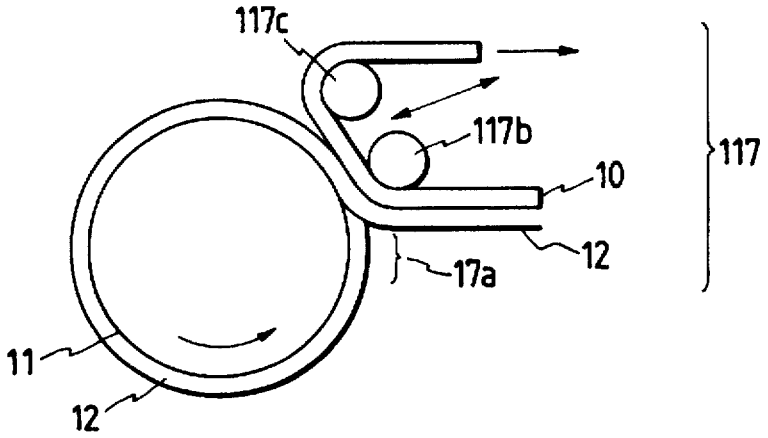
FIG. 6 is a schematic view of the apparatus for the formation of transfer layer utilizing release paper.

The light-sensitive element comprising X-form metal-free phthalocyanine and having the surface releasability which had been prepared in Example I-1 was equipped on the apparatus shown in FIG. 5.

On release paper (Sanrelease manufactured by Sanyo-Kokusaku Pulp Co., Ltd.) was provided a transfer layer compising Resin (A-401) having the structure shown below and having a thickness of 3.5 μm. The resulting paper was equipped to the heat transfer means 117 of FIG. 5 and the transfer layer was peeled from the release paper and transferred onto the surface of light-sensitive element under conditions of a nip pressure of the rollers of 3 kgf/cm$^2$, a surface temperature of 80° C. and a transportation speed of 10 mm/sec.

Resin (A-401)

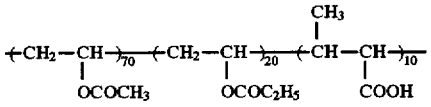

Mw 8 × 10$^4$

The formation of toner image by an electrophotographic process, transfer of the toner image together with the transfer layer and removal of the transfer layer to prepare a printing plate, and its evaluation on printing properties were conducted in the same manner as in Example I-1.

As the result, more than 60,000 prints with a clear image free from the occurrence of stains in the non-image areas and degradation in the toner image areas were obtained same as in Example I-1.

EXAMPLES VII-2 TO VII-7

A printing plate was prepared in the same manner as in Example VII-1 except for using each of the resins (A) shown in Table VII-1 below in place of Resin (A-401) in the transfer layer provided on the release paper.

TABLE VII-1

| Example | Resin (A) |
|---|---|
| VII-2 | A-5 |
| VII-3 | A-8 |
| VII-4 | A-9 |
| VII-5 | A-12 |
| | A-402 |
| VII-6 | 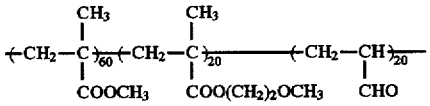 Mw $3\times10^4$ |
| | A-403 |
| VII-7 | 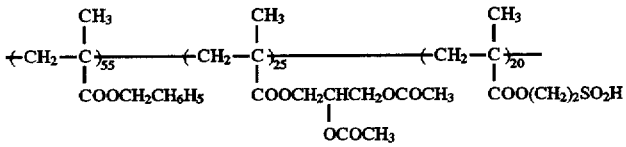 Mw $2.5\times10^4$ |

Each of the resulting printing plates was evaluated for various properties in the same manner as in Example VII-1. The excellent results similar to those in Example VII-1 were obtained.

EXAMPLES VIII-1

The light-sensitive element comprising X-form metal-free phthalocyanine and having the surface releasability which had been prepared in Example II-1 was equipped on the apparatus shown in FIG. 5.

On release paper (Separate-shi manufactured by Oji Paper Co., Ltd.) was provided a transfer layer comprising Resin (A-501) having the structure shown below and having a thickness of 3.5 μm. The resulting paper was equipped to the heat transfer means 117 of FIG. 5 and the transfer layer was peeled from the release paper and transferred onto the surface of light-sensitive element under conditions of a nip pressure of the rollers of 3 kgf/cm$^2$, a surface temperature of 90° C. and a transportation speed of 10 mm/sec.

Resin (A-501)

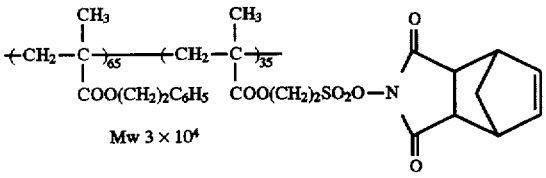

Mw $3\times10^4$

The formation of toner image by an electrophotographic process, transfer of the toner image together with the transfer layer and removal of the transfer layer to prepare a printing plate, and its evaluation on printing properties were conducted in the same manner as in Example II-1.

As the result, more than 60,000 prints with a clear image free from the occurrence of stains in the non-image areas and degradation in the toner image areas were obtained same as in Example II-1.

EXAMPLES VIII-2 TO VIII-7

A printing plate was prepared in the same manner as in Example VIII-1 except for using each of the resins (A) shown in Table VIII-1 below in place of Resin (A-501) in the transfer layer provided on the release paper.

TABLE VIII-1

| Example | Resin (A) |
|---|---|
| VIII-2 | A-105 |
| VIII-3 | A-109 |
| VIII-4 | A-118 |
| VIII-5 | A-129 |
| VIII-6 | A-131 |
| VIII-7 | A-132 |

Each of the resulting printing plates was evaluated for various properties in the same manner as in Example VIII-1. The excellent results similar to those in Example VIII-1 were obtained.

POSSIBILITY OF UTILIZATION IN INDUSTRY

In accordance with the present invention, printing plates having the excellent properties on the image qualities of plate-making and printing are constantly obtained even by a continuous processing for a long period of time. The electrophotographic plate-making method is also suitable for a scanning exposure system using, for example, a laser beam. Further, it can reduce running cost since the electrophotographic light-sensitive element is repeatedly usable.

What is claimed is:

1. A method for preparation of an electrophotographic printing plate, comprising the steps of:

(a) forming a toner image by an electrophotographic process on a peelable transfer layer of an electrophotographic light-sensitive material, the material comprising an electrophotographic light-sensitive element including a surface having a predetermined releasibility, the peelable transfer layer being provided on the surface and being mainly composed of a thermoplastic resin capable of being removed upon a chemical reaction treatment, (b) heat-transferring the toner image together with the transfer layer onto a receiving material having a surface capable of providing a hydrophilic surface suitable for lithographic printing at the time of printing, and (c) removing the thermoplastic resin of the transfer layer while the transfer layer is located on the receiving material by the chemical reaction treatment.

2. The method for preparation of an electrophotographic printing plate as claimed in claim 1, wherein the surface of the electrophotographic light-sensitive element has an adhesive strength of not more than 200 gram•force.

3. The method for preparation of an electrophotographic printing plate as claimed in claim 1, wherein the transfer layer has a thickness of from 0.1 to 20 μm.

4. The method for preparation of an electrophotographic printing plate as claimed in claim 1, wherein the light-sensitive element is used repeatedly.

5. A method for preparation of an electrophotographic printing plate, comprising the steps of:

(a) forming a peelable transfer layer mainly composed of a thermoplastic resin capable of being removed upon a chemical reaction treatment on a surface of an electrophotographic light-sensitive element having a predetermined releasibility, (b) forming a toner image by an electrophotographic process on the peelable transfer layer, (c) heat-transferring the toner image together with the transfer layer onto a receiving material having a surface capable of providing a hydrophilic surface suitable for lithographic printing at the time of printing, and (d) removing the thermoplastic resin of the transfer layer while the transfer layer is located on the receiving material by the chemical reaction treatment.

6. The method for preparation of an electrophotographic printing plate as claimed in claim 5, wherein step (a) comprises forming the transfer layer by a hot-melt coating method.

7. The method for preparation of an electrophotographic printing plate as claimed in claim 5, wherein step (a) comprises forming the transfer layer by an electrodeposition coating method.

8. The method for preparation of an electrophotographic printing plate as claimed in claim 7, wherein step (a) comprises the step of supplying grains mainly comprising the thermoplastic resin as a dispersion thereof in an electrical insulating solvent having an electric resistance of not less than $10^8$ Ω·cm and a dielectric constant of not more than 3.5.

9. The method for preparation of an electrophotographic printing plate as claimed in claim 7, wherein step (a) comprises supplying grains mainly comprising the thermoplastic resin between the electrophotographic light-sensitive element and an electrode placed in face of the light-sensitive element, and migrating the grains by electrophoresis according to a potential gradient applied from an external power source to cause the grains to adhere to or electrodeposit on the electrophotographic light-sensitive element and form a film.

10. The method for preparation of an electrophotographic printing plate as claimed in claim 5, wherein step (a) comprises forming the transfer layer by a transfer method.

11. The method for preparation of an electrophotographic printing plate as claimed in claim 5, wherein the transfer layer has a thickness of from 0.1 to 20 μm.

12. The method for preparation of an electrophotographic printing plate as claimed in claim 5, wherein the light-sensitive element can be used repeatedly.

* * * * *